US006851466B2

(12) United States Patent
Adachi et al.

(10) Patent No.: US 6,851,466 B2
(45) Date of Patent: Feb. 8, 2005

(54) METHOD AND APPARATUS FOR SHAPING SEMISOLID METALS

(75) Inventors: Mitsuru Adachi, Ube (JP); Hiroto Sasaki, Ube (JP); Yasunori Harada, Ube (JP); Tatsuo Sakamoto, Ube (JP); Satoru Sato, Ube (JP)

(73) Assignee: Ube Industries, Ltd., Yamaguchi (JP)

( * ) Notice: Subject to any disclaimer, the term of this patent is extended or adjusted under 35 U.S.C. 154(b) by 0 days.

(21) Appl. No.: 10/852,952

(22) Filed: May 24, 2004

(65) Prior Publication Data

US 2004/0238150 A1 Dec. 2, 2004

Related U.S. Application Data

(63) Continuation of application No. 09/490,983, filed on Jan. 24, 2000, now Pat. No. 6,769,473, and a continuation-in-part of application No. 08/967,136, filed on Nov. 10, 1997, now abandoned, and a continuation-in-part of application No. 08/672,378, filed on May 28, 1996, now abandoned.

(30) Foreign Application Priority Data

| | | |
|---|---|---|
| May 29, 1995 | (JP) | 7-130134 |
| Jun. 27, 1995 | (JP) | 7-160890 |
| Sep. 14, 1995 | (JP) | 7-236501 |
| Sep. 22, 1995 | (JP) | 7-244109 |
| Sep. 22, 1995 | (JP) | 7-244111 |
| Sep. 26, 1995 | (JP) | 7-247897 |
| Sep. 27, 1995 | (JP) | 7-249482 |
| Sep. 29, 1995 | (JP) | 7-252762 |
| Sep. 29, 1995 | (JP) | 7-252768 |
| Sep. 29, 1995 | (JP) | 7-252769 |
| Nov. 9, 1995 | (JP) | 7-290760 |
| Dec. 8, 1995 | (JP) | 7-320650 |
| Dec. 21, 1995 | (JP) | 7-332955 |
| Apr. 10, 1996 | (JP) | 8-87848 |
| Nov. 8, 1996 | (JP) | 8-296420 |
| Nov. 28, 1996 | (JP) | 8-317313 |

(51) Int. Cl.[7] ..... B22D 27/08

(52) U.S. Cl. ..... 164/71.1; 164/113; 164/122; 164/900

(58) Field of Search ..... 164/71.1, 113, 164/122, 900

(56) References Cited

U.S. PATENT DOCUMENTS 3,902,544 A 9/1975 Flemings et al.

(List continued on next page.)

FOREIGN PATENT DOCUMENTS

EP 0 392 998 A1 10/1990

(List continued on next page.)

OTHER PUBLICATIONS

*Transactions of the American Foundrymen's Society*, Proceedings of the 64th Annual Meeting, May 9–13, 1960; vol. 68, pp. 691–695, "Solidification of Metals"—Summation Paper of the solidification symposium.

(List continued on next page.)

*Primary Examiner*—Kiley Stoner
*Assistant Examiner*—I. H. Lin
(74) *Attorney, Agent, or Firm*—Frishauf, Holtz, Goodman & Chick, P.C.

(57) ABSTRACT

A method of shaping a semisolid metal to provide shaped parts which are produced in a convenient, easy and inexpensive manner, without relying upon the conventional mechanical or electromagnetic agitation. The method includes feeding, without using a cooling jig, into an insulating vessel, a molten alloy containing an element for promoting generation of crystal nuclei and being held to be superheated to less than 100° C. above a liquidus temperature of the alloy; maintaining the molten alloy in the insulating vessel for 5 seconds to 60 minutes as the alloy is cooled at a cooling rate of 0.01° C./s to 3.0° C./s thereby crystallizing fine primary spherical crystals in an alloy solution containing a specified liquid fraction; and feeding the alloy solution into a forming mold for shaping the alloy under pressure.

10 Claims, 77 Drawing Sheets

U.S. PATENT DOCUMENTS

| | | | | |
|---|---|---|---|---|
| 4,415,374 | A | 11/1983 | Young et al. | |
| 4,457,354 | A | 7/1984 | Dantzig et al. | |
| 5,501,266 | A | 3/1996 | Wang et al. | |
| 5,523,050 | A | 6/1996 | Lloyd et al. | |
| 5,533,562 | A | 7/1996 | Moschini et al. | |
| 5,571,346 | A | 11/1996 | Bergsma | |
| 5,575,325 | A | 11/1996 | Sugiura et al. | |
| 5,697,425 | A | 12/1997 | Nanba et al. | |
| 5,701,942 | A | 12/1997 | Adachi et al. | |
| 5,730,198 | A | 3/1998 | Sircar | |
| 5,758,707 | A | 6/1998 | Jung et al. | |
| 6,769,473 | B1 * | 8/2004 | Adachi et al. | 164/71.1 |

FOREIGN PATENT DOCUMENTS

| | | | |
|---|---|---|---|
| EP | 0 701 002 | A1 | 3/1996 |
| EP | 0 719 606 | A1 | 7/1996 |
| GB | 2 100 613 | A | 1/1983 |
| JP | 51-9004 | | 1/1976 |
| JP | 61-235047 | A | 10/1986 |
| JP | 63-7867 | B2 | 2/1988 |
| JP | 63-40852 | B2 | 8/1988 |
| JP | 6-73485 | A | 3/1994 |
| JP | 7-164108 | A | 6/1995 |
| JP | 8-187547 | A | 7/1996 |
| JP | 8-257722 | A | 10/1996 |
| WO | WO 92/13662 | A1 | 8/1992 |

OTHER PUBLICATIONS

Peter Marsh, *New Scientist*, Jan. 14, 1982, pp. 72–74, "The Die is Cast in the Metal Making Battle".

Zillgen, M. and Hirt, G., "Microstructural Effects of Electro–magnetic Stirring in Continuous Casting of Various Aluminum Alloys", *4th Intl. Conference on Semi–Solid Processing of Alloys and Composites*, pp. 180–186.

Woods, A., "The Wheeldon Process", *Modern Casting*, Aug. 1967, pp. 61–63.

*Designations and Chemical Composition Limits for Aluminum Alloys in the Form of Castings and Ingot*, The Aluminum Association, Washington, D.C., Jan. 1996, pg. 3 (specification of alloy A357).

Patent Abstracts of Japan, vol. 011, No. 078 (M–570), Mar. 10, 1987 of JP 61–235047.

Patent Abstracts of Japan, vol. 017, No. 574 (M–1498), Oct. 19, 1993 of JP 5–169227.

Wan, G. et al., Thixoforming of Aluminum Alloys Using Modified Chemical Grain Refinement for Billet Production, Interrnational Conference, "Aluminum Alloys: New Process Technologies", Marina de Ravenna, Italy, Jun. 3–4, 1993, 115.

Haavard Gjestland, Thixotropic Casting of Magnesium Using a Conventional Casting Machine, (Norsk hydro a.s.): D0244B SAE Tech Pap Ser (Soc Automot Eng) (USA) [SAE–930753] 7P (1993), 101–106.

Young, K. et al., "Semi–Solid Metal Cast Aluminum Automotive Components", The 3rd Int'l. Conf. on Semi–Solid Processing of Alloys and Composites, 1994,6, 155–177.

* cited by examiner

Heat-retained at top but heated at bottom

Left to cool at both top and bottom

Temperature of atmosphere : 200°C

SUS304 preheated to 200°C $Al_2O_3$-$SiO_2$ composite preheated to 200°C $Al_2O_3$-$SiO_2$ composite preheated to 200°C $Al_2O_3$-$SiO_2$ composite preheated to 350°C $Al_2O_3$-$SiO_2$ composite preheated to 350°C

WHEN MOLDING TEMPERATURE IS REACHED

WHEN HEATED AND HELD WITH rf INDUCTION HEATER (AT 8 kHz) FOR 20 min AFTER MOLDING TEMPERATURE WAS REACHED WHEN HEATED AND HELD WITH rf INDUCTION HEATER (AT 40 kHz) FOR 20 min AFTER MOLDING TEMPERATURE WAS REACHED AC4CH(Al-7Si-0.3Mg-0.15Ti)

7075(Al-5.5Zn-2.5Mg-1.6Cu-0.15Ti)

METHOD AND APPARATUS FOR SHAPING SEMISOLID METALS

CROSS REFERENCE TO RELATED APPLICATIONS

This application is a continuation application of application Ser. No. 09/490,983, filed Jan. 24, 2000 now U.S. Pat. No. 6,769,473, which is a continuation-in-part application of (i) application Ser. No. 08/672,378, filed May 28, 1996 (now abandoned) and (ii) application Ser. No. 08/967,136, filed Nov. 10, 1997 (now abandoned); the entire contents of said applications are hereby incorporated by reference herein.

BACKGROUND OF THE INVENTION

FIELD OF THE INVENTION

This invention relates to a method of shaping semisolid metals. More particularly, the invention relates to a method of shaping semisolid metals, in which a liquid alloy having crystal nuclei at a temperature not lower than the liquidus temperature or a partially solid, partially liquid alloy having crystal nuclei at a temperature not lower than a molding temperature is fed into an insulated vessel having a heat insulating effect, holding the alloy for a period from 5 seconds to 60 minutes as it is cooled to the molding temperature where a specified liquid fraction is established, thereby generating fine primary crystals in the alloy solution and the alloy is shaped under pressure. The invention also relates to an apparatus for implementing this method.

More particularly, the invention further relates to a method of shaping semisolid metals, in which a liquid alloy having crystal nuclei and at a temperature not lower than the liquidus temperature or a partially solid, partially liquid alloy having crystal nuclei and at a temperature less than the liquidus temperature but not lower than the molding temperature is poured into a holding vessel, cooled at an average cooling rate in a specified range and held as such until just prior to the start of shaping under pressure, whereby fine primary crystals are generated in the alloy solution and the alloy within the holding vessel is temperature adjusted by induction heating such that the temperatures of various parts of the alloy fall within the desired molding temperature range for the establishment of a specified fraction liquid not later than the start of shaping and the alloy is recovered from the holding vessel, supplied into a forming mold and shaped under pressure.

The invention also relates to a method of shaping semisolid metals, in which a molten aluminum or magnesium alloy containing a crystal grain refiner which is maintained superheated to less than 50° C. above the liquidus temperature is poured directly into a holding vessel without using any cooling jig and held for a period from 30 seconds to 30 minutes as the melt is cooled to the molding temperature where a specified liquid fraction is established such that the temperature of the poured alloy which is either liquid and superheated to less than 10° C. above the liquidus temperature or which is partially solid, partially liquid and less than 5° C. below the liquidus temperature is allowed to decrease from the initial level and pass through a temperature zone 5° C. below the liquidus temperature within 10 minutes, whereby fine primary crystals are generated in the alloy solution, and the alloy within said holding vessel is temperature adjusted by induction heating such that the temperatures of various parts of the alloy fall within the desired molding temperature range for the establishment of a specified fraction liquid not later than the start of shaping and the alloy is recovered from the holding vessel, supplied into a forming mold and shaped under pressure.

BACKGROUND INFORMATION

Various methods for shaping semisolid metals are known in the art. A thixo-casting process is drawing researchers' attention these days since it involves a fewer molding defects and segregations, produces uniform metallographic structures and features longer mold lives but shorter molding cycles than the existing casting techniques. The billets used in this molding method (A) are characterized by spheroidized structures obtained by either performing mechanical or electromagnetic agitation in temperature ranges that produce semisolid metals or by taking advantage of recrystallization of worked metals. On the other hand, raw materials cast by the existing methods may be molded in a semisolid state. There are three examples of this approach; the first two concern magnesium alloys that will easily produce an equiaxed microstructure and Zr is added to induce the formation of finer crystals [method (B)] or a carbonaceous refiner is added for the same purpose [method (C)]; the third approach concerns aluminum alloys and a master alloy comprising an Al-5% Ti-1% B system is added as a refiner in amounts ranging from 2–10 times the conventional amount [method (D)]. The raw materials prepared by these methods are heated to temperature ranges that produce semisolid metals and the resulting primary crystals are spheroidized before molding. It is also known that alloys within a solubility limit are heated fairly rapidly up to a temperature near the solidus line and, thereafter, in order to ensure a uniform temperature profile through the raw material while avoiding local melting, the alloy is slowly heated to an appropriate temperature beyond the solidus line so that the material becomes sufficiently soft to be molded [method (E)]. A method is also known, in which molten aluminum at about 700° C. is cast to flow down an inclined cooling plate to form partialy molten aluminum, which is collected in a vessel [method (F)].

These methods in which billets are molded after they are heated to temperatures that produce semisolid metals are in sharp contrast with a rheo-casting process (G), in which molten metals containing spherical primary crystals are produced continuously and molded as such without being solidified to billets. It is also known to form a rheo-casting slurry by a method in which a metal which is at least partially solid, partially liquid and which is obtained by bringing a molten metal into contact with a chiller and inclined chiller is held in a temperature range that produces a semisolid metal [method (H)].

Further, a casting apparatus (I) is known which produces a partially solidified billet by cooling a metal in a billet case either from the outside of a vessel or with ultrasonic vibrations being applied directly to the interior of the vessel and the billet is taken out of the case and shaped either as such or after reheating with r-f induction heater.

However, the above-described conventional methods have their own problems. Method (A) is cumbersome and the production cost is high irrespective of whether the agitation or recrystallization technique is utilized. When applied to magnesium alloys, method (B) is economically disadvantageous since Zr is an expensive element and concerning method (C), in order to ensure that carbonaceous refiners will exhibit their function to the fullest extent, the addition of Be as an oxidation control element has to be reduced to a level as low as about 7 ppm, but then the alloy is prone to burn by oxidation during the heat treatment just prior to molding and this is inconvenient in operations.

In the case of aluminum alloys, about 500 μm is the size that can be achieved by the mere addition of refiners and it is not easy to obtain crystal grains finer than 100 μm to 200 μm. To solve this problem, increased amounts of refiners are added in method (D), but this is industrially difficult to implement because the added refiners are prone to settle on the bottom of the furnace; furthermore, the method is costly. Method (E) is a thixo-casting process which is characterized by heating the raw material slowly after the temperature has exceeded the solidus line such that the raw material is uniformly heated and spheroidized. In fact, however, an ordinary dendritic microstructure will not transform to a thixotropic structure (in which the primary dendrites have been spheroidized) upon heating. According to method (F), partially molten aluminum having spherical particles in the microstructure can be obtained conveniently but no conditions are available that provide for direct shaping.

Moreover, thixo-casting methods (A)–(F) have a common problem in that they are more costly than the existing casting methods because in order to perform molding in the semisolid state, the liquid phase must first be solidified to prepare a billet, which is heated again to a temperature range that produces a semisolid metal. In addition, the billets as the starting material are difficult to recycle and the liquid fraction cannot be increased to a very high level because of handling considerations. In contrast, method (G) which continuously generates and supplies a molten metal containing spherical primary crystals is more advantageous than the thixocasting approach from the viewpoint of cost and energy but, on the other hand, the machine to be installed for producing a metal material consisting of a spherical structure and a liquid phase requires cumbersome procedures to assure effective operative association with the casting machine to yield the final product. Specifically, if the casting machine fails, difficulty arises in the processing of the semisolid metal.

Method (E) which holds the chilled metal for a specified time in a temperature range that produces a semisolid metal has the following problem. Unlike the thixo-casting approach which is characterized by solidification into billets, reheating and subsequent shaping, the method (H) involves direct shaping of the semisolid metal obtained by holding in the specified temperature range for a specified time and in order to realize industrial continuous operations, it is necessary that an alloy having a good enough temperature profile to establish a specified liquid fraction suitable for shaping should be formed within a short time. However, the desired rheo-casting semisolid metal which has a fraction liquid and a temperature profile that are suitable for shaping cannot be obtained by merely holding the cooled metal in the specified temperature range for a specified period.

In method (I), a case for cooling the metal in a vessel is employed but the top and the bottom portions of the metal in the vessel will cool faster than the center and it is difficult to produce a partially solidified billet having a uniform temperature profile and immediate shaping will yield a product of nonuniform structure. Furthermore, considering the need to satisfy the requirement that the partially solidified billet as taken out of the billet case has such a temperature that the initial state of the billet is maintained, it is difficult for the liquid fraction of the partially solidified billet to exceed 50% and the maximum that can be attained practically is no more than about 40%, which makes it necessary to give special considerations in determining injection and other conditions for shaping by diecasting. If the liquid fraction of the billet has dropped below 40%, it could be reheated with a r-f induction heater but is is still difficult to attain a liquid fraction in excess of 50% and special considerations must be made in injection and other shaping conditions. In addition, eliminating any significant temperature uneveness that has occurred within the partially solidified billet is a time-consuming practice and it is required, although for only a short time, that the r-f induction heater produce a high power comparable to that required in thixo-casting. In addition it is necessary to install multiple units of the r-f induction heater in order to achieve continuous operation in short cycles.

Another problem with the industrial practice of shaping semisolid metals in a continuous manner is that if a trouble occurs in the casting machine, the semisolid metal may occasionally be held in a specified temperature range for a period longer than the prescribed time. Unless a certain problem occurs in the metallographic structure, it is desired that the semisolid metal be maintained at a specified temperature; in practice, however, particularly in the thixo-casting process where the semisolid metal is held with its temperature elevated from room temperature, the metallographic structure becomes coarse and the billets are considerably deformed (progressively increase in diameter toward the bottom) and, in addition, such billets are usually discarded, which is simply a waste in resources, unless their temperatures are individually controlled.

The present invention has been accomplished under these circumstances of the prior art and has an object is to provide a method that does not use billets or any cumbersome procedures, but which ensures convenience and ease in the production of semisolid metals having fine primary crystals and shaping them under pressure.

Another object of the invention is to provide an apparatus that can implement this method.

It is a further object of the present invention to provide a method to produce semisolid metal (including those which have higher values of liquid fraction than what are obtained by the conventional thixo-casting process) which are suitable for subsequent shaping on account of both a uniform structure containing spheroidized primary crystals and uniform temperature profile in a convenient and easy manner with such great rapidity that the power requirement of the r-f induction heater is no more than 50% of what is commonly expended in shaping by the thixo-casting process, the semisolid metals being subsequently shaped under pressure.

SUMMARY OF THE INVENTION

One of the objects of the invention can be attained by the method of shaping a semisolid metal according to a first embodiment of the present invention, in which a liquid alloy having crystal nuclei at a temperature not lower than the liquidus temperature or a partially solid, partially liquid alloy having crystal nuclei at a temperature not lower than a molding temperature is fed into an insulated vessel having a heat insulating effect, held in said insulated vessel for a period from 5 seconds to 60 minutes as it is cooled to the molding temperature where a specified fraction liquid is established, thereby crystallizing primary crystals in the alloy solution, and the alloy is fed into a forming mold, where it is shaped under pressure.

According to a second embodiment of the present invention, the crystal nuclei in the first embodiment of the present invention are generated by contacting the molten alloy with a surface of a jig at a temperature lower than the melting point of the alloy which has been maintained superheated to less than 300° C. above the liquidus temperature.

According to a third embodiment of the present invention, the jig in the second embodiment of the present invention is a metallic or nonmetallic jig, or a metallic jig having a surface coated with nonmetallic materials or semiconductors, or a metallic jig compounded of nonmetallic materials or semiconductors, with the jig being adapted to be coolable from either inside or outside.

According to a fourth embodiment of the present invention, the crystal nuclei in the first or second embodiments of the present invention are generated by applying vibrations to the molten metal in contact with either the jig or the insulated vessel or both.

According to a fifth embodiment of the present invention, the alloy in the first or second embodiments of the present invention is an aluminum alloy of a composition within a maximum solubility limit or a hypoeutectic aluminum alloy of a composition at or above a maximum solubility limit.

According to a sixth embodiment of the present invention, the alloy in the first or second embodiments of the present invention is a magnesium alloy of a composition within a maximum solubility limit.

According to a seventh embodiment of the present invention, the aluminum alloy in the fifth embodiment of the present invention has 0.001%–0.01% B and 0.005%–0.3% Ti added thereto.

According to an eighth embodiment of the present invention, the magnesium alloy in the sixth embodiment of the present invention is one having 0.005%–0.1% Sr added thereto, or one having 0.01%–1.5% Si and 0.005%–0.1% Sr added thereto, or one having 0.05%–0.3% Ca added thereto.

According to a ninth embodiment of the present invention, a molten aluminum alloy held superheated to less than 100° C. above the liquidus temperature is directly poured into an insulated vessel without using a jig.

According to a tenth embodiment of the present invention, a molten magnesium alloy held superheated to less than 100° C. above the liquidus temperature is directly poured into an insulated vessel without using a jig.

According to a eleventh embodiment of the present invention, a liquid alloy having crystal nuclei that has been superheated by a degree (X° C.) of less than 10° C. above the liquidus line is maintained in an insulated vessel for a period from 5 seconds to 60 minutes as it is cooled to a molding temperature where a specified liquid fraction is established, such that the cooling from the initial temperature at which the alloy is held in the insulated vessel to its liquidus temperature is completed within a time shorter than the time Y (in minutes) calculated by the relationship $Y=10-X$ and that the period of cooling from said initial temperature to a temperature 5° C. lower than the liquidus temperature is not longer than 15 minutes, whereby fine primary crystals are crystallized in the alloy solution, which is then fed into a forming mold, where it is shaped under pressure.

According to a twelfth embodiment of the present invention, a partially solid, partially liquid alloy having crystal nuclei at a temperature not lower than a molding temperature is maintained within an insulated vessel for a period from 5 seconds to 60 minutes as it is cooled to the molding temperature where a specified liquid fraction is established, such that the period of cooling from the initial temperature at which the alloy is held in the insulated vessel to a temperature 5° C. lower than its liquidus temperature is not longer than 15 minutes, whereby fine primary crystals are crystallized in the alloy solution, which is then fed into a forming mold, where it is shaped under pressure.

According to a thirteenth embodiment of the present invention, the crystal nuclei in the eleventh or twelfth embodiments of the present invention are generated by holding a molten alloy superheated to less than 300° C. above the liquidus temperature and contacting the melt with a surface of a jig at a lower temperature than its melting point.

One of the objects of the invention can be attained by the apparatus in a fourteenth embodiment of the present invention which is for producing a semisolid forming metal having fine primary crystals dispersed in a liquid phase, the apparatus comprising a nucleus generating section that causes a molten metal to contact a cooling jig to generate crystal nuclei in the solution and a crystal generating section having an insulated vessel in which the metal obtained in the nucleus generating section is maintained as it is cooled to a molding temperature at which the metal is partially solid, partially liquid.

According to a fifteenth embodiment of the present invention, the cooling jig in the nucleus generating section in the fourteenth embodiment of the present invention is either an inclined flat plate that has an internal channel for a cooling medium and that has a pair of weirs provided on the top surface parallel to the flow of the melt, or a cylindrical or semicylindrical tube.

According to a sixteenth embodiment of the present invention, a liquid alloy having crystal nuclei at a temperature not lower than the liquidus temperature or a partially solid, partially liquid having crystal nuclei at a temperature not lower than a molding temperature is poured into a vessel so that it is cooled to a temperature at which a solid fraction appropriate for shaping is established, the vessel being adapted to be heatable or coolable from either inside or outside, being made of a material having a thermal conductivity of at least 1.0 kcal/hr·m·° C. (at room temperature) and being maintained at a temperature not higher than the liquidus temperature of the alloy prior to its pouring, and the alloy is poured into the vessel in such a manner that fine, nondendritic primary crystals are crystallized in the alloy solution and that the alloy is cooled rapidly enough to be provided with a uniform temperature profile in the vessel, and the alloy, after being cooled, is fed into a forming mold, where it is shaped under pressure.

According to a seventeenth embodiment of the present invention, the step of cooling the alloy in the sixteenth embodiment of the present invention is performed with the top and bottom portions of the vessel being heated by a greater degree than the middle portion or heat-retained with a heat-retaining material having a thermal conductivity of less than 1.0 kcal/hr·m·° C. or with either the top or bottom portion of the vessel being heated, while the remainder is heat-retained.

According to an eighteenth embodiment of the present invention, the step of cooling the alloy in the sixteenth embodiment of the present invention is performed with the vessel holding the alloy being accommodated in an outer vessel that is capable of accommodating the alloy holding vessel and that has a smaller thermal conductivity than the holding vessel, or that has a thermal conductivity equal to or greater than that of the holding vessel and which has a higher initial temperature than the holding vessel, or that is spaced from the holding vessel by a gas-filled gap, at a sufficiently rapid cooling rate to provide a uniform temperature profile through the alloy in the holding vessel no later than the start of the shaping step.

According to a nineteenth embodiment of the present invention, there is provided a method of managing the temperature of a semisolid metal slurry for use in molding equipment in which a molten metal containing a large number of crystal nuclei is poured into a vessel, where it is cooled to produce a semisolid metal slurry containing both a solid and a liquid phase in specified amounts, the slurry being subsequently fed into a molding machine for shaping under pressure, which method is characterized in that the vessel for holding the molten metal is temperature-managed such as to establish a preset desired temperature prior to the pouring of the molten metal and such that the molten metal is cooled at an intended rate after said molten metal is poured into the vessel.

According to a twentieth embodiment of the present invention, there is provided an apparatus for managing the temperature of a semisolid metal slurry to be used in molding equipment in which a molten metal containing a large number of crystal nuclei is poured from a melt holding furnace into a vessel, where it is cooled to produce a semisolid metal slurry containing both a solid and a liquid phase in specified amounts and in which the slurry is directly fed into a molding machine for shaping under pressure, which apparatus is further characterized by comprising a vessel for holding the molten metal, a vessel temperature control section for managing the temperature of the vessel, a semisolid metal cooling section for managing the temperature of the as-poured molten metal such that it is cooled at an intended rate, and a vessel transport mechanism comprising basically a robot for gripping, moving and transporting the vessel and a conveyor for carrying, moving and transporting the vessel.

According to a twenty-first embodiment of the present invention, the vessel temperature control section in the twentieth embodiment of the present invention comprises a vessel cooling furnace for cooling the vessel to an ambient temperature not higher than a target temperature for the vessel and a vessel heat-retaining furnace for maintaining the vessel at an ambient temperature equal to the target temperature.

According to a twenty-second embodiment of the present invention, the semisolid metal cooling section in the twentieth embodiment of the present invention comprises a semisolid metal cooling furnace and a semisolid metal annealing furnace for managing the temperature to be higher than the temperature in the semisolid metal cooling furnace.

According to a twenty-third embodiment of the present invention, the semisolid metal cooling furnace in the semisolid metal cooling section in the twenty-second embodiment of the present invention is such that the area around the vessel carried on the conveyor device which is moved to pass through the furnace is partitioned into three regions, the upper, middle and lower parts, by means of two pairs of heat insulating plates, one pair comprising an upper right and an upper left plate and the other pair comprising a lower right and a lower left plate, with a heater being installed in both the upper and lower parts for heating the two parts at a higher temperature than hot air to be supplied to the central part.

According to a twenty-fourth embodiment of the present invention, a preheating furnace is installed at a stage prior to the semisolid metal cooling furnace in the twenty-second embodiment of the present invention to ensure that both a plinth having a lower thermal conductivity than the vessel and which carries the vessel before it is directed to the semisolid metal cooling furnace and a lid having a lower thermal conductivity than the vessel and which is to be placed to cover it after it accommodates the molten metal are preheated by being moved to pass through the preheating furnace in advance.

According to a twenty-fifth embodiment of the present invention, the semisolid metal cooling furnace is equipped with a control unit with which the temperature or the velocity of hot air to be supplied into the semisolid metal cooling furnace is controlled to vary with the lapse of time.

According to a twenty-sixth embodiment of the present invention, the semisolid metal cooling furnace in the twenty-second embodiment of the present invention comprises an array of housings each accommodating the vessel as it contains the molten metal and being equipped with an openable cover and hot air feed/exhaust pipes, as well as a mechanism by which a receptacle for carrying the vessel is rotated about a vertical shaft.

According to a twenty-seventh embodiment of the present invention, a vibrator for vibrating the receptacle in the twenty-sixth embodiment of the present invention is provided for each housing.

According to a twenty-eighth embodiment of the present invention, the semisolid metal cooling furnace for treating the molten metal as poured into a vessel having a thermal conductivity of at least 1.0 kcal/hr·m·° C. is supplied with hot air having a temperature in the range from 150° C. to 350° C. for aluminum alloys and from 200° C. to 450° C. for magnesium alloys.

According to a twenty-ninth embodiment of the present invention, the semisolid metal cooling furnace for treating the molten metal as poured into a vessel having a thermal conductivity of less than 1.0 kcal/hr·m·° C. is supplied with hot air having a temperature in range from 50° C. to 200° C. for aluminum alloys and from 100° C. to 250° C. for magnesium alloys.

According to a thirtieth embodiment of the present invention, the molten metal as poured into the insulated vessel in the first or second embodiments of the present invention is isolated from the ambient atmosphere by closing the top surface of the vessel with an insulating lid having a heat insulating effect as long as the molten metal is held within the vessel until the molding temperature is reached.

According to a thirty-first embodiment of the present invention, the alloy in the first or second embodiments of the present invention is a zinc alloy.

According to a thirty-second embodiment of the present invention, the alloy in the first or second embodiments of the present invention is a hypereutectic Al—Si alloy having 0.005%–0.03% P added thereto or a hypereutectic Al—Si alloy containing 0.005%–0.03% P having either 0.005%–0.03% Sr or 0.001%–0.01% Na or both added thereto.

According to a thirty-third embodiment of the present invention, the alloy in the first or second embodiments of the present invention is a hypoeutectic Al—Mg alloy containing Mg in an amount not exceeding a maximum solubility limit and which has 0.3%–2.5% Si added thereto.

According to a thirty-fourth embodiment of the present invention, the pressure forming in the first or second embodiments of the present invention is accomplished with the alloy being inserted into a container on an extruding machine.

According to a thirty-fifth embodiment of the present invention, the extruding machine is of either a horizontal or a vertical type or of such a horizontal type in which the container changes position from being vertical to horizontal and the method of extrusion is either direct or indirect.

According to a thirty-sixth embodiment of the present invention, the crystal nuclei in the first embodiment of the present invention are generated by a method in which two or more liquid alloys having different melting points that are maintained superheated to less than 50° C. above the liquidus temperature are mixed either directly within the insulated vessel having a heat insulating effect or along a trough in a path into the insulated vessel, such that the temperature of the metal as mixed is either just above or below the liquidus temperature.

According to a thirty-seventh embodiment of the present invention, the two or more metals to be mixed in the thirty-sixth embodiment of the present invention are preliminarily contacted with respective jigs each having a cooling zone such as to produce metals of different melting points that have crystal nuclei and which have attained temperatures just either above or below the liquidus temperature.

According to a thirty-eighth embodiment of the present invention, the top surface of the semisolid metal that is held within the insulated vessel and which is to be fed into the forming mold in the first embodiment of the present invention is removed by means of either a metallic or nonmetallic jig during a period from just after the pouring into the vessel, but before the molding temperature is reached and, thereafter, the semisolid metal is inserted into an injection sleeve.

According to a thirty-ninth embodiment of the present invention, the outer vessel in the eighteenth embodiment of the present invention is heated either from inside or outside or by induction heating, with such heating being performed only or before or after the insertion of the holding vessel into the outer vessel or continued throughout the period not only before, but also after the insertion.

According to a fortieth embodiment of the present invention, the aluminum alloy in the ninth embodiment of the present invention is replaced by a zinc alloy.

With these methods and apparatus of the invention, either liquid or partially solid, partially liquid alloys having crystal nuclei (as exemplified by molten Al and Mg alloys) are charged into an insulated vessel having a heat insulating effect and held there for a period from 5 seconds to 60 minutes as they are cooled to a molding temperature, whereby fine and spherical primary crystals are generated in the solution and the resulting semisolid alloy is fed into a mold, where it is pressure formed to produce a shaped part having a homogeneous microstructure.

Another object of the invention can be attained by a method of shaping a semisolid metal recited in which a liquid alloy having crystal nuclei and at a temperature not lower than the liquidus temperature or a partially solid, partially liquid alloy having crystal nuclei and at a temperature less than the liquidus temperature, but not lower than the molding temperature is poured into a holding vessel having a thermal conductivity of at least 1 kcal/mh° C., cooled at an average cooling rate of 0.01° C./s –3.0° C./s and maintained as such until just prior to the start of shaping under pressure, whereby fine primary crystals are generated in the alloy solution and the alloy within the holding vessel is temperature adjusted by induction heating such that the temperatures of various parts of the alloy fall within the desired molding temperature range for the establishment of a specified liquid fraction no later than the start of shaping and the alloy is recovered from the holding vessel, supplied into a forming mold and shaped under pressure.

The induction heating discussed above is for effecting thermal adjustment such that a specified amount of electric current is applied for a specified time immediately after the pouring of the molten alloy before the representative temperature of the alloy slowly cooling in the holding vessel has dropped to at least 10° C. below the desired molding temperature, so that the temperatures of various areas of the alloy within the holding vessel fall within the limits of ±5° C. of the desired molding temperature.

Once the temperatures of various parts of the alloy within the holding vessel have been adjusted by induction heating to fall within the desired molding temperature range within a specified time the temperature of the alloy is maintained until just before the start of the shaping step by induction heating at a frequency comparable to or higher than the frequency used in the induction heating for the preceding temperature adjustment.

Either the top portion or the bottom portion or both of the holding vessel can be heat-retained or heated to a higher temperature than the middle portion or the top and bottom portions of the holding vessel are smaller in wall thickness than the middle portion.

The alloy within the holding vessel can be is cooled by blowing either air or water or both against said holding vessel from its outside.

Either air or water or both which are at a specified temperature can be blown from at least two different, independently operable heights exterior to the holding vessel such that the blowing conditions and times can be varied freely.

The alloy to be supplied into the forming mold can have a liquid fraction of at least. 1.0% but less than 75%.

The crystal nuclei can be generated by vibrating the alloy which builds up in the holding vessel by pouring in a melt superheated to less than 50° C. above the liquidus temperature, the vibration being applied to the alloy either by means of a vibrating rod which is submerged in the melt during its pouring so that it is in direct contact with the alloy or by vibrating not only the vibrating rod, but also the holding vessel as the alloy is poured into said holding vessel.

The crystal nuclei can also be generated by pouring a molten aluminum alloy into the holding vessel, said alloy being held superheated to less than 50° C. above the liquidus temperature and containing 0.001%–0.01% B and 0.005% –0.3% Ti.

The crystal nuclei can further be generated by pouring a molten magnesium alloy into the holding vessel, the alloy being maintained superheated to less than 50° C. above the liquidus temperature and containing 0.01%–1.5% Si and 0.005%–0.1% Sr or 0.05%–0.30% Ca alone.

The invention also concerns a method of shaping a semisolid metal in which a molten aluminum or magnesium alloy containing a crystal grain refiner which is held superheated to less than 50° C. above the liquidus temperature is poured directly into a holding vessel without using any cooling jig and held for a period from 30 seconds to 30 minutes as the melt is cooled to the molding temperature where a specified liquid fraction is established such that the temperature of the poured alloy which is liquid and superheated to less than 10° C. above the liquidus temperature or which is partially solid, partially liquid and less than 5° C. below the liquidus temperature is allowed to decrease from the initial level and pass through a temperature zone 5° C. below the liquidus temperature within 10 minutes, whereby fine primary crystals are generated in the alloy solution, and the alloy is recovered from the holding vessel, supplied into a forming mold and shaped under pressure.

The aluminum alloy in the above method can have added thereto 0.03%–0.30% Ti added and can be superheated to less than 30° C. above the liquidus temperature as it is poured into the holding vessel.

The aluminum alloy in the above method can have 0.005%–0.3% Ti and 0.001%–0.01 B added thereto and can be superheated to less than 50° C. above the liquidus temperature as it is poured into the holding vessel.

The temperature of the alloy poured into the holding vessel can be maintained by temperature adjustment through induction heating such that the temperatures of various parts of said alloy within said holding vessel are allowed to fall within the desired molding temperature range for the establishment of a specified fraction liquid not later than the start of shaping.

BRIEF DESCRIPTION OF THE DRAWINGS

FIG. 51(*a*) is an exploded view showing in detail the position of the temperature measurement;

DETAILED DESCRIPTION OF THE INVENTION

Figure 1A:
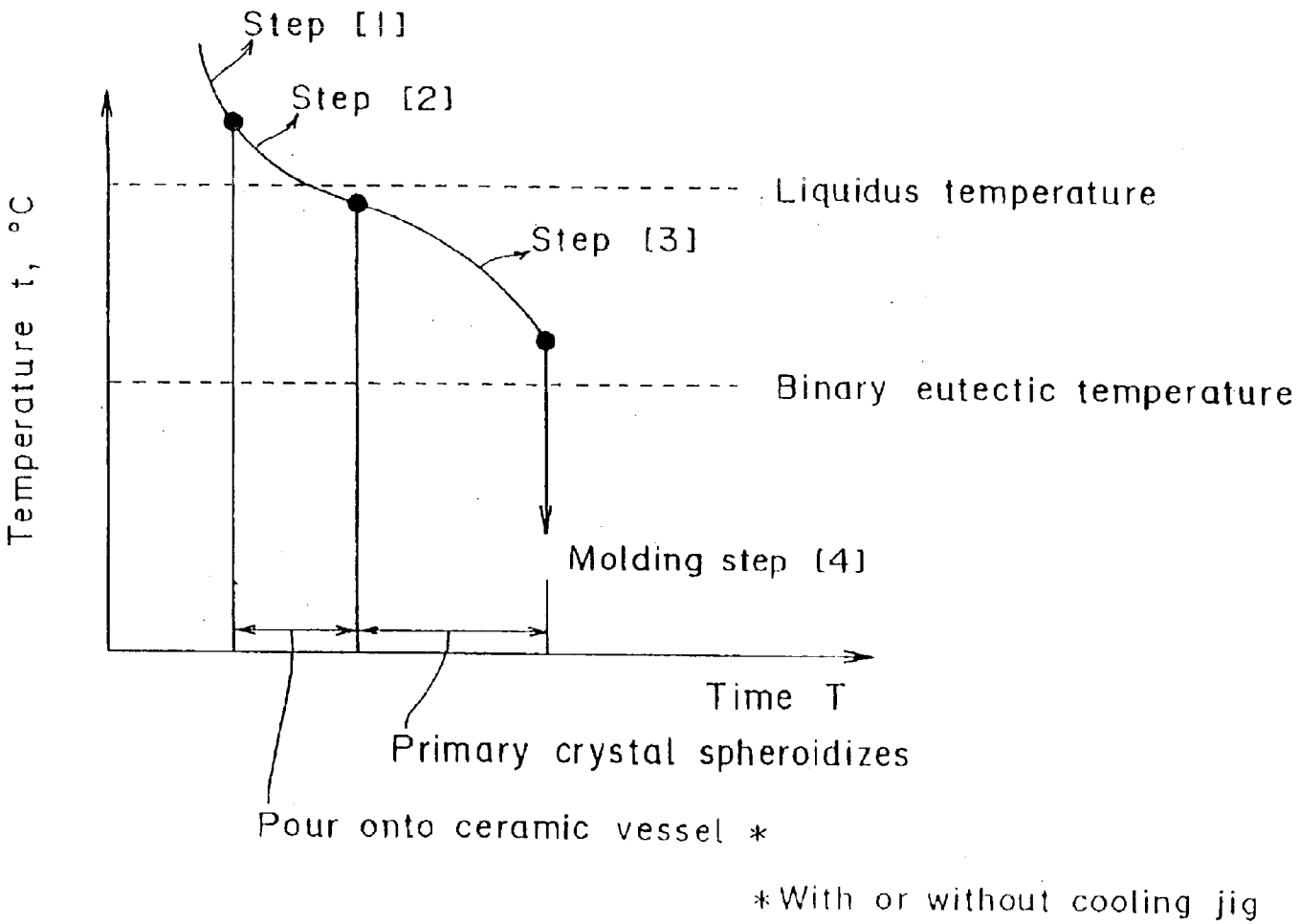
FIGS. 1(*a*) and 1(*b*) are schematic diagrams showing a process sequence for the semisolid forming of a hypoeutectic aluminum alloy having a composition at or above a maximum solubility limit according to the invention.

A liquid alloy having crystal nuclei at a temperature not lower than the liquidus line or a partially solid, partially liquid alloy having crystal nuclei at a temperature not lower than a molding temperature, as exemplified by a molten aluminum or magnesium alloy, is fed into an insulated vessel having a heat insulating effected, and the alloys are held in that vessel for a period from 5 seconds to 60 minutes as they are cooled to the molding temperature, thereby generating fine and spheroidized primary crystals in the alloy solution and the resulting semisolid alloy is fed into a mold, where it is pressure formed into a shaped part having a homogeneous microstructure.

The present invention also concerns a process wherein a liquid alloy having crystal nuclei and at a temperature not lower than the liquidus temperature or a partially solid, partially liquid alloy having crystal nuclei and at a temperature less than the liquidus temperature, but not lower than the molding temperature is poured into a holding vessel having a thermal conductivity of at least 1 kcal/mh° C., is cooled at an average cooling rate of 0.01° C./s–3.0° C./s and held as such until just prior to the start of shaping under pressure, whereby fine primary crystals are generated in said alloy solution and the alloy within the holding vessel is temperature adjusted by induction heating such that the temperatures of various parts of the alloy fall within the desired molding temperature range for the establishment of a specified liquid fraction not later than the start of shaping and the alloy is recovered from the holding vessel, supplied into a forming mold and shaped under pressure. Since the temperature control of the alloy prior to the shaping step is performed in the ideal manner, satisfactory shaped parts can be obtained that have a homogeneous structure containing spheroidized primary crystals.

It is also within the scope of the invention that a molten aluminum containing Ti either alone or in combination with B or a molten magnesium alloy containing Ca or both Si and Sr, is held superheated to less than 50° C. above the liquidus temperature, poured directly into a holding vessel without using any cooling jig and held for a period from 30 seconds to 30 minutes as the melt is cooled to the molding temperature where a specified liquid fraction is established such that the temperature of the poured alloy which is liquid and superheated to less than 10° C. above liquidus temperature or which is partially solid, partially liquid and less than 5° C. below the liquidus temperature is allowed to decrease from the initial level and pass through a temperature zone 5° C. below the liquidus temperature within 10 minutes, whereby fine primary crystals are generated in said alloy solution and the temperatures of various parts of the alloy within the holding vessel are adjusted such that by means of induction heating and local heating or heat retention of the vessel, said temperatures will fall within the desired molding temperature range for the establishment of a specified fraction liquid not later than the start of shaping, and the alloy is recovered from the holding vessel, supplied into a forming mold and shaped under pressure. As a result, satisfactory shaped parts are obtained that have a fine and uniform microstructure.

EXAMPLES

Example 1

Figure 1:
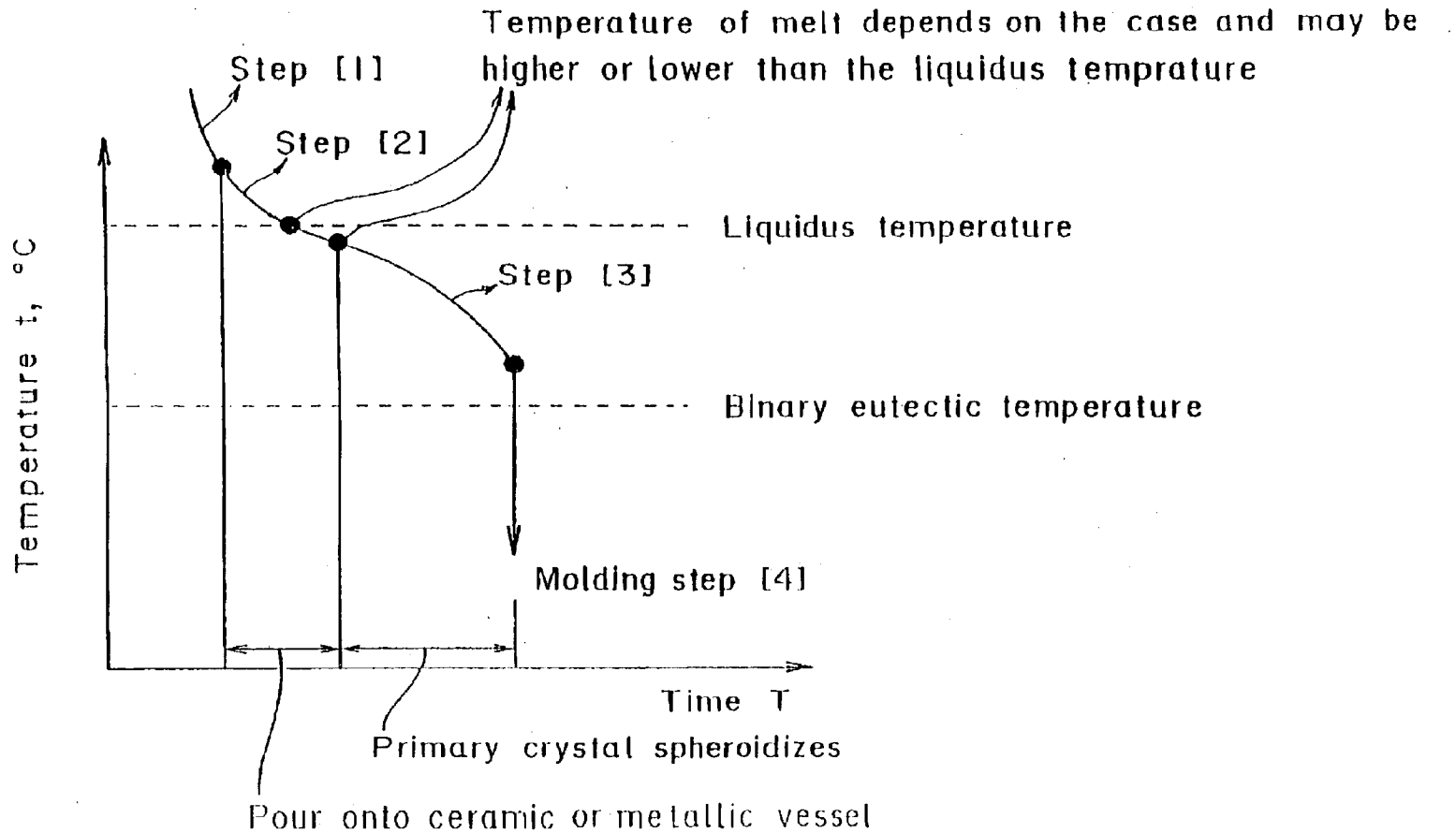
Figure 2A:
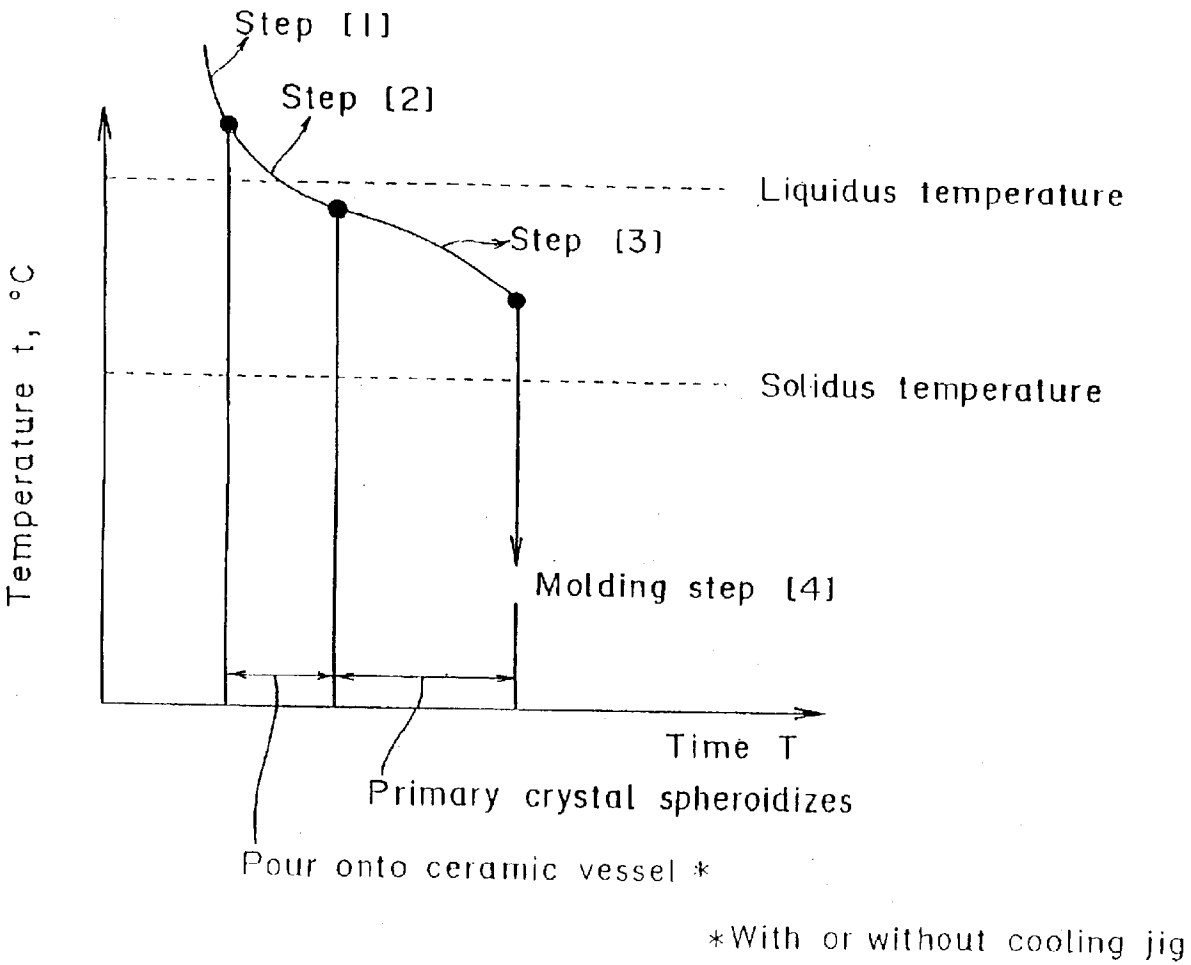
FIGS. 2(*a*) and 2(*b*) are schematic diagrams showing a process sequence for the semisolid forming of a magnesium or an aluminum alloy having a composition within a maximum solubility limit according to the invention.
Figure 2:
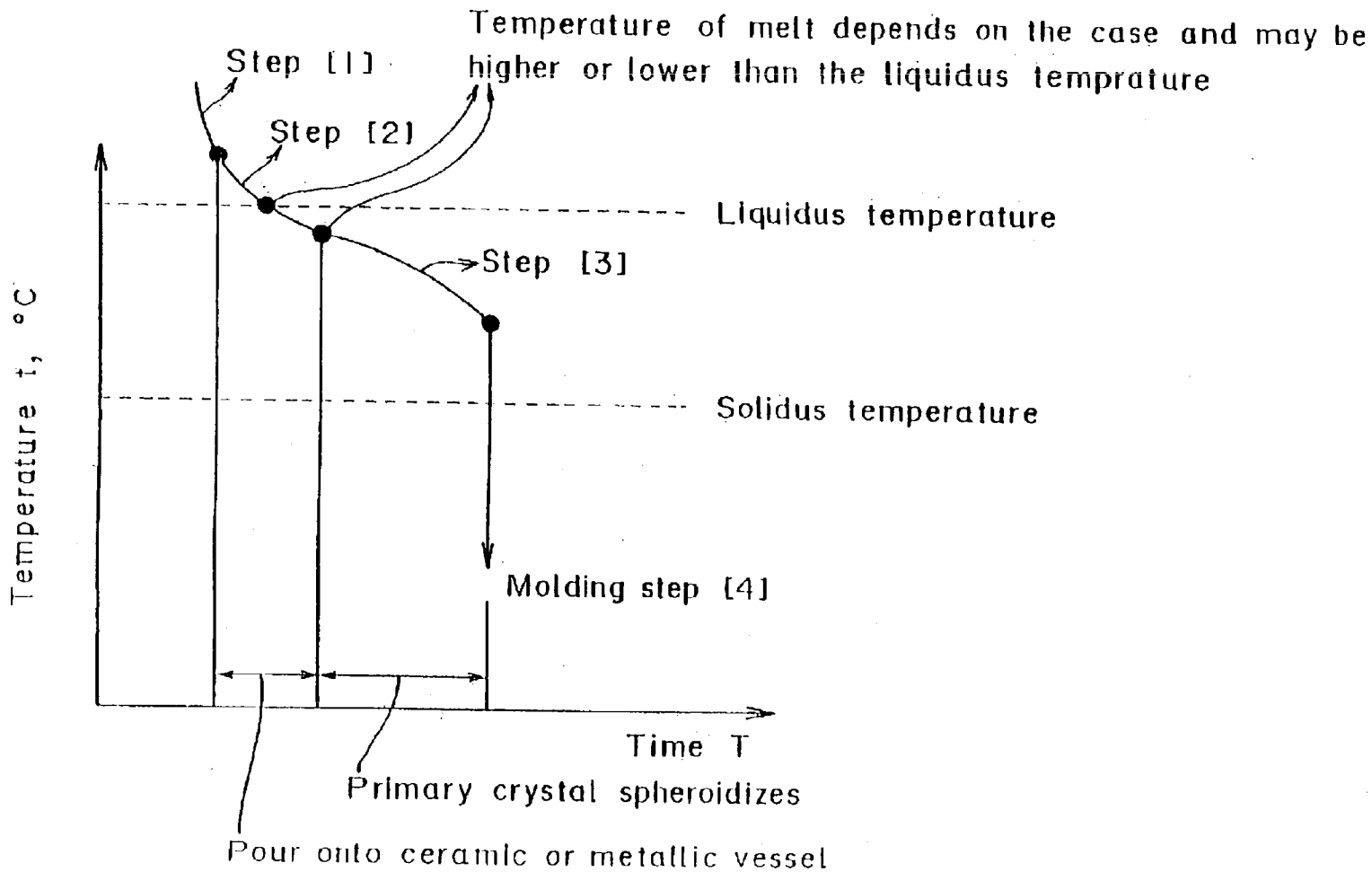
Figure 3A:
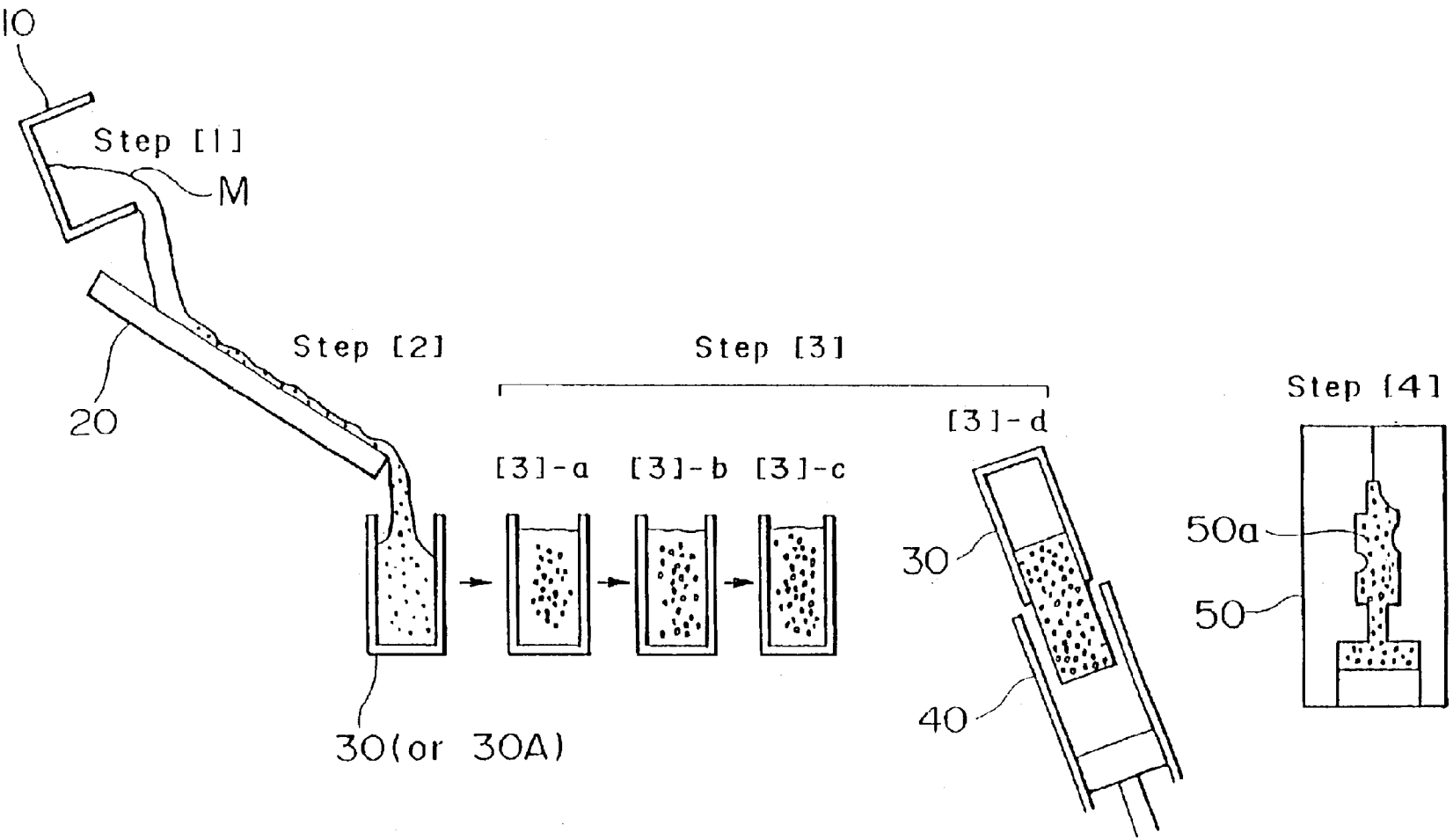
FIGS. 3(*a*) and 3(*b*) are schematic diagrams which show a process flow starting with the generation of spherical primary crystals and ending with the molding step.
Figure 3B:
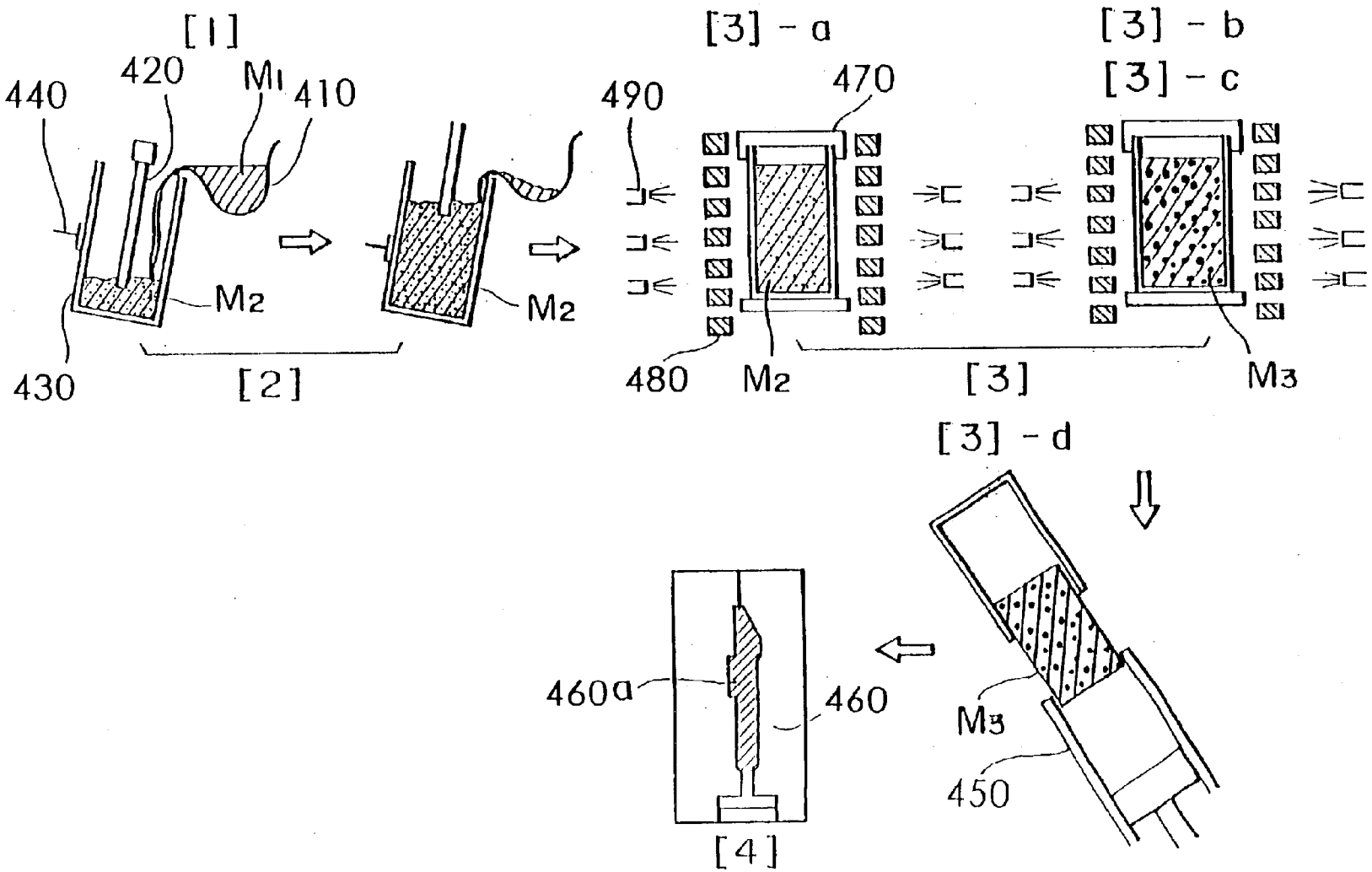
Figure 4:
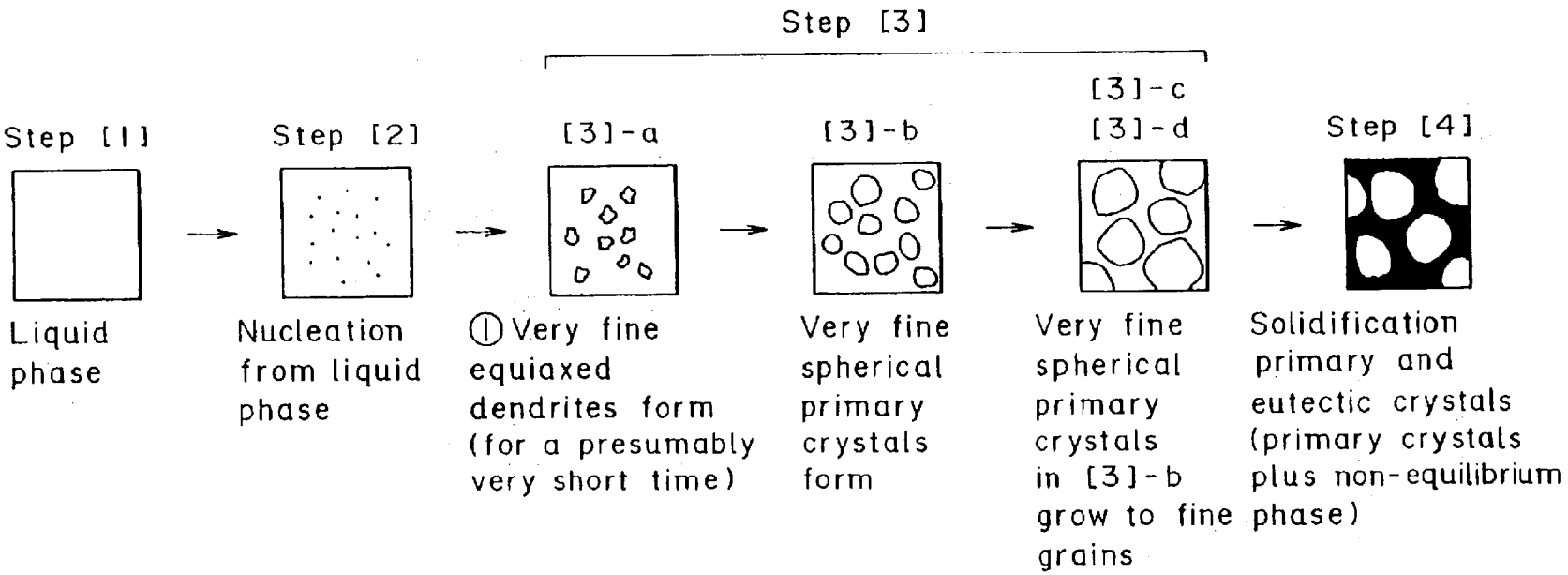
FIG. 4 is a schematic diagram which shows the metallographic structures obtained in the respective steps shown in FIGS. 3(*a*) and 3(*b*)
Figure 5A:
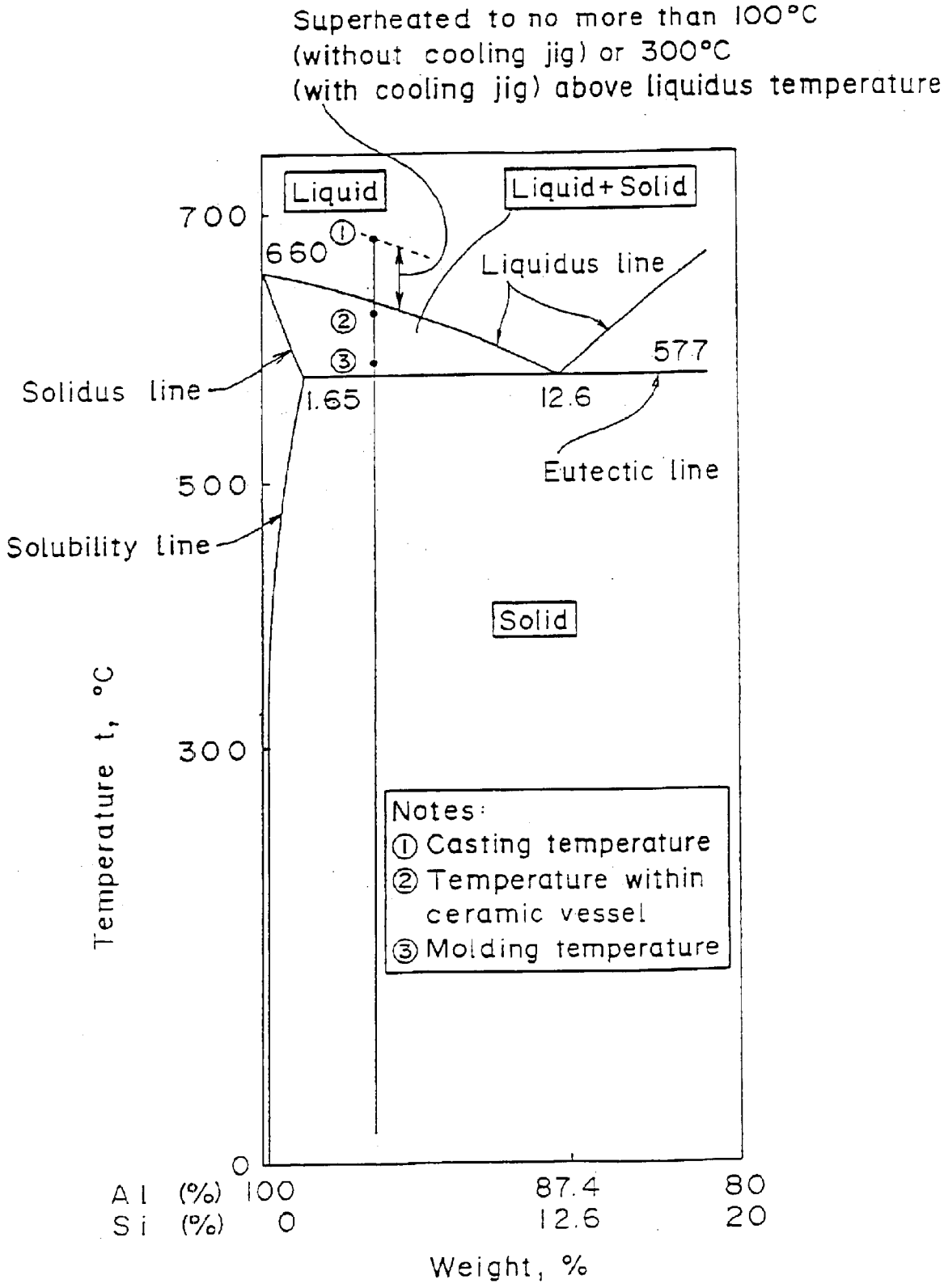
FIGS. 5(*a*) and 5(*b*) are equilibrium phase diagrams for an Al—Si alloy as a typical aluminum alloy system according to the invention.
Figure 5B:
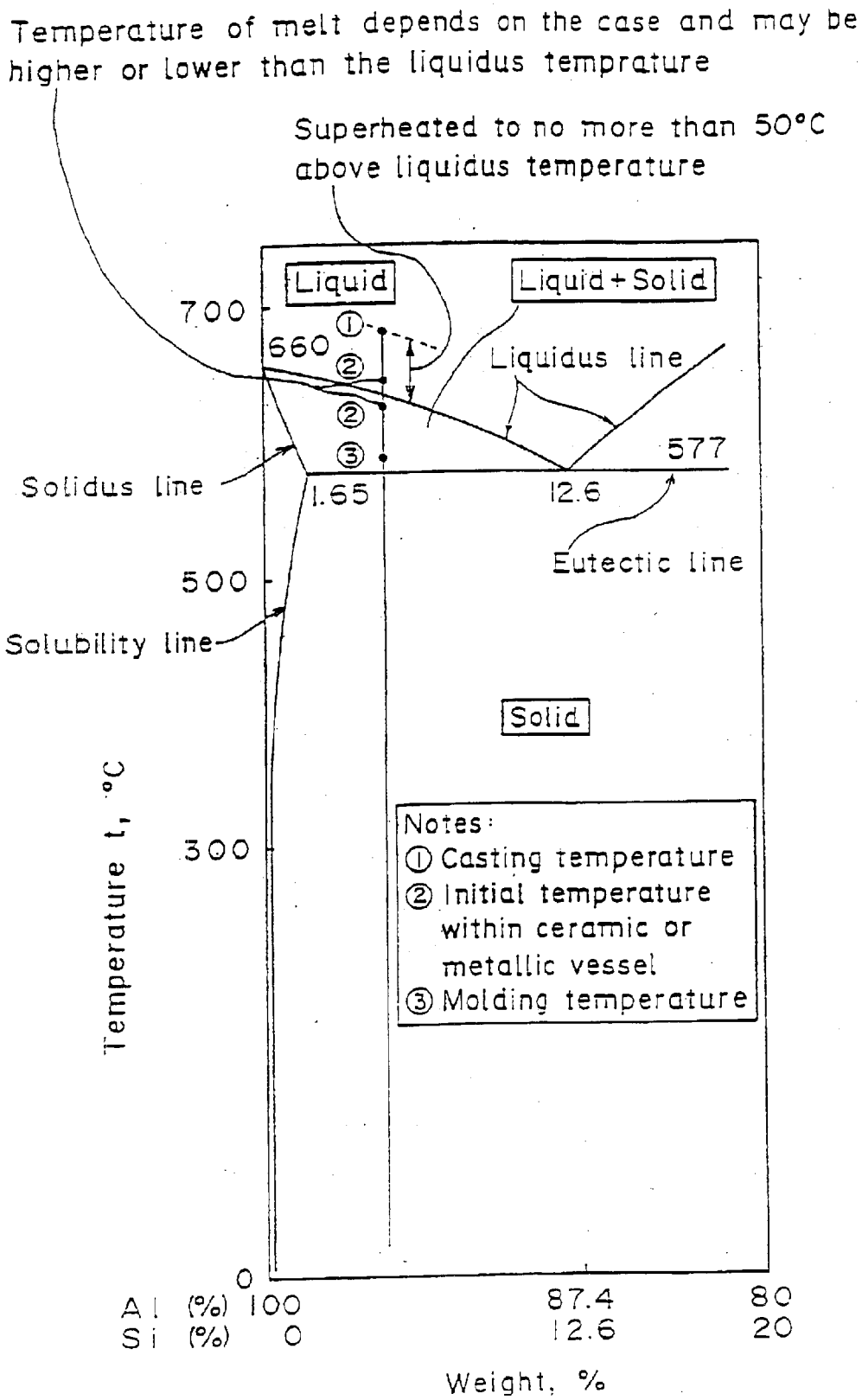
Figure 6A:
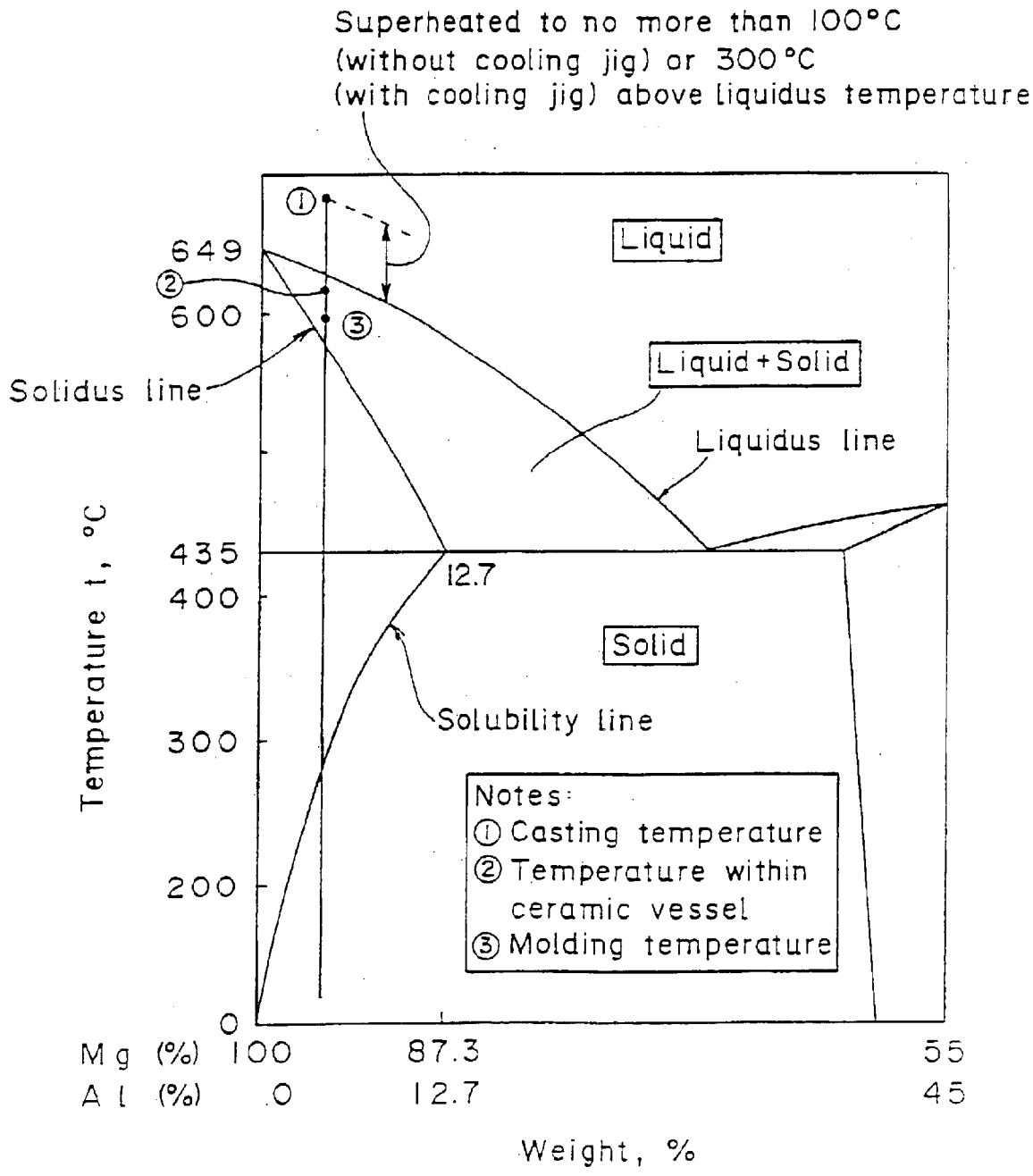
FIGS. 6(*a*) and 6(*b*) are equilibrium phase diagrams for a Mg—Al alloy as a typical magnesium alloy system according to the invention.
Figure 6:
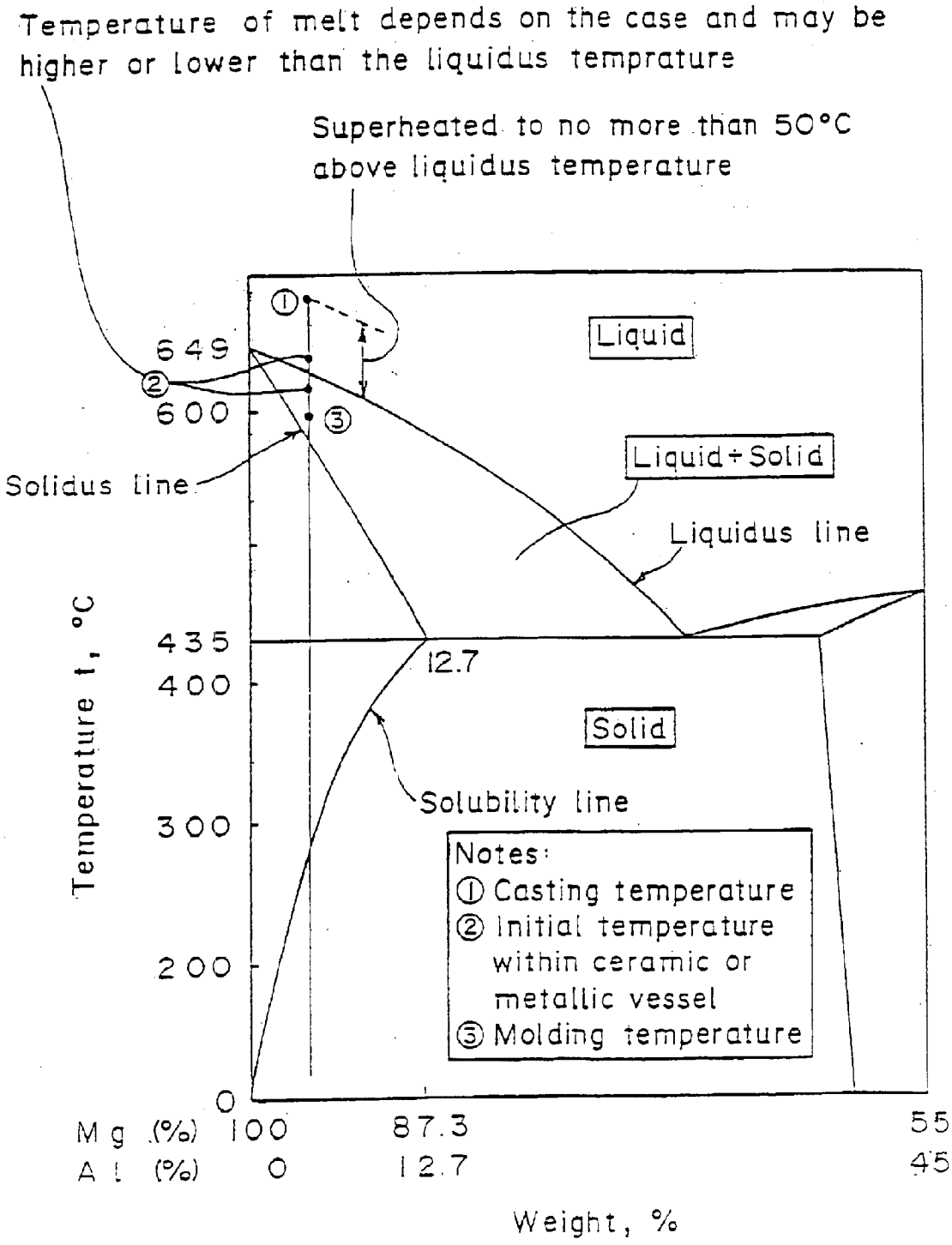
Figure 7A:
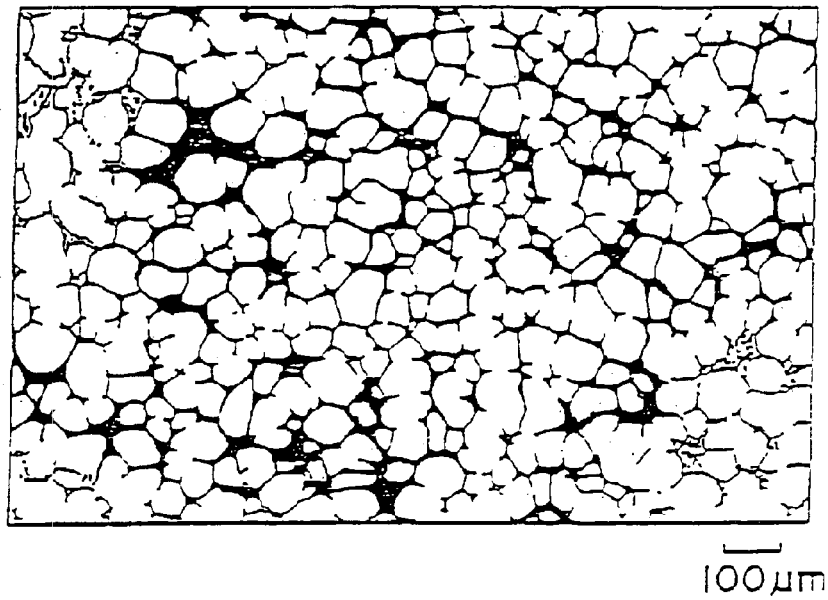
FIGS. 7(*a*) and 7(*b*) are diagrammatic representations of a micrograph showing the metallographic structure of a shaped part (such as of a AC4CH alloy in FIG. 8(*b*)) according to the invention.
Figure 8A:
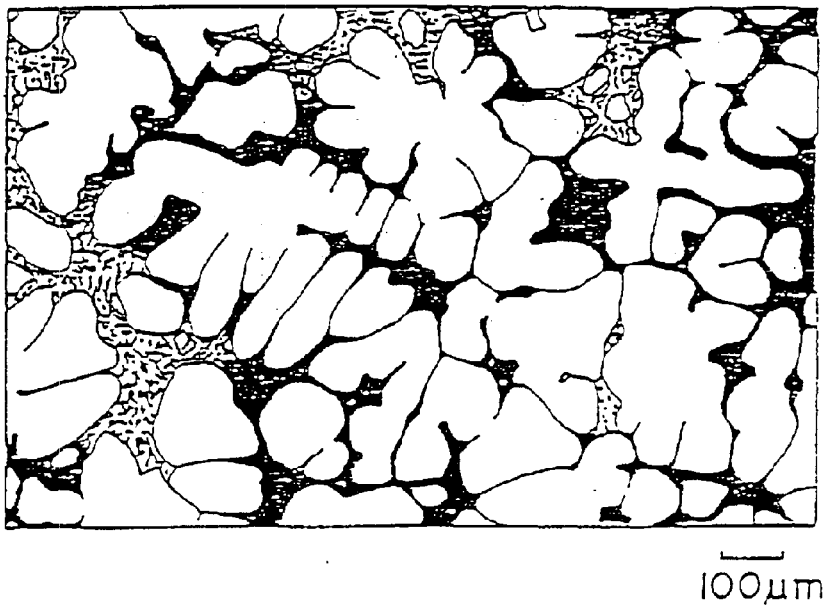
FIG. 8(a) Prior Art
FIGS. 8(*a*) and 8(*b*) are diagrammatic representations of a micrograph showing the metallographic structure of a shaped part (such as of a AC4CH alloy in FIG. 8(*b*)) according to the prior art (FIG. 8(*a*)) or a comparative example (FIG. 8(*b*))
Figure 7B:
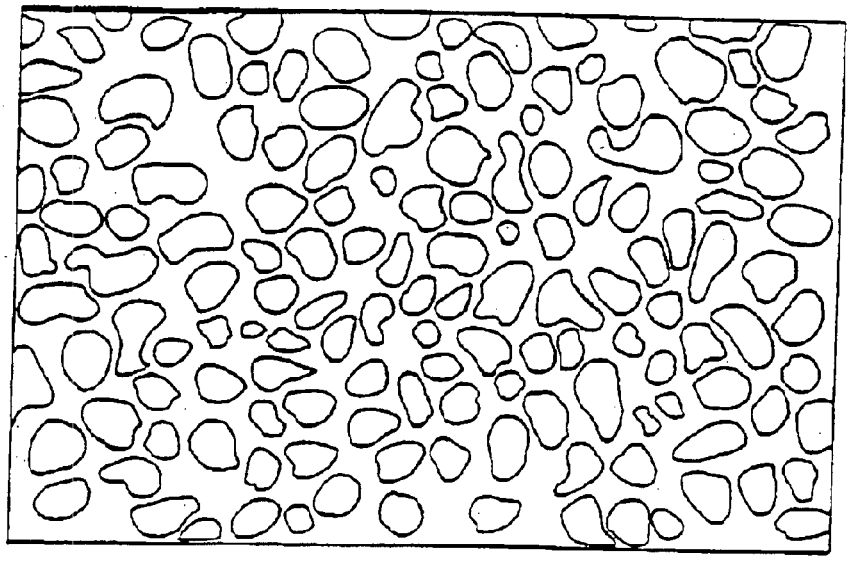
Figure 8B:
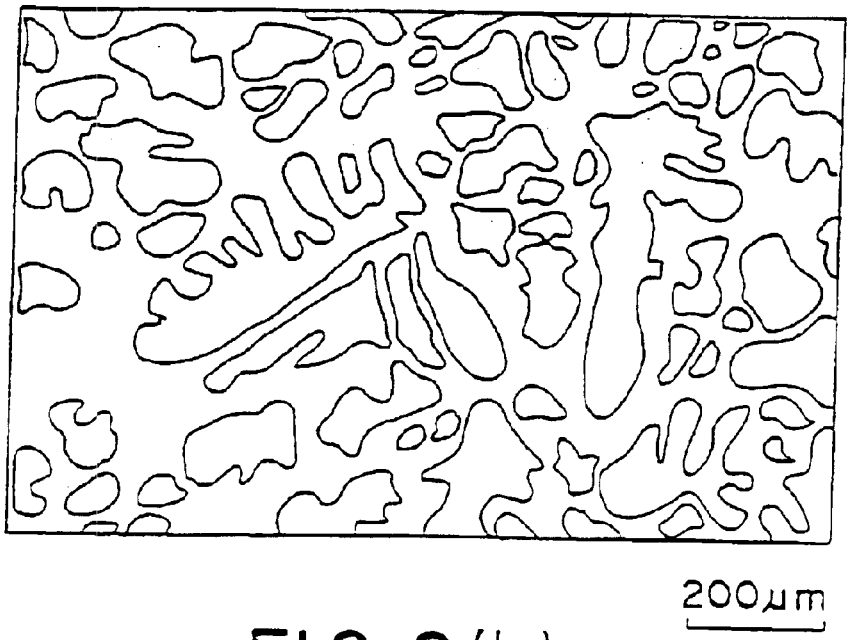
FIG. 8(b) PRIOR ART

An example of the invention (as in the fifth to the tenth embodiments of the present invention) will now be described in detail with reference to accompanying FIGS. 1(*a*), 2(*a*), 3(*a*), 4, 5(*a*), 6(*a*), 7(*a*) and 8(*a*), in which: FIG. 1(*a*) is a diagram showing a process sequence for the semisolid forming of a hypoeutectic aluminum alloy having a composition at or above a maximum solubility limit; FIG. 2(*a*) is a diagram showing a process sequence for the semisolid forming of a magnesium or aluminum alloy having a composition within a maximum solubility limit; FIG. 3(*a*) shows a process flow starting with the generation of spherical primary crystals and ending with the molding step; FIG. 4 shows diagrammatically the metallographic structures obtained in the respective steps shown in FIG. 3(*a*); FIG. 5(*a*) is an equilibrium phase diagram for an Al—Si alloy as a typical aluminum alloy system; FIG. 6(*a*) is an equilibrium phase diagram for a Mg—Al alloy as a typical magnesium alloy system; FIG. 7(*a*) is a diagrammatic representation of a micrograph showing the metallographic structure of a shaped part according to the invention; and FIG. 8 is a diagrammatic representation of a micrograph showing the metallographic structure of a shaped part according to the prior art.

As shown in FIGS. 1(*a*), 2(*a*), 5(*a*) and 6(*a*) the first step of the process according to the invention comprises:

(1) superheating the melt of a hypoeutectic aluminum alloy of a composition at or above a maximum solubility limit or a magnesium or aluminum alloy of a composition within a maximum solubility limit, holding the melt superheated to less than 300° C. above the liquidus temperature and contacting the melt with a surface of a jig at a lower temperature than its melting point so as to generate crystal nuclei in the alloy solution; or alternatively, (2) superheating the melt of an aluminum or magnesium alloy containing an element for promoting the generation of crystal nuclei, holding the melt superheated to less than 100° C. above the liquidus temperature.

The cooled molten alloy prepared in (1) is poured into an insulated vessel having a heat insulating effect and, in the case of (2), the melt is directly poured into the insulated vessel without being cooled with a jig. The melt is held within the insulated vessel for a period from 5 seconds to 60 minutes at a temperature not higher than the liquidus temperature but higher than the eutectic or solidus temperature, whereby a large number of fine spherical primary crystals are generated in the alloy, which is then shaped at a specified fraction liquid.

The, term "a specified liquid fraction" means a relative proportion of the liquid phase which is suitable for pressure forming. In high-pressure casting operations such as die casting and squeeze casting, the liquid fraction ranges from 20% to 90%, preferably from 30% to 70%. If the liquid fraction is less than. 30%, the formability of the raw material is poor; above 70%, the raw material is so soft that it is not only difficult to handle but also less likely to produce a homogeneous microstructure. In extruding and forging operations, the liquid fraction ranges from 0.1% to 70%, preferably from 0.1% to 50%, beyond which an inhomogeneous structure can potentially occur.

The "insulated vessel" as used in the invention is a metallic or nonmetallic vessel, or a metallic vessel having a surface coated with nonmetallic materials or semiconductors, or a metallic vessel compounded of nonmetallic materials or semiconductor, which vessels are adapted to be either heatable or coolable from either inside or outside.

According to the invention, semisolid metal forming will proceed by the following specific procedure. In step (1) of the process shown in FIGS. 3(*a*) and 4, a complete liquid form of metal M is contained in a ladle 10. In step (2), the metal is treated by either one of the following methods to produce an alloy having a large number of crystal nuclei which is of a composition just below the liquidus line: (a) the low-temperature melt (which may optionally contain an element that is added to promote the generation of crystal nuclei) is cooled with a jig 20 to generate crystal nuclei and the melt is then poured into a ceramic vessel 30 having a heat insulating effect; or (b) the low-temperature melt of a composition just above the melting point which contains an element to promote the generation of a fine structure is directly poured into the insulated vessel (or a ceramics-coated metallic vessel 30A) having a heat insulating effect. In subsequent step (3) the alloy is held partially molten within the insulated vessel 30 (or 30A). In the meantime, very fine, isotropic dendritic primary crystals result from the introduced crystal nuclei [step (3)-a] and grow into spherical primary crystals as the fraction solid increases with the decreasing temperature of the melt [steps (3)-b and (3)-c]. Metal M thus obtained at a specified liquid fraction is inserted into a die casting injection sleeve 40 [step (3)-d] and thereafter pressure formed within a mold cavity 50*a* on a die casting machine to produce a shaped part [step (4)].

The semisolid metal forming process of the invention shown in FIGS. 1(*a*), 2(*a*), 3(*a*) and 4 has clear differences from the conventional thixocasting and rheocasting methods. In the invention method, the dendritic primary crystals that have been crystallized within a temperature range for the semisolid state are not ground into spherical grains by mechanical or electromagnetic agitation as in the prior art but the large number of primary crystals that have been crystallized and grown from the introduced crystal nuclei with the decreasing temperature in the range for the semisolid state are spheroidized continuously by the heat of the alloy itself (which may optionally be supplied with external heat and held at a desired temperature). In addition, the semisolid metal forming method of the invention is very convenient since it does not involve the step of partially melting billets by reheating in the thixocasting process.

The casting, spheroidizing and molding conditions that are respectively set for the steps shown in FIG. 3(*a*), namely, the step of pouring the molten metal on to the cooling jig 20, the step of generating and spheroidizing primary crystals and the forming step, are set forth below more specifically. Also discussed below is the criticality of the numerical limitations set forth in the second and seventh to tenth embodiments of the present invention.

If the casting temperature is at least 300° C. higher than the melting point or if the surface temperature of jig 20 is not lower than the melting point, the following phenomena will occur;

(1) only a few crystal nuclei are generated;

(2) the temperature of the melt M as poured into the insulated vessel having a heat insulating effect is higher than the liquidus temperature and, hence, the proportion of the remaining crystal nuclei is low enough to produce large primary crystals.

To avoid these problems, the casting temperature to be employed in the invention is controlled to be such that the degree of superheating above the liquidus line is less than 300° C. whereas the surface temperature of jig 20 is controlled to be lower than the melting point of alloy M. Primary crystals of an even finer size can be produced by ensuring that the degree of superheating above the liquidus line is less than 100° C. and by adjusting the surface temperature of jig 20 to be at least 50° C. lower than the melting point of alloy M. The melt M can be contacted with jig 20 by one of two methods: the melt M is moved on the surface of jig 20 (the melt is caused to flow down the inclined jig), or the jig moves through the melt. The "jig" as used herein means any device that provides a cooling action on the melt as it flows down. The jig may be replaced by the tubular pipe on a molten metal supply unit. Insulated vessel 30 for holding the melt the temperature of which has dropped to just below the liquidus line shall have a heat insulating effect in order to ensure that the primary crystals generated will spheroidize and have the desired liquid fraction after the passage of a specified time. The constituent material of the insulated vessel is in no way limited and those which have a heat-retaining property and which wet with the melt only poorly are preferred. If a gas-permeable ceramic container is to be used as the insulated vessel 30 for holding magnesium alloys which are prone to oxidize and burn, the exterior to the vessel is preferably filled with a specified atmosphere (e.g. an inert or vacuum atmosphere). For preventing oxidation, it is desired that Be or Ca is preliminarily added to the molten metal. The shape of the insulated vessel 30 is by no means limited to a tubular form and any other shapes that are suitable for the subsequent forming process may be adopted. The molten metal need not be poured into the insulated vessel but it may optionally be charged directly into a ceramic injection sleeve. If the holding time within the insulated vessel 30 is less than 5 seconds, it is not easy to attain the temperature for the desired liquid fraction and it is also difficult to generate spherical primary crystals. If the holding-time exceeds 60 minutes, the spherical primary crystals and eutectic structure generated are so coarse that deterioration in mechanical properties will occur. Hence, the holding time within the insulated vessel is controlled to lie between 5 seconds and 60 minutes. If the liquid fraction in the alloy which is about to be shaped by high-pressure casting processes is less than 20%, the resistance to deformation during the shaping is so high that it is not easy to produce shaped parts of good quality. If the liquid fraction exceeds 90%, shaped parts having: a homogeneous structure cannot be obtained. Therefore, as already mentioned, the liquid fraction in the alloy to be shaped is preferably controlled to lie between 20% and 90%. By adjusting the effective liquid fraction to range from 30% to 70%, shaped parts having a more homogeneous structure and higher quality can be easily obtained by pressure forming. If, in the case of shaping Al—Si alloy systems having a near eutectic composition, it is necessary to generate eutectic Si within the insulated vessel while reducing the liquid fraction to 80% or below, Na or Sr may be added as an Si modifying element and this is advantageous for refining the eutectic Si grains, thereby providing improved ductility. The means of pressure forming are in no way limited to high-pressure casting processes typified by squeeze casting and die casting and various other methods of pressure forming may be adopted, such as extruding and casting operations.

The constituent material of the jig 20 with which the melt M is to be contacted is not limited to any particular types as long as it is capable of lowering the temperature of the melt. A jig 20 that is made of a highly heat-conductive metal such as copper, a copper alloy, aluminum or an aluminum alloy and which is controlled to provide a cooling effect for maintaining temperatures below a specified level is particularly preferred since it allows for the generation of many crystal nuclei. In this connection, it should be mentioned that coating the cooling surface of the jig 20 with a nonmetallic material is effective for the purpose of ensuring that solid lumps of metal will not adhere to the jig 20 when it is contacted by the melt M. The coating method may be either mechanical or chemical or physical.

A semisolid alloy containing a large number of crystal nuclei and which has a temperature not higher than the liquidus line can be obtained by contacting the melt M with the jig 20. If desired, (1) in order to generate more crystal nuclei so as to produce a homogeneous structure comprising fine spherical grains or (2) to ensure that a semisolid alloy containing a large number of crystal nuclei and which has a temperature not higher than the liquidus line is produced from a melt that has been superheated to less than 100° C. above the liquidus line and which is not contacted with any jig, various elements may be added to the melt, as exemplified by Ti and B for the case where the melt is an aluminum alloy, and Sr, Si and Ca for the case where the melt is a magnesium alloy. If the Ti addition is less than 0.005%, the intended refining effect is not attained; beyond 0.30%, a coarse Ti compound will form to cause deterioration in ductility. Hence, the Ti addition is controlled to lie between 0.005% and 0.30%. Boron (B) cooperates with Ti to promote the refining of crystal grains but its refining effect is small if the addition is less than 0.001%; on the other hand, the effect of B is saturated at 0.02% and no further improvement is expected beyond 0.02%. Hence, the B addition is controlled to lie between 0.001% and 0.02%. If the Sr addition is less than 0.005%, the intended refining effect is not attained; on the other hand, the effect of Sr is saturated at 0.1% and no further improvement is expected beyond 0.1%. Hence, the Sr addition is controlled to lie between 0.005% and 0.1%. If 0.01%–1.5% of Si is added in combination with 0.005%–0.1% of Sr, even finer crystal grains will be formed than when Sr is added alone. If the Ca addition is less than 0.0.05%, the intended refining effect is not attained; on the other hand, the effect of Ca is saturated at 0.30% and no further improvement is expected beyond 0.30%. Hence, the Ca addition is controlled to lie between 0.05% and 0.30%.

If the fine spherical primary crystals are to be obtained without employing jig 20, the degree of superheating above the liquidus line is set to be less than 100° C. and this is to ensure that the molten alloy poured into the insulated vessel 30 having a heat insulating effect is brought to either a liquid state having crystal nuclei or a partially solid, partially liquid state having crystal nuclei at a temperature not lower than the molding temperature. If the melt poured into the insulated vessel 30 is unduly hot, so much time will be taken for the temperature of the melt to decrease to establish a specified liquid fraction that the operating efficiency becomes low. Another inconvenience is that the poured melt M is oxidized or burnt at the surface.

Table 1 shows the conditions of various samples of semisolid metal to be shaped, as well as the qualities of shaped parts. As shown in FIG. 3(*a*), the shaping operation consisted of inserting the semisolid metal into an injection sleeve and subsequent forming on a squeeze casting machine. The forming conditions were as follows: pressure, 950 kgf/cm$^2$; injection speed, 1.5 m/s; mold cavity dimensions, 100×150×10; mold temperature, 230° C.

TABLE 1

| | | | Conditions of the semisolid metal to be shaped | | | | | |
|---|---|---|---|---|---|---|---|---|
| | No. | Alloy | Casting temperature (° C.) | Cooling jig | Temperature of the cooling jig (° C.) | Temperature of the metal within vessel (° C.) | Holding time (min) | Fraction liquid just before shaping (%) |
| Comparative Sample | 1 | AC4CH | 625 | Used | 622 | 618 | 5 | 60 |
| | 2 | AC4CH | 950 | Used | 30 | 730 | 20 | 60 |
| | 3 | AC4CH | 680 | Used | 30 | 622 | 65 | 15 |
| | 4 | AC4CH-0.15% Ti—0.005% B | 630 | Used | 30 | 613 | 0.04 | 95 |
| | 5 | AC4CH | 630 | Used | 30 | 610 | 2 | 60 |
| | 6 | AC4CH-0.15% Ti—0.005% B | 630 | Used | 30 | 611 | 1 | 92 |
| | 7 | AC4CH | 630 | Not used | — | 620 | 5 | 60 |
| Invention Sample | 8 | AC4CH-0.15% Ti—0.005% B | 630 | Used | 30 | 612 | 6.5 | 55 |
| | 9 | AC4CH | 630 | Used | 30 | 611 | 12 | 45 |
| | 10 | AC4CH-0.15% Ti—0.005% B | 630 | Used | 400 | 614 | 5.5 | 60 |
| | 11 | AC4CH-0.15% Ti—0.005% B | 850 | Used | 25 | 613 | 6 | 60 |
| | 12 | AC4CH-0.15% Ti—0.015% B | 630 | Not Used | — | 620 | 15 | 35 |
| | 13 | AC7A | 660 | Used | 30 | 632 | 5.7 | 50 |
| | 14 | 7075 | 650 | Used | 30 | 620 | 1.5 | 80 |
| | 15 | AZ91 | 620 | Used | 30 | 590 | 4.2 | 55 |
| | 16 | AZ91-0.4% Si—0.01% Sr | 620 | Used | 30 | 590 | 4.3 | 55 |
| | 17 | AZ91-0.15% Ca | 620 | Not used | 30 | 590 | 4.5 | 55 |
| | 18 | AC4CH-0.15% Ti—0.015% B | 630 | Not used | — | 620 | 5 | 60 |

| | | | Quality of shaped part | | | | | |
|---|---|---|---|---|---|---|---|---|
| | No. | Alloy | Internal Segregation | Primary crystal size (μm) | Amount unspherical primary crystal | Eutectic size | External appearance | Remarks |
| Comparative Sample | 1 | AC4CH | X | 280 | X | ○ | Δ | High jig temperature |
| | 2 | AC4CH | X | 450 | X | ○ | ○ | High casting temperature |
| | 3 | AC4CH | ○ | 180 | ○ | X | X | Long holding time |
| | 4 | AC4CH-0.15% Ti—0.005% B | X | | *1 | ○ | ○ | Short holding time, high fraction liquid |
| | 5 | AC4CH | X | | *2 | ○ | X | Metallic container was used at ordinary temperature. |
| | 6 | AC4CH-0.15% Ti—0.005% B | X | | *2 | ○ | ○ | Short holding time, high fraction liquid |
| | 7 | AC4CH | X | 290 | X | ○ | Δ | No grain refiner was used. |
| Invention Sample | 8 | AC4CH-0.15% Ti—0.005% B | ○ | 55 | ○ | ○ | ○ | |
| | 9 | AC4CH | ○ | 70 | ○ | ○ | ○ | |
| | 10 | AC4CH-0.15% Ti—0.005% B | ○ | 85 | ○ | ○ | ○ | |
| | 11 | AC4CH-0.15% Ti—0.010% B | ○ | 75 | ○ | ○ | ○ | |
| | 12 | AC4CH-0.15% Ti—0.015% B | ○ | 115 | ○ | ○ | ○ | Water-cooled cooling jig was used. |
| | 13 | AC7A | ○ | 80 | ○ | ○ | ○ | No jig was used. |
| | 14 | 7075 | ○ | 90 | ○ | ○ | ○ | |
| | 15 | AZ91 | ○ | 85 | ○ | ○ | ○ | |
| | 16 | AZ91-0.4% Si—0.01% Sr | ○ | 75 | ○ | ○ | ○ | |

TABLE 1-continued

| | | | | | | | |
|---|---|---|---|---|---|---|---|
| 17 | AZ91-0.15% Ca | ○ | 120 | ○ | ○ | ○ | No jig was used. |
| 18 | AC4CH-0.15% Ti—0.015% B | ○ | 95 | ○ | ○ | ○ | Vibrations (100 Hz) were applied at amplitude of 0.1 mm. |

AC4CH: Al—7% Si—0.35% Mg m.p. 620° C.
7075: Al—4.5% Zn—1.1% Mg m.p. 640° C.
AZ91: Mg—9% Al—0.7% Zn m.p. 595° C.
AC7A: Al—5% Mg—0.4% Mn m.p. 635° C.
*1 Dendritic primary crystals
*2 Spherical primary crystals (with dendritic primary crystals)
External appearance: ○, good; Δ, fair; X, poor
Internal segregations: ○, a few; X, many
Amount of unspherical primary crystals: ○, small; X, large
Eutectic size: ○, fine; X, coarse In Comparative Sample 1, the temperature of jig 20 with which the melt M was contacted was so high that the number of crystal nuclei generated was insufficient to produce fine spherical primary crystals; instead coarse unspherical primary crystals formed as shown in FIG. 7(*a*). In Comparative Sample 2, the casting temperature was so high that very few crystal nuclei remained within the ceramic vessel 30, yielding the same result as with Comparative Sample 1. In Comparative Sample 3, the holding time was so long that the liquid fraction in the metal to be shaped was low, yielding a shaped part of poor appearance. In addition, the size of primary crystals was undesirably large. In Comparative Sample 4, the holding time within the ceramic vessel 30 was short whereas the liquid fraction in the metal to be shaped was high; hence, only dendritic primary crystals formed. In addition, the high liquid fraction caused many segregations of components within the shaped part. With Comparative Sample 5 the insulated vessel 30 was a metallic container having a small heat insulating effect, so the dendritic solidified layer forming on the inner surface of the vessel 30 would enter the spherical primary crystals generated in the central part of the vessel, thus yielding an inhomogeneous structure involving segregations. In Comparative Sample 6, the liquid fraction in the metal to be shaped was so high that the result was the same as with Comparative Sample 4. With Comparative Sample 7, the jig 20 was not used; the starting alloy did not contain any grain refiners, so the number of crystal nuclei generated was small enough to yield the same result as with Comparative Sample 1.

In each of Invention Samples 8–17, a homogeneous microstructure comprising fine (<150 μm) spherical primary crystals was obtained to enable the production of a shaped part having good appearance.

Example 2

An example of the invention (as in the eleventh to the thirteenth embodiments of the present invention) will now be described in detail with reference to accompanying drawings. As shown in FIGS. 9–12, the eleventh to thirteenth embodiments of the present invention is such that:

(1) the melt of a hypoeutectic aluminum alloy of a composition at or above a maximum solubility limit or a magnesium or aluminum alloy of a composition within a maximum solubility limit which are held superheated less than 300° C. above the liquidus temperature is contacted with a surface of a jig having a lower temperature than the melting point of the alloy so as to generate crystal nuclei in the alloy solution which is then poured into an insulated vessel; or (2) the melt of an aluminum or magnesium alloy that is held superheated to less than 100° C. above the liquidus temperature is directly poured into an insulated vessel without using any jig, thereby generating crystal nuclei in the liquid alloy.

Subsequently, the liquid alloy having crystal nuclei that has been superheated by a degree (X° C.) of less than 10° C. above the liquidus temperature is held in the insulated vessel for a period from 5 seconds to 60 minutes as said alloy is cooled to a molding temperature that is higher than the eutectic or solidus temperature and where a specified liquid fraction is established, such that the cooling to the liquidus temperature of said alloy is completed within a time shorter than the time Y (in minutes) calculated by the relationship Y=10−X and that the period of cooling from the initial temperature at which said alloy is held in the insulated vessel to a temperature 5° C. lower than the liquidus temperature is not longer than 15 minutes, whereby fine spherical primary crystals are crystallized in the alloy solution, which is then fed into a forming mold, where it is shaped under pressure.

Alternatively, a partially solid, partially liquid alloy (at a temperature not lower than a molding temperature higher than the eutectic or solidus temperature) is held within the insulated vessel for a period from 5 seconds to 60 minutes as it is cooled to the molding temperature where a specified liquid fraction is established, such that the period of cooling from the initial temperature at which said alloy is held within the insulated vessel to a temperature St lower than the liquidus temperature of said alloy is not longer than 150 minutes, whereby fine spherical primary crystals are crystallized in the alloy solution, which is then fed into a forming mold, where it is shaped under pressure.

The specific procedure of semisolid metal forming to be performed in Example 2 is essentially the same as described in Example 1.

The casting, spheroidizing and molding conditions that are respectively set for the steps shown in see FIG. 3, namely, the step of pouring the molten metal on to the ceramic jig 20, the step of generating and spheroidizing primary crystals and the forming step, are set forth below more specifically. Also discussed below is the criticality of the numerical limitations in the eleventh to thirteenth embodiments of the present invention.

If the alloy to be held within the insulated vessel 30 is superheated such that its initial temperature is at least 10° C. above the liquidus line, only nonspherical primary crystals of a size of 300 μm and larger will form and fine, spherical primary crystals cannot be obtained no matter what conditions are used to cool the alloy to the molding temperature where a specified liquid fraction is established with a view to introducing crystal nuclei into the melt. To avoid this problem, the initial temperature of the alloy held within the insulated vessel. 30 is controlled to be less than 10° C. above the liquidus line.

If the alloy to be held within the insulated vessel 30 is superheated such that its initial temperature is less than 10° C. above the liquidus line, the alloy must be cooled to the liquidus temperature within a shorter time than the period calculated by the relationship Y-10-X, where Y is the time (in minutes) taken for the alloy temperature to drop to the liquidus temperature and X is the degree of superheating (in ° C.). Otherwise, nonspherical primary crystals of a size of 300 μm and larger will form as is the case where the degree of superheating is 10° C. or more above the liquidus line. To avoid this problem, the alloy is cooled to the liquidus temperature within a shorter time than the period calculated by the relation Y=10−X.

Even if the alloy is cooled from the initial temperature to the liquidus temperature within a shorter time than the period determined by the relationship Y=10−X, nonspherical primary crystals of a size of 300 μm and larger will form or the size of spherical crystals to be obtained tends to be larger than 200 μm if the cooling from the initial temperature to the temperature 5° C. lower than the liquidus temperature is completed within 15 minutes. Therefore, the period of cooling from the initial temperature to the temperature 5° C. lower than the liquidus temperature should not be longer than 15 minutes.

Referring to the case where the alloy to be held within the insulated vessel 30 is in a partially solid, partially liquid state having an initial temperature lower than the liquidus temperature, the cooling from the initial temperature to the temperature 5° C. lower than the liquidus temperature must be completed within 15 minutes; otherwise, nonspherical primary crystals of a size of 300 μm and larger will form or the size of spherical crystals to be obtained tends to be larger than 200 μm. Therefore, the period of cooling from the initial temperature to the temperature 5° C. lower than the liquidus temperature should not be longer than 15 minutes.

Figure 15:
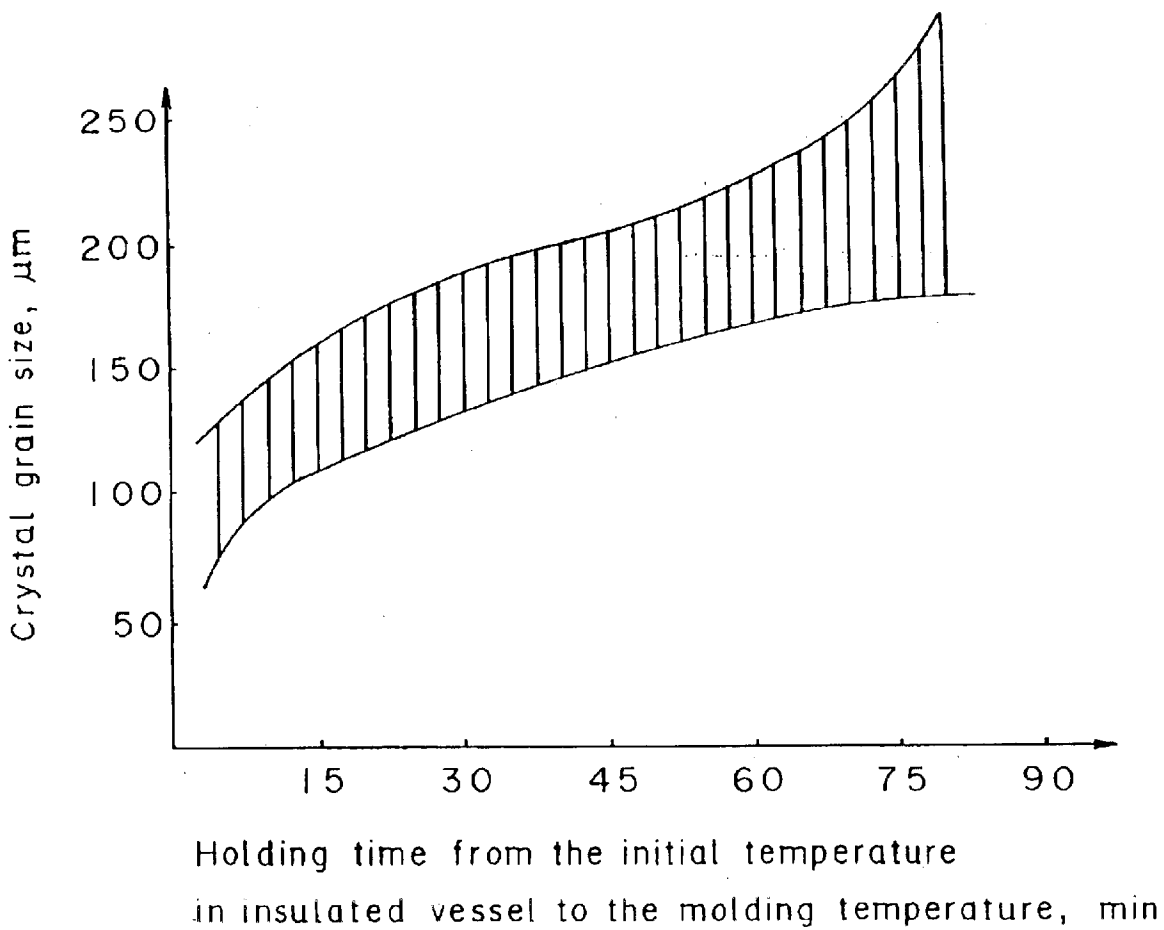
FIG. 15 is a graph showing how the holding time affects the crystal grain size of a typical alloy (AZ91)
Figure 16:
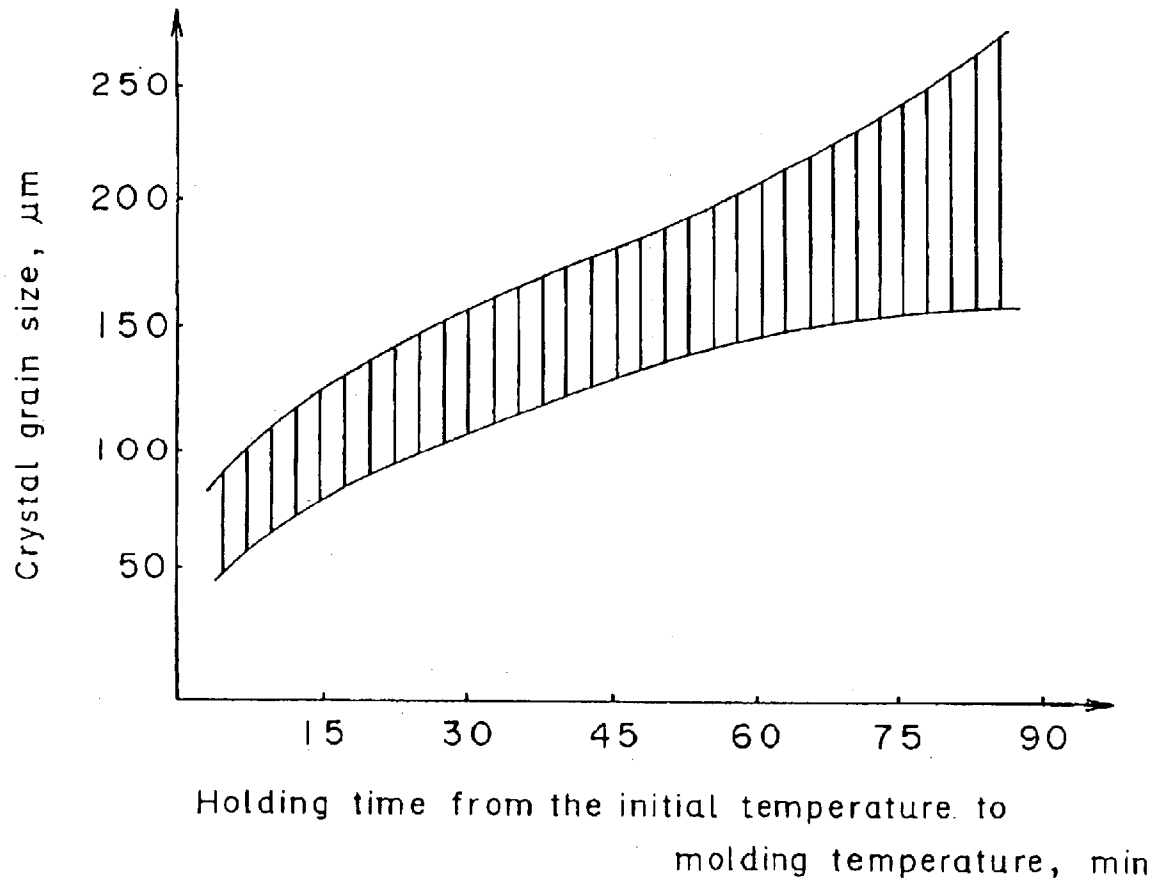
FIG. 16 is a graph showing how the holding time affects the crystal grain size of a typical alloy (AC4CH)
Figure 17:
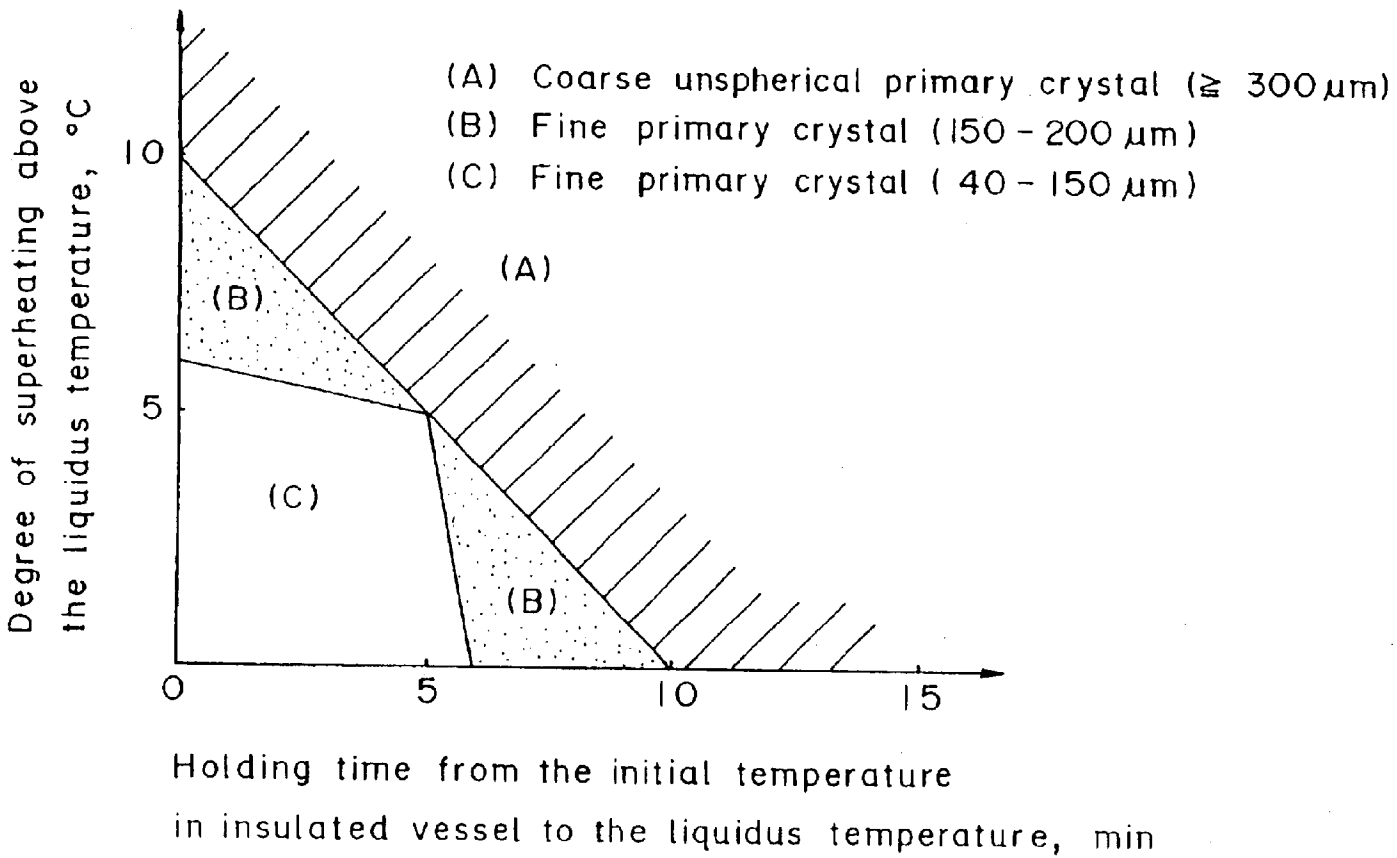
FIG. 17 is a graph showing how the degree of superheating of the typical alloy AZ91 (above the liquidus line) and the holding time (from the initial temperature within an insulated vessel to the liquidus temperature) affect the crystal grain size of the alloy.
Figure 18:
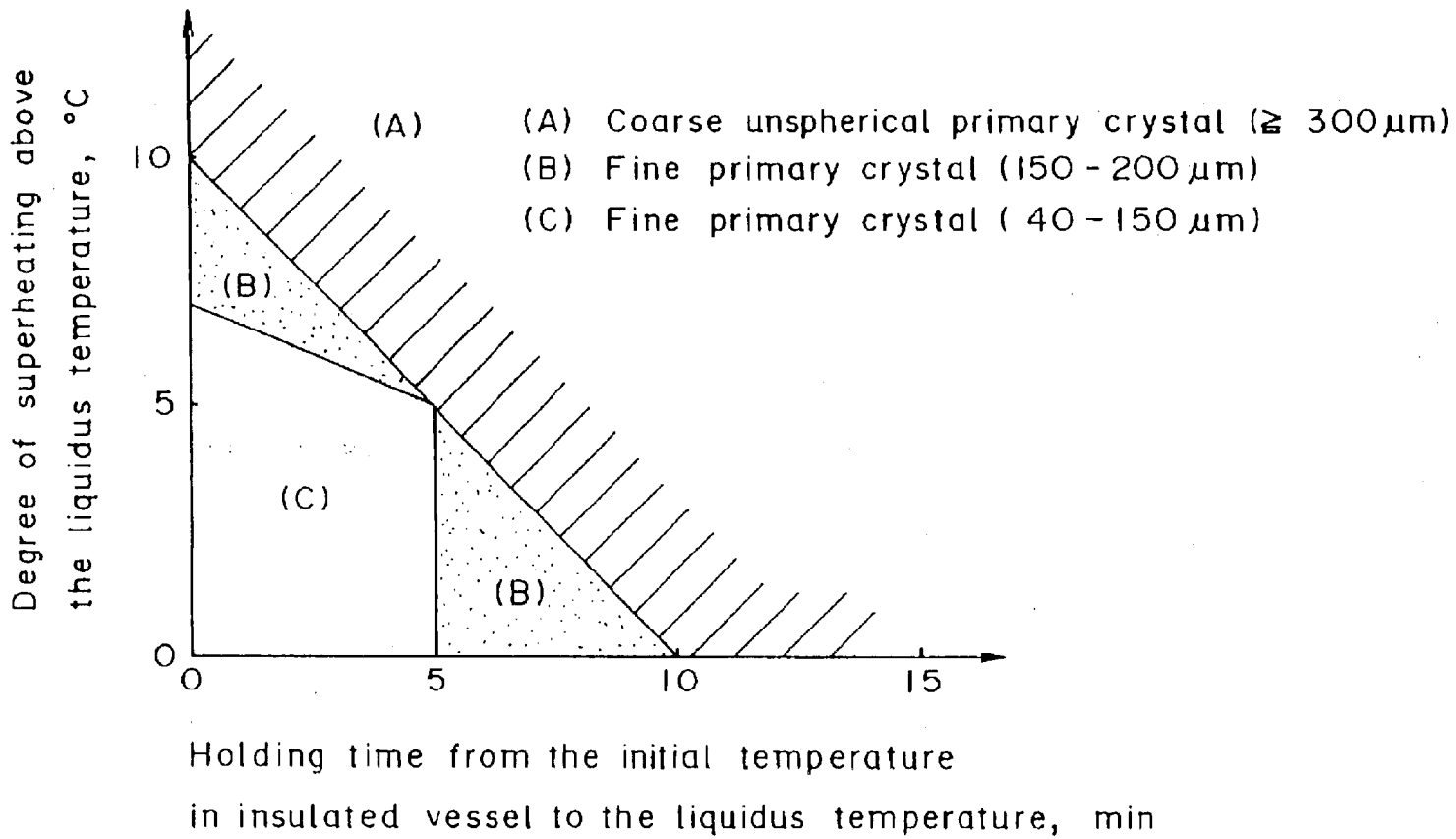
FIG. 18 is a graph showing how the degree of superheating of the typical alloy AC4CH (above the liquidus line) and the holding time (from the initial temperature within the insulated vessel to the liquidus temperature) affect the crystal grain size of the alloy.

FIGS. 15 and 16 show how the holding time affects the crystal grain sizes of AZ91 and AC4CH which respectively are typical magnesium and aluminum alloys. The "holding time" is the time for which the metal as poured into the insulated vessel is held until the molding temperature is reached. The "molding temperature" is a typical value at which about 50% fraction liquid is established and it is 570° C. for AZ91 and 585° C. for AC4CH. Obviously, the dependency of the crystal grain size on the holding time differs with the alloy type but in both cases the grain size tends to be greater than 200 μm if the holding time exceeds 60 minutes. On the other hand, primary crystals finer than 200 μm are prone to occur in the present invention. FIGS. 17 and 18 show how the degree by which the AZ91 and AC4CH within the holding vessel are superheated above the liquidus temperature and the holding time from the initial temperature within the insulated vessel to the liquidus temperature will affect the crystal grain sizes of the respective alloys.

Figure 13:
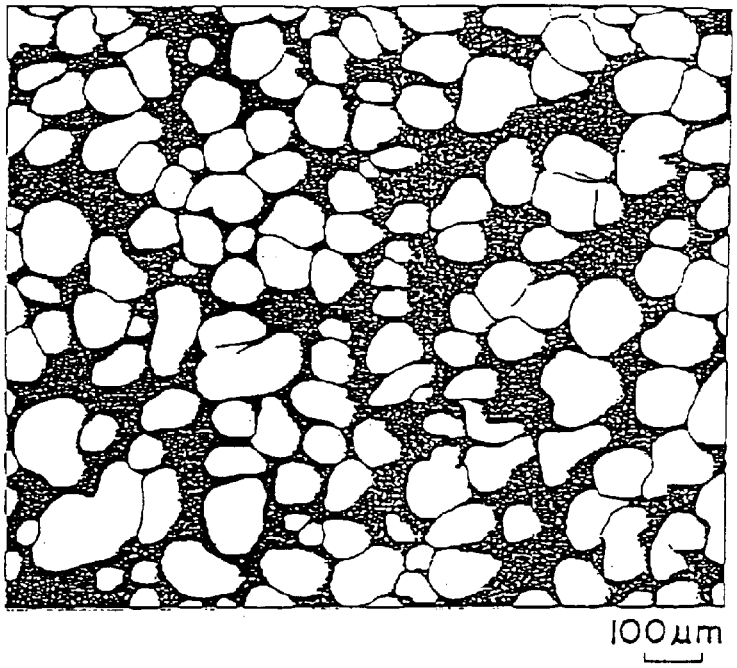
FIG. 13 is a diagrammatic representation of a micrograph showing the metallographic structure of a shaped part according to the invention (as in the eleventh, twelfth and thirteenth embodiments of the present invention)
Figure 14:
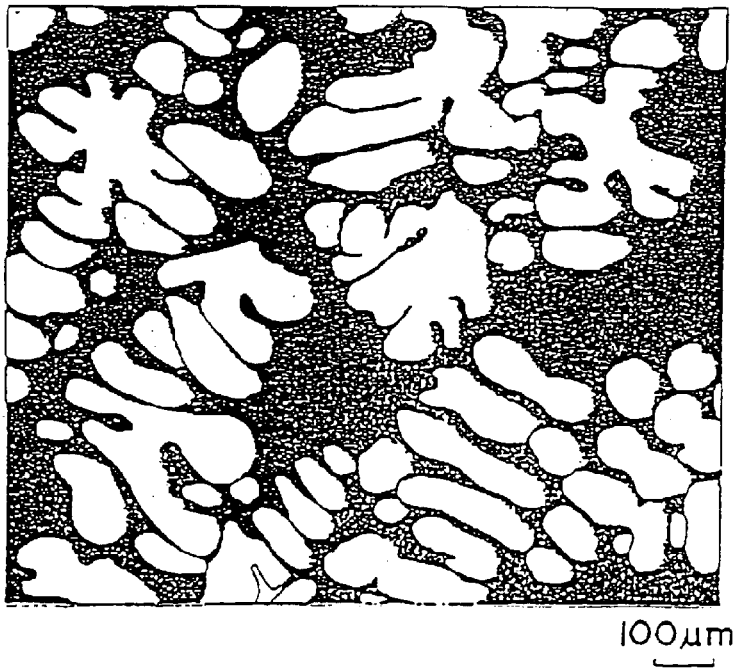
FIG. 14 Prior Art
FIG. 14 is a diagrammatic representation of a micrograph showing the metallographic structure of a shaped part according to the prior art (for comparison with the eleventh, twelfth and thirteenth embodiments of the present invention)
Figure 19:
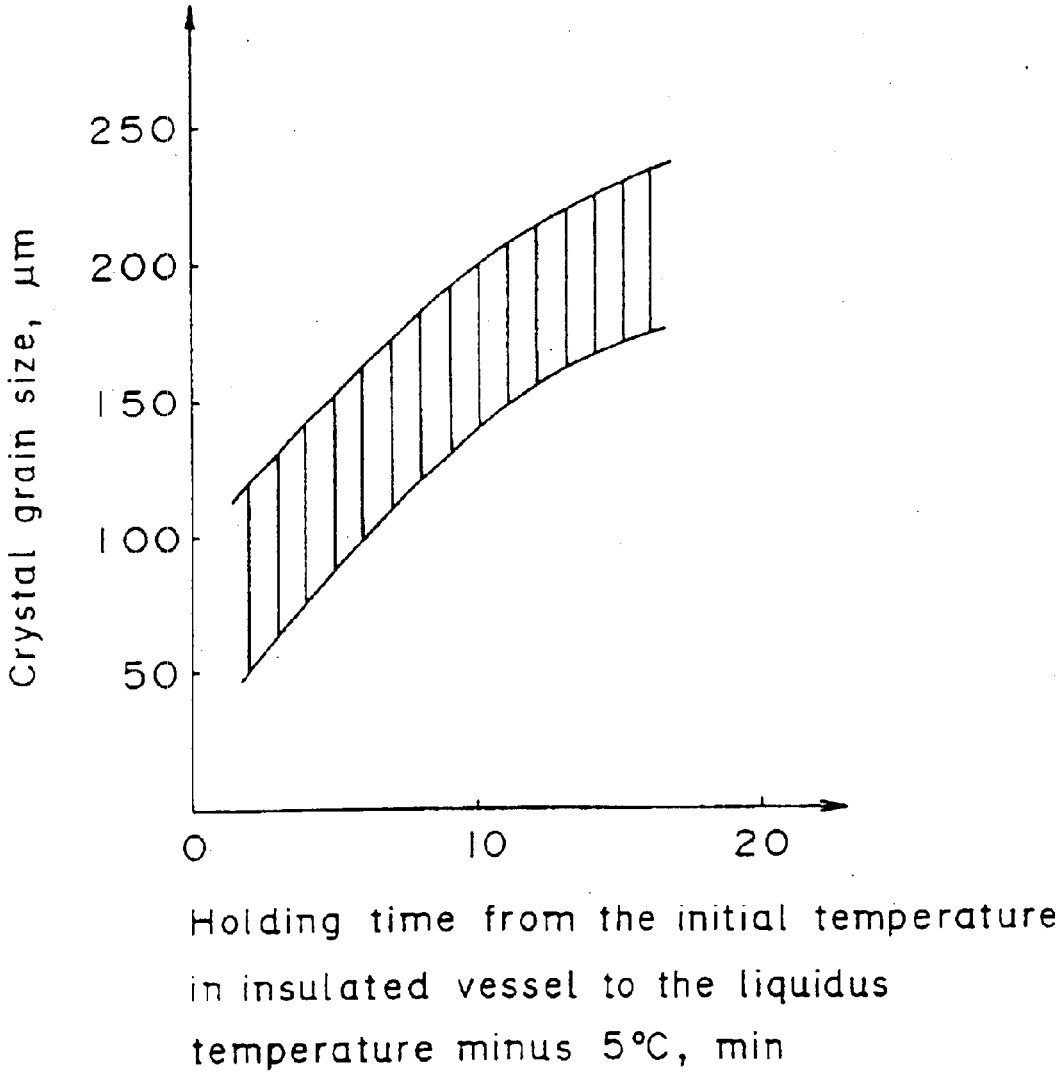
FIG. 19 is a graph showing how the holding time (from the initial temperature within the insulated vessel to the liquidus temperature minus 5° C.) affects the crystal grain size of the crystal grain size of the prior art alloy AZ91.
Figure 20:
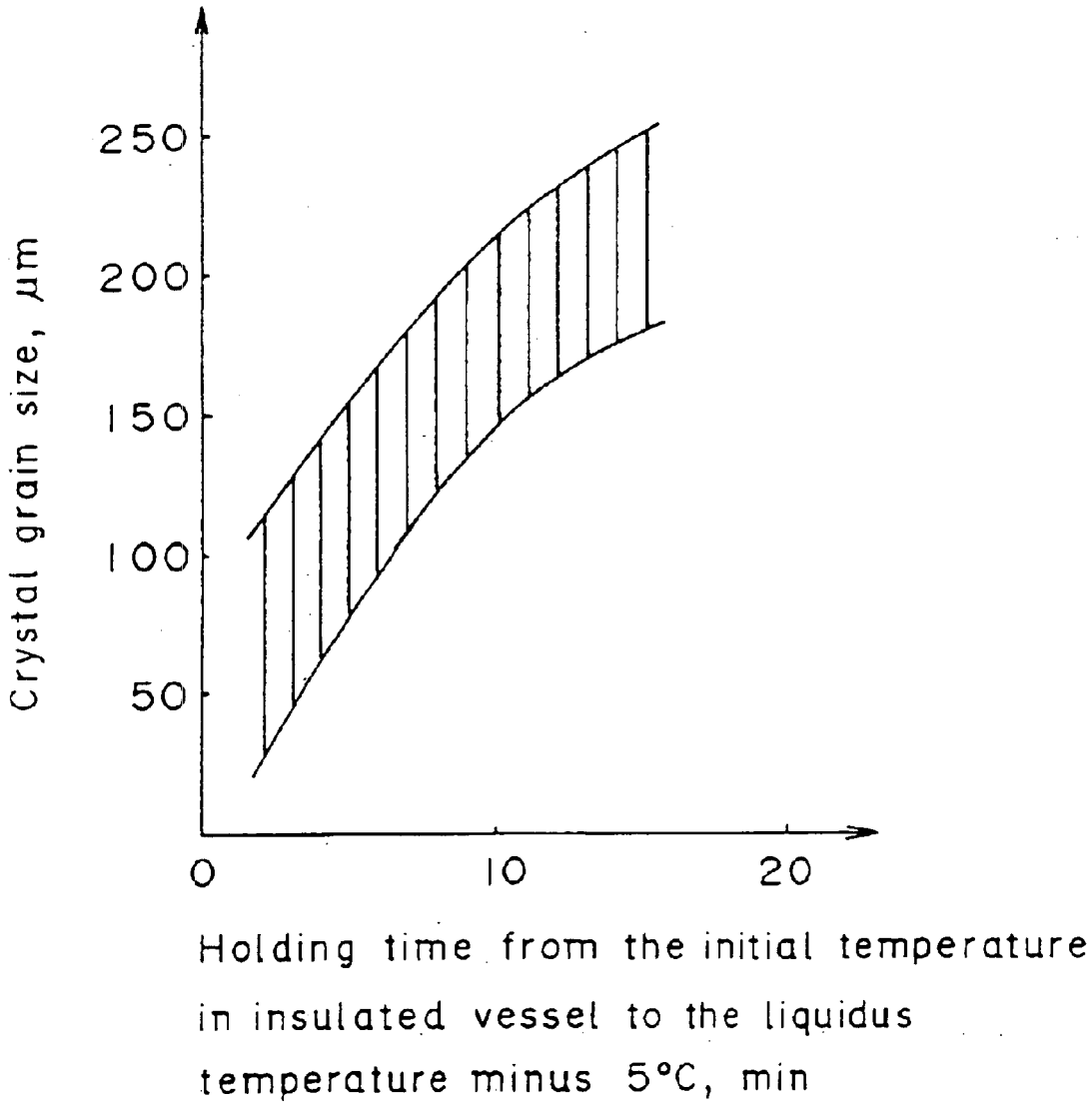
FIG. 20 is a graph showing how the holding time (from the initial temperature within the insulated vessel to the liquidus temperature minus 5° C.) affects the crystal grain size of the prior art alloy AC4CH.

In the area of each graph where the degree of superheating (t) and the holding time (min) are below the line connecting two points (10, 0) and (0, 10), fine (<200 μm) primary crystals are generated in accordance with the invention as shown diagrammatically in FIG. 13. In the area above the line, coarse (>300 μm) unspherical primary crystals occur as shown diagrammatically in FIG. 14. Even finer and more homogeneous primary crystals are obtained under the conditions for the holding time and the degree of superheating that are represented by area (C) in FIGS. 17 and 18 [the region bound by points (0,6), (5,5) and (6,0) in FIG. 17 and the region bound by points (0,7), (5,5) and (5,0) in FIG. 18]. FIGS. 19 and 20 show how the holding time (from the initial temperature within the insulated vessel to the liquidus temperature minus 5° C.) affects the crystal grain sizes of AZ91 and AC4CH, respectively. Obviously, the crystal grain size increases with the holding time and if the latter exceeds 15 minutes, there is a marked tendency for the crystal grain size to exceed 200 μm and coarse nonspherical primary crystals occur. In the present invention where the holding time is less than 15 minutes, there is a marked tendency for the primary crystals to be generated in small sizes less than 200 μm.

Example 3

Figure 21:
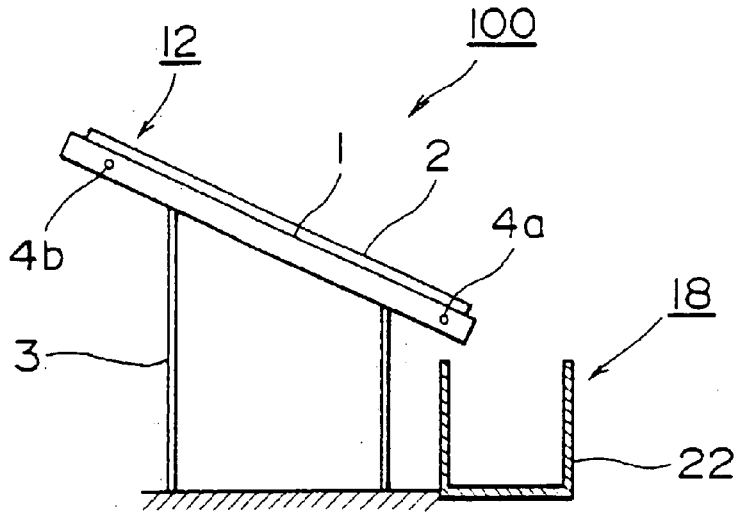
FIG. 21 is a side view of an apparatus for producing a semisolid forming metal according to an example of the invention (as in the fourteenth and fifteenth embodiments of the present invention)
Figure 22:
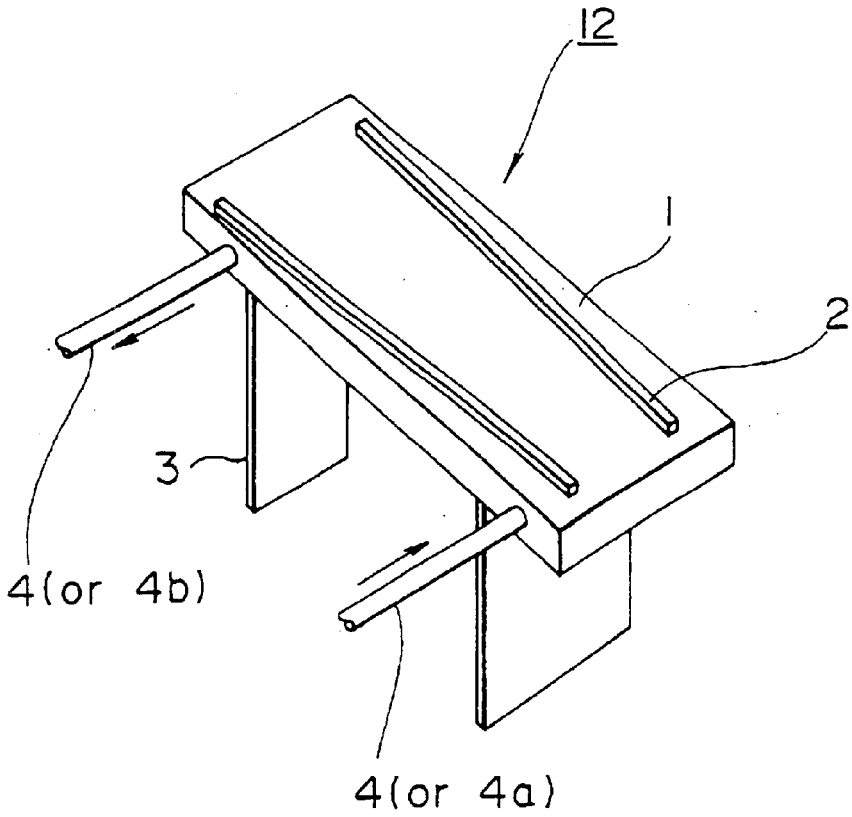
FIG. 22 is a perspective view of a cooling jig as part of the nucleus generating section of the apparatus shown in FIG. 21.
Figure 23A:
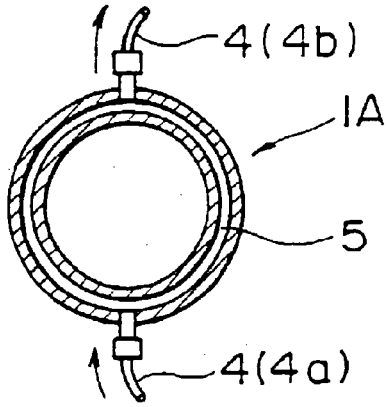
FIG. 23(*a*) and FIG. 23(*b*) show in cross section two types of a cooling jig as part of the nucleus generating section of an apparatus for producing a semisolid forming metal according to another example of the invention (as in the fourteenth and fifteenth embodiments of the present invention)
Figure 23B:
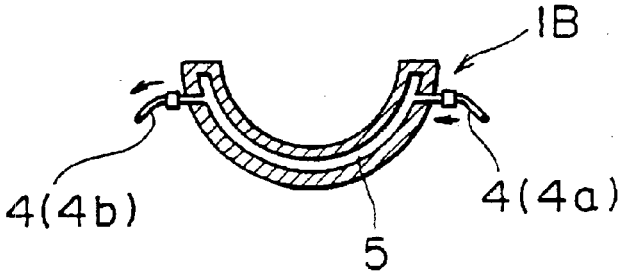
Figure 24:
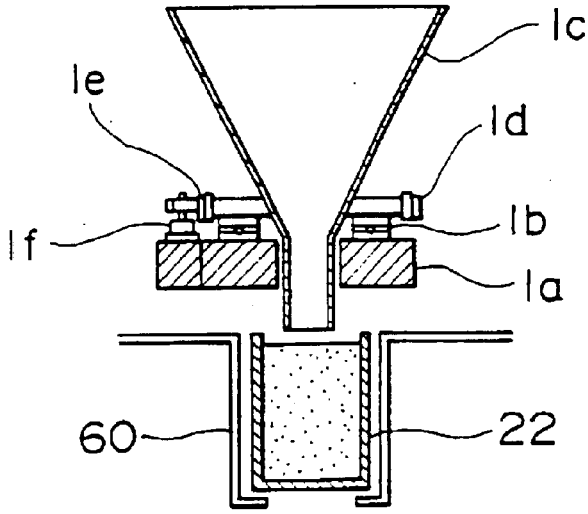
FIG. 24 is a sectional side view of a cooling jig as; part of the nucleus generating section of an apparatus for producing a semisolid forming metal according to yet another example of the invention (as in the fourteenth and fifteenth embodiments of the present invention)
Figure 25:
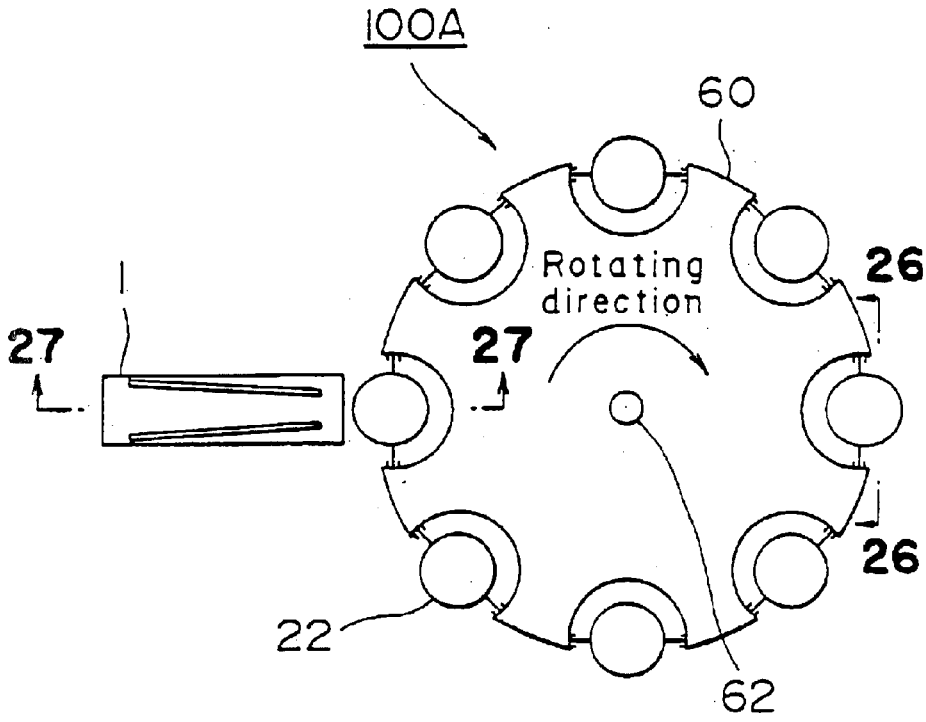
FIG. 25 is a plan view showing the general layout of an apparatus for producing a semisolid forming metal according to another example of the invention (as in the fourteenth and fifteenth embodiments of the present invention)
Figure 26:
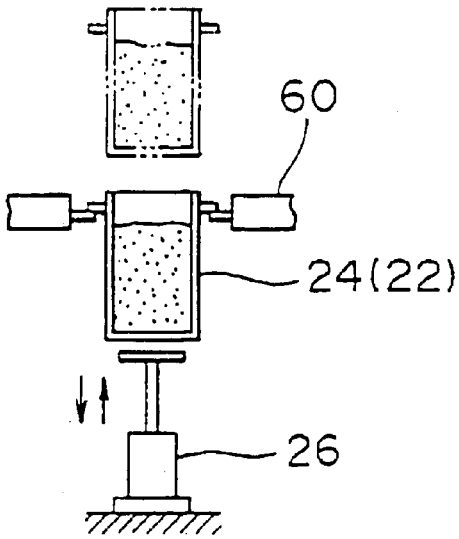
FIG. 26 is a longitudinal section 26—26 of FIG. 25.
Figure 27:
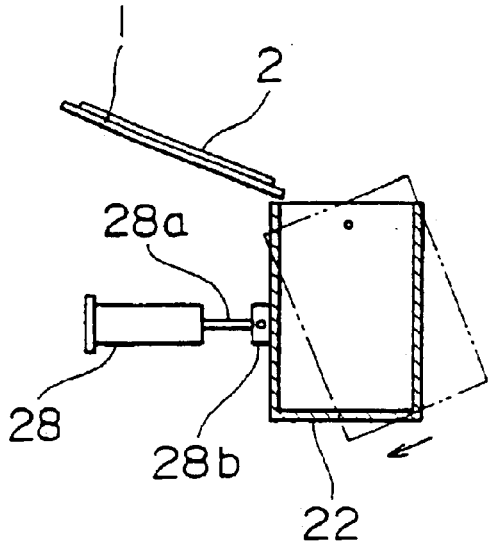
FIG. 27 is a longitudinal section 27—27 of FIG. 25.
Figure 28:
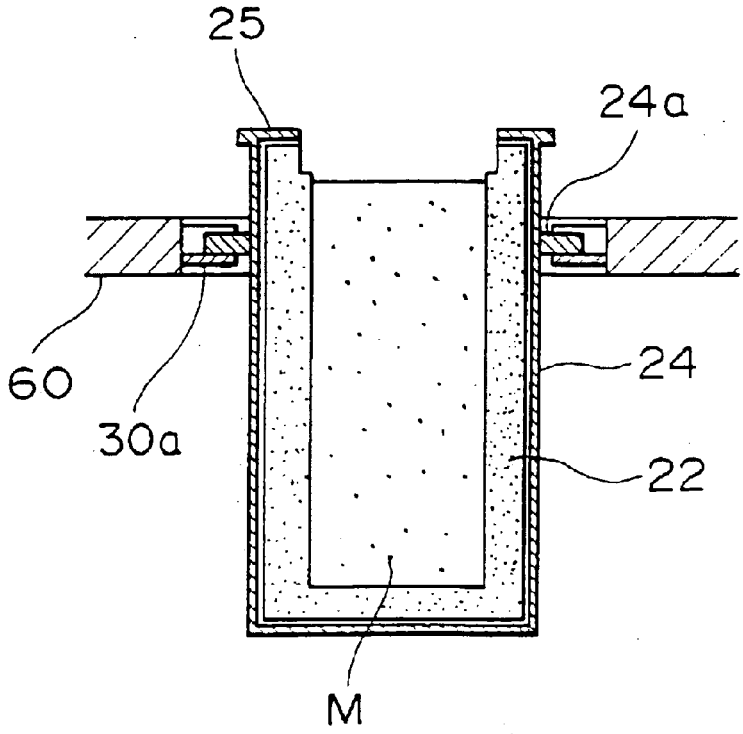
FIG. 28 is a longitudinal section of an insulated vessel in the examples of the invention (as in the fourteenth and fifteenth embodiments of the present invention)

An example of the invention (as in the fourteenth to fifteenth embodiments of the present invention) will now be described in detail with reference to the accompanying FIGS. 3(*a*), 7(*a*), 8(*a*) and 21 28, in which: FIG. 21 is a side view of an apparatus 100 for producing a semisolid forming metal; FIG. 22 is a perspective view of a cooling jig 1 as part of the nucleus generating section 12 of the apparatus 100; FIG. 23 shows in cross section two other cooling jigs 1A and 1B; FIG. 24 is a sectional side view of another cooling jig 1C which is funnel-shaped; FIG. 25 is a plan view showing the general layout of another apparatus 100A for producing a semisolid forming metal; FIG. 26 is a longitudinal section A—A of FIG. 25; FIG. 27 is a longitudinal section B—B of FIG. 25; FIG. 28 is a longitudinal section of an insulated vessel 22; FIG. 3 shows a process flow illustrating the method of producing a semisolid forming metal; FIG. 7 is a diagrammatic representation of a micrograph showing the metallographic structure of a shaped part according to the invention; and FIG. 8 is a diagrammatic representation of a micrograph showing the metallographic structure of a shaped part produced by a prior art process in which the molten metal is directly poured into the insulated vessel for cooling without passing through the nucleus generating section.

As shown in FIG. 21, the apparatus 100 for producing semisolid forming metal comprises the nucleus generating section 12 and a crystal generating section 18. The nucleus generating section 12 consists of the cooling jig 1 having a pair of weirs 2 provided to project from the right and left sides of the top surface of an inclined flat copper plate, stands 3 for supporting the jig 1 in an inclined position, and cooling pipes 4 (an inlet pipe 42 and a outlet pipe 4*b*) which are connected to a passage through which a cooling medium (usually water) is to be supplied into the cooling jig 1. The crystal generating section 18 serves to generate fine crystals by ensuring that the molten metal obtained in the nucleus generating section 12 is held as it is cooled to a molding temperature where it becomes partially solid, partially liquid. The crystal generating section 18 is constituted of the insulated vessel 22 which serves as a container of the molten metal M pouring down the cooling jig 1. As shown in FIG. 28, the insulated vessel 22 may optionally be accommodated within a metallic container 24 and equipped with a bolted cover plate 25 to ensure rigidity. As will be mentioned hereinafter, a pair of hooks 24*a* made of a round steel bar are provided to project from the lateral side of the metallic container 24 in order to assure convenience in transport.

If a flat metallic (e.g. Cu) plate is to be used as the cooling jig 1, the molten metal can potentially stick to the cooling plate; to prevent this problem, it is desirable to reduce the wettability of the plate by applying a nonmetallic (e.g. BN) coating material onto its surface. Weirs 2 are provided to control the flow of the molten metal as it descends the top surface of the cooling jig 1.

FIG. 23 shows the case where cooling jig 1A in the form of a cylindrical tube or cooling jig 13 in the form of a semicylindrical tube 1B is used as the cooling jig. As in the case of the cooling jig 1 in the form of a flat copper plate, both cooling jigs 1A and 1B are equipped with a cooling medium channel 5 and cooling pipes 4 (inlet pipe 4*a* and outlet pipe 4*b*)

A funnel-shaped tube may be used as the cooling jig as shown in FIG. 24. The cooling jig 1C may be stationary while the molten metal M is poured so that it drips into the underlying insulated vessel 22. Alternatively, in order to provide an enhanced cooling effect, the cooling jig 1C may be rotationally journaled on a thrust bearing 1*b* on a pedestal 1*a* such that the molten metal is poured into the jig as it is rotated at slow speed by means of a reduction motor if which transmits the rotating power via spur gears 1*e* and 1*d*.

To obtain a semisolid forming metal with the thus constructed apparatus 100, a molten alloy held superheated to less than 300° C. above the liquidus temperature is poured on to the upper end of the cooling jig 1 (or 1A, 1B or 1C) in the nucleus generating section 12 so that the alloy flows down the jig. During the flowing of the alloy, the surface temperature of the cooling jig 1 is held to be lower than the melting point of the alloy. The molten alloy which has flowed down the cooling jig 1 (or 1A, 1B or 1C) is gently received by the insulated vessel 22, in which it is held for a period from 5 seconds to 60 minutes in such a condition that its temperature is not higher than the liquidus temperature but higher than the eutectic or solidus temperature, whereby a large number of fine spherical primary crystals are generated to ensure that the alloy can be shaped at a specified liquid fraction.

The specific procedure of semisolid metal forming to be performed in Example 3 is essentially the same as described in Example 1.

As already mentioned, the holding time within the insulated vessel 22 varies widely from 5 seconds to 60 minutes depending on the time taken for the alloy to be cooled to the molding temperature. If the holding time is as long as 10–60 minutes, the productivity is very low on an apparatus in which one nucleus generating section 12 (cooling jig 1) is combined with one crystal generating section 18 (insulated vessel 22).

In order to solve this problem, the present, inventors have devised an apparatus that shortens the interval between successive cooling cycles so as to enhance the efficiency of the production of semisolid forming metals. Shown by 100A in FIG. 25, the apparatus comprises a turntable 60 that is capable of suspending a plurality of insulated vessels 22 on the circumference and which is free to rotate horizontally about a central shaft 62. Each of the insulated vessels 22 is accommodated within a metallic container 24 which, as shown in FIG. 28, is fitted with a pair of hooks 24*a* that are each formed of a round steel bar and which are welded to project from the lateral side of the container 24. The turntable 60 is provided with semicircular cutouts in the circumference that are spaced apart at generally equal intervals and which have a greater diameter than the metallic container 24; at the same time, the turntable 60 has as many hook receptacles 30*a* as the insulated vessels 22 and each receptacle 30*a* is in the form of a semicircular pipe that extends horizontally from the circumference of the turntable 60 so that the hooks 24*a* will rest on the receptacle to suspend the metallic container 24 which is integral with the insulated vessel 24 as shown in FIG. 28.

Each of the insulated vessels 22 suspended on the turntable 60 is charged with the molten metal via the cooling jig 1 on the left side (see FIG. 25) and carried by the slowly rotating turntable until it reaches the diametrically opposite position (as a result of 180° turn) after the passage of a predetermined cooling period. In this diametrically opposite position (i.e. on the right side of the turntable), a hydraulic cylinder or other means 26 for vertically moving the insulated vessel 22 is provided below the position where the insulated vessel is suspended (see FIG. 26). The hydraulic cylinder 26 serves to push up the bottom of the insulated vessel 22 so that it is transferred to an injection sleeve 40 at the subsequent stage, which is then supplied with the partially solidified metal from within the insulated vessel.

If the molten metal flowing down the cooling jig 1 is directly poured into the erect insulated vessel 22, air will be entrapped to potentially cause casting defects. To avoid this problem, it is desirable to incline the insulated vessel 22 by a specified angle such that the molten metal will gently pour into the insulated vessel along its sidewall (see FIG. 27). To this end, a hydraulic cylinder or some other depressing means 28 is provided below the cooling jig 1; as shown, the hydraulic cylinder 28 has a piston rod 28*a* fitted at the terminal end with a rotatable depressing plate 28*b* supported on a pin.

The thus constructed apparatus 100A for producing semisolid forming metals is capable of feeding the molten metal into the injection sleeve by continuous treatment in a plurality of insulated vessels 22 and compared to the apparatus using a single unit of insulated vessels 22, the interval between successive cooling cycles is substantially reduced to ensure against the drop in productivity.

Thus, the apparatus 100 and 100A according to the invention are capable of producing semisolid metals that are suitable for use in semisolid forming, that have fine primary crystals dispersed within a liquid phase and that are free from the contamination by nonmetallic inclusions. In addition, due to the holding of the molten metal within the insulated vessel for cooling purposes, the semisolid metal obtained is difficult to be oxidized at the surface and has a very uniform temperature profile in its interior; hence, with almost all alloys, there is no need to use a high-frequency furnace for heating molding materials although this has been necessary in the conventional semisolid forming technology.

If desired a robot or a dedicated machine may be used to grip the insulated vessel 22 and when the metal within the vessel has attained a specified molding temperature, it may be inserted into the injection sleeve 40 in a die casting machine (which may be a squeeze casting machine), with the top end directed to the side facing the injection tip, such as to accomplish semisolid forming. In this way, one can produce castings or high quality that have fine, spherical primary crystals as shown in FIG. 7(*a*). In fact, however, only coarse dendrites with slightly round corners as shown in FIG. 8(*a*) can be obtained by simply pouring the molten metal into the insulated vessel 22 without passing through the nucleus generating section 12. The semisolid metals produced with the apparatus of the invention may be shaped by pressure forming methods other than die casting; alternatively, they may be inserted into a sand or metallic mold gently without applying pressure.

In the example described above, the flat copper plate having internal cooling means is used as the nucleus generating means but this is not the sole case of the invention and any other means may be employed as long as it is capable of generating crystal nuclei that will not redissolve in the liquid phase. As example of this alternative nucleus generating means is described below.

The flat copper plate without weirs 2 may be replaced by the tubular cooling jig 1A or semicylindrical cooling jig 1B as shown in FIG. 23. Alternatively, the molten metal may be poured into the conical cooling jig 1C as it is rotated by drive means and after crystal nuclei have been generated in the metal, the latter is withdrawn from the bottom the cooling jig 1C to be poured into the insulated vessel 22. The constituent material of the cooling jig 1 is by no means limited to metals and it may be of any type as long as it is capable of cooling the molten alloy within a specified time while producing crystal nuclei in the alloy.

In the example described above, the insulated ceramic vessel is used as the crystal generating means and in a practical version of the example, the rotating turntable 60 which is capable of arranging a plurality of insulated vessels 22 is used. However, this is not the sole method of arranging and fixing the insulated vessels 22 and they may be linearly or otherwise arranged. To fix the insulated vessel 22, it may be positioned at a specified site as typically shown in FIG. 28, wherein the insulated vessel 22 is placed within the metallic container 24 having a slightly larger inside diameter and the bottom of the container 24 is pushed up by the hydraulic cylinder 26 as required.

In the above description of the invention, the cooling jig consists of the nucleus generating section and the crystal generation section but, if desired the two steps may be integrated. For instance, the molten metal within the insulated vessel 22 may be treated with the cooling jig and/or a melt surface vibrating jig to ensure that both nuclei and crystals will be generated.

Example 4

Figure 29:
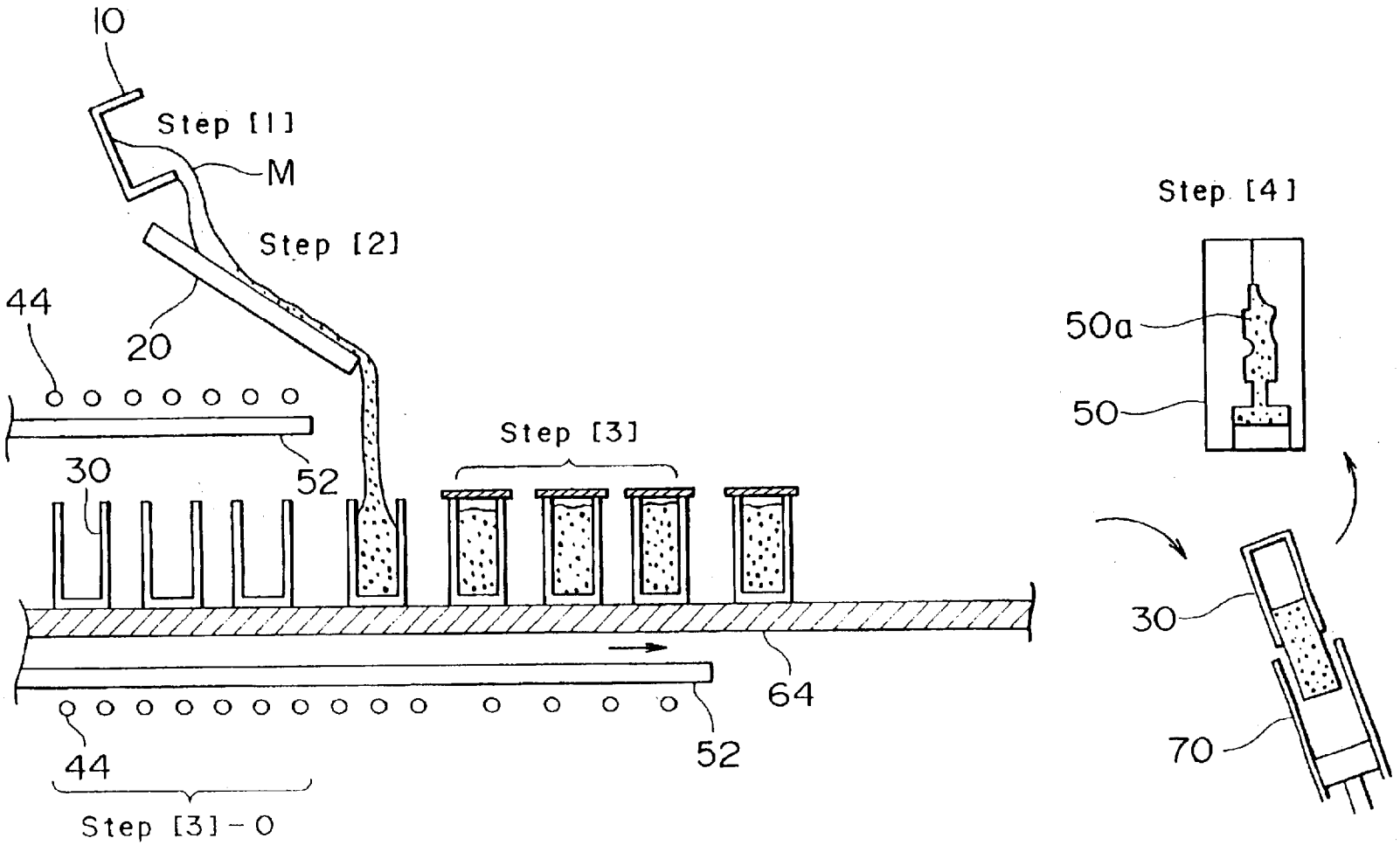
FIG. 29 shows a process flow starting with the generation of spherical primary crystals and ending with the molding step (as in the sixteenth and seventeenth embodiments of the present invention)
Figure 30B:
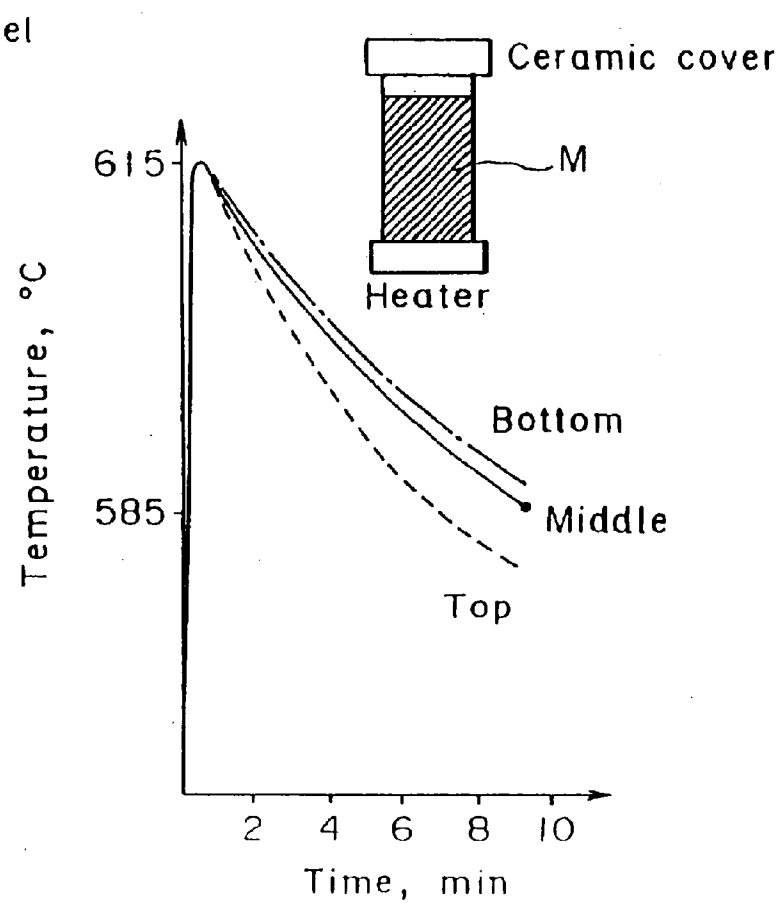
FIGS. 30(*a*) and 30(*b*) are two graphs plotting the temperature changes in the metal being cooled within a vessel during step 3 shown in FIG. 29.
Figure 30A:
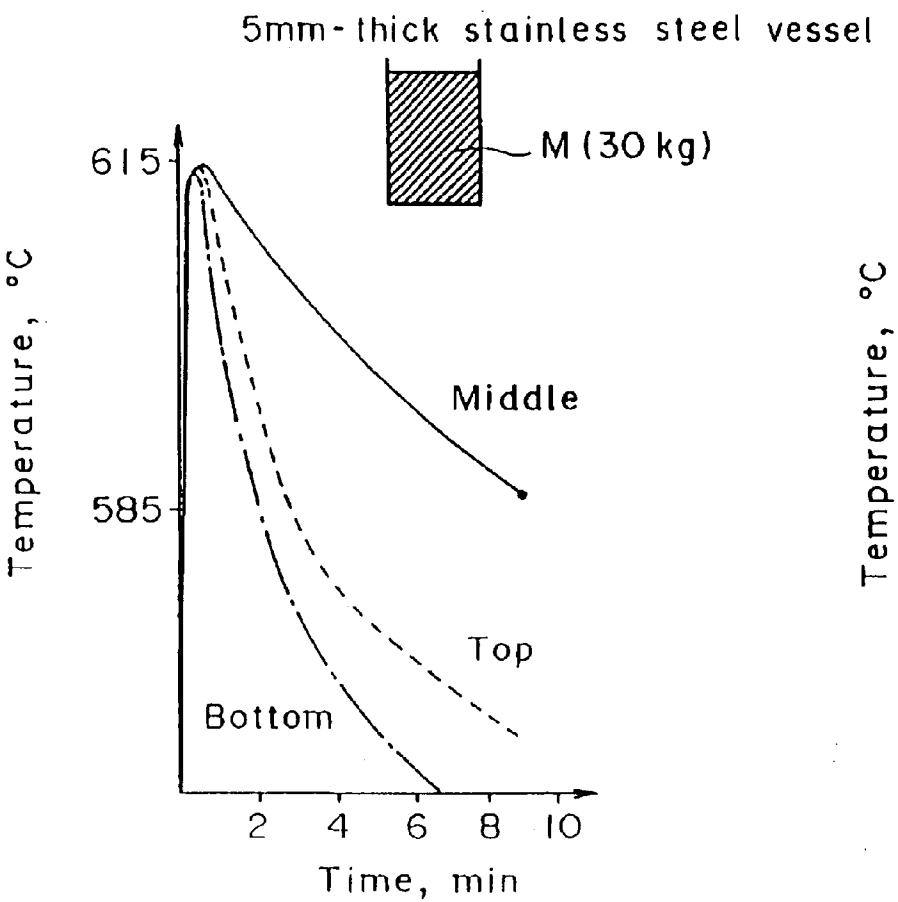
Figure 31A:
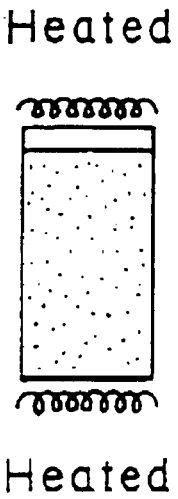
FIG. 31(*a*), FIG. 31(*b*), FIG. 31(*c*) and FIG. 31(*d*) are schematic diagrams that illustrate respectively four methods of managing the temperature within a vessel according to the invention (as in the sixteenth and seventeenth embodiments of the present invention)
Figure 31B:
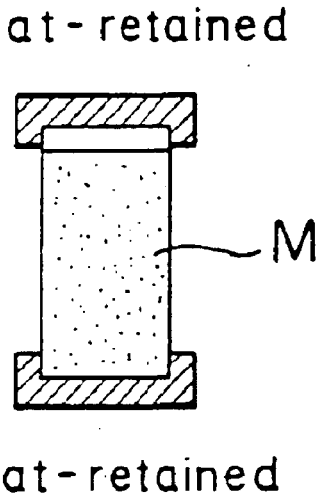
Figure 31C:
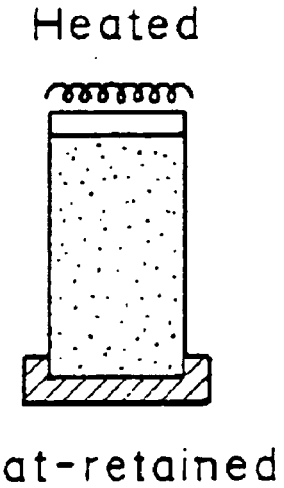
Figure 31D:
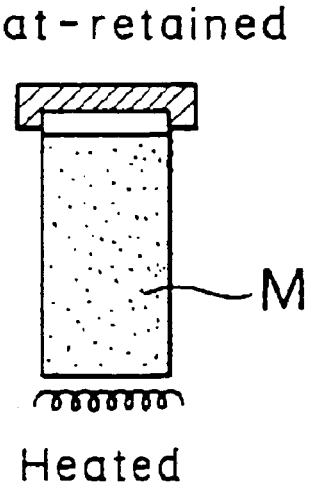

An example of the invention (as in the sixteenth and seventeenth embodiments of the present invention) will now be described with reference to accompanying FIGS. 1(*a*), 2(*a*), 4, 5(*a*), 6(*a*), 7(*a*) and 8(*a*) and 29–31, in which: FIG. 1(*a*) is a diagram showing a process sequence for the semisolid forming of a hypoeutectic aluminum alloy having a composition at or above a maximum solubility limit; FIG. 2(*a*) is a diagram showing a process sequence for the semisolid forming of a magnesium or aluminum alloy having a composition within a maximum solubility limit; FIG. 29 shows a process flow starting with the generation of spherical primary crystals and ending with the molding step; FIG. 4 shows diagrammatically the metallographic structures obtained in the respective steps shown in FIG. 29; FIGS. 30(*a*) and 30(*b*) serve to compare graphs which plot the temperature changes in the metal being cooled within a vessel during step 3 shown in FIG. 29; FIG. 31 illustrates four methods of managing the temperature within a vessel according to the invention; FIG. 5(*a*) is an equilibrium phase diagram for an Al—Si alloy as a typical aluminum alloy system; FIG. 6(*a*) is an equilibrium phase diagram for a Mg—Al alloy as a typical magnesium alloy system; FIG. 7(*a*) is a diagrammatic representation of a micrograph showing the metallographic structure of a shaped part according to the invention; and FIG. 8(*a*) is a diagrammatic representation of a micrograph showing the metallographic structure of a shaped part according to the prior art.

As shown in FIGS. 1(*a*), 2(*a*), 5(*a*) and 6(*a*), the sixteenth and seventeenth embodiments of the present invention is based on the second, ninth and tenth embodiments of the present invention and it is such that:

(1) the melt of a hypoeutectic aluminum alloy of a composition at or above a maximum solubility limit or the melt of a magnesium alloy of a composition within a maximum solubility limit is held superheated to less than 300° C. above the liquidus temperature and then contacted with a surface of the jig 20 having a lower temperature than the melting point of either alloy and the resulting alloy is poured into a vessel 30; or (2) the melt of an aluminum or magnesium alloy that is held superheated to less than 100° C. above the liquidus temperature as it contains an element to promote the generation of crystal nuclei is directly poured into the vessel 30 without using the jig 20. The vessel 30 of a specified wall thickness is adapted to be heatable or coolable from either inside or outside, is made of a material having a thermal conductivity of at least 1.0 kcal/hr·m·° C. (at room temperature) and is held at a temperature not higher than the liquidus temperature of said alloy prior to its pouring, and the melt is subsequently cooled to a temperature at which a fraction solid appropriate for shaping is established, such that while the alloy is poured into the vessel 30, its top and bottom portions are heated by a greater degree than the middle portion or that the top or bottom portion is heat-retained with a heat-retaining material having a thermal conductivity of less than 1.0 kcal/hr·m·° C. or that the top portion of the vessel is heated by a greater degree than the middle portion while the bottom portion is heat-retained or that the top portion is heat-retained while the bottom portion is heated by a greater degree than the middle portion, whereby nondendritic fine primary crystals are crystallized in the alloy solution while, at the same time, the alloy is cooled at a sufficiently rapid rate to provide a uniform temperature profile through the alloy in the vessel 30, with the cooled alloy being subsequently supplied into a forming mold 50, where it is pressure formed to a shape.

Four methods of managing the temperature of the vessel 30 and that of the alloy within the vessel 30 are collectively shown in FIG. 31, wherein (a)–(d) correspond to the methods of temperature management in the seventeenth embodiment of the present invention.

The wall thickness of the vessel 30 is desirably such that after pouring of the molten metal, no dendritic primary crystals will result from the metal in contact with the inner surface of the vessel and yet no solidified layer will remain in the vessel at the stage where the semisolid metal has been discharged from within the vessel just before shaping. The exact value of the wall thickness of the vessel is appropriately determined in consideration of the alloy type and the weight of the alloy in the vessel 30.

The term "solid fraction appropriate for shaping" means a relative proportion of the solid phase which is suitable for pressure forming. In high-pressure casting operations such as die casting and squeeze casting, the solid fraction ranges from 10% to 80%, preferably from 30,% to 70%. If the solid fraction is more than 70%, the formability of the raw material is poor; below 30%, the raw material is so soft that it is not only difficult to handle but also less likely to produce a homogeneous structure. In extruding and forging operations, the solid fraction ranges from 30% to 99.9%, preferably from 50% to 99.9%; if the solid fraction is less than 50%, an inhomogeneous structure can potentially occur.

The "temperature not higher than the liquidus temperature" means such a temperature that even if the temperature of the metal within the vessel is rapidly lowered to the level equal to the molding temperature, no dendritic primary crystals will result from the melt in contact with the inner surface of the vessel and yet no solidified layer will remain in the vessel at the stage where the semisolid metal is discharged from within the vessel just before shaping. The exact value of the "temperature not higher than the liquidus temperature" varies with the alloy type and the weight of the alloy within the vessel.

The "vessel" as used in the invention is a metallic or nonmetallic vessel, or a metallic vessel having a surface coated with nonmetallic materials or semiconductors, or a metallic vessel compounded of nonmetallic materials or semiconductors. Coating the surface of the metallic vessel with a nonmetallic material is effective in preventing the sticking of the metal. To heat the vessel, its interior or exterior may be heated with an electric heater; alternatively, induction heating with high-frequency waves may be employed if the vessel is electrically conductive.

The specific procedure of semisolid metal forming to be performed in Example 4 is essentially the same as described in Example 1.

Vessel 30 is used to hold the molten metal until it is cooled to a specified fraction solid after its temperature has dropped just below the liquidus line. If the thermal conductivity of the vessel 30 is less than 1.0 kcal/hr·m·° C. at room temperature, it has such a good heat insulating effect that an unduly prolonged time will be required for the molten metal M in the vessel 30 to be cooled to the temperature where a specified solid fraction is established, thereby reducing the operational efficiency. In addition, the generated spherical primary crystals become coarse to deteriorate the formability of the alloy. It should, however, be mentioned that if the vessel contains a comparatively small quantity of the melt, the holding time necessary to achieve the intended cooling becomes short even if the thermal conductivity of the vessel is less than 1.0 kcal/hr·m·° C. at room temperature. If the temperature of the vessel 30 is higher than the liquidus temperature, the molten metal M as poured into the vessel is higher than the liquidus temperature, so that only a few crystal nuclei will remain in the liquid phase to produce large primary crystals. If the top and bottom portions of the vessel are neither heated nor heat-retained as the molten metal M is cooled until the solid fraction in the metal reaches the value appropriate for shaping, dendritic primary crystals may occur at the site in the top or bottom portion of the vessel that is contacted by the metal M or a solidified layer will grow at that site, thereby creating a nonuniform temperature profile through the metal in the vessel which makes the subsequent shaping operation difficult to accomplish on account of the remaining solidified layer within the vessel. To avoid these difficulties, it is preferred to heat the top or bottom portion of the vessel by a greater degree than the middle portion while the bottom or top portion is heat-retained during the cooling process after the pouring of the metal; if necessary, the top or bottom portion of the vessel may be heated not only during the cooling process following the pouring of the metal but also prior to its pouring and this is another preferred practice in the invention.

The constituent material of the vessel 30 is in no way limited except on the thermal conductivity and those which are poorly wettable with the molten metal are preferred. Table 2 shows the conditions of various samples of semisolid metal to be shaped, as well as the qualities of shaped parts. As shown in FIG. 29, the shaping operation consisted of inserting the semisolid metal into an injection sleeve and subsequent forming on a squeeze casting machine. The forming conditions were as follows: pressure, 950 kgf/cm$^2$; injection speed, 1.0 m/s; casting weight (including biscuits), 30 kg; mold temperature, 230° C.

TABLE 2

| | | | Casting | | Temperature of the | Thermal conductivity of holding | Temperature of the holding vessel *1 | | | Heating or Heat-retaining of the holding vessel | | |
|---|---|---|---|---|---|---|---|---|---|---|---|---|
| | No. | Alloy | temperature (° C.) | Cooling jig | cooling jig (° C.) | vessel (kcal/hr·m·° C.) | Upper part | Middle part | Lower part | Upper part | Middle part | Lower part |
| Comparative Sample | 1 | AC4CH | 640 | Used | 25 | 0.3 | 100 | 100 | 100 | No treatment | No treatment | No treatment |
| | 2 | AC4CH | 640 | Used | 25 | 0.3 | 200 | 100 | 300 | No treatment | No treatment | No treatment |
| | 3 | AC4CH | 640 | Used | 25 | 14 | 100 | 100 | 100 | No treatment | No treatment | No treatment |
| | 4 | AC4CH | 640 | Used | 25 | 14 | 25 | 25 | 25 | No treatment | No treatment | No treatment |
| | 5 | AC4CH | 950 | Used | 25 | 14 | 100 | 100 | 100 | No treatment | No treatment | No treatment |
| | 6 | AC4CH | 640 | Used | 625 | 14 | 100 | 100 | 100 | No treatment | No treatment | No treatment |
| | 7 | AC4CH | 640 | Used | 25 | 14 | 200 | 100 | 250 | Heat-retained | No treatment | Heated |
| Invention Sample | 8 | AC4CH | 640 | Used | 25 | 14 | 500 | 400 | 500 | Heat-retained | No treatment | Heated |
| | 9 | AC4CH | 640 | Used | 25 | 14 | 200 | 100 | 200 | Heat-retained | No treatment | Heated |
| | 10 | AC4CH | 670 | Used | 25 | 14 | 250 | 250 | 250 | Heated | No treatment | Heated |
| | 11 | AC4CH | 640 | Used | 25 | 14 | 300 | 200 | 300 | Heat-retained | No treatment | Heat-retained |
| | 12 | AC4CH | 660 | Used | 25 | 14 | 200 | 200 | 200 | Heated | No treatment | Heat-retained |
| | 13 | AC4CH | 640 | Not used | — | 14 | 200 | 100 | 200 | Heat-retained | No treatment | Heated |
| | 14 | AC4CH | 640 | Used | 25 | 14 | 300 | 200 | 300 | Heat-retained | No treatment | Heated |

TABLE 2-continued

| | No. | Alloy | Quality of shaped part: Amount of unspherical primary crystal | Primary crystal size (μm) | Solidified layer within vessel | Structural homogeneity | Time to molding temperature (min) *2 | Remarks |
|---|---|---|---|---|---|---|---|---|
| Comparative Sample | 1 | AC4CH | ○ | 150 | X | ○ | 30 | Small thermal conductivity; the vessel was neither heated nor heat-retained. |
| | 2 | AC4CH | ○ | 150 | ○ | ○ | 34 | Small thermal conductivity |
| | 3 | AC4CH | ○ | 80 | X | X | 12 | The vessel was neither heated nor heat-retained. |
| | 4 | AC4CH | X | 90 | X | X | 6 | The vessel was neither heated nor heat-retained; its wall thickness was 20 mm. |
| | 5 | AC4CH | X | 500 | X | X | 22 | High casting temperature |
| | 6 | AC4CH | X | 450 | X | X | 12 | High jig temperature |
| | 7 | AC4CH | Δ | 100 | ○ | X | 3 *3 | Low fraction solid (8%) |
| Invention Sample | 8 | AC4CH | ○ | 100 | ○ | ○ | 17 | |
| | 9 | AC4CH | ○ | 85 | ○ | ○ | 10 | |
| | 10 | AC4CH | ○ | 90 | ○ | ○ | 11 | |
| | 11 | AC4CH | ○ | 90 | ○ | ○ | 13 | |
| | 12 | AC4CH | ○ | 90 | ○ | ○ | 13 | |
| | 13 | AC4CH | ○ | 170 | ○ | ○ | 14 | No cooling jig was used. |
| | 14 | AC4CH | ○ | 80 | ○ | ○ | 9 | |

*1: Temperature of the vessel before pouring of the metal
*2: Holding temperature at 50% fraction solid (excepting *3)
*3: Molding temperature at 8% fraction solid
AC4CH: Al—7% Si—0.35% Mg m.p. 615° C.
AZ91: Mg—9% Al—0.7% Zn m.p. 595° C.
Wall thickness of the holding vessel: 5 mm (but 20 mm with No. 4)
Amount of unspherical primary crystals; ○, small; X, large
Structural homogeneity: X, many segregations: ○, a few segregations
Solidified layer within vessel: ○, absent; X, present In Comparative Sample 1, the thermal conductivity of the holding vessel was small and, in addition, the vessel was heated or heat-retained inappropriately after the pouring of the metal so that the holding time to the shaping temperature was unduly long; what is more, the formation of a solidified layer within the vessel prevented the discharge of the semisolid metal, thus making it impossible to perform shaping. In Comparative Sample 2, the thermal conductivity of the holding vessel was so small that the holding time to the shaping temperature was unduly prolonged. In Comparative Sample 3, the holding vessel was heated or heat-retained inappropriately after the pouring of the metal so that a solidified layer formed within the vessel to prevent the discharge of the semisolid metal, thus making it impossible to start the shaping step. In Comparative Sample 4, the wall thickness of the holding vessel was unduly great and, in addition, the vessel was heated or heat-retained inappropriately after the pouring of the metal so that nonspherical primary crystals were generated; what is more, the formation of a solidified layer within the vessel prevented the discharge of the semisolid metal, thus making it impossible to perform shaping. In Comparative Sample 5, the casting temperature was so high that very few crystal nuclei remained within the vessel to yield only coarse nonspherical primary crystals as shown in FIG. 8(*a*). In Comparative Sample 6, the cooling jig had such a high temperature that the number of crystal nuclei formed was insufficient to produce fine spherical primary crystals and, instead, only coarse nonspherical primary grains formed as in Comparative Sample. 5. In Comparative Sample 7, the fraction solid in the metal was so small that many segregations occurred within the shaped part.

In Invention Samples 8–14, the metal in the vessel 30 was rapidly cooled with its temperature profile being maintained sufficiently uniform that semisolid metals having nondendritic fine primary crystals were produced in a convenient and easy way. Such alloys were then fed into a forming mold and pressure formed to produce shaped parts of a homogeneous structure having fine (<200 μm) spherical primary crystals.

Example 5

Figure 9:
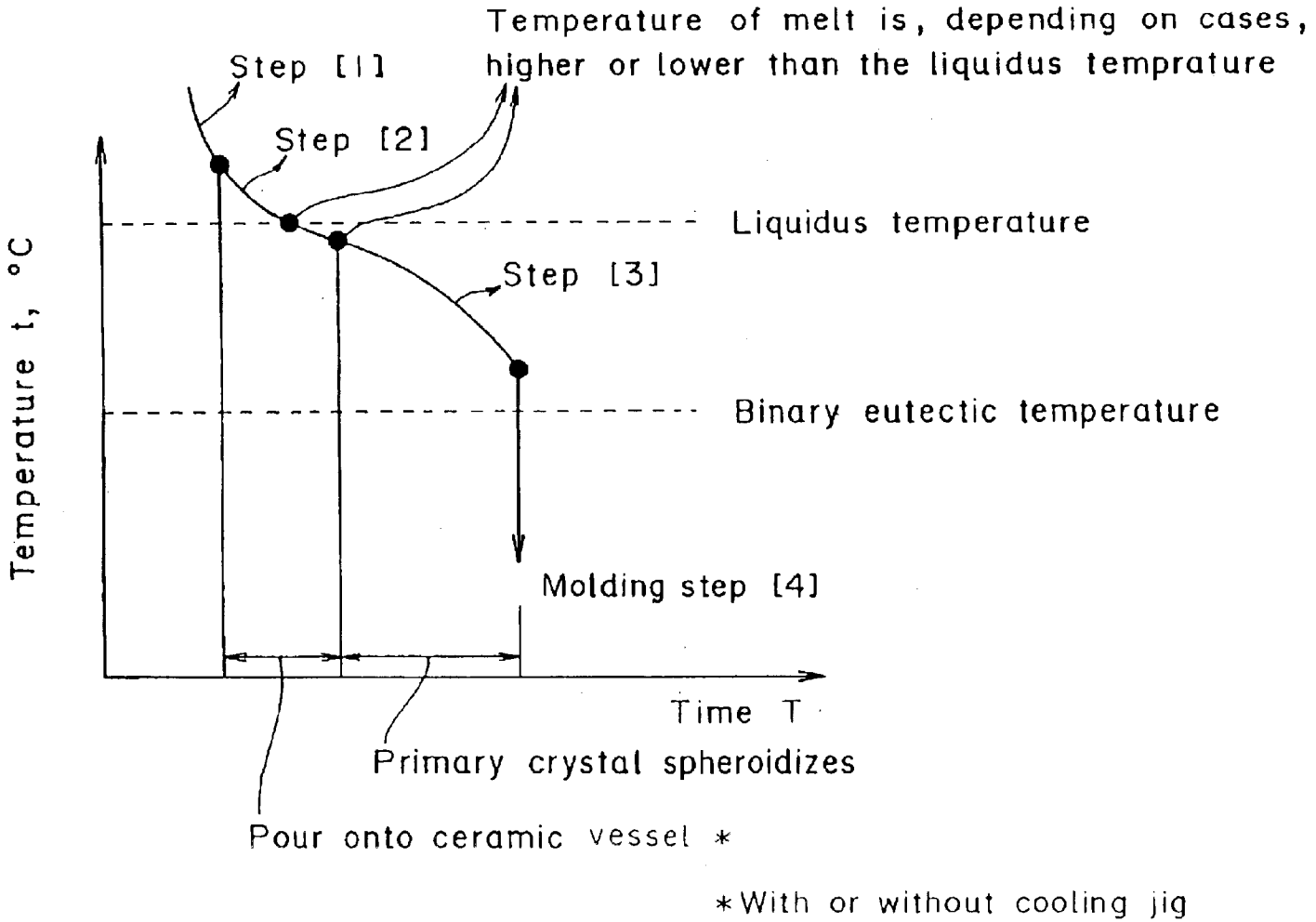
FIG. 9 is a schematic diagram showing a process sequence for the semisolid forming of hypoeutectic aluminum alloys having a composition at or above a maximum solubility limit according to examples of the invention (as in the eleventh, twelfth, thirteenth and eighteenth embodiments of the present invention)
Figure 10:
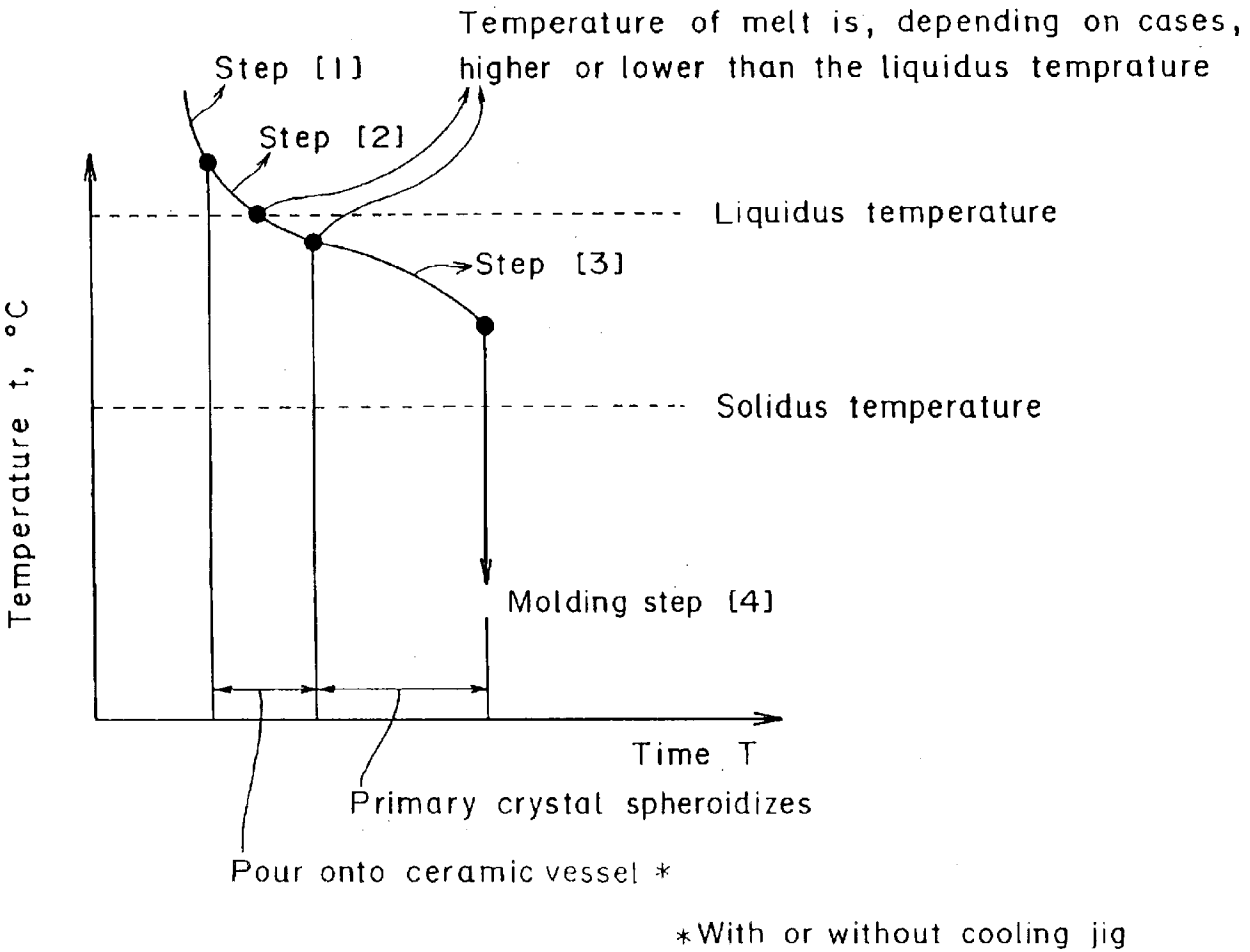
FIG. 10 is a schematic diagram showing a process sequence for the semisolid forming of magnesium or aluminum alloys having a composition within a maximum solubility limit according to examples of the invention (as in the eleventh, twelfth, thirteenth and eighteenth embodiments of the present invention)
Figure 11:
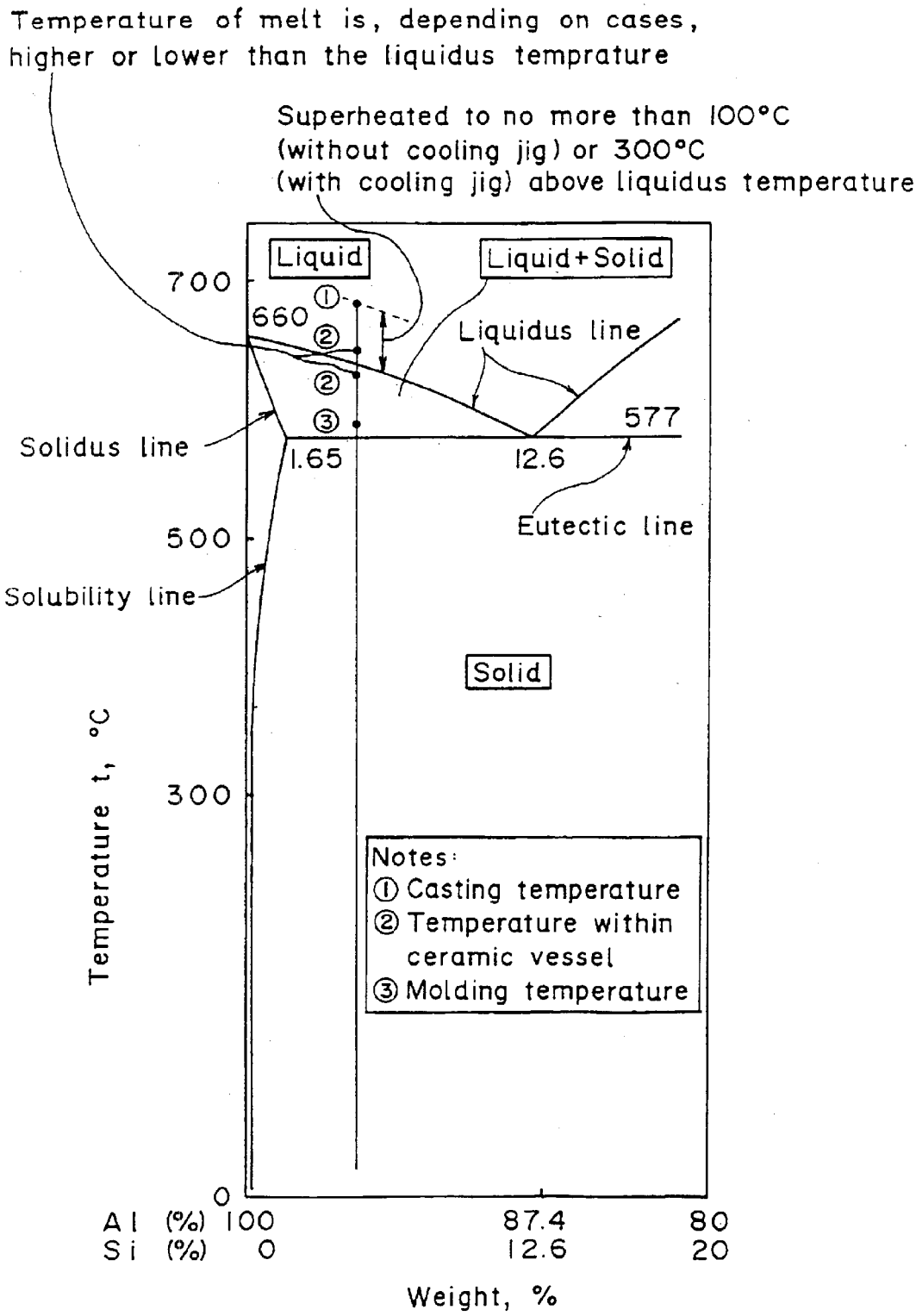
FIG. 11 is an equilibrium phase diagram for Al—Si alloys as a typical aluminum alloy system according to the invention (as in the eleventh, twelfth, thirteenth and eighteenth embodiments of the present invention)
Figure 12:
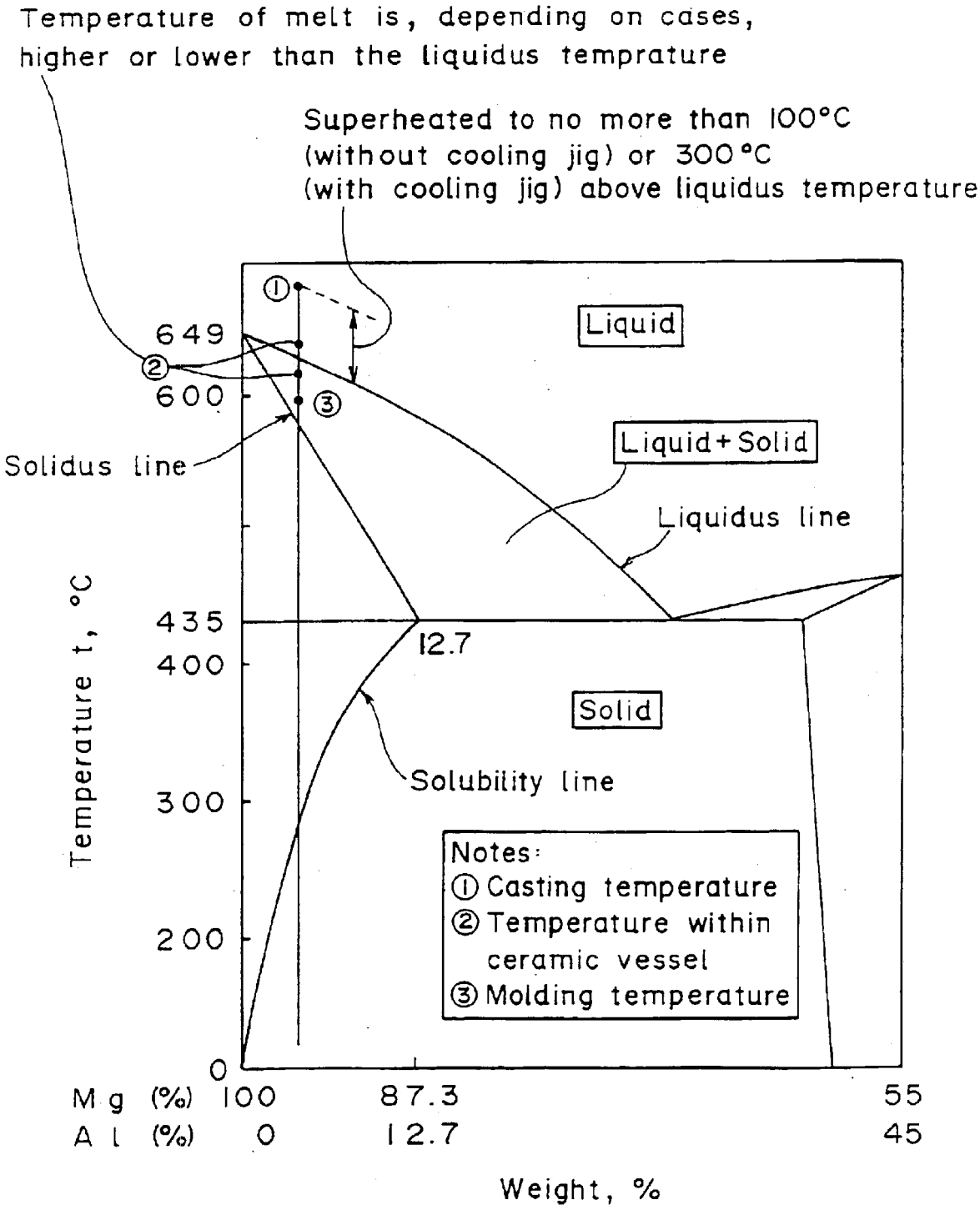
FIG. 12 is an equilibrium phase diagram for Mg—Al alloys as a typical magnesium alloy system according the invention (as in the eleventh, twelfth, thirteenth and eighteenth embodiments of the present invention)
Figure 32:
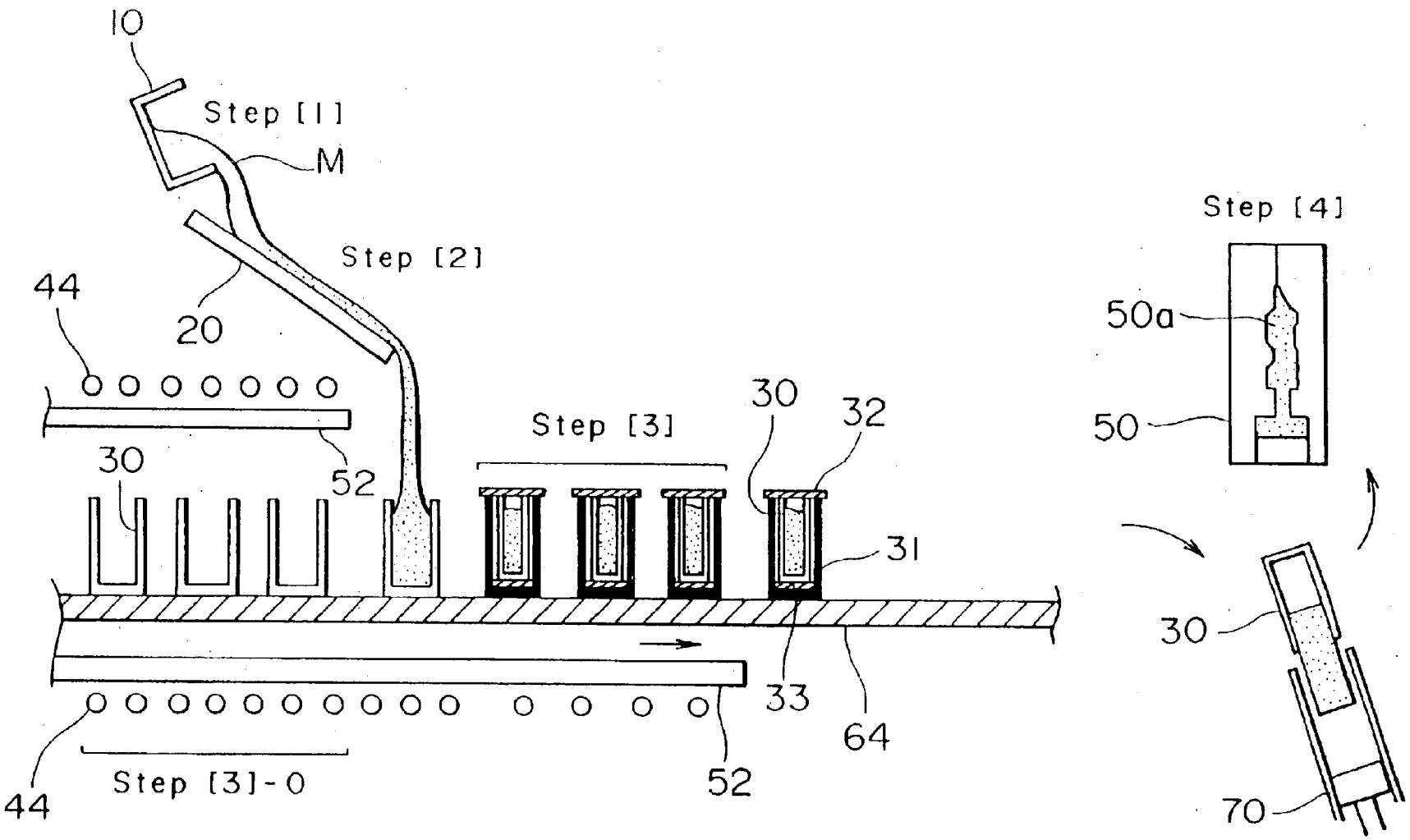
FIG. 32 is a schematic diagram which shows a process flow starting with the generation of spherical primary crystals and ending with the molding step according to the invention (as in the eighteenth of the present invention)
Figure 33B:
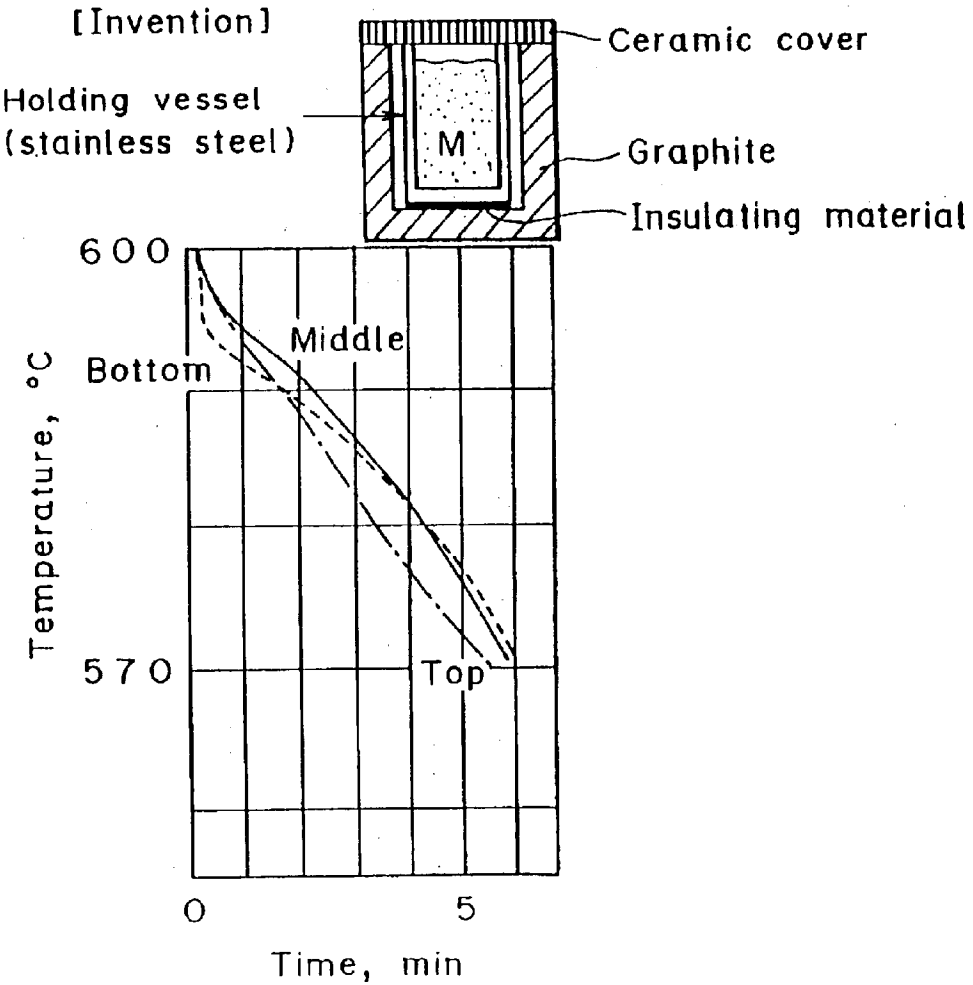
FIG. 33(*a*) and FIG. 33(*b*) include graphs showing the temperature profiles through two semisolid metals, one being held within a vessel according to an example of the invention (as in the eighteenth of the present invention) and the other treated by the prior art.
Figure 33A:
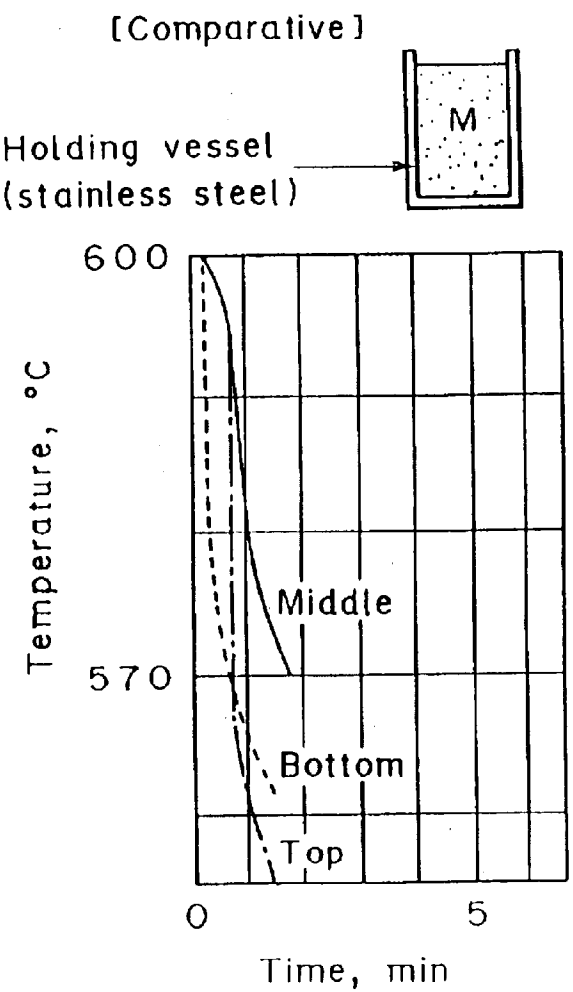
Figure 34:
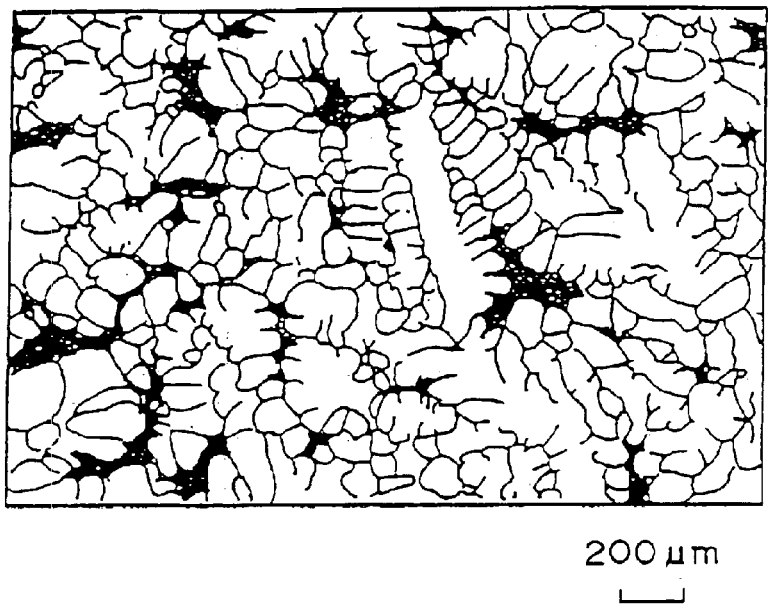
FIG. 34 Prior Art
FIG. 34 is a diagrammatic representation of a micrograph showing the metallographic structure of a shaped part according to the prior art (for comparison with the eighteenth of the present invention)
Figure 35:
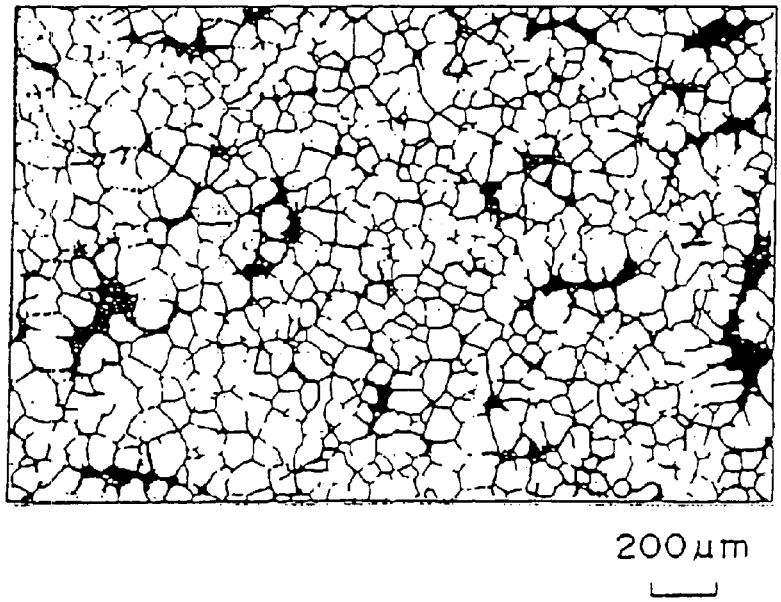
FIG. 35 is a diagrammatic representation of a micrograph showing the metallographic structure of a shaped part according to an example of the invention (as in the eighteenth of the present invention)

An example of the invention (as in the eighteenth embodiment of the present invention) will now be described with reference to the accompanying FIGS. 4, 9, 10 and 32–35, in which: FIG. 9 is a diagram showing a process sequence for the semisolid forming of hypoeutectic aluminum alloys having a composition at or above a maximum solubility limit; FIG. 10 is a diagram showing a process sequence for the semisolid forming of magnesium or aluminum alloys having a composition within a maximum solubility limit; FIG. 32 shows a process flow starting with the generation of spherical primary crystals and ending with the molding step; FIG. 4 shows diagrammatically the metallographic structures obtained in the respective steps shown in FIG. 32; FIG. 33 compares the temperature profiles through two semisolid metals, one being held within a vessel in step (3) shown in FIG. 32 and the other being treated by the prior art without using any outer vessel; FIG. 34 is a diagrammatic representation of a micrograph showing the metallographic structure of a shaped part according to the prior art; and FIG. 35 is a diagrammatic representation of a micrograph showing the metallographic structure of a shaped part according to the invention.

As shown in FIGS. 9, 10 and 32, the eighteenth embodiment of the present invention is such that the melt of a hypoeutectic aluminum alloy of a composition at or above a maximum solubility limit or the melt of a magnesium or aluminum alloy of a composition within a maximum solubility limit is held superheated to less than 300° C. above the liquidus temperature, contacted with a surface of the jig 20 at a lower temperature than the melting point of either alloy, and poured into a holding vessel 29 of a specified wall thickness that is made of a material having a thermal conductivity of at least 1.0 kcal/hr·m·° C. (at room temperature) and that is preliminarily held at a temperature not higher than the liquidus temperature of either alloy, and the melt is subsequently cooled, with a heat insulating lid 32 placed on top of the holding vessel, down to a temperature at which a fraction solid appropriate for shaping is established, characterized in that during the cooling of the alloy, the outer surface of said holding vessel is heated or heat-retained with an outer vessel 31 capable of accommodating said holding vessel, whereby nondendritic fine spherical primary crystals are crystallized in the alloy within said holding vessel while the cooling rate is controlled to be rapid enough to provide a uniform temperature profile through the alloy in said holding vessel no later than the start of the forming step and, thereafter, the cooled alloy is fed into a mold where it is subjected to pressure forming.

The wall thickness of the holding vessel 29 is desirably such that after pouring of the molten metal, no dendritic primary crystals will result from the metal in contact with the inner surface of the vessel and yet no solidified layer will remain in the vessel at the stage where the semisolid metal has been discharged from within the vessel just before shaping. The exact value of the wall thickness of the vessel is appropriately determined in consideration of the alloy type and the weight of the alloy in the holding vessel 29.

The term "solid fraction appropriate for shaping" means a relative proportion of the solid phase which is suitable for pressure forming. In high-pressure casting operations such as die casting and squeeze casting, the solid fraction ranges from 10% to 80%, preferably from 30% to 70%. If the solid fraction is more than 70%, the formability of the raw material is poor; below 30%, the raw material is so soft that it is not only difficult to handle but also less likely to produce a homogeneous structure. In extruding and forging operations, the solid fraction ranges from 30% to 99.9%, preferably from 50% to 99.9%; if the solid fraction is less than 50%, an inhomogeneous structure can potentially occur.

The "temperature not higher than the liquidus temperature" means such a temperature that even if the temperature of the alloy within the holding vessel is rapidly lowered to the level equal to the molding temperature, no dendritic primary crystals will result from the melt in contact with the inner surface of the holding vessel and yet no solidified layer will remain in the vessel at the stage where the semisolid alloy has been discharged from within the vessel just before shaping. The "temperature not higher than the liquidus temperature" is also such that the alloy containing crystal nuclei can be poured into the holding vessel 29 without losing the crystal nuclei. The exact value of this temperature differs with the alloy type and the weight of the alloy within the holding vessel The "holding vessel" as used in the invention is a metallic or nonmetallic vessel, or a metallic vessel having a surface coated with nonmetallic materials or semiconductors, or a metallic vessel compounded of nonmetallic materials or semiconductors. Coating the surface of the metallic vessel with a nonmetallic material is effective in preventing the sticking of the metal.

The "outer vessel" as used in the invention serves to ensure that the alloy in the holding vessel will be cooled within a specified time. To this end, the outer vessel must have the ability to cool the holding vessel 29 rapidly in addition to a capability for heat-retaining or heating said vessel. To meet this requirement, the temperature of the outer vessel 31 should be lowered to the level equal to the molding temperature within a specified time.

In order to provide a more uniform temperature profile through the alloy within the holding vessel 29, the outer vessel 31 may be provided with a temperature profile by for example, heating the top and bottom portions of the outer vessel 31 in a high-frequency heating furnace by a greater degree than the middle portion. In the case where the outer vessel 31 starts to be heated before the holding vessel 29 is inserted and continues to be heated until after its insertion, the heating of the outer vessel 31 may be interrupted temporarily if it is necessary for adjusting the temperature of the alloy within the holding vessel 29.

The inside diameter of the outer vessel 31 is made sufficiently larger than the outside diameter of the holding vessel 29 to provide a clearance between the outer vessel 31 and the holding vessel 29 accommodated in it. To insure the clearance, a plurality of projections are provided along the outer circumference of the holding vessel 29 and/or the inner circumference of the outer vessel 31. Alternatively, the clearance may be insured by replacing the projections with recesses formed in either the outer circumference of the holding vessel or the inner circumference of the outer vessel.

The gap between the holding vessel 29 and the outer vessel 31 is typically filled with air but various other gases may be substituted such as inert gases, carbon dioxide and $SF_6$.

According to the invention, semisolid metal forming will proceed by the following specific procedure. In step (1) of the process shown n FIGS. 32 and 4, a complete liquid form of metal M is contained in a ladle 10. In step (2), the low-temperature melt (which may optionally contain an element that is added to promote the generation of crystal nuclei) is cooled with a jig 20 to generate crystal nuclei; in step (3)-0, the melt is poured into a vessel 30 that is preliminarily held at a specified temperature not higher than the liquidus temperature, thereby yielding an alloy containing a large number of crystal nuclei at a temperature either just below or above the liquidus line.

Alternatively, the cooling jig 20 may be dispensed with and the low-temperature melt of a composition just above the melting point and which contains an element added to promote the generation of a fine structure may be directly poured into the holding vessel 29 which is preliminarily maintained at a temperature not higher than the liquidus temperature.

In subsequent step (3), the holding vessel 29 is accommodated within the outer vessel 31 lined with a heat insulator 33 on the bottom and then fitted with a lid. Thereafter, the alloy in the holding vessel is held in a semisolid condition with its temperature being lowered, whereby fine particulate (nondendritic) primary crystals are generated from the introduced crystal nuclei. In order to ensure that the temperature in the holding vessel 29 is lowered under the temperature conditions specified in FIGS. 9 and 10, the outer vessel 31 is temperature managed such as by internal or external heating or by induction heating, with the heating being performed only before or after the insertion of the holding vessel 29 or for a continued period starting prior to the insertion of the holding vessel and ending after its insertion.

Metal M thus obtained at a specified fraction solid is inserted into a die casting injection sleeve 70 and thereafter pressure formed within a mold cavity 50*a* on a die casting machine to produce a shaped part.

The casting, spheroidizing and molding conditions that are respectively set for the steps shown in (see FIG. 9), namely, the step of pouring the molten metal on to the cooling jig, the step of generating and spheroidizing primary crystals and the forming step, are set forth below more specifically. Also discussed below is the criticality of the numerical limitations in the eighteenth embodiment of the present invention.

The holding vessel 29 is used to hold the molten metal until it is cooled to a specified fraction solid after its temperature has dropped just below the liquidus line. If the thermal conductivity of the vessel 29 is less than 1.0 kcal/hr·m·° C. (at room temperature), it has such a good heat insulating effect that an unduly prolonged time is required for the molten metal M in the holding vessel 29 to be cooled to the temperature where a specified fraction solid is established, thereby reducing the operational efficiency. In addition, the generated spherical primary crystals become coarse to deteriorate the formability of the alloy.

It should, however, be mentioned that if the holding vessel contains a comparatively small quantity of the melt, the holding time necessary to achieve the intended cooling becomes short even if the thermal conductivity of the vessel is less than 1.0 kcal/hr·m·° C. at room temperature. If the temperature of the holding vessel 29 is higher than the liquidus temperature, the molten metal M as poured into the vessel is higher than the liquidus line, so that only a few crystal nuclei will remain in the liquid phase to produce large primary crystals. In order to endure a more uniform temperature profile through the alloy within the holding vessel 29 by means of the outer vessel 31 while the molten metal M is cooled to a temperature where the fraction solid appropriate for shaping is established, either one of the following conditions should be satisfied: the top of the holding vessel 29 should be fitted with a lid; an adequate clearance should be provided between the holding vessel 29 and the outer vessel 31; a heat insulator should be provided in the area where the bottom of the holding vessel 29 contacts the outer vessel 31; or projections or recesses should be provided on either the holding vessel 29 or the outer vessel 31.

In the example under discussion, the crystal nuclei were generated by the method of the second, ninth and tenth embodiments of the present invention.

Table 3 shows the conditions of the holding vessel, the alloy within the holding vessel, and the outer vessel, as well as the qualities of shaped parts. As shown in FIG. 32, the shaping operation consisted of inserting the semisolid metal into an injection sleeve and subsequent forming on a squeeze casting machine. The forming conditions were as follows: pressure, 950 kgf/cm$^2$; injection speed; 1.0 m/s; casting weight (including biscuits), 2 kg; mold temperature, 250° C.

TABLE 3

| | No. | Alloy | Temperature of cooling plate (° C.) | Initial temperature of holding vessel (° C.) | Constituent material of holding vessel | Initial *1 temperature of the alloy within holding vessel (° C.) | Constituent material of outer vessel | Method of heating the outer vessel |
|---|---|---|---|---|---|---|---|---|
| Invention Sample | 1 | AZ91 | 20 | 250 | SUS | 601 | SUS | B |
| | 2 | AZ91 | 20 | 450 | SUS | 601 | Graphite | C |
| | 3 | AZ91 | 100 | 250 | SUS | 599 | Graphite | C |
| | 4 | AZ91 | 20 | 250 | SUS | 597 | Graphite | C |
| | 5 | AZ91 | 20 | 250 | SUS | 600 | SUS | A |
| | 6 | AZ91 | 20 | 250 | SUS | 601 | SUS | B |
| | 7 | AZ91 | *5 | 100 | SUS | 599 | Graphite | C |
| | 8 | AC4CH | 20 | 450 | SiN | 616 | Graphite | B |
| | 9 | AC4CH | 20 | 250 | SUS | 615 | Graphite | C |
| Comparative Sample | 10 | AZ91 | 20 | 200 | SUS | 601 | *6 | — |
| | 11 | AC4CH | 20 | 250 | SUS | 615 | *6 | — |
| | 12 | AZ91 | 20 | 250 | SUS | 599 | Graphite | A |
| | 13 | AC4CH | 20 | 250 | SUS | 720 *7 | Graphite | C |
| | 14 | AC4CH | 20 | 250 | SUS | 615 | Graphite | C |
| | 15 | AZ91 | 20 | 650 | SUS | 604 | Graphite | C |

| | No. | Alloy | Temperature of the outer vessel just before insertion of the holding vessel (° C.) | When the outer vessel was heated | Holding time to molding temperature (min) | Size of primary crystal grains in molding material (μm) | Temperature profile through the metal within vessel |
|---|---|---|---|---|---|---|---|
| Invention Sample | 1 | AZ91 | 480 | C | 5.0 | 80 | ○ |
| | 2 | AZ91 | 480 | A | 6.1 | 100 | ○ |
| | 3 | AZ91 | 610 | A | 9.4 | 97 | ○ |
| | 4 | AZ91 | 540 | A | 5.8 | 93 | ○ |
| | 5 | AZ91 | 20 | B | 5.5 | 83 | ○ |
| | 6 | AZ91 | 600 | C | 50.0 | 175 | ○ |
| | 7 | AZ91 | 480 | A | 6.5 | 145 | ○ |
| | 8 | AC4CH | 500 | A | 8.5 | 90 | ○ |
| | 9 | AC4CH | 300 | A | 4.5 | 81 | ○ |

TABLE 3-continued

| | | | | | | | |
|---|---|---|---|---|---|---|---|
| Comparative Sample | 10 | AZ91 | — | — | 1.5 | 70 | X |
| | 11 | AC4CH | — | — | 2.5 | 60 | X |
| | 12 | AZ91 | 650 | C | 70.1 | 220 | ○ |
| | 13 | AC4CH | 500 | A | 8.5 | 600 | ○ |
| | 14 | AC4CH | 300 | A | 0.04 | 40 *8 | X |
| | 15 | AZ91 | 480 | A | 6.5 | 3,000 | X |

(Notes)
*1 m.p. AZ91: 598° C. AC4CH: 618° C.
*2 A. The outer vessel was heated from inside with an electric heater.
B. The outer vessel was heated from outside with an electric heater.
C. The outer vessel was heated by induction heating.
*3 A. Only before insertion of the holding vessel.
B. Only after insertion of the holding vessel.
C. From before insertion of the holding vessel until after its insertion.
*4 Molding temperature was 570° C. for AZ91 and 585° C. for AC4CH, except that it was 610° C. for No. 14.
*5 No cooling plate was used.
*6 No outer vessel was used.
*7 Molten metal was poured on to the cooling plate at 950° C.
*8 Not all primary crystals were spherical.
*9 ○, Good (with temperature difference within 5° C. between maximum and minimum values)
X, Poor (with temperature difference more than 5° C. between maximum and minimum values)
*10 Alloy weight, ca.2kg With Comparative Samples 10 and 11 which did not use the outer vessel, the temperature of the alloy within the holding vessel dropped so rapidly that fine primary crystals formed but, on the other hand, the temperature profile through the semisolid alloy in the holding vessel was poor as shown in the graph on left of FIG. 33(*a*). With Comparative Sample 12, the semisolid metal holding time within the holding vessel was sufficiently long to provide a good temperature profile through the metal in the holding vessel but, on the other hand, unduly large primary crystals formed. With Comparative Sample 13, the casting temperature was so high that the alloy as poured into the holding vessel acquired a sufficiently high temperature to either substantially preclude the generation of crystal nuclei or cause rapid disappearance of crystal nuclei, thereby yielding unduly large primary crystals. With Comparative Sample 14, the liquid fraction in the semisolid metal was high whereas the holding time was short, thereby providing only a poor temperature profile through the semisolid alloy within the holding vessel.

In Invention Samples 1–9, the metal in the vessel was rapidly cooled with its temperature profile being maintained sufficiently uniform that semisolid metals having nondendritic fine primary crystals were produced in a convenient and easy way. Such alloys were then fed into a mold and pressure formed to produce shaped parts of a homogeneous structure having fine (<200 $\mu$m) spherical primary crystals.

Example 6

Figure 36:
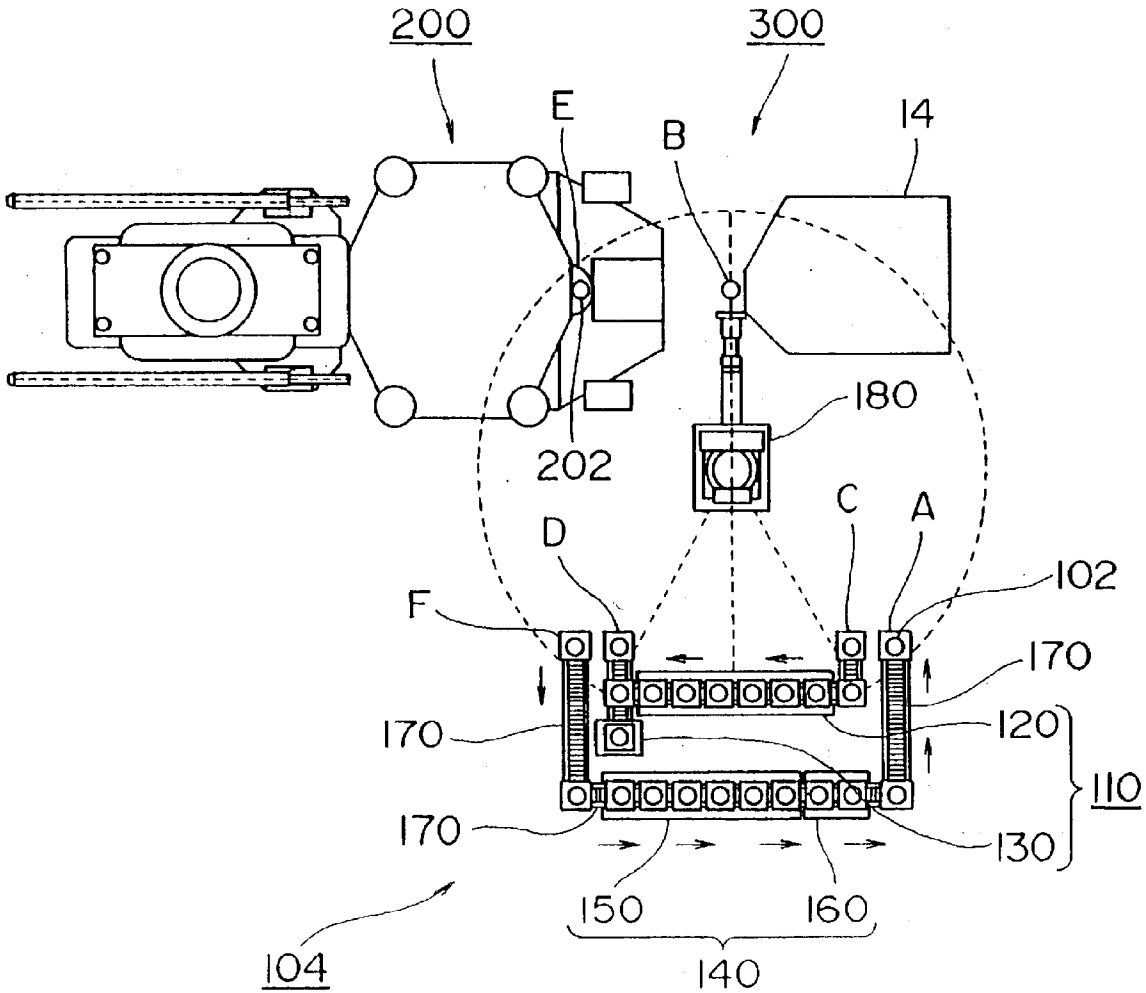
FIG. 36 is a plan view showing the general layout of molding equipment (its first embodiment) according to an example of the nineteenth to twenty-third embodiments of the present invention.
Figure 37:
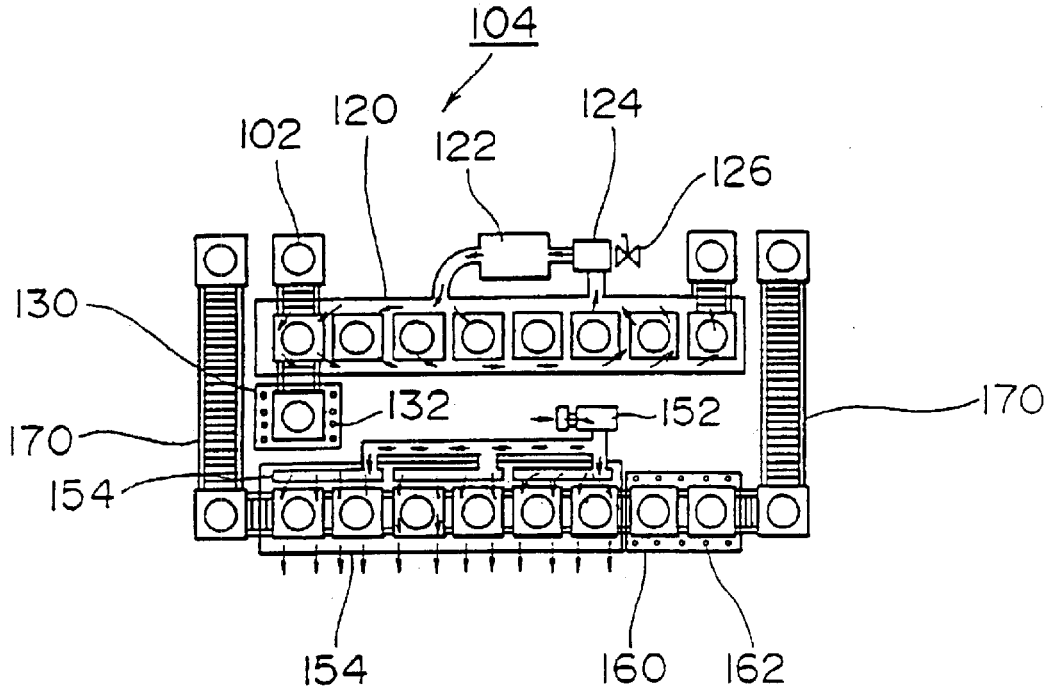
FIG. 37 is a plan view of a temperature management unit (its first embodiment) according to an example of the nineteenth to twenty-third embodiments of the present invention.
Figure 38:
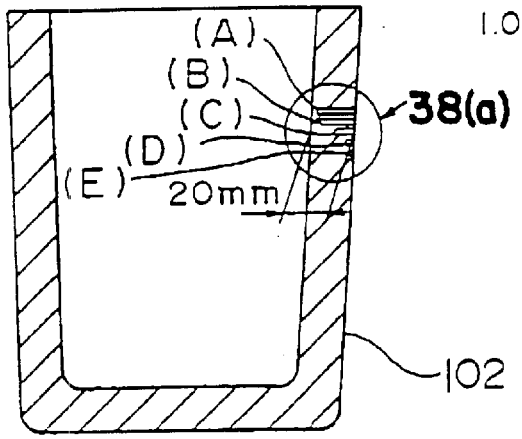
FIG. 38 is an elevational sectional view of a vessel and FIG. 38(*a*) is an exploded view showing the specific positions of temperature measurement within the vessel according to an example of the invention (as in the nineteenth to twenty-third embodiments of the present invention)
Figure 38A:
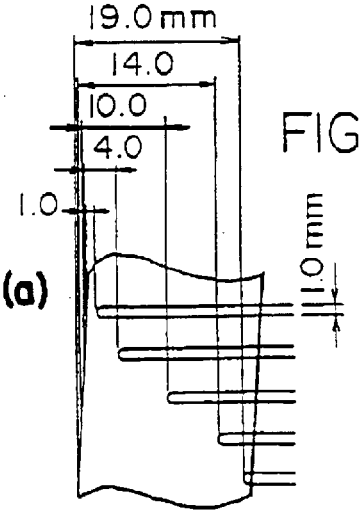
Figure 39:
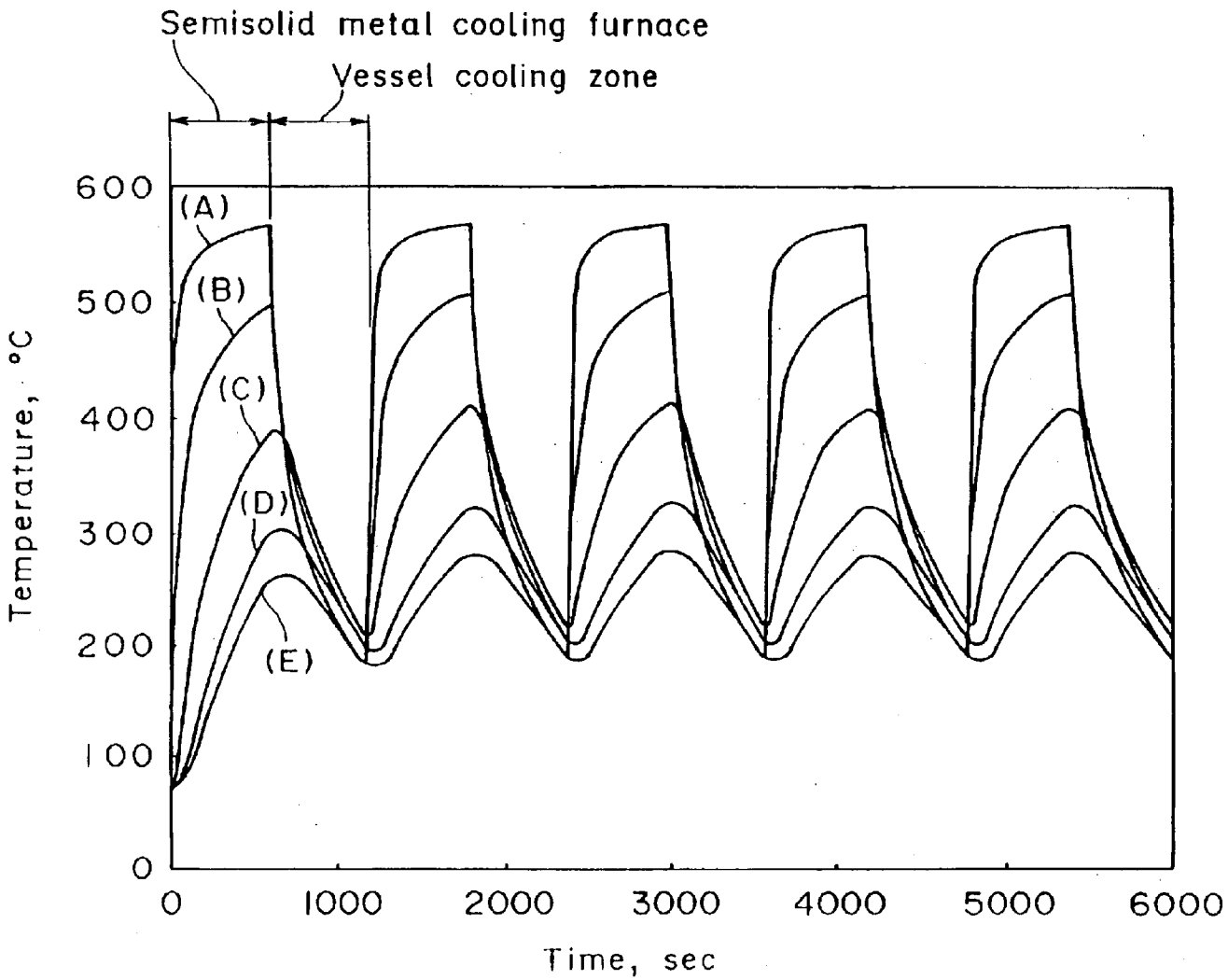
FIG. 39 is a graph showing the temperature history of cooling within the vessel according to an example of the invention (as in the nineteenth to twenty-third embodiments of the present invention)
Figure 40:
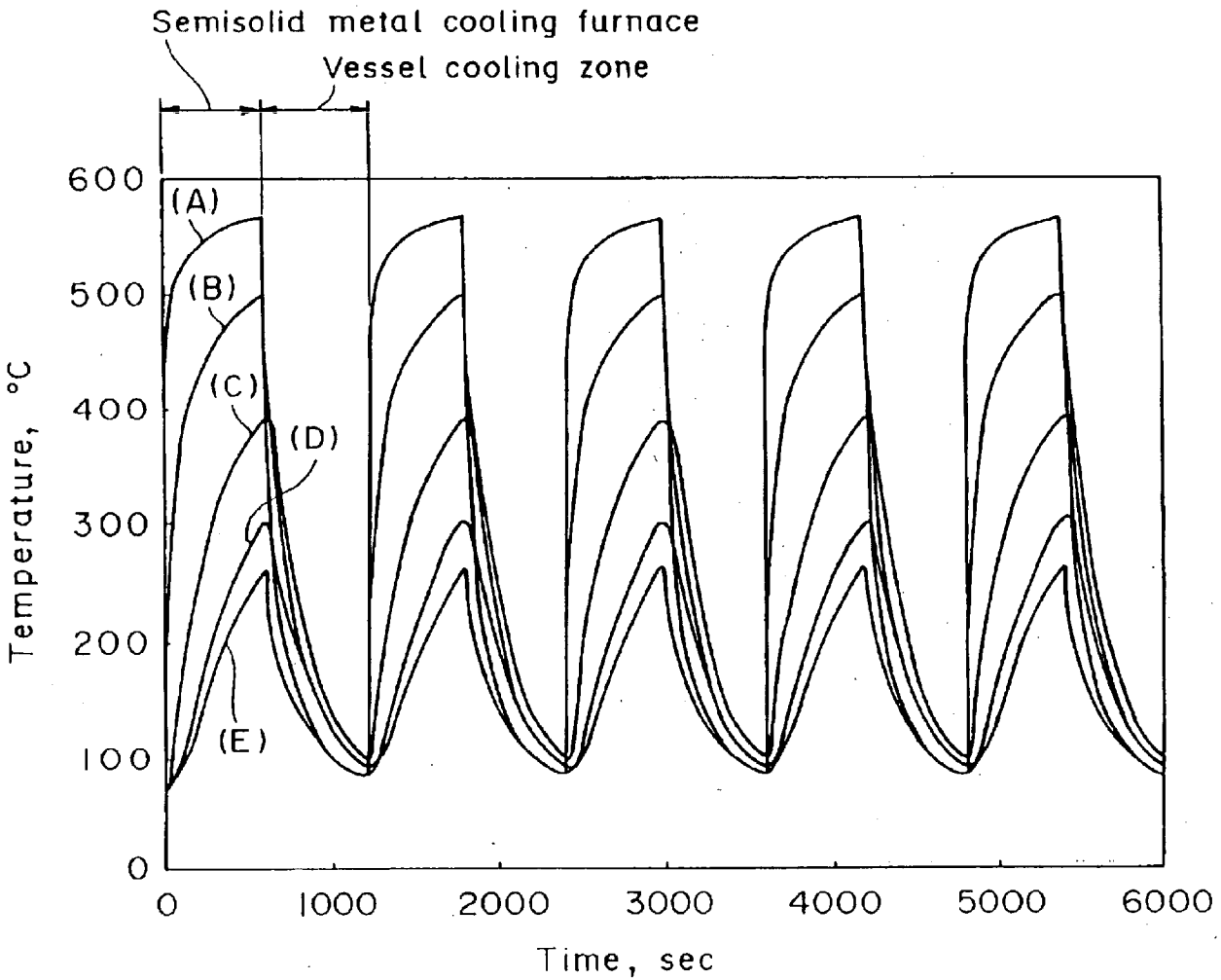
FIG. 40 is a graph showing the temperature history of cooling within the vessel according to another example of the invention (as in the nineteenth to twenty-third embodiments of the present invention)
Figure 41:
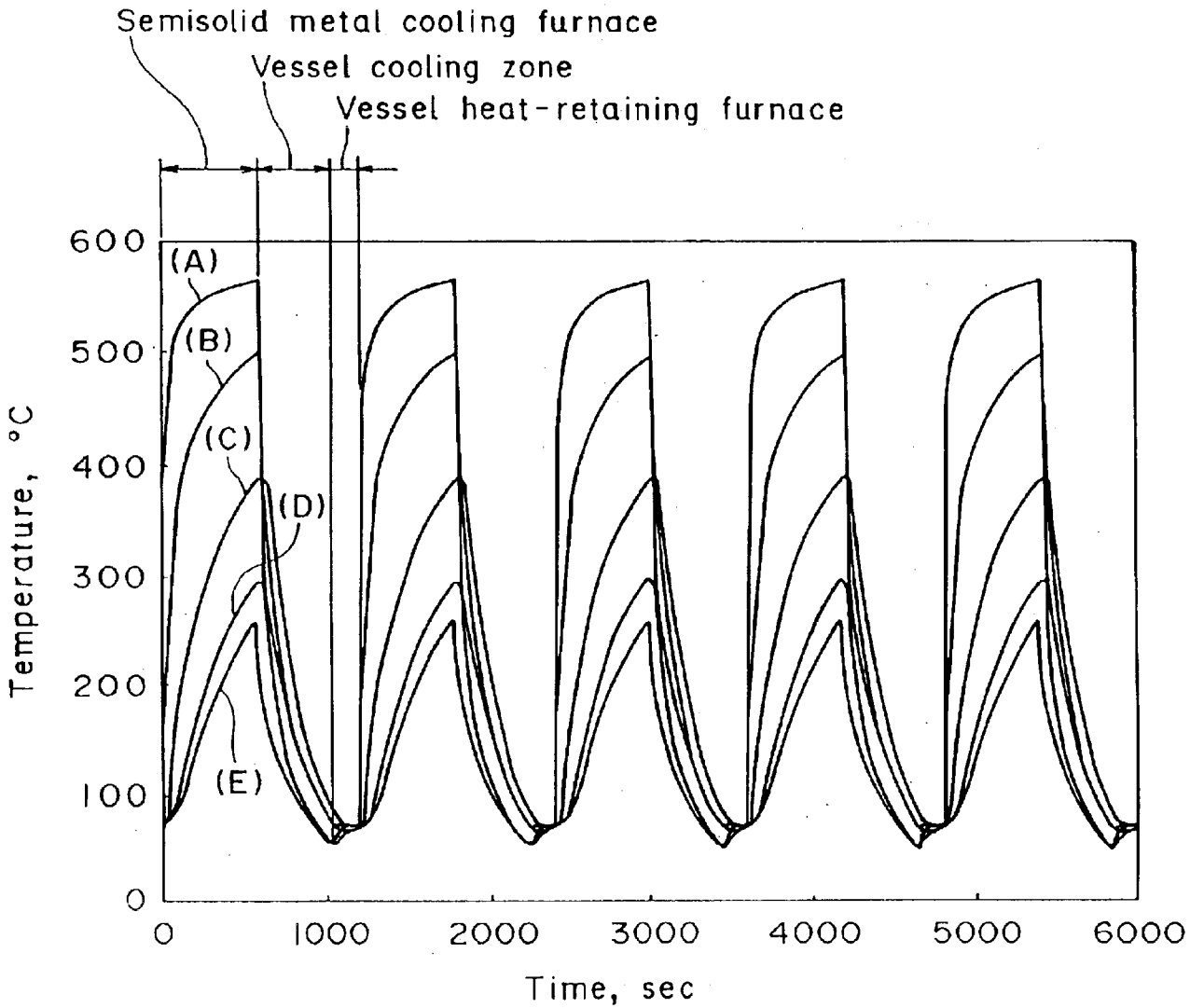
FIG. 41 is a graph showing the temperature history of cooling within the vessel according to another example of the invention (as in the nineteenth to twenty-third embodiments of the present invention)
Figure 42:
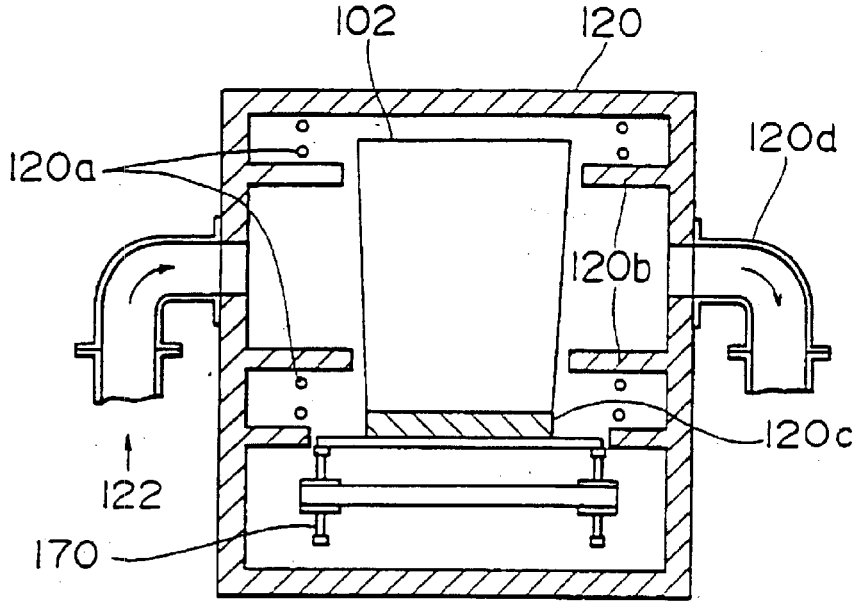
FIG. 42 is a longitudinal section of a semisolid metal cooling furnace according to another example of the invention (as in the nineteenth to twenty-third embodiments of the present invention)
Figure 43:
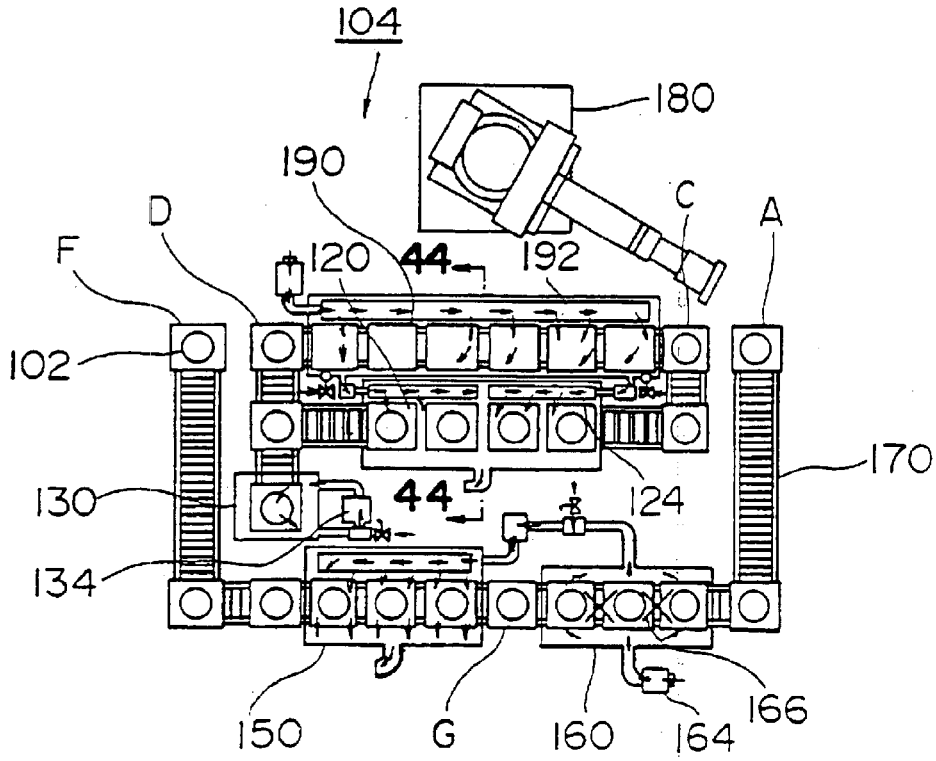
FIG. 43 is a plan view of a temperature management unit (its second embodiment) according to other examples of the invention (as in the nineteenth to twenty-third embodiments of the present invention)
Figure 44:
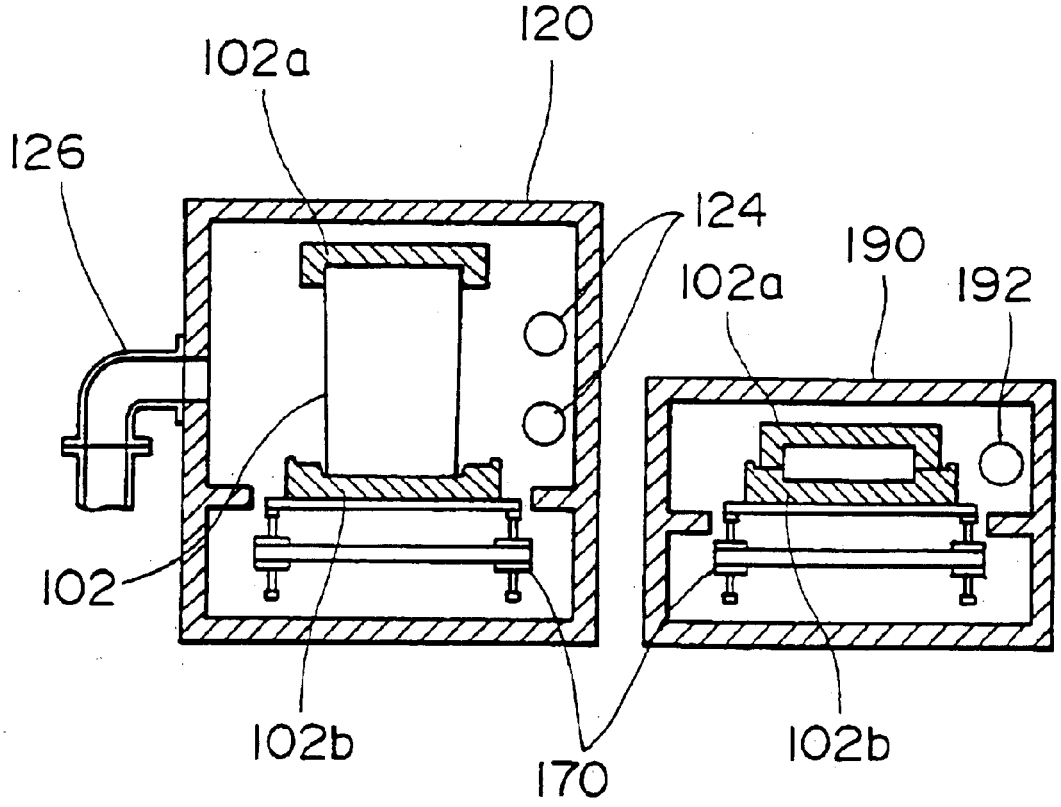
FIG. 44 is a longitudinal section 44—44 of FIG. 43.
Figure 45A:
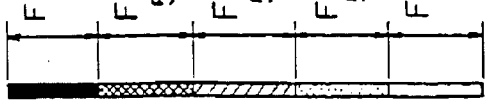
FIGS. 45(*a*) to 45(*d*) are schematic diagrams which show the temperature profiles in the vessel fitted with heat insulators according to an example of the invention (as in the nineteenth to twenty-third embodiments of the present invention) as compared with the temperature profile in the absence of such heat insulators.
Figure 45B:
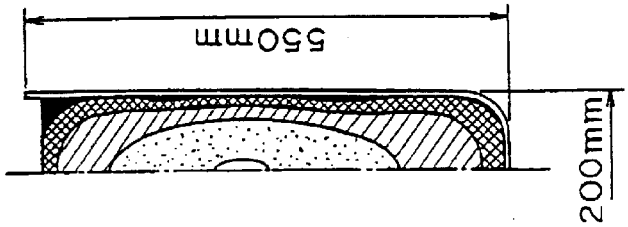
Figure 45C:
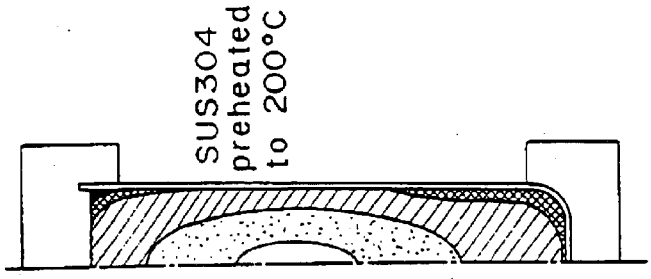
Figure 45D:
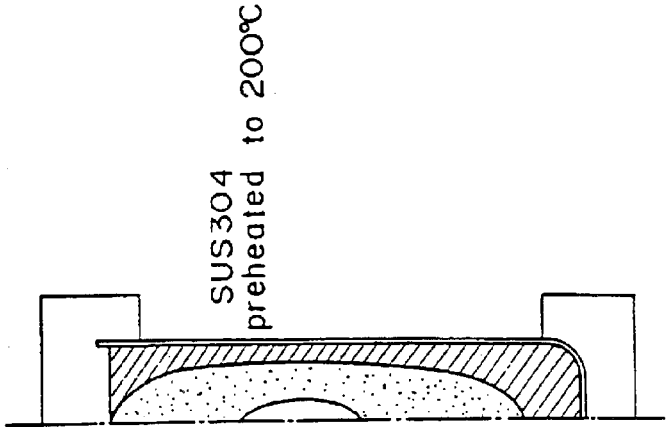
Figure 46:
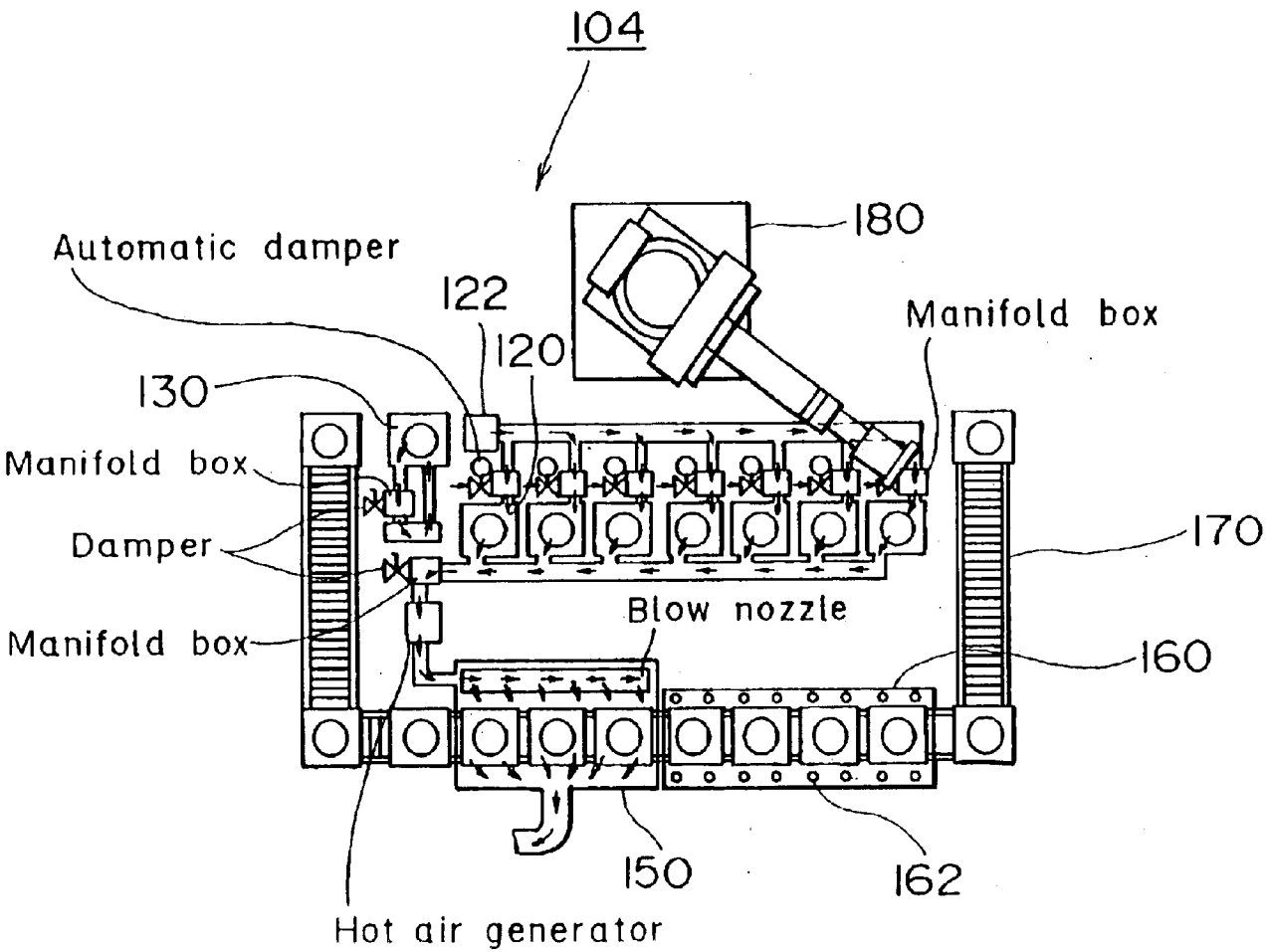
FIG. 46 is a plan view of a temperature management unit (its third embodiment) according to another example of the invention (as in the nineteenth to twenty-third embodiments of the present invention)
Figure 47:
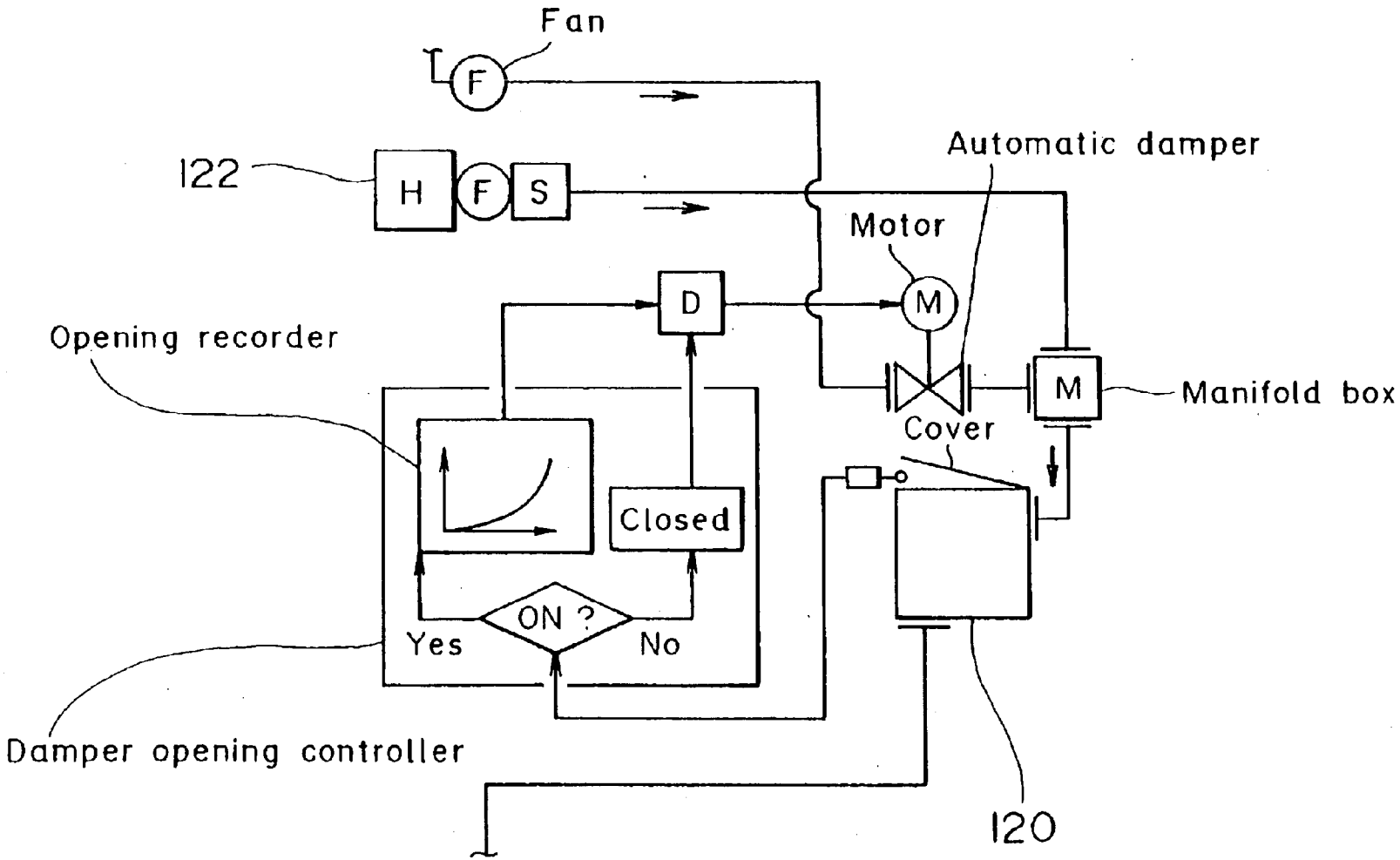
FIG. 47 is a schematic diagram which shows schematically the composition of a temperature controller (its first embodiment) for a semisolid metal cooling furnace according to an example of the invention (as in the nineteenth to twenty-third embodiments of the present invention)
Figure 48:
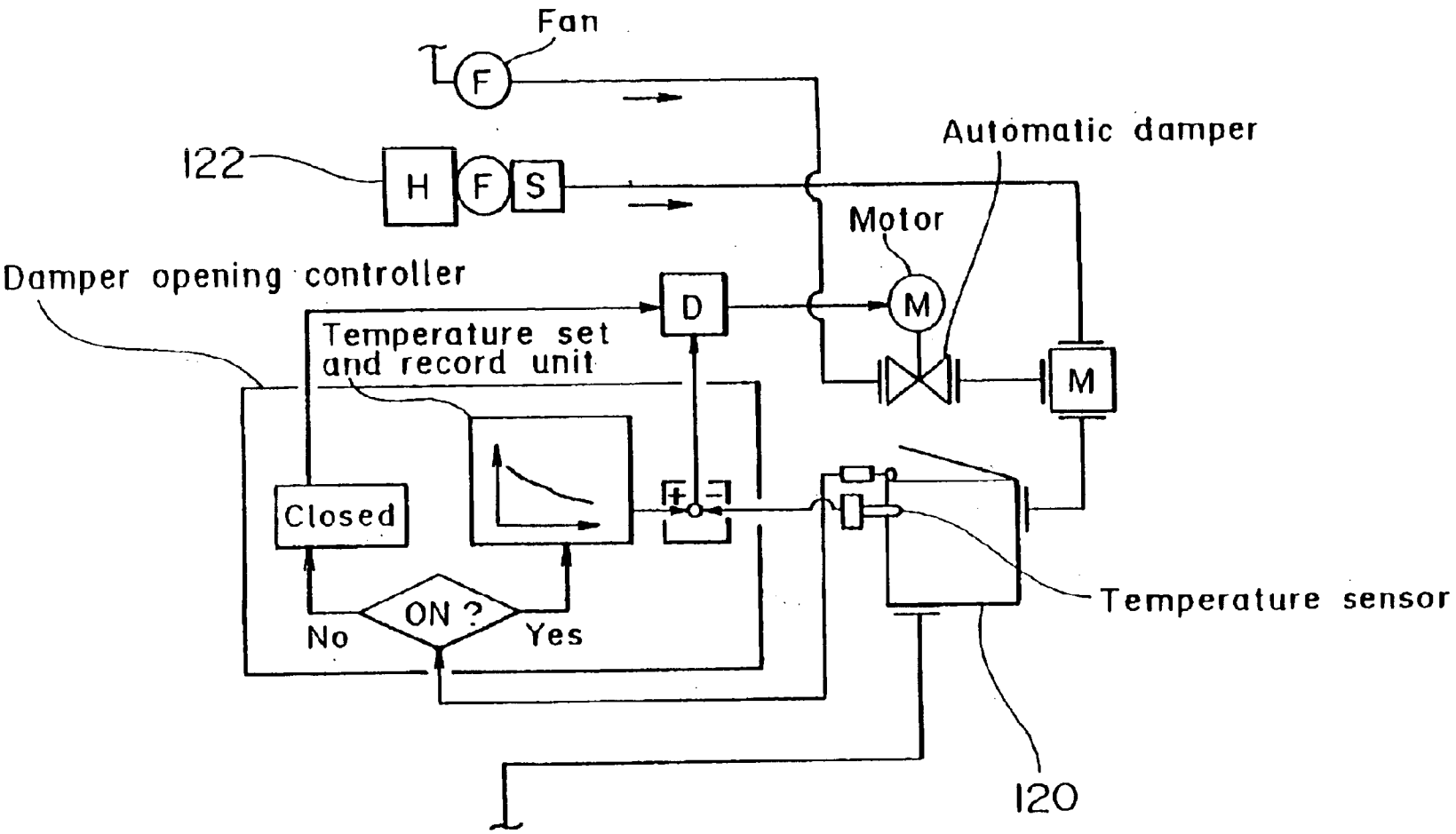
FIG. 48 is a schematic diagram which shows schematically the composition of a temperature controller (its second embodiment) for a semisolid metal cooling furnace according to another example of the invention (as in the nineteenth to twenty-third embodiments of the present invention)
Figure 49:
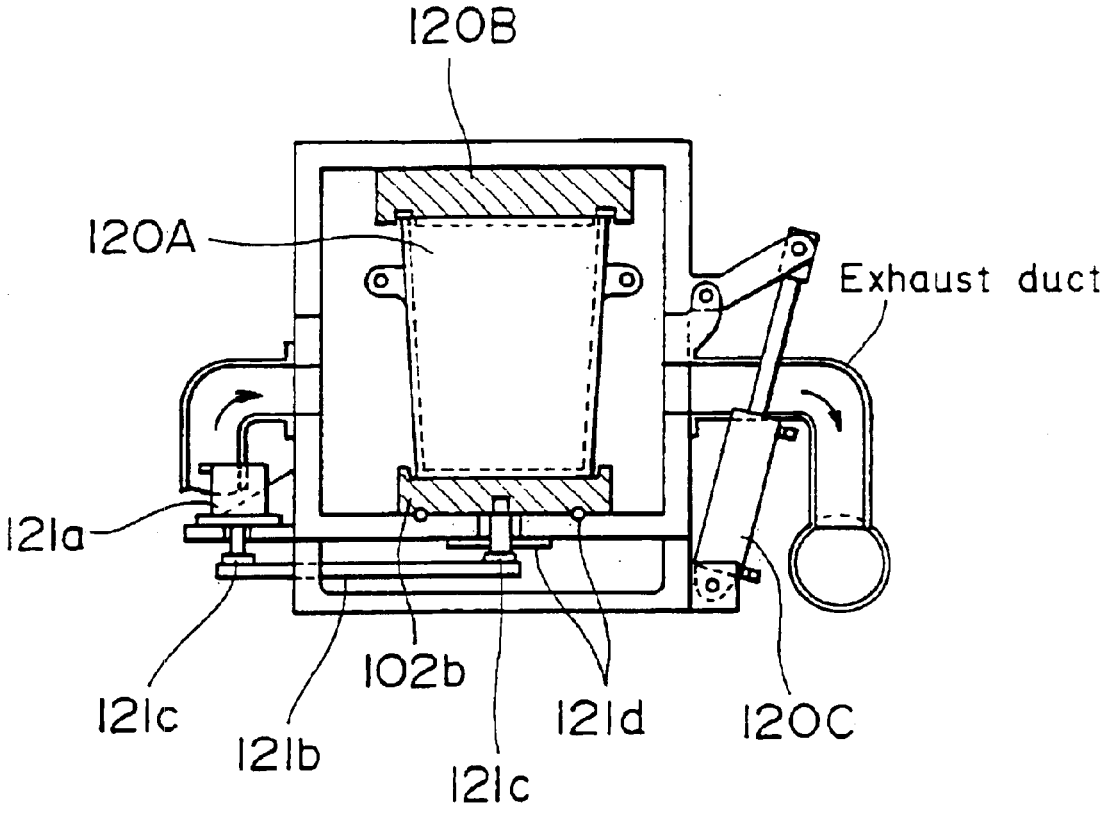
FIG. 49 is a longitudinal section of a vessel rotating unit according to an example of the invention (as in the nineteenth to twenty-third embodiments of the present invention)
Figure 53:
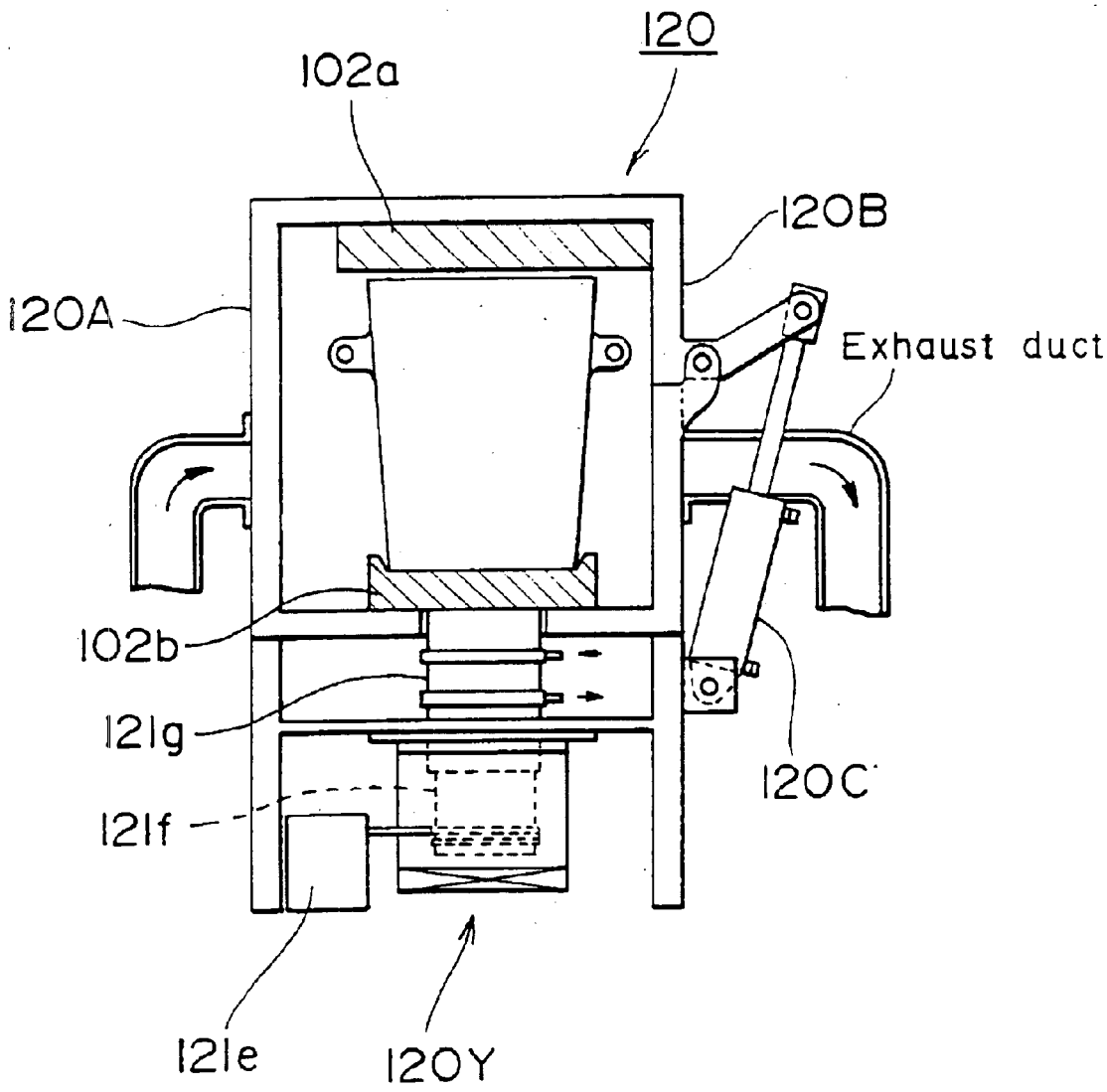
FIG. 53 is a longitudinal section of a semisolid metal cooling furnace (equipped with a vessel vibrator) according to the twenty-fourth to twenty-ninth embodiments of the present invention.

Examples of the invention (as in the nineteenth to twenty-third embodiments of the present invention) will now be described with reference to accompanying drawings FIGS. 36–49 and 53, in which: FIG. 36 is a plan view showing the general layout of molding equipment (its first embodiment) according, to an example of the invention; FIG. 37 is a plan view of a temperature management unit (its first embodiment) according to the example of the invention; FIG. 38 and FIG. 38(*a*) show the specific positions of temperature measurement within a vessel according to an example of the invention; FIGS. 39, 40 and 41 are graphs showing the temperature history of cooling within the vessel under different conditions; FIG. 42 is a longitudinal section of a semisolid metal cooling furnace according to another example of the invention; FIG. 43 is a plan view of a temperature management unit (its second embodiment) according to yet another example of the invention; FIG. 44 is a longitudinal section A—A of FIG. 43; FIGS. 45(*a*) to 45(*d*) show the temperature profiles in the vessel fitted with heat insulators according to an example of the invention; FIG. 46 is a plan view of a temperature management unit (its third embodiment) according to another example of the invention; FIG. 47 shows schematically the composition of a temperature controller for a semisolid metal cooling furnace (its first embodiment) according to an example of the invention; FIG. 48 shows schematically the composition of a temperature controller (its second embodiment) for a semisolid metal cooling furnace according to another example of the invention; FIG. 49 is a longitudinal section of a vessel rotating unit according to an example of the invention; and FIG. 53 is a longitudinal section of a semisolid metal cooling furnace as it is equipped with a vessel vibrator according to another example of the invention.

As FIG. 36 shows, the molding equipment generally indicated by 300 consists of a melt holding furnace 14 for feeding the molten metal as a molding material (containing a large number of crystal nuclei)., a molding machine 200, and a temperature management unit 104 for managing the temperature of the melt until it is fed to the molding machine 200. The molten metal held within the furnace 14 contains a large number of crystal nuclei.

As also shown in FIG. 36, the temperature management unit 104 consists of a semisolid metal cooling section 110 and a vessel temperature control section 140; the semisolid metal cooling section 110 is composed of a semisolid metal cooling furnace 120 and a semisolid metal slowly cooling furnace 130 which are connected in a generally rectangular arrangement by means of a transport mechanism such as a conveyor 170 whereas the vessel temperature control section 140 is composed of a vessel cooling furnace 150 and a vessel heat-retaining furnace 160. The temperature management unit 104 is also equipped with a robot 180 which grips the vessel 102 and transports it to one of the specified positions A–F (to be described below).

The temperature management unit 104 is operated as follows. An empty vessel 102 is first located in the heating vessel pickup position A. The robot 180 then transfers the vessel 102 to the position B, where the vessel is charged with a prescribed amount of the molten metal from the melt holding furnace 14.

Thereafter, the robot 180 transports the vessel 102 to the filled vessel rest position C; subsequently, the vessel is cooled as it is carried by the conveyor 170 to pass through the semisolid metal cooling furnace 120 in a specified period of time. The vessel 102 leaving the furnace 120 reaches the slurry vessel rest position D, from which it is immediately transferred to the sleeve position E by the robot 180 if the injection sleeve 202 in the molding machine 200 is ready to accept the molten metal; at position E, the slurry of semisolid metal in the vessel is poured into the injection sleeve 202. If the injection sleeve 202 is not ready to accept the molten metal when the vessel 102 has reached the slurry vessel rest position D (i.e., if the molding machine is operating to perform pressure forming), the slurry of semisolid metal within the vessel will progressively solidify upon cooling while it is waiting for acceptance in the position D, thereby making it impossible for all the slurry to be discharged from the vessel or the crystal nuclei in the slurry will disappear to cause deterioration in the quality of the shaped part. In order to avoid these problems, the vessel 102 is forwarded to the semisolid metal slowly cooling furnace 130, where it waits for the molding machine 200 to become completely ready for the acceptance of the molten metal while ensuring against its rapid cooling.

The vessel 102 from which the slurry of semisolid metal having satisfactory properties has been emptied into the injection sleeve 202 is then transferred to the empty vessel rest position F by means of the robot 180, carried by the conveyor 170 into the vessel cooling furnace 150, where it is cooled for a specified time, passed through the vessel heat-retaining furnace 160 as it is held at a suitable temperature, and is thereafter returned to the heating vessel pick up position A.

A specific embodiment of the temperature management unit 104 is shown in FIG. 37. In this first embodiment, aluminum alloys are to be treated at a comparatively small scale with the molten metal being poured in an amount of no more than 10 kg; the system configuration is such that the molding cycle on the molding machine 200 is about 75 seconds and the time of passage through the semisolid metal cooling furnace 120 and the vessel temperature controller 140 (i.e., consisting of the vessel cooling furnace 150 and the vessel heat-retaining furnace 160) is 600 seconds in total. If the total passage time is longer than 600 seconds, the overall equipment becomes impractically bulky and the volume of the slurry in process which results from machine troubles and which has to be discarded is increased and these are by no means preferred or the purpose of constructing commercial production facilities. Considering these points and in order to achieve consistent temperature management for a small quantity of slurry having good properties, the vessel 102 is made of an $Al_2O_3 \cdot SiO_2$ composite having a small thermal conductivity (0.3 kcal/hr·m·° C.). As a result, a slurry of semisolid metal having satisfactory properties can be obtained if only the temperature of the vessel 102 is retained by circulation of hot air the temperature of which is set at a constant value of 120° C.

The system shown in FIG. 37 has the following differences from the system of FIG. 36. Since the vessel 102 is made of the $Al_2O_3 \cdot SiO_2$ composite, it has a sufficiently small thermal conductivity that one only need supply the interior of the semisolid metal cooling furnace 120 (which is set at a temperature of 200° C.) with a circulating hot air flow of a constant temperature from a hot air generating furnace 122. In addition, one only need equip the semisolid metal slowly cooling furnace 130 (which is set at a temperature of 550 t) and the vessel heat-retaining furnace 160 (which is set at a temperature of 100° C.) with heaters 132 and 162, respectively. With these provisions, the temperature in the vessel 102 can be managed correctly to ensure that slurries of semisolid metal having satisfactory properties can be produced in a short time while assuring farily consistent temperature management. The temperature in the vessel is optimally at 70° C.; to ensure that the temperature in the vessel is consistently managed at the optimal 70° C., adequate heat removal must be effected in the vessel cooling furnace 150; otherwise, the temperature in the vessel 102 becomes undesirably high. To deal with this problem, the vessel cooling furnace 150 is fitted with a blower 152 and a blow nozzle 152*a* such that a fast air flow is blown at room temperature to achieve forced cooling.

For system assessment on the management of the temperature in the vessel 102, a sheathed thermocouple was set up in the vessel and temperature data were taken under various conditions. FIG. 38 shows five different positions (A)–(E) of temperature measurement in the vessel 102, into which the 1.0-mm thick sheathed thermocouple was inserted.

FIG. 39 shows the temperature history of cooling under condition I, i.e., the vessel temperature control section 140 was not divided into the vessel cooling furnace 150 and the vessel heat-retaining furnace 160 and a hot air flow having the target temperature of 70° C. was circulated within the monolithic vessel temperature control section 140 at a velocity of about 5 m/sec. With this approach, the temperature in the vessel dropped to only about 200° C. which was far from the target value.

FIG. 40 shows the temperature history of cooling under condition II, i.e., a hot air flow having a temperature of 70° C. was circulated at a higher velocity of about 30 m/sec. This approach was effective in further reducing the temperature in the vessel but not to the desired level of 70° C.

FIG. 41 shows the temperature history of cooling under condition III, i.e., the vessel temperature control section 140 was divided into the vessel cooling furnace 150 and the vessel heat-retaining furnace 160, with an air flow at ordinary temperature being circulated within the cooling furnace 150 at a velocity of 30 m/sec whereas the atmosphere in the vessel heat-retaining furnace 160 had its temperature increased to 70° C. by means of an electric heater. It was only with this system that the temperature in the vessel could be managed to be stable at the intended 70° C.

If, in the case of treating aluminum alloys at a large scale, the vessel 102 is made of ceramics having thermal conductivities of no more than 1 kcal/m·hr·° C., the time to cool the slurry of semisolid metal becomes impractically long. Therefore, in the second embodiment of the temperature management unit 104 which is adapted for handling comparatively large volumes of aluminum alloys such that the molten alloy is poured in an amount of 20 kg or more, the vessel 102 is made of SUS304 (see FIG. 43) rather than the ceramics which are used with the first embodiment shown in FIG. 37 and which require a prolonged cooling time. The resulting differences between the first embodiment of the temperature management unit 104 (FIG. 37) and the second embodiment are as follows.

In order to ensure smooth recovery of the slurry from the vessel 102, its inner surfaces have to be coated with a water-soluble (which is desirable for ensuring against gas evolution) spray of a lubricant and, to this end, a spray position (spray equipment) is provided between the vessel cooling furnace 150 and the vessel heat-retaining furnace 160. Accordingly, the vessel 102 emerging from the vessel cooling furnace 150 must be kept at a sufficient temperature (200° C.) to allow for the deposition of the spray solution; to meet this requirement, hot air at 200° C. is applied against the vessel through a blow nozzle. As the result of the application of the water-soluble spray, the vessel 102 experiences a local temperature drop. In order to ensure that the vessel 102 has a uniform temperature of 200° C. throughout, a hot air flow at 200° C. is circulated within the vessel heat-retaining furnace 160 while it is agitated by a rotating fan to ensure uniformity in the temperature of the vessel 102.

The vessel 102 which is made of SUS304 allows thermal diffusion through it, so even if the semisolid metal cooling furnace 120 is of the design shown in FIG. 42, no sharp border line can be drawn between the high-temperature range of the vessel (consisting of its top and bottom portions) and the low-temperature range (the middle portion of the vessel). To deal with this problem, a preheating furnace 190 is provided as accessory equipment on a lateral side of the semisolid metal cooling furnace 120 and, as shown in FIG. 44, a lid 102*a* made of a ceramic material ($Al_2O_3 \cdot SiO_2$ composite) and a plinth 102*b* are used to heat-retain the top and bottom of the vessel 102 while it is heated in the preheating furnace 190 before it is charged into the semisolid metal cooling furnace 120.

The interior of the semisolid metal cooling furnace 120 is supplied with hot air from the hot air generating furnace via two sets of blow nozzles 124, one being in the upper position and the other in the lower position. The supplied hot air is circulated within the cooling furnace 120 with its temperature and velocity being 220° C. and 5 m/sec at the entrance and 180° C. and 20 m/sec at the exit, whereby the semisolid metal is cooled comparatively slowly in the initial cooling period but cooled rapidly in the latter period.

Thus, the present invention provides a method of temperature management in which the step of managing the temperature in the vessel 102 at an appropriate level before it is supplied with the molten metal is distinctly separated from the step of managing the temperature in the vessel 102 in such a way that the as poured molten metal can be cooled at a desired appropriate rate; the invention also provides the apparatus for temperature management 104 which is capable of automatic performance of these steps in an efficient and continuous manner. Also proposed by the invention is a system configuration that implements the respective steps by means of the vessel temperature control section 140 and the semisolid metal cooling section 110.

In a specific embodiment, the vessel temperature control section 140 is composed of the vessel cooling furnace 150 capable of forced cooling with a circulating hot air flow that provides an appropriate cooling capacity by controlling the temperature and velocity of the air passing through the furnace and the vessel heat-retaining furnace 160 which controls the temperature of the atmosphere to lie at the target value in the vessel 102 and which maintains the vessel 102 at said temperature of the atmosphere. It should be noted here that the temperature to which the vessel cooling furnace 150 and the vessel heat-retaining furnace 160 should be controlled differs between aluminum and magnesium alloys. In the case of aluminum alloys, the interior of the vessel cooling furnace 150 is controlled to lie between room temperature and 300° C. whereas the interior of the vessel heat-retaining furnace 160 is controlled to lie between 50° C. and 350° C.; in the case of magnesium alloys, the interior of the vessel cooling furnace 150 is controlled to lie between room temperature and 350° C. whereas the interior of the vessel heat-retaining furnace 160 is controlled to lie between 200° C. and 450° C.

The semisolid metal cooling section 110 is composed of the semisolid metal cooling furnace 120 which is adapted to circulate hot air at an appropriate temperature such as to accomplish cooling within the shortest possible time that produces the slurry of semisolid metal with satisfactory properties and the semisolid metal slowly cooling furnace 130 which is designed to maintain the slurry of semisolid metal for 2–5 minutes in a temperature range appropriate for shaping such as to be adaptive for the specific molding cycle on the molding machine 200. Again, the temperature to which the semisolid metal cooling furnace 120 should be controlled differs between aluminum and magnesium alloys. In the case of aluminum alloys, the temperature should be controlled to lie between 150° C. and 350° C. and in the case of magnesium alloys, the temperature should be controlled to lie between 200° C. and 450° C. On the other hand, the interior of the semisolid metal slowly cooling furnace 130 should be controlled to be at 500° C. and above in both cases.

If the injection sleeve 202 on the molding machine 200 is ready to accept the molten metal just at time when the vessel 102 holding the metal has left the semisolid metal cooling furnace 120, the metal is immediately fed (poured) into the molding machine 200 without being directed into the semisolid metal slowly cooling furnace 130. Conversely, if the injection sleeve 202 is not ready to accept the molten metal since the molding machine 200 is operating, the vessel 102 leaving the semisolid metal cooling furnace 120 is transferred to the semisolid metal slowly cooling furnace 130.

As shown in FIGS. 37 and 42, the semisolid metal cooling furnace 120 has the vessel 102 carried on the conveyor 170 via a heat insulating plate 120*c* and the inner surfaces on the sidewall of the furnace 120 is partitioned by an: upper and a lower heat insulating plate 120*b* in the middle portion of its height, with hot air (set at an appropriate temperature of 120° C.) being circulated through the partitioned area to establish a low-temperature region; at the same time, the inner surfaces of both top and bottom portions of the furnace 120 are heated with electric heaters 120*a* (set at a temperature of 500° C.) to establish a high-temperature (ca. 500° C.) region, thereby ensuring that a uniform temperature is provided throughout the molten metal in the vessel 102.

A first version of the heating system in the semisolid metal cooling furnace 120 according to the invention is such that either the temperature or the velocity of the circulating hot air is controlled to vary appropriately with the lapse of time or, alternatively, both the temperature and the velocity of the hot air are controlled to vary simultaneously with the lapse of time.

The first specific embodiment of the heating system is as shown in FIG. 47 and comprises a hot air line for supplying a hot air flow into the semisolid metal cooling furnace 120, an air line from which an air flow at ordinary temperature emerges to combine with the hot air to lower its temperature, a damper for controlling the quantity of the air flowing through the air line, and a damper opening controller.

The second specific embodiment of the heating system is as shown in FIG. 48 and comprises a temperature sensor installed within the semisolid metal cooling furnace 120, a hot air line for supplying a hot air flow into the furnace, an air line that combines with the hot air line, an automatic damper installed on the air line, and a damper opening controller that performs feed back control on the damper opening on the basis of the data obtained by measurement with the temperature sensor. The opening of the automatic damper is controlled on the basis of the data for the temperature in the furnace and the hot air is mixed with an appropriate amount of air and fed into the furnace, whereby the temperature and the velocity of the circulating hot air are controlled such that the molten metal will be cooled at a desired rate.

Example 7

Figure 50:
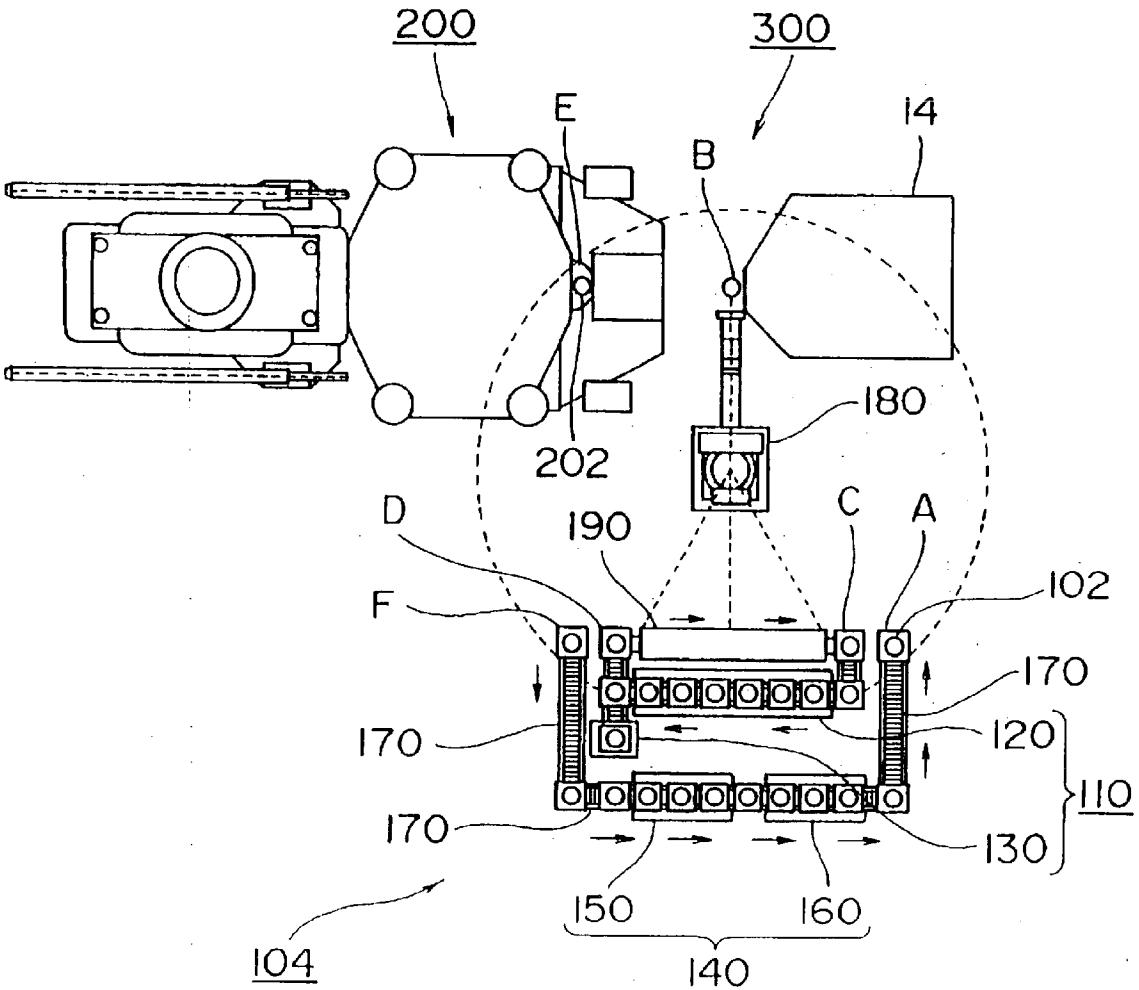
FIG. 50 is a plan view showing the general layout of molding equipment according to an example of the invention (as in the twenty-fourth to twenty-ninth embodiments of the present invention)
Figure 51:
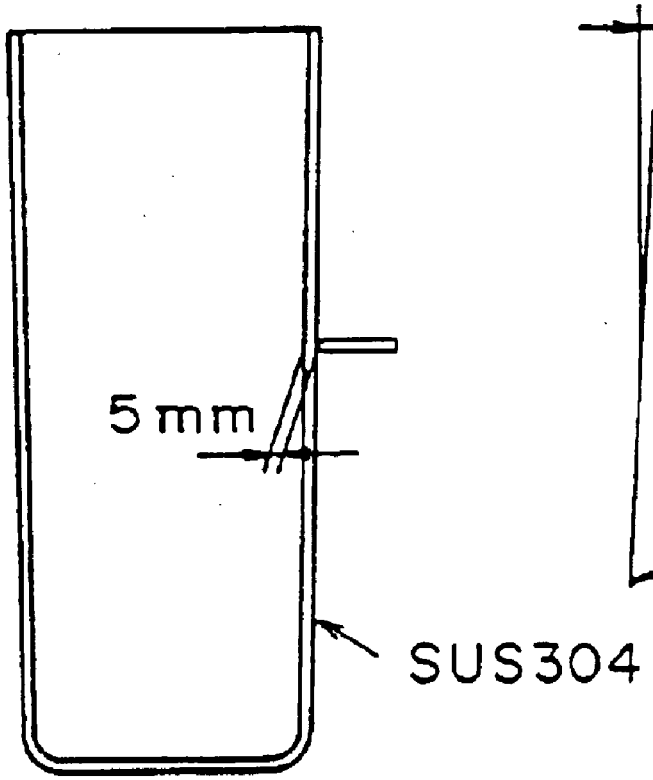
FIG. 51 is a longitudinal sectional view showing the position of temperature measurement within the holing vessel in the example shown in FIG. 50.
Figure 51A:
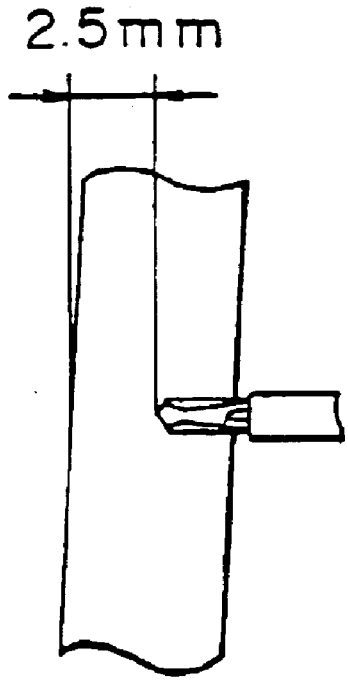
Figure 52:
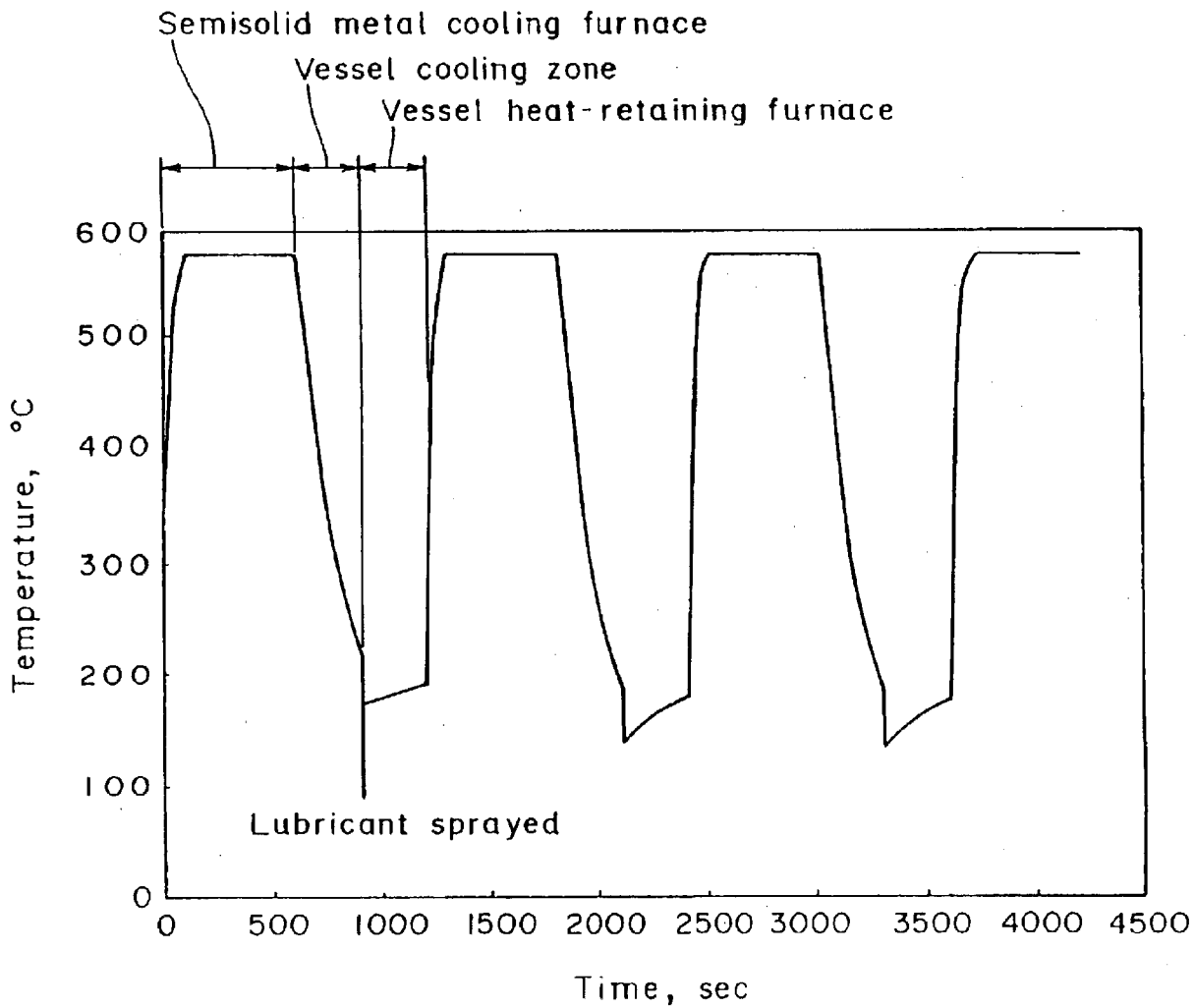
FIG. 52 is a graph showing the temperature history of cooling within the holding vessel in the example shown in FIG. 50.

An example of the invention (as in the twenty-fourth to the twenty-ninth embodiments of the present invention) will now be described specifically with reference to accompanying FIGS. 43–53, in which: FIG. 50 is a plan view showing the general layout of molding equipment; FIG. 43 is a plan view of the temperature management unit (its first embodiment); FIG. 51 is a longitudinal sectional view showing in detail the position of temperature measurement within the holding vessel; FIG. 52 is a graph showing the temperature history of cooling within the holding vessel; FIG. 44 is a longitudinal section A—A of FIG. 43; FIG. 46 is a plan view of the temperature management unit (its second embodiment) according to another example of the invention; FIG. 45 shows the temperature profiles in the vessel fitted with heat insulators as compared with the temperature profile in the absence of such heat insulators; FIG. 47 shows schematically the composition of the temperature control unit (its first embodiment) for a semisolid metal cooling furnace; FIG. 48 shows schematically the composition of the temperature control unit (its second embodiment) for a semisolid metal cooling furnace according to another example of the invention; FIG. 49 is a longitudinal section of the semisolid metal cooling furnace according to the second embodiment in which it is equipped with a vessel rotating mechanism; and FIG. 53 is a longitudinal section of the semisolid metal cooling furnace according to the third embodiment in which it is equipped with a vessel vibrating mechanism.

As shown in FIG. 50, the molding equipment generally indicated by 104 consists of a melt holding furnace 10 for feeding the molten metal as a molding material, a molding machine 200 and a temperature management unit 100 for managing the temperature of the melt until it is fed to the molding machine 200.

As also shown in FIG. 50, the temperature management unit generally indicated by 104 consists of a semisolid metal cooling section 110 and a vessel temperature control section 140; the semisolid metal cooling section 110 is composed of a semisolid metal cooling furnace 120 and a semisolid metal slowly cooling furnace 130 which are connected in a generally rectangular arrangement by means of a transport mechanism such as a conveyor 170 whereas the vessel temperature control section 140 is composed of a vessel cooling furnace 150 and a vessel heat-retaining vessel 160. The temperature management unit 100 is also equipped with a robot 180 which grips the vessel 102 and transports it to one of the specified positions A –F (to be described below). The vessel 102 moves in the direction of arrows.

In the first embodiment of the temperature management unit 104, the preheating furnace 190 is provided near and parallel to the semisolid metal cooling furnace as shown in FIGS. 43 and 44. The purpose of the preheating furnace 190 is to ensure that both the plinth 102*b* placed under the melt containing vessel 102 and the lid 102*a* placed on top of the vessel 102 are preliminarily heated to a higher temperature than the hot air to be passed through the semisolid metal cooling furnace 120 such that uniformity will be assured for the temperature of the melt within the vessel as it is cooled in the semisolid metal cooling furnace 120. To this end, both the lid 102*a* and the plinth 102*b* which are carried on the conveyor 170 will be heated by the hot air being injected through the blow nozzle 192 as they move together with the conveyor 170 (see FIG. 44).

The temperature management unit 104 is operated as follows. An empty vessel 102 is first located in the heating vessel pickup position A. The robot 180 then transfers the vessel 102 to the position B, where the vessel is charged with a prescribed amount of the molten metal from the melt holding furnace 10 (which holds the molten metal containing a large number of crystal nuclei). Thereafter, the robot 180 transports the vessel 102 to the filled vessel rest position C, where it is placed on the plinth 102*b* and has its top covered with the lid 102*a* (both the lid 102*a* and the plinth 102*b* are preliminarily heated with the preheater 190); subsequently, the vessel is cooled as it is carried by the conveyor 170 to pass through the semisolid metal cooling furnace 120 in a specified period of time. The vessel 102 leaving the furnace 120 reaches the slurry vessel rest position D, from which it is immediately transferred to the sleeve position E by the robot 180 if the injection sleeve 202 in the molding machine 200 is ready to accept the molten metal; at position E, the slurry of semisolid metal in the vessel is poured into the injection sleeve 202. If the injection sleeve 202 is not ready to accept the molten metal when the vessel 202 has reached the slurry vessel rest position D (i.e., if the molding machine is operating to perform pressure forming), the slurry of semisolid metal within the vessel will progressively solidify upon cooling while it is waiting for acceptance in position D, thereby making it impossible for all the slurry to be discharged from the vesselor the crystal nuclei in the slurry will disappear to cause deterioration in the quality of the shaped part. In order to avoid these problems, the vessel 102 is forwarded to the semisolid metal slowly cooling furnace 130, where it waits for the molding machine 200 to become completely ready for the acceptance of the molten metal while ensuring against its rapid cooling.

The vessel 102 from which the slurry of semisolid metal having satisfactory properties has been emptied into the injection sleeve 202 is then transferred to the empty vessel rest position P by means of the robot 180, carried by the conveyor 170 into the vessel cooling furnace 150, where it is cooled for a specified time, passed through the vessel heat-retaining furnace 160 as it is held at a suitable temperature, and is thereafter returned to the heating vessel pickup position A.

A specific embodiment of the temperature management unit 104 is shown in FIG. 43. In this first embodiment, aluminum alloys are to be treated on a comparatively large scale with the molten metal being poured in an amount of at least 20 kg; the system configuration is such that the molding cycle on the molding machine 200 is about 150 seconds and the time of passage through the semisolid metal cooling furnace 120 and the vessel temperature control section 140 (i.e., comprising the vessel cooling furnace 150 and the vessel heat-retaining furnace 160) is 600 seconds in total. If the total passage time is longer than 600 seconds, the overall equipment becomes impractically bulky and the volume of the slurry in process which results from machine troubles and which has to be discarded is increased and these are by no means preferred for the purpose of constructing commercial production facilities.

To satisfy these cycle conditions and yet to produce slurries of good properties, details of the system have been determined as follows. SUS304 was adopted as the constituent material of the vessel (in the case of a comparatively small-scale operation with the molten metal being poured in an amount of no more than 10 kg, materials of small thermal conductivity provide comparative ease in temperature management; however, in a large-scale operation like the case under discussion, the use of ceramics and other materials of small thermal conductivity as the constituent material of the vessel requires an unduly prolonged time to cool the slurry, resulting in the failure to satisfy the cycle time requirement set forth above).

In order to ensure smooth recovery of the slurry from the vessel 102, its inner surfaces had to be coated with a water-soluble (which is desirable for ensuring against gas evolution) spray of a lubricant and, to this end, a spray position was provided between the vessel cooling furnace 150 and the vessel heat-retaining furnace 160. The vessel 102 emerging from the vessel cooling furnace 150 had to be cooled within 5 minutes down to a temperature (200° C.–250° C.) that would allow for effective deposition of the spray; to meet this requirement, hot air at 100° C. was applied against the vessel through a blow nozzle.

As the result of the application of the water-soluble spray, the vessel 102 experienced a local temperature drop. In order to ensure that the vessel 102 would have a uniform temperature of 180° C.–190° C. throughout to provide a uniform temperature profile through the slurry, the vessel 102 was heated in the vessel heat-retaining furnace 160 in which a hot air flow at 190° C. was circulated by means of a fan.

In order to provide a uniform temperature profile through the slurry in the vessel, preheating furnace 190 was installed as an accessory and the plinth 102*b* and lid 102*a* which were each made of a heat insulator ($Al_2O_3 \cdot SiO_2$ composite) were heated at 350° C. before they were set up on the vessel 102; this arrangement allowed the vessel 102 to be inserted into the semisolid metal cooling furnace 120 together with the lid 102*a* and plinth 102*b*.

The interior of the semisolid metal cooling furnace 120 was equipped with two sets each of hot air generating furnaces and blow nozzles, through which hot air was supplied to circulate within the furnace 120, with its temperature and velocity being 220° C. and 5 m/sec at the entrance and 180° C. and 20 m/sec at the exit, whereby the semisolid metal was cooled comparatively slowly in the initial cooling period but cooled rapidly in the latter period.

For management of the temperature in the vessel 102, a sheathed thermocouple was set in the vessel to take data on the temperature. Detailed discussion will follow based on the thus taken temperature data.

FIG. 51 and FIG. 51(*a*) show the position of temperature measurement in the vessel 102. As shown enlarged on the right-hand illustration, a hole was made in the outer surface of the sidewall of the vessel to a depth at one half the wall thickness and thermocouple was inserted into the hole and spotwelded.

FIG. 52 shows the temperature history of cooling of the vessel 102. The vessel temperature control section 140 was divided into the vessel cooling furnace 150 and the vessel heat-retaining furnace 160 and, as already mentioned above, the vessel cooling furnace 150 was so adapted that "hot air at 100° C. was applied against the vessel through the blow nozzles" whereas the vessel heat-retaining vessel 160 was designed to "permit circulation of hot air at 190° C."

The system under discussion requires that the "spray should be deposited" within a limited time period while "a uniform temperature (180° C.–190° C.) should be established throughout the vessel 102". To meet these requirements, the vessel temperature control section 140 was divided into the vessel cooling furnace 150 and the vessel heat-retaining furnace 160 and optimal temperature management was performed in each furnace.

The second embodiment of the temperature management unit 100 shown in FIG. 46 was chiefly intended for the treatment of magnesium alloys. As typically shown in FIG. 49, the temperature management unit 100 comprises a plurality of linearly arranged housings 120A in a generally cubic shape, each being fitted with a top cover 120B that could be opened or closed by means of an air cylinder 120C. Sot air could be forced into the housings 120A. With the cover 120B open, the melt containing vessel 102 was placed on the plinth 102*b* at the bottom of each housing 120A and a lid 102*a* fixed to the inside surface of the cover 120B was fitted over the top of the vessel 102 so that it would ensure a heat insulating effect during the cooling of the vessel 102. The vessel was adapted for transfer into or out of the housing 120A by manipulation of the robot 180.

Thus, the semisolid metal cooling furnace 120 according to the first embodiment shown in FIG. 44 is of a continuous type in which the vessel 102 is carried by the conveyor 170 while the furnace is operating and, in contrast, the semisolid metal cooling furnace 120 according to the second embodiment shown in FIG. 46 is of a batch system.

As also shown in FIG. 49, the plinth 102*b* seated on the bottom of the housing 120A is coupled to a rotational drive mechanism consisting of a motor 121*a*, a chain 121*b*, a sprocket 121*c*, a bearing 121*d*, etc. and this drive mechanism allows the vessel 102 to rotate freely during its cooling operation.

Another embodiment of the semisolid metal cooling furnace 120 is shown in FIG. 53; it is fitted with not only a vibrator 121*f* that is actuated with an ultrasonic oscillator 121*e* but also a water-cooled booster 121*g* and this arrangement will provide effective vibrations to the vessel 102.

FIG. 45 shows the temperature profiles obtained by fitting the top and bottom of the vessel with the lid 102*a* and the plinth 102*b* which were each made of a heat insulator ($Al_2O_3 \cdot SiO_2$ composite). Obviously, the use of the heat insulator produced uniform temperature profiles as compared with the case of using no such heat insulators. The uniformity in temperature profile was further improved by preheating the insulator.

We next discuss the "high-viscosity region". The alloy to be treated in the case at issue is AC4C which has a eutectic temperature of 577° C. Within a narrow temperature range centered at this eutectic point, the solid fraction increases sharply from 56% to 100% and the viscosity will inturn rises noticeably. Hence, the region of 56% to 100% solid fraction may well be considered as the "high-density region". When no heat insulator was used, both the top and bottom portions of the vessel were entirely covered with the "high-density region" and in a case like this, the desired slurry would not form smoothly. In contrast, the mere use of the heat insulator resulted in a significant decrease in the "high-density region", which barely remained at the corners. Obviously, the "high-density region" totally disappeared when the heat insulator was heated. In the case under discussion, the heat insulator had to be heated but with smaller vessel sizes, there was no particular need to heat the heat insulator.

Magnesium alloys involve difficulty in temperature management since they have small latent heat and will cool rapidly. To deal with this problem, the semisolid metal cooling furnace 120 according to the second embodiment shown in FIG. 46 have the following differences from the first embodiment shown in FIG. 43.

First, silicon nitride was used as the constituent material of the vessel but it was difficult to obtain a uniform temperature profile through the slurry in the vessel. Under the circumstances., the semisolid metal cooling furnace 120 for handling vessels having a diameter of more than 100 mm had to be equipped with a vessel rotating mechanism as indicated by 120X in FIG. 49 or a vessel vibrator as indicated by 120Y in FIG. 53. (With vessels having diameters ranging from 50 mm to less than 100 mm, neither the vessel rotating mechanism nor the vessel vibrator had to be installed. With vessel diameters of 100 mm–200 mm, a vessel vibrator as indicated by 120Y in FIG. 53 was necessary and with vessel diameters of more than 200 mm, a vessel rotating mechanism capable of more vigorous agitation as indicated by 120X in FIG. 49 had to be employed.)

It was also necessary to perform the temperature management in such a manner as to be flexible with time; to meet this need, a furnace temperature controller as indicated by 120Z in FIG. 47 or 48 was installed. (with vessel diameters of less than 100 mm, the rate of cooling the slurry was so sensitive to the variations in the temperature within the furnace that it was necessary to control the temperature in the furnace by the mechanism shown in FIG. 47. With vessel diameters of less than 70 mm, not only the furnace temperature controller but also a feedback control system as shown in FIG. 48 was necessary.)

In order to permit the addition of these capabilities, the semisolid metal cooling furnace 120 was designed as a batch system of the type shown in FIG. 46 and the timing for the transfer of the vessel into and out of the furnace 120 was controlled by the robot 180.

Thus, the present invention provides a method of temperature management in which the step of managing the temperature in the vessel 102 at an appropriate level before it is supplied with the molten metal is distinctly separated from the step of managing the temperature in the vessel 102 in such a way that the as poured molten metal can be cooled at a desired appropriate rate; the invention also provides the apparatus for temperature management 104 which is capable of automatic performance of these steps in an efficient and continuous manner. Also proposed by the invention is a system configuration that implements the respective steps by means of the vessel temperature control section 140 and the semisolid metal cooling section 110.

In a specific embodiment, the vessel temperature control section 140 is composed of the vessel cooling furnace 150 capable of forced cooling with a circulating hot air flow that provides an appropriate cooling capacity by controlling the temperature and velocity of the air passing through the furnace and the vessel heat-retaining furnace 160 which controls the temperature of the atmosphere to lie at the target value in the vessel 102 and which maintains the vessel 102 at said temperature of the atmosphere. It should be noted here that the temperature to which the vessel cooling furnace 150 and the vessel heat-retaining furnace 160 should be controlled differs between aluminum and magnesium alloys. In the case of aluminum alloys, the interior of the vessel cooling furnace 150 is controlled to lie between room temperature and 300° C. whereas the interior of the vessel heat-retaining furnace 160 is controlled to lie between 50° C. and 350° C.; in the case of magnesium alloys, the interior of the vessel cooling furnace 150 is controlled to lie between room temperature and 350° C. whereas the interior of the vessel heat-retaining vessel 160 is controlled to lie between 200° C. and 450° C.

The semisolid metal cooling section 110 is composed of the semisolid metal cooling furnace 120 which is adapted to circulate hot air at an appropriate temperature such as to accomplish cooling within the shortest possible time that produces the slurry of semisolid metal with satisfactory properties and the semisolid metal slowly cooling furnace 130 which is designed to maintain the slurry of semisolid metal for 2–5 minutes in a temperature range appropriate for shaping such as to be adaptive for the specific molding cycle on the molding machine 200. Again, the temperature to which the semisolid metal cooling furnace 120 should be controlled differs between aluminum and magnesium alloys. In the case of aluminum alloys, the temperature should be controlled to lie between 150° C. and 350° C. and in the case of magnesium alloys, the temperature should be controlled to lie between 200° C. and 450° C. On the other hand, the interior of the semisolid metal slowly cooling furnace 130 should be controlled to be at 500° C. and above in both cases.

If the injection sleeve 202 on the molding machine 200 is ready to accept the molten metal just at the time when the vessel 102 holding the metal has left the semisolid metal cooling furnace 120, the metal is immediately fed (poured) into the molding machine 200 without being directed into the semisolid metal slowly cooling furnace 130. Conversely, if the injection sleeve 202 is not ready to accept the molten metal since the molding machine 200 is operating, the vessel 102 leaving the semisolid metal cooling 120 is transferred to the semisolid metal annealing furnace 130.

A first version of the heating system in the semisolid metal cooling furnace 120 according to the invention is such that either the temperature or the velocity of the circulating hot air is controlled to vary appropriately with the lapse of time or, alternatively, both the temperature and the velocity of the hot air are controlled to vary simultaneously with the lapse of time.

The first specific embodiment of the heating system (furnace temperature control unit 120Z) is as shown in FIG. 47 and comprises a hot air line for supplying a hot air flow into the semisolid metal cooling furnace 120, an air line from which an air flow at ordinary temperature emerges to combine with the hot air to lower its temperature, a damper for controlling the quantity of the air flowing through the air line, and a damper opening controller.

The second specific embodiment of the heating system (furnace temperature control unit 120Z) is as shown in FIG. 48 and comprises a temperature sensor installed within the semisolid metal cooling furnace 120, a hot air line for supplying a hot air flow into the furnace, an air line that combines with the hot air line, an automatic damper installed on the air line, and a damper opening controller that performs feedback control on the damper opening on the basis of the data obtained by measurement with the temperature sensor. The opening of the automatic damper is controlled on the basis of the data for the temperature in the furnace and the hot air is mixed with an appropriate amount of air and fed into the furnace, whereby the temperature and the velocity of the circulating hot air are controlled such that the molten metal will be cooled at a desired rate.

Example 8

Figure 54:
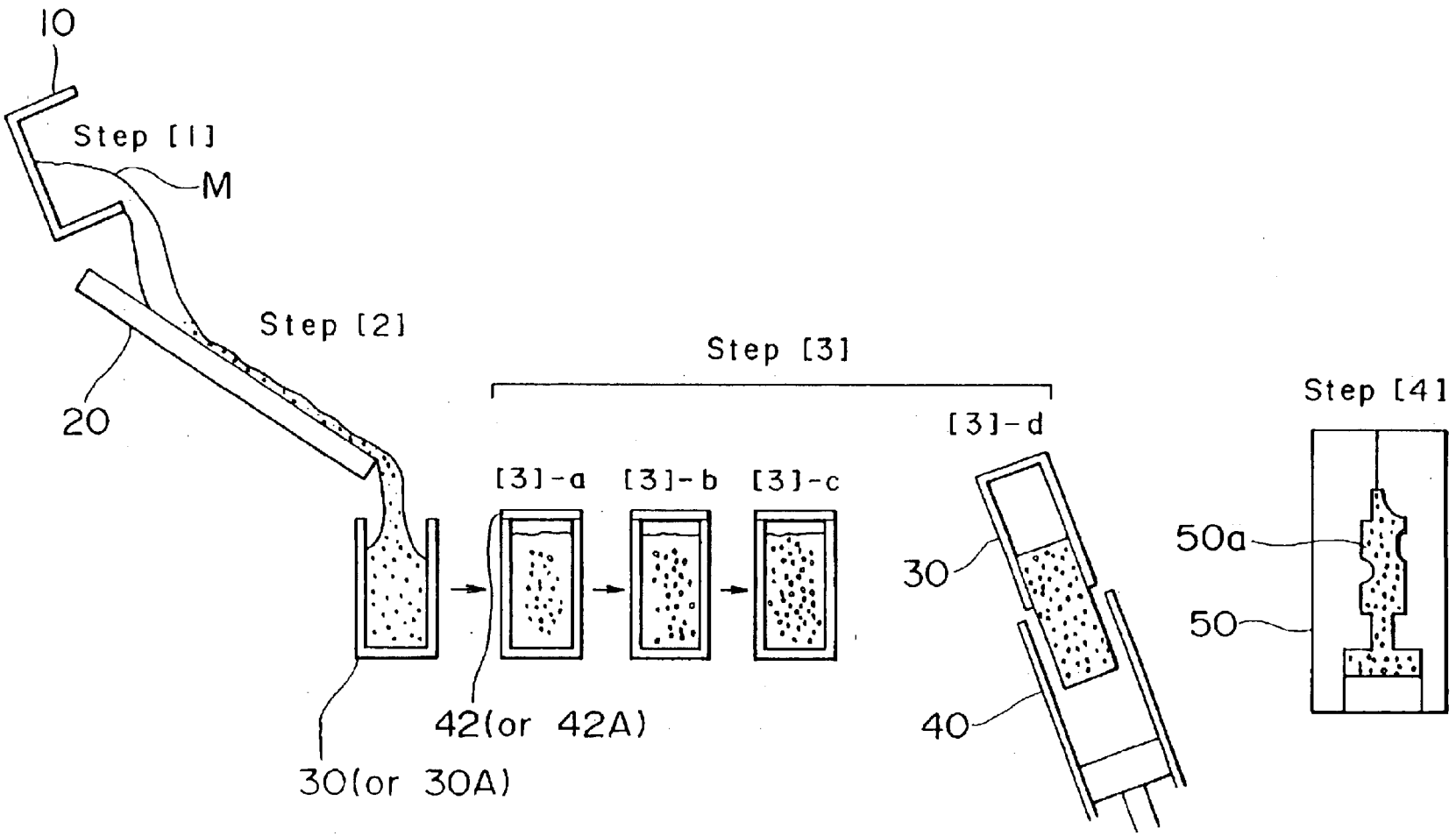
FIG. 54 is a schematic diagram which shows a process flow starting with the generation of spherical primary crystals and ending with the molding step according to the invention (as in the thirteenth embodiment of the present invention)

An example of the invention (as in the thirtieth embodiment of the present invention) will now be described specifically with reference to accompanying drawings. The example was implemented by the same method as in Example 1, except that FIG. 3 was replaced by FIG. 54 and the top surface of the insulated vessel 30 (or 30A) was fitted with a heat insulating lid 42 (or a ceramics coated metallic lid 42A). Thus, FIGS. 1(*a*), 2(*a*), 54 and 4, 5(*a*), 6(*a*) and 7(*a*) concern Example 8, in which: FIG. 1(*a*) is a diagram showing a process sequence for the semisolid forming of a hypoeutectic aluminum alloy having a composition at or above a maximum solubility limit; FIG. 2(*a*) is a diagram showing a process sequence for the semisolid forming of a magnesium or aluminum alloy having a composition within a maximum solubility limit; FIG. 54 shows a process flow starting with the generation of spherical primary crystals and ending with the molding step; FIG. 4 shows diagrammatically the metallographic structures obtained in the respective steps shown in FIG. 54; FIG. 5(*a*) is an equilibrium phase diagram for an Al—Si alloy as a typical aluminum alloy system; FIG. 6(*a*) is an equilibrium phase diagram for a Mg—Al alloy as a typical magnesium alloy system; FIG. 7(*a*) is a diagrammatic representation of a micrograph showing the metallographic structure of a shaped part according to the invention; and FIG. 8 is a diagrammatic representation of a micrograph showing the metallographic structure of a shaped according to the prior art.

The insulated vessel 30 for holding the molten metal the temperature of which has dropped to just below the liquidus line shall have a heat insulating effect in order to ensure that the primary crystals generated will spheroidize and have the desired liquid fraction after the passage of a specified time. Problems, however, will occur in certain cases, such as where near-eutectic Al—Si alloys and others that are prone to form skins are to be held, or where the molten metal is so heavy that it has to be held in a semisolid condition for more than 10 minutes, or where the height to diameter ratio of the insulated vessel 30 exceeds 1:2. Although, there is no problem with the internal microstructure of the molten metal, a solidified layer is prone to grow on the surface of the melt and can potentially cover the top of the semisolid metal, thus, making it difficult to insert the metal into the injection sleeve 40. To deal with this situation, the top of the insulated vessel 30 is fitted with the heat insulating lid 42 in order to ensure against solidification from the surface of the molten metal which is being held within the insulated vessel 30, thereby enabling the metal to be cooled while providing uniformity in temperature throughout the metal.

The constituent material of the insulated vessel 30 and the heat-insulating lid 42 is in no way limited to metals and those which have a heat-retaining property and which yet wet with the melt only poorly are preferred. If a gas-permeable ceramic vessel is to be used as the insulated vessel 30 and the heat-insulating lid 42 for holding magnesium alloys which are easy to oxidize and burn, the exterior to the vessel is preferably filled with a specified atmosphere (e.g., an inert or vacuum atmosphere). For preventing oxidation, it is desired that Be or Ca is preliminarily added to the molten metal. The shape of the insulated vessel 30 and the heat-insulating lid 42 is by no means limited to a tubular or cylindrical form and any other shapes that are suitable for the subsequent forming process maybe adopted. The molten metal need not be poured into the insulated vessel 30 but it may optionally be charged directly into the ceramic injection sleeve 40.

Table 4 shows how the presence or absence of the heat insulating lid 42 affected the procedure of making shaped parts. Comparative Samples 19–22 refer to the case of holding the molten metal without the insulating lid. In Comparative Sample 19, the insulated vessel 30 held the melt of an alloy that was prone to form a skin and, hence, a solidified layer formed over the semisolid metal, making it impossible to recover the metal from the vessel 30. In Comparative Sample 20, it was attempted to have the semisolid metal inserted into the injection sleeve with the molding temperature lowered; in Comparative Sample 22, the metal was unduly heavy.

Hence, in both cases, the holding time was prolonged and the result was substantially the same as with Comparative Sample 1 shown in Table 1. In Comparative Sample 21, the height-to-diameter ratio of the insulated vessel 30 was greater than 1:2 and, hence, the temperature profile through the semisolid metal was so poor that the result was substantially the same as with Comparative Sample 1 shown in Table 1.

Invention Samples 23–26 refer to the case of using the insulated vessel 30 fitted with the heat-insulating lid 42; they showed better results than Comparative Samples 19–22 in the recovery of the semisolid metal.

TABLE 4

| | | | Conditions of the semisolid metal to be shaped | | | | | | | |
|---|---|---|---|---|---|---|---|---|---|---|
| | No. | Alloy | Metal weight (kg) | Diameter-to-height ratio of holding vessel | Insulating lid | Holding time (min) | Molding temperature (° C.) | Temperature profile just before shaping | Handling of semisolid metal | Remarks |
| Comparative Sample | 19 | ADC12 | 2 | 1/2 | Not used | 5 | 571 | X | X | Alloy was prone to form a skin. |
| | 20 | AC4CH | 2 | 1/2 | Not used | 10 | 580 | Δ | Δ | Long holding time |
| | 21 | AC4CH | 2 | 1/4 | Not used | 5 | 585 | Δ | Δ | Holding vessel had large diameter-to-height ratio. |
| | 22 | AC4CH | 20 | 1/2 | Not used | 20 | 585 | X | X | Heavy metal weight, long holding time |
| Invention Sample | 23 | ADC12 | 2 | 1/2 | Used | 5 | 571 | ○ | ○ | Alloy was prone to form a skin. |
| | 24 | AC4CH | 2 | 1/2 | Used | 10 | 580 | ○ | ○ | Long holding time |
| | 25 | AC4CH | 2 | 1/4 | Used | 5 | 585 | ○ | ○ | Holding vessel had large diameter-to-height ratio. |
| | 26 | AC4CH | 20 | 1/2 | Used | 20 | 585 | ○ | ○ | Heavy metal weight, long holding time |

* Cooling Jig (30° C.) was used to induce the generation of crystal nuclei.
* Casting temperature was 20° C. above the liquidus line.
* ADC12: Al—10.6% Si—1.8% Cu—0.8% Fe m.p. 577° C.
* AC4CH: Al—7% Si—0.35% Mg m.p. 615° C.
* Insulated ceramic vessel and lid were chiefly composed of special calcium silicate.
* Temperature profile just before shaping: ○, uniform; Δ, slightly nonuniform; X, nonuniform
* Handling of semisolid metal: ○, easy; Δ, somewhat difficult; X, difficult

Example 9

Figure 55:
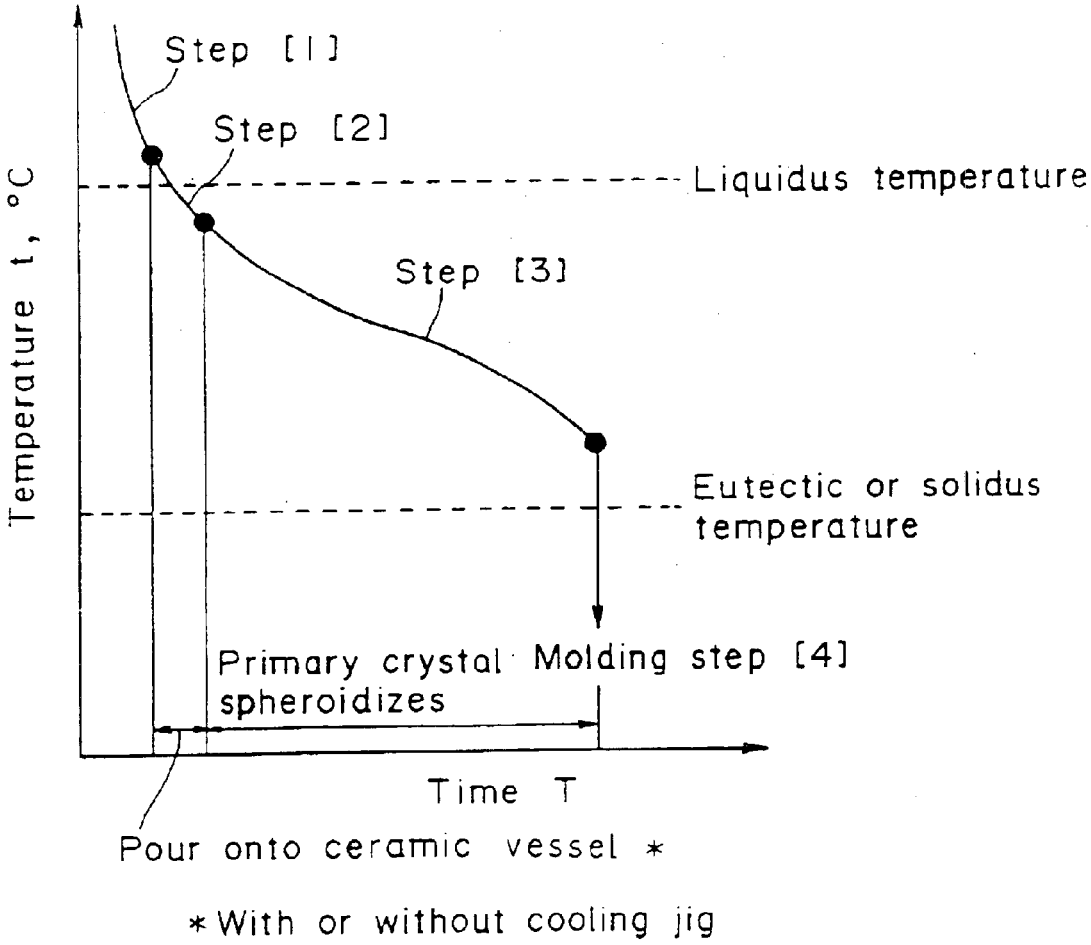
FIG. 55 is a schematic diagram showing a process sequence for the semisolid-forming of a zinc alloy of a hypoeutectic composition according to the invention (as in the thirty-first embodiment of the present invention)
Figure 56:
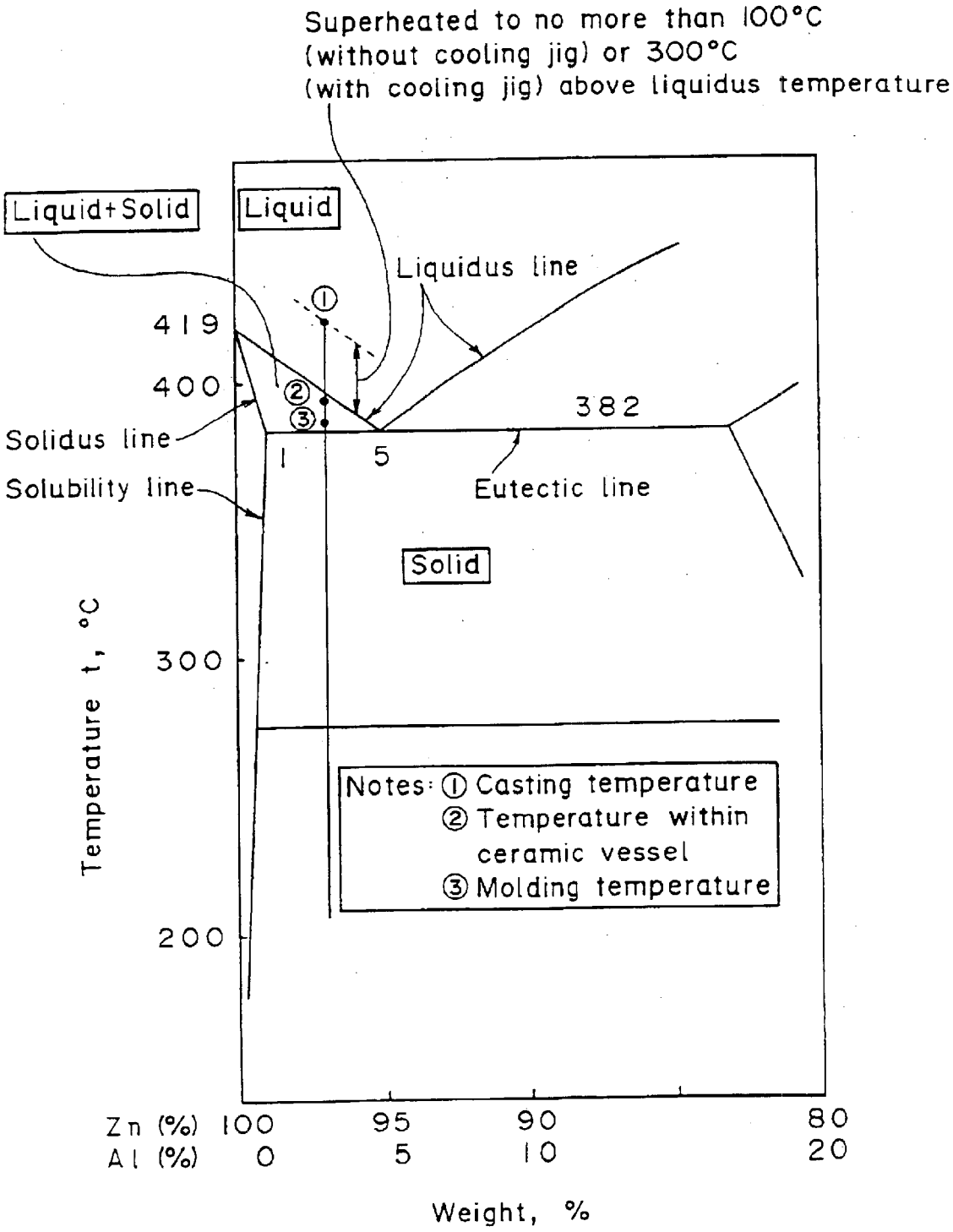
FIG. 56 is an equilibrium phase diagram for a binary Zn—Al alloy as a typical zinc alloy system according to the invention (as in the thirty-first embodiment of the present invention)
Figure 57:
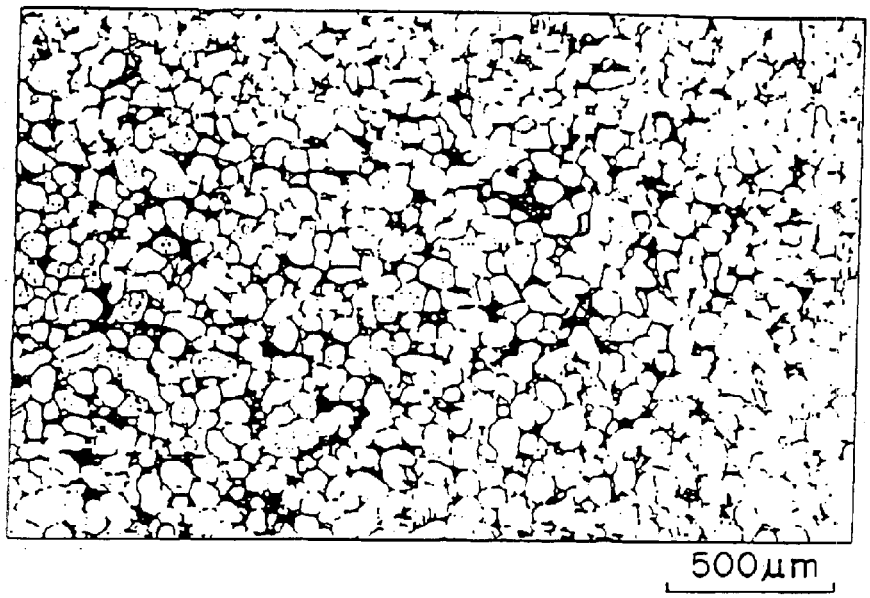
FIG. 57 is a diagrammatic representation of a micrograph showing the metallographic structure of a shaped part according to the invention (as in the thirty-first embodiment of the present invention)
Figure 58:
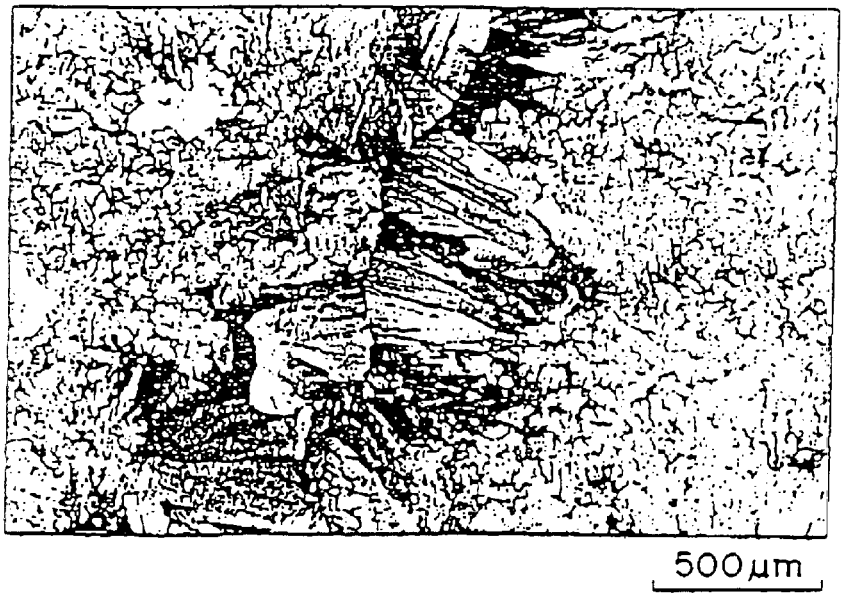
FIG. 58 Prior Art
FIG. 58 is a diagrammatic representation of micrograph showing the metallographic structure of a shaped part according to the prior art (for comparison with the thirty-first embodiment of the present invention)

An example of the invention (as in the thirty-first embodiment of the present invention will now be described with reference to accompanying FIGS. 3(*a*), 4 and 55–58, in which: FIG. 55 is a diagram showing a process sequence for the semisolid forming of a zinc alloy of a hypoeutectic composition; FIG. 3(*a*) shows a process flow starting with the generation of spherical primary crystals and ending with the molding step; FIG. 4 shows diagrammatically the metallographic structures obtained in the respective steps shown in FIG. 3(*a*); FIG. 56 is an equilibrium phase diagram for a binary Zn-Al alloy as a typical zinc alloy system; FIG. 57 is a diagrammatic representation of a micrograph showing the metallographic structure of a shaped part according to the invention; and FIG. 58 is a diagrammatic representation of a micrograph showing the metallographic structure of a shaped part according to the prior art.

As shown in FIGS. 55 and 56, the first step of the process according to the invention comprises:

(1) holding the melt of a hypoeutectic zinc alloy superheated to less than 300° C. above the liquidus temperature and contacting the melt with a surface of a jig at a lower temperature than its melting point so as to generate crystal nuclei; or alternatively, (2) holding the melt of a zinc alloy superheated to less than 100° C. above the liquidus temperature.

The cooled molten alloy prepared in (1) is poured into an insulated vessel having a heat insulating effect and, in the case of (2), the melt is directly poured into the insulated vessel without being cooled with a jig. The melt is held within the insulated vessel for a period from 5 seconds to 60 minutes at a temperature not higher than the liquidus temperature but higher than the eutectic or solidus temperature, whereby a large number of fine spherical primary crystals are generated in the alloy, which is then shaped at a specified liquid fraction.

The term "a specified liquid fraction" means a relative proportion of the liquid phase which is suitable for pressure forming. In high-pressure casting operations such as die casting and squeeze casting, the liquid fraction ranges from 20% to 90%, preferably from 30% to 70%. If the liquid fraction is less than 30%, the formability of the raw material is poor; above 70%, the raw material is so soft that it is not only difficult to handle but also less likely to produce a homogeneous micro-structure. In extruding and forging operations, the liquid fraction ranges from 0.1% to 70%, preferably from 0.1% to 50%, beyond which an inhomogeneous structure can potentially occur.

The "insulated vessel" as used in the invention is a metallic or nonmetallic vessel, or a metallic vessel having a surface coated with a nonmetallic material or a semiconductor, or a metallic vessel compounded of a nonmetallic material or semiconductor, which vessels are adapted to be either heatable or coolable from either inside or outside.

The specific procedure of semisolid metal forming performed in Example 9 is essentially the same as described in Example 1.

The casting, spheroidizing and molding conditions that are respectively set for the steps shown in FIG. 3(*a*), namely, the step of pouring the molten metal on to the cooling jig 20, the step of generating and spheroidizing primary crystals and the forming step are the same as set forth in Example 1. The criticality of the numerical limitations in the second and ninth embodiments of the present invention is also the same as set forth in Example 1.

It should be noted here that zinc alloys are prone to form equiaxed crystals and, hence, provide comparative ease inproducing fine spherical primary crystals without using the cooling jig 20. With such zinc alloys, the degree of superheating is adjusted to less than 100° C. above the liquidus line in order to ensure that the alloy poured into the insulated vessel 30 having a heat-insulating effect is rendered either liquid to have crystal nuclei or partially solid, partially liquid to have crystal nuclei at a temperature equal to or higher than the molding temperature. If the temperature of the melt as poured into the insulated vessel 30 is unduly high, the crystal nuclei once generated will dissolve again or coarse primary crystals will form and, in either case, it is impossible to produce the desired semisolid structure. In addition, so much time will be taken for the temperature of the melt to decrease to establish a specified fraction liquid that the operating efficiency becomes low. Another inconvenience is that the poured melt M is oxidized or burnt at the surface.

Table 5 shows the conditions of various samples of semisolid metal to be shaped, as well as the qualities of shaped parts. As shown in FIG. 3(*a*), the shaping operation consisted of inserting the semisolid metal into an injection sleeve and subsequent forming an a on a squeeze casting machine. The forming conditions were as follows: pressure, 95 kgf/cm$^2$; injection speed, 1.0 m/s; mold temperature, 200° C. The product shaped parts were flat plates 100 mm wide and 200 mm long, with the thickness varying at 2 mm, 5 mm and 10 mm in the longitudinal direction.

TABLE 5

| | | | Conditions of the semisolid metal to be shaped | | | | | |
|---|---|---|---|---|---|---|---|---|
| | No. | Alloy Composition | Casting temperature (° C.) | Cooling jig | Temperature of the cooling jig (° C.) | Temperature of the metal within vessel (° C.) | Holding time (min) | Fraction liquid just before shaping (%) |
| Invention Sample | 1 | Zn—2.5% Al | 430 | Used | 36 | 397 | 6 | 60 |
| | 2 | Zn—2.5% Al | 429 | Used | 45 | 398 | 9 | 50 |
| | 3 | Zn—2.5% Al | 440 | Used | 48 | 398 | 12 | 40 |
| | 4 | Zn—4% Al | 425 | Used | 38 | 389 | 8 | 50 |
| | 5 | Zn—2.5% Al | 410 | Not used | — | 400 | 8 | 50 |
| | 6 | Zn—4% Al | 400 | Not used | — | 391 | 7 | 50 |
| | 7 | Zn—2.5% Al | 430 | Not used | — | 407 | 11 | 50 |
| | 8 | Zn—2.5% Al | 680 | Used | 27 | 399 | 9 | 50 |
| Comparative Sample | 9 | Zn—2.5% Al | 440 | Used | 410 | 408 | 10 | 50 |
| | 10 | Zn—4% Al | 700 | Used | 34 | 434 | 19 | 50 |
| | 11 | Zn—2.5% Al | 430 | Used | 37 | 398 | 65 | 15 |
| | 12 | Zn—2.5% Al | 430 | Used | 42 | 399 | 0.03 | 91 |
| | 13 | Zn—2.5% Al | 430 | Used | 35 | 398 | 1.33 | 50 |

| | | | Quality of shaped part | | | | |
|---|---|---|---|---|---|---|---|
| | No. | Alloy Composition | Internal segregation | Primary crystal size (μm) | Amount of unspherical primary crystal | External appearance | Remarks |

TABLE 5-continued

| | | | | | | | | |
|---|---|---|---|---|---|---|---|---|
| Invention Sample | 1 | Zn—2.5% Al | ○ | 135 | | ○ | ○ | |
| | 2 | Zn—2.5% Al | ○ | 150 | | ○ | ○ | |
| | 3 | Zn—2.5% Al | ○ | 160 | | ○ | ○ | |
| | 4 | Zn—4% Al | ○ | 130 | | ○ | ○ | |
| | 5 | Zn—2.5% Al | ○ | 190 | | ○ | ○ | |
| | 6 | Zn—4% Al | ○ | 175 | | ○ | ○ | |
| | 7 | Zn—2.5% Al | ○ | 135 | | ○ | ○ | Vibrations (100 Hz) were applied at amplitude of 0.1 mm. |
| | 8 | Zn—2.5% Al | ○ | 125 | | ○ | ○ | Water-cooled cooling jig was used. |
| Comparative Sample | 9 | Zn—2.5% Al | X | 410 | | ○ | Δ | High jig temperature |
| | 10 | Zn—4% Al | X | 660 | | X | X | High casting temperature |
| | 11 | Zn—2.5% Al | ○ | 320 | | ○ | X | Long holding time |
| | 12 | Zn—2.5% Al | X | | *1 | | Δ | Short holding time, high fraction liquid |
| | 13 | Zn—2.5% Al | X | | *2 | | Δ | Metallic (non-insulated) vessel was used at ordinary temperature. |

Zn—2.5% Al m.p. 400° C.
Zn—4% Al m.p. 390° C.
*1 Dendritic primary crystals
*2 Spherical primary crystals plus dendrites
Segregations: ○, a few: X, many
Amount of unspherical primary crystals: ○, small; X, large
External appearance: ○, good; Δ, fair; X, poor In Comparative Sample 9, the temperature of jig 20 with which the melt M was contacted was so high that the number of crystal nuclei generated was insufficient to produce fine spherical primary crystals; instead, coarse nonspherical primary crystals formed. In Comparative Sample 10, the casting temperature was so high that very few crystal nuclei remained within the ceramic vessel 30, yielding the same result as with Comparative Sample 9. In Comparative Sample 11, the holding time was so long that the liquid fraction in the metal to be shaped was low, yielding a shaped part of poor appearance. In addition, the size of primary crystals was undesirably large. In Comparative Sample 12, the holding time within the ceramic vessel 30 was short whereas the liquid fraction in the metal to be shaped was high; hence, many segregations of components occurred within the shaped part as shown in FIG. 58. With Comparative Sample 13, the insulated vessel 30 was a metallic container having a very small heat insulating effect, so the dendritic solidified layer forming on the inner surface of the vessel 30 would enter the spherical primary crystals generated in the central part of the vessel, yielding an inhomogeneous structure involving segregations.

In each of Invention Samples 1–8, a homogeneous microstructure comprising fine (<200 μm) spherical primary crystal was obtained to enable the production of a shaped part having good appearance.

Example 10

Figure 59:
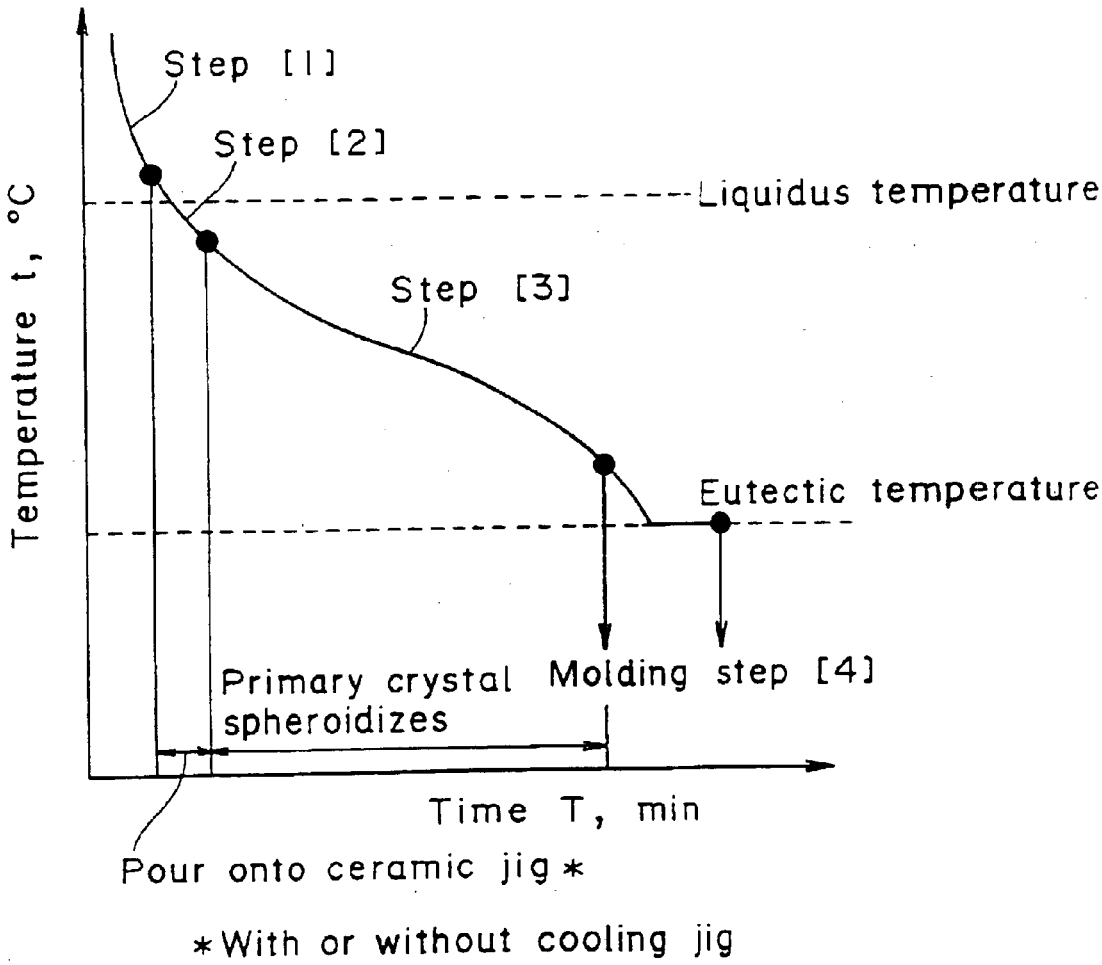
FIG. 59 is a schematic diagram showing a process sequence for the semisolid forming of a hypereutectic Al—Si alloy according to an example of the invention (as in the thirty-second embodiment of the present invention)
Figure 60:
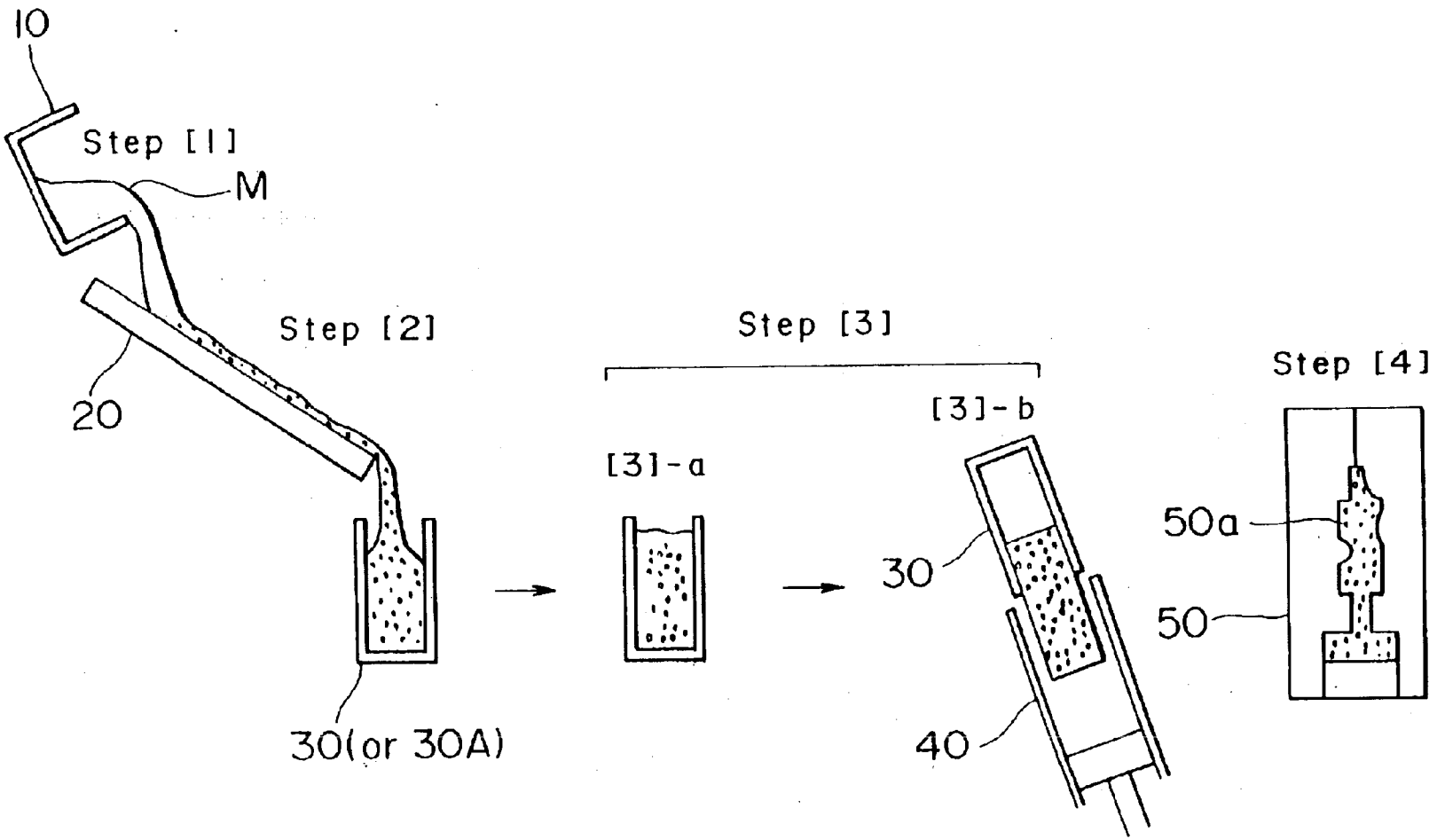
FIG. 60 is a schematic diagram which shows a process flow starting with the generation of spherical primary crystals and ending with the molding step according to the example shown in FIG. 59.
Figure 61:
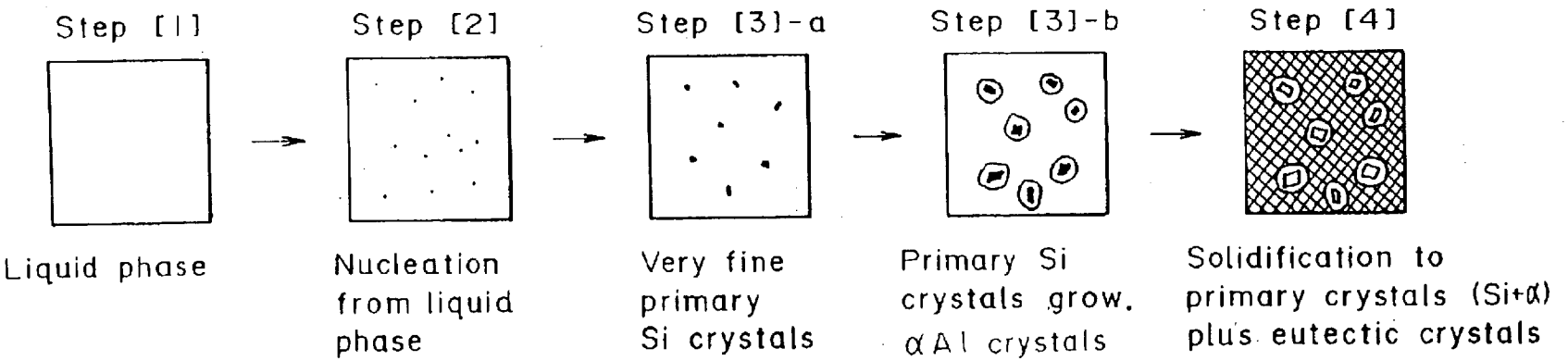
FIG. 61 is a schematic diagram which shows the metallographic structures obtained in the respective steps shown in FIG. 60.
Figure 62:
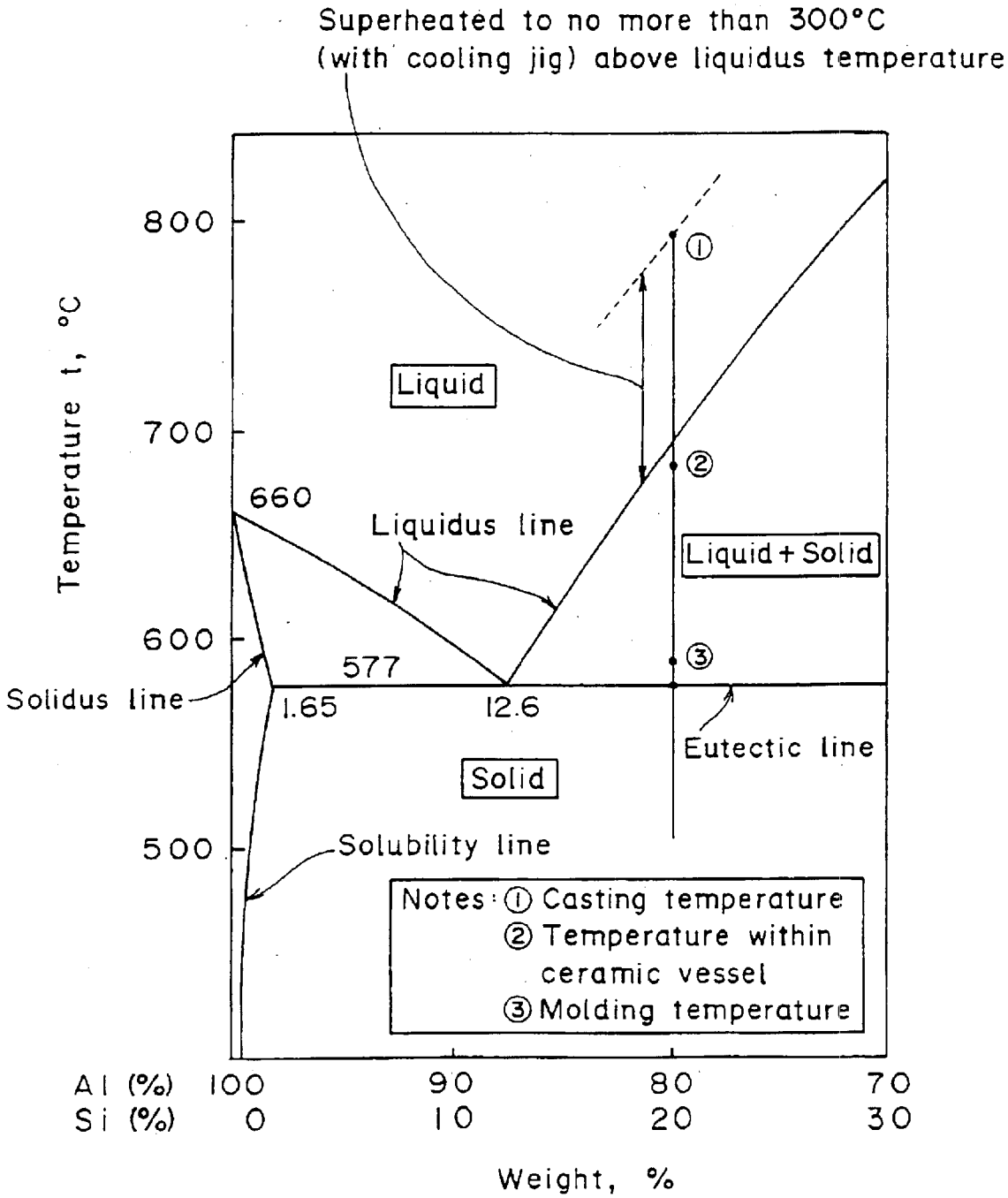
FIG. 62 is an equilibrium phase diagram for a binary Al—Si alloy according to another example of the invention (as in the thirty-second embodiment of the present invention)
Figure 63:
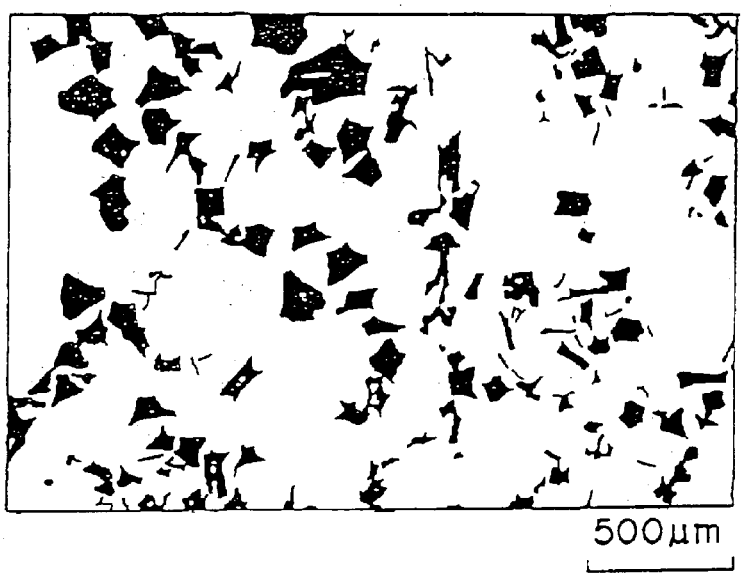
FIG. 63 is a diagrammatic representation of a micrograph showing the metallographic structure of a shaped part according to the thirty-second embodiment of the present invention.
Figure 64:
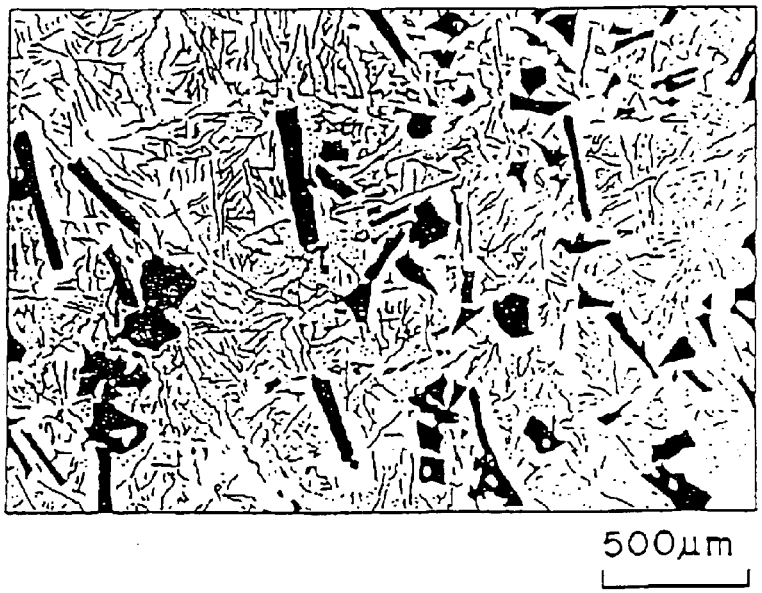
FIG. 64 Prior Art
FIG. 64 is a diagrammatic representation of a micrograph showing the metallographic structure-of a shaped part according to the prior art (form comparison with the thirty-first embodiment of the present invention)

An example of the invention (as in the thirty-second embodiment of the present invention) will now be described with reference to accompanying FIGS. 59–64, in which: FIG. 59 is a diagram showing a process sequence for the semisolid forming of a hypereutectic Al—Si alloy starting with the preparation of a semisolid metal and ending with the molding step; FIG. 60 is a diagram showing a process flow starting with the generation of very fine primary Si crystals and ending with the molding step; FIG. 61 shows diagrammatically the metallographic structures obtained in the respective steps shown in FIG. 60; FIG. 62 is an equilibrium phase diagram for a binary Al—Si alloy; FIG. 63 is a diagrammatic representation of a micrograph showing the metallographic structure of a shaped part according to the invention; and FIG. 64 is a diagrammatic representation of a micrograph showing the metallographic structure of a shaped part according to the prior art.

As shown in FIGS. 59 and 62, the process of the invention starts with superheating the melt of a hypereutectic Al—Si alloy to less than 300° C. above the liquidus line. The thus superheated alloy is contacted with a jig at lower temperature than its melting point so as to generate crystal nuclei within the alloy solution; the alloy is then cooled in an insulated vessel until a specified liquid fraction is established, with it being held either at a temperature between the liquidus and eutectic temperatures or at the eutectic temperature for a period from 5 seconds to 60 minutes, thereby generating a large number of fine primary crystals. The hypereutectic Al—Si alloy permits only a small amount of primary crystals to be crystallized and, hence, it has high liquid fraction in a semisolid condition at temperatures exceeding the eutectic point. Therefore, if the desired liquid fraction is low, the alloy which has been heated to its eutectic temperature has to be held at that temperature for a sufficient time to allow for the progress of solidification (eutectic reaction).

According to the invention, semisolid metal forming will proceed by the following specific procedure. In step (1) of the process shown in FIGS. 60 and 61, a complete liquid form of metal M is contained in a ladle 10. In step (2), the metal is cooled with a jig 20 to generate crystal nuclei and the melt is then poured into a ceramic vessel 30 (or ceramics-coated vessel 30A) having a heat insulating effect so as to produce an alloy having a large number of crystal nuclei which is of a composition just below the liquidus line. In subsequent step (3), the alloy is held partially molten within the insulated vessel 30 (or 30A). In the meantime, very-fine primary Si crystals result from the introduced crystal nuclei [step (3)-a] and grow into granules together with the surrounding primary a as the fraction solid increases.

Metal M thus obtained at a specified liquid fraction maybe inserted into a die casting injection sleeve 40 [step (3)-b] and thereafter pressure formed within a mold cavity 50*a* in a die casting machine to produce a shaped part [step (4)].

The semisolid metal forming process of the invention shown in FIGS. 59, 60 and 61 has obvious differences from the conventional thixocasting and rheocasting methods. In the invention method, the primary crystals that have been crystallized within a temperature range for the semisolid state are not ground into spherical grains by mechanical or electromagnetic agitation as in the prior art but the large number of primary crystals that have been crystallized and grown from the introduced crystal nuclei with the decreasing temperature in the range for the semisolid state and with the lapse of the time of holding at the eutectic point are continuously rendered granular by the heat of the alloy itself (which may optionally be supplied with external heat and held at a desired temperature). In addition, the semisolid metal forming method of the invention is very convenient since it does not involve the step of partially melting billets by reheating in the thixocasting process.

The casting, spheroidizing and molding conditions that are respectively set for the steps shown in FIG. 59, namely, the step of pouring the molten metal on to the cooling jig 20 and the step of generating and spheroidizing primary crystals, are set forth below more specifically. Also discussed below is the criticality of the numerical limitations in the thirty-second embodiment of the present invention.

If the casting temperature is at least 300° C. higher than the melting point or if the surface temperature of jig 20 is not lower than the melting point, the following phenomena will occur:

(1) only a few crystal nuclei are generated;

(2) the temperature of the melt M as poured into the insulated vessel having a heat insulating effect is higher than the liquidus temperature and, hence, the proportion of the remaining crystal nuclei is low enough to produce large primary crystals.

To avoid these problems, the casting temperature to be employed in the invention is controlled to be such that the degree of superheating above the liquidus line is less than 300° C. whereas the surface temperature of jig 20 is controlled to be lower than the melting point of alloy M. Primary crystals of an even finer size can be produced by ensuring that the degree of superheating above the liquidus line i's less than 100° C. and by adjusting the surface temperature of jig 20 to be at least 50° C. lower than the melting point of alloy M. It should, however, be noted that in the presence of P as a refiner of primary Si crystals, the molten metal should be superheated to at least 30° C. above the liquidus line; if the temperature of the melt is unduly low, the grains of Al P serving as a refiner will agglomerate to become no longer effective.

In order to ensure that the alloy solution at a specified fraction liquid will form a modified eutectic structure after solidification, thereby providing satisfactory mechanical properties, either Sr or Na or both are added. If the P addition is less than 0.005%, it is not very effective in refining the primary Si crystals; the effect of P is saturated at 0.03% and no further improvement is expected beyond 0.03%. Hence, the P addition is controlled to lie between 0.005% and 0.03%. If the Sr addition is less than 0.005%, it is not very effective in modifying the eutectic Si structures; beyond 0.03%, an Al—Si—Sr compound will crystalize out to cause deterioration in the mechanical properties of the alloy. Hence, the Sr addition is controlled to lie between 0.005% and 0.03%. If the Na addition is less than 0.001%, it is not very effective in modifying the eutectic Si structures; beyond 0.01%, coarse eutectic Si grains will form. Hence, the Na addition is controlled to lie between 0.001% and 0.01%.

Table 6 sets forth the conditions for the preparation of semisolid metal samples and the results of evaluation of their metallographic structures by microscopic examination.

TABLE 6

| | | Alloy composition | | | | Casting | | Temperature of the | Temperature of the metal | Holding | Internal | Average size of primary | |
|---|---|---|---|---|---|---|---|---|---|---|---|---|---|
| | | Si | Additive | | | temperature | Cooling | cooling | within | time | segregation | crystals | |
| | No. | (%) | P | Sr | Na | (° C.) | jig | jig (° C.) | vessel (° C.) | (min) | | (μm) | Remarks |
| Invention Sample | 1 | 20 | No | No | No | 750 | Used | 35 | 678 | 7 | ○ | 140 | |
| | 2 | 20 | Yes | No | No | 750 | Used | 35 | 680 | 7 | ○ | 40 | |
| | 3 | 20 | Yes | Yes | No | 750 | Used | 50 | 683 | 7 | ○ | 55 | |
| | 4 | 20 | Yes | No | Yes | 750 | Used | 40 | 678 | 7 | ○ | 60 | |
| | 5 | 20 | Yes | Yes | No | 730 | Used | 35 | 685 | 10 | ○ | 40 | Vibrations (100 Hz) were applied at amplitude of 0.1 mm. |
| | 6 | 20 | Yes | Yes | No | 850 | Used | 30 | 682 | 7 | ○ | 60 | Water-cooled cooling jig was used. |
| Comparative Sample | 7 | 20 | Yes | Yes | No | 750 | Used | 650 | 715 | 16 | X | 250 | High jig temperature |
| | 8 | 15 | Yes | No | No | 950 | Used | 35 | 730 | 19 | X | 200 | High casting temperature |
| | 9 | 20 | Yes | No | Yes | 750 | Used | 40 | 678 | 70 | ○ | 400 | Long holding time, low fraction liquid |
| | 10 | 20 | Yes | No | Yes | 750 | Used | 40 | 681 | 0.03 | X | 60 | Short holding time, high fraction liquid |
| | 11 | 20 | Yes | Yes | No | 750 | Not used | — | 710 | — | X | 210 | Conventional gravity casting was performed. |

Al—20% Si m.p. 692° C.
Al—15% Si m.p. 620° C.
Segregations: ○, a few; X, many

In Comparative Sample 7, the temperature of jig 20 with which the melt M was contacted was so high that the number of crystal nuclei generated was insufficient to produce fine primary crystals; instead, coarse primary crystals formed. In Comparative Sample 8, the casting temperature was so high that very few crystal nuclei remained within the ceramic vessel 30, yielding the same result as with Comparative Sample 7. In Comparative Sample 9, the holding time was so long that the liquid fraction in the metal to be shaped was low, making the alloy unsuitable for shaping. In addition, the size of primary crystals was undesirably large. In Comparative Sample 10, the holding time within the ceramic vessel 30 was short whereas the liquid fraction in the metal to be shaped was high; hence, many segregations of components occurred within the shaped part. In Comparative Sample 11, solidification occurred within the insulated vessel and many coarse primary crystals were generated in the form of a rectangular rod (see FIG. 64).

In each of Invention Samples 1–6, there was obtained a homogeneous microstructure having fine (<ca. 150 μm) granular primary crystals that were adapted for pressure forming.

Example 11

Figure 65:
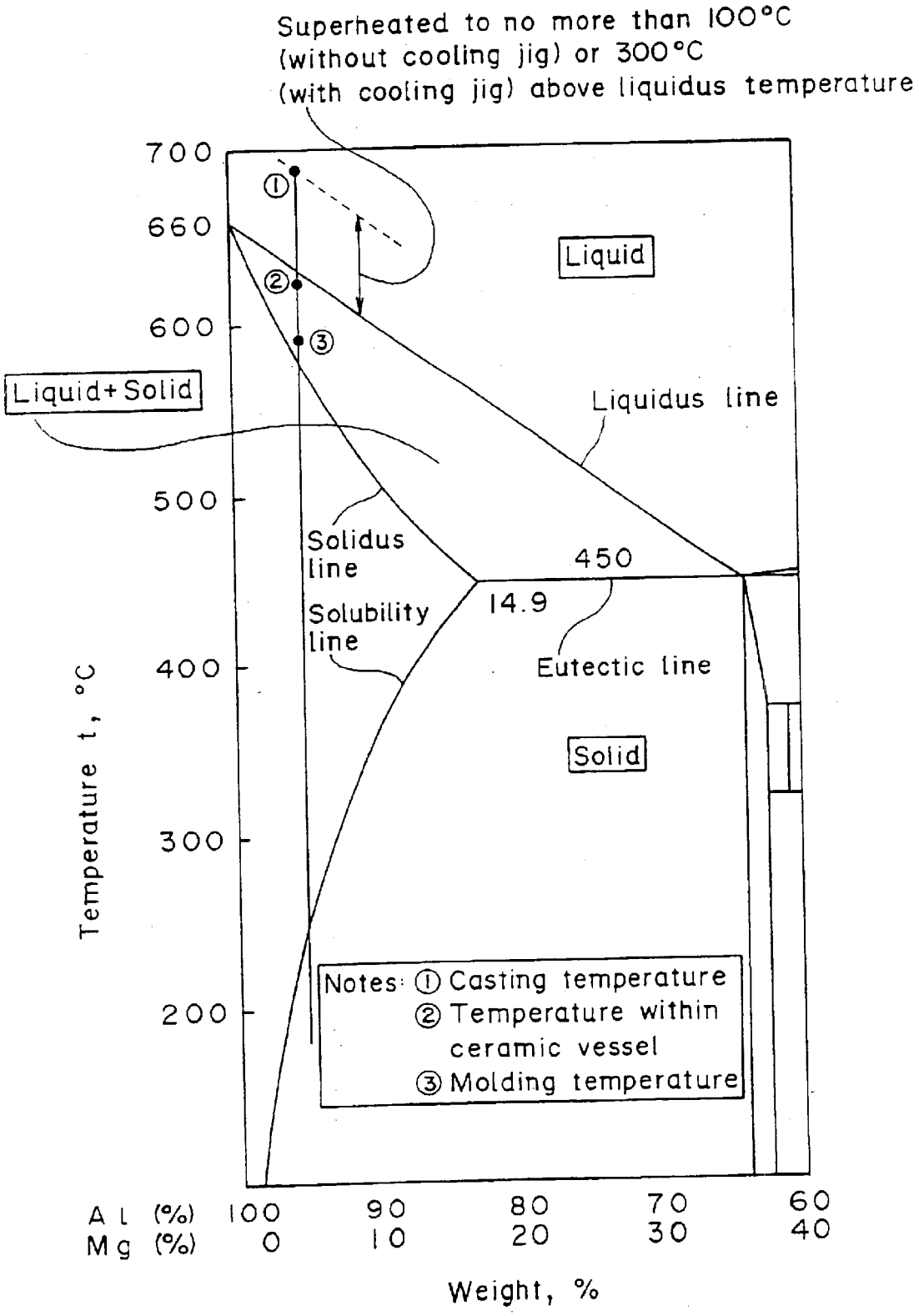
FIG. 65 is an equilibrium phase diagram for a binary Al—Mg alloy according to the invention (as in the thirty-third embodiment of the present invention)
Figure 66:
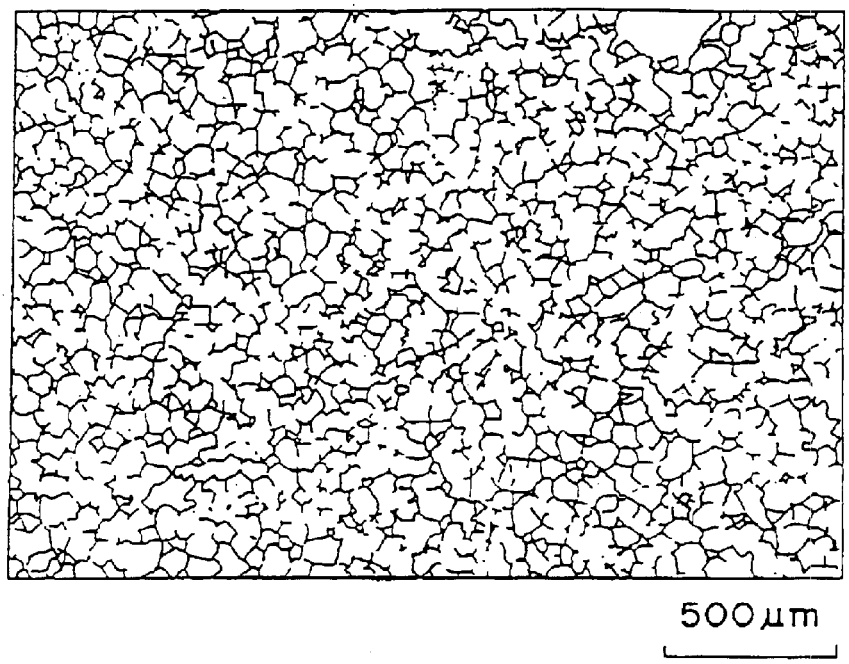
FIG. 66 is a diagrammatic representation of a micrograph showing the metallographic structure of a shaped part according to an example of the invention (as in the thirty-third embodiment of the present invention)
Figure 67:
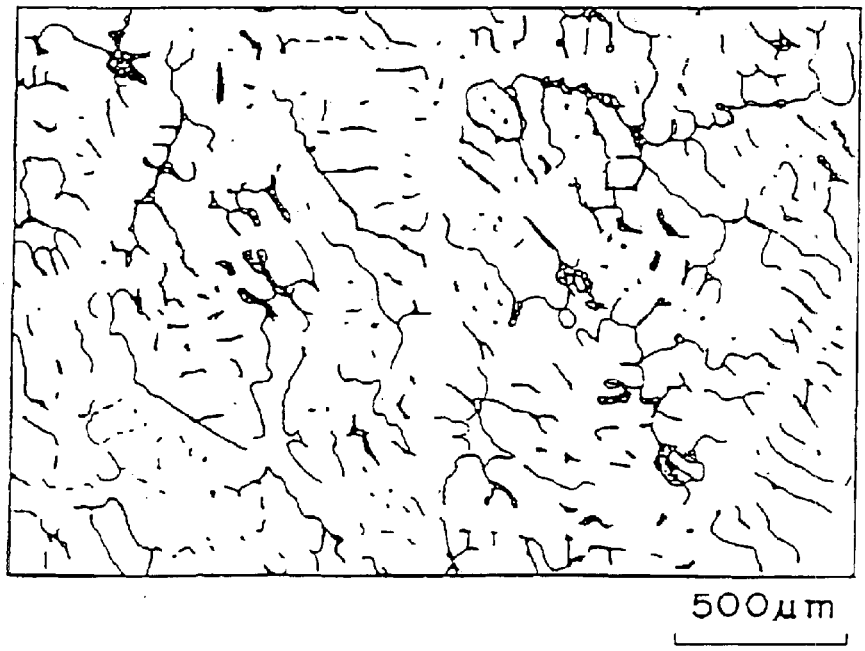
FIG. 67 Prior Art
FIG. 67 is a diagrammatic representation of a micrograph showing the metallographic structure of a shaped part according to the prior art (for comparison with the thirty-third embodiment of the present invention)

An example of the invention (as in the thirty-third embodiment of the present invention will now be described in detail with reference to FIGS. 1(*a*), 3(*a*), 4 and 65–67, in which: FIG. 1(*a*) is a diagram showing a process sequence for the semisolid forming of an Al—Mg alloy; FIG. 3 shows a process flow starting with the generation of granular primary crystals and ending with the molding step; FIG. 4 shows diagrammatically the metallographic structures obtained in the respective steps shown in FIG. 3; FIG. 65 is an equilibrium phase diagram for a binary Al—Mg alloy; FIG. 66 is a diagrammatic representation of a micrograph showing the metallographic structure of a shaped part according to the invention; and FIG. 67 is a diagrammatic representation of a micrograph showing the metallographic structure of a shaped part according to the prior art.

As shown in FIGS. 1(*a*) and 65, the invention recited in the thirty-third embodiment of the present invention is such that:

(1) the melt of an Al—Mg alloy held superheated to less than 300° C. above the liquidus line is contacted with a jig at a lower temperature than its melting point, thereby generating crystal nuclei in the alloy solution, and the molten metal is poured into an insulated vessel having a heat insulating effect; or (2) the melt of an Al—Mg alloy that contains an element to promote the generation of crystal nuclei and that is held superheated to less than 100° C. above the liquidus temperature is directly poured into the insulated vessel without cooling the melt with a jig.

The poured metal is held within the insulated vessel at a temperature not higher than the liquidus temperature but higher than the eutectic or solidus temperature for a period from 5 seconds to 60 minutes until a specified liquid fraction is established, whereby a large number of fine granular primary crystals are generated to produce a semisolid Al—Mg alloy at the specified fraction liquid.

The specific procedure of semisolid metal forming to be performed in Example 11 is essentially the same as described in Example 1.

Silicon (Si) is added in order to promote the spheroidization of the generated granular primary crystals. If the Si addition is less than 0.3%, the intended effect in promoting the spheroidization is not expected; adding more than 2.5% of Si will merely result in deteriorated properties of the alloy and no further improvement in spheroidization is expected. Hence, the Si addition is controlled to Lie between 0.3% and 2.5%.

It should be noted that the Al—Mg alloy of the invention may incorporate up to 1% of Mn or up to 0.5% of Cu with a view to improving its strength.

Table 7 sets forth the conditions for the preparation of semisolid metal samples and the results of evaluation of their metallographic structures by microscopic examination.

TABLE 7

| | No. | Alloy composition | Casting temperature (° C.) | Cooling jig | Temperature of the cooling jig (° C.) | Temperature of the metal within vessel (° C.) | Holding time (min) | Internal segregation | Average size of primary crystals (μm) | Remarks |
|---|---|---|---|---|---|---|---|---|---|---|
| Invention Sample | 1 | Al—5% Mg | 660 | Used | 35 | 634 | 4 | ○ | 105 | |
| | 2 | Al—5% Mg | 660 | Used | 45 | 635 | 4 | ○ | 75 | With the addition of 0.015% Ti and 0.003% B |
| | 3 | Al—5% Mg—2.5% Si | 650 | Used | 35 | 624 | 4 | ○ | 80 | With the addition of 0.015% Ti and 0.003% B; m.p. 626° C. |
| | 4 | Al—10% Mg | 630 | Used | 45 | 605 | 4 | ○ | 95 | |
| | 5 | Al—5% Mg | 640 | Not used | — | 625 | 4 | ○ | 100 | With the addition of 0.1% Ti and 0.01% B |
| | 6 | Al—10% Mg | 610 | Not used | — | 597 | 3 | ○ | 95 | With the addition of 0.1% Ti and 0.01% B |
| | 7 | Al—5% Mg | 660 | Used | 30 | 635 | 4 | ○ | 105 | Vibrations (100 Hz) were applied at amplitude of 0.1 mm. |
| | 8 | Al—5% Mg | 660 | Used | 27 | 633 | 4 | ○ | 80 | Water-cooled cooling jig was used. |
| Comparative Sample | 9 | Al—5% Mg | 660 | Used | 650 | 640 | 8 | X | 450 | High jig temperature |
| | 10 | Al—10% Mg | 950 | Used | 35 | 675 | 14 | X | 500 | High casting temperature |
| | 11 | Al—5% Mg | 660 | Used | 40 | 635 | 70 | ○ | 320 | Long holding time |
| | 12 | Al—5% Mg | 660 | Used | 40 | 635 | 0.03 | X | 70 | Short holding time, high fraction liquid |
| | 13 | Al—5% Mg | 680 | Not used | — | 650 | — | X | 500 | Metallic (non-insulated) vessel was used at ordinary temperature. |

Al—5% Mg m.p. 631° C.
Al—10% Mg m.p. 602° C.
*1 Dendritic primary crystals
*2 Granular primary crystals plus dendrities
Internal segregations: ○, a few; X, many In Comparative Sample 9, the temperature of jig 20 with which the melt M was contacted was so high that the number of crystal nuclei generated was insufficient to produce fine primary crystals; instead, coarse primary crystals formed. In Comparative Sample 10, the casting temperature was so high that very few crystal nuclei remained within the ceramic vessel 30, yielding the same result as with Comparative Sample 9. In Comparative Sample 11, the holding time was so long that the liquid fraction in the metal to be shaped was low, making the alloy unsuitable for shaping. In addition, the size of primary crystals was undesirably large. In Comparative Sample 12, the holding time within the ceramic vessel 30 was short whereas the liquid fraction in the metal to be shaped was high; hence, only coarse primary crystals formed. In addition, the high liquid fraction caused many segregations of components within the shaped part. In Comparative Sample 13, the hot molten metal was directly poured into the insulated vessel, where it was solidified as such, yielding coarse, dendritic primary crystals (see FIG. 67) In each of Invention Sample 1–8, there was obtained a homogeneous microstructure having fine (<ca. 100 $\mu$m) granular primary crystals that were adapted for pressure forming.

Example 12

Figure 68:
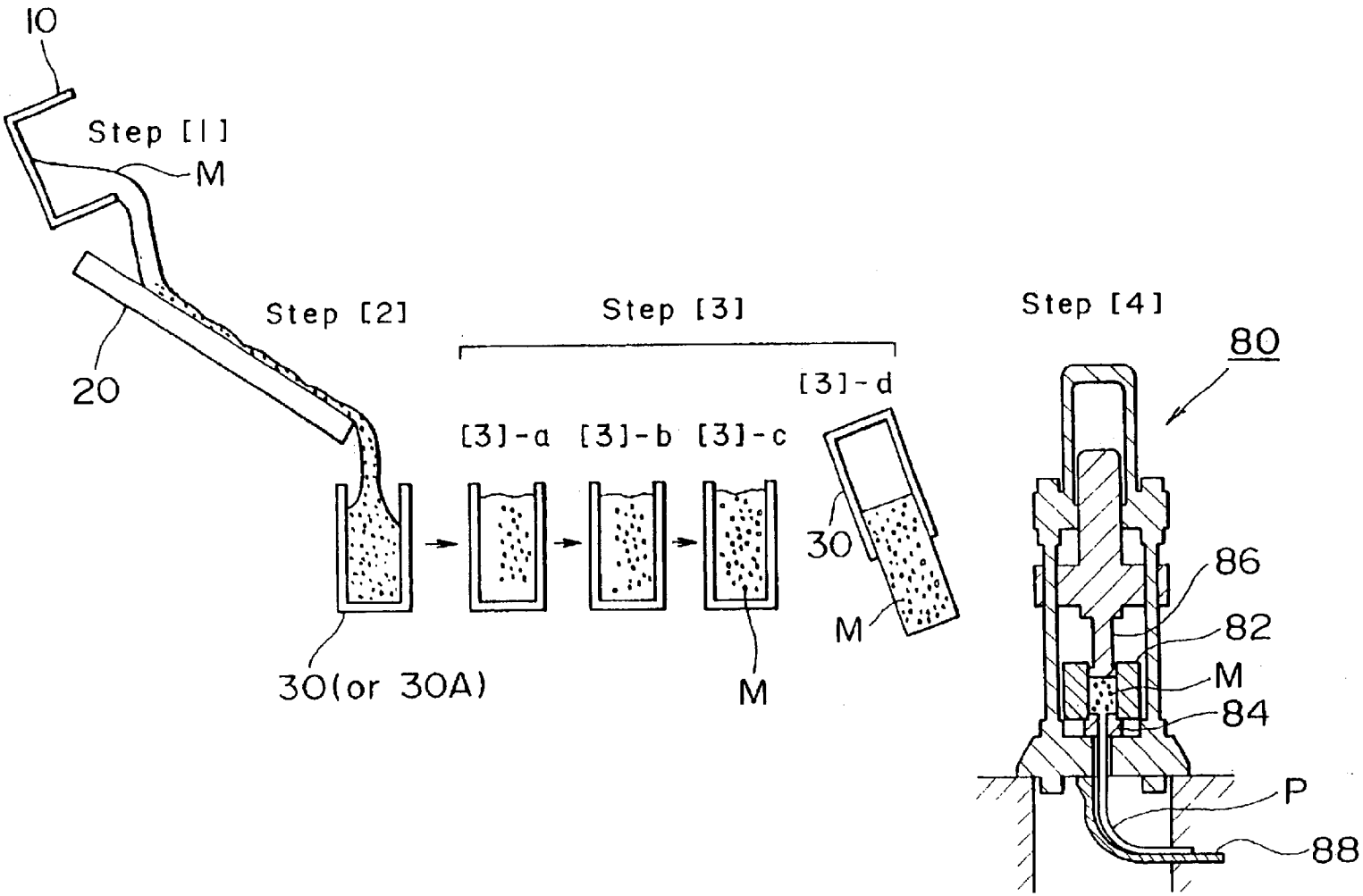
FIG. 68 is a schematic diagram which shows process flow starting with the generation of spherical primary crystals and ending with the molding step according to an example of the invention (as in the thirty-fourth and thirty-fifth embodiments of the present invention)

An example of the invention (as in the thirty-fourth to thirty-fifth embodiments of the present invention) will now be described in detail with reference to accompanying FIGS. 1(*a*), 2(*a*), 68 and 4, 5(*a*), 6(*a*), 7(*a*), 8(*a*), in which: FIG. 1(*a*) is a diagram showing a process for the semisolid forming of a hypoeutectic aluminum alloy having a composition at or above a maximum solubility limit; FIG. 2(*a*) is a diagram showing a process sequence for the semisolid forming of a magnesium or aluminum alloy having a composition within a maximum solubility limit; FIGS. 68(*a*) and 68(*b*) show a process flow starting with the generation of spherical primary crystals and ending with the molding step; FIG. 4 shows diagrammatically the metallographic structures obtained in the respective steps shown in FIGS. 68(*a*) and 68(*b*); FIG. 5 is an equilibrium phase diagram for an Al—Si alloy as a typical aluminum alloy system; FIG. 6 is an equilibrium phase diagram for a Mg—Al alloy as a typical magnesium alloy system; FIG. 7 is a diagrammatic representation of a micrograph showing the metallographic structure of a shaped part according to the invention; and FIG. 8 is a diagrammatic representation of a micrograph showing the metallographic structure of a shaped part: according to the prior art.

As shown in FIGS. 1(*a*), 2(*a*), 5(*a*) and 6(*a*), the thirty-fourth and thirty-fifth embodiments of the present invention comprise the following: the melt of a hypoeutectic aluminum alloy having a composition at or above a maximum solubility limit or the melt of a magnesium or aluminum alloy having a composition within a maximum solubility limit is held superheated to less than 300° C. above the liquidus temperature; either melt is contacted with a surface of a jig at a lower temperature than its melting point, thereby generating crystal nuclei in the alloy solution; the melt is then poured into an insulated vessel having a heat insulating effect, in which vessel the melt is held at a temperature not higher than the liquidus line but higher than the eutectic or solidus temperature for a period from 5 seconds to 60 minutes, whereby a large number of fine spherical primary crystals are generated in the melt, which is subsequently shaped at a specified liquid fraction.

The "specified liquid fraction." ranges from 0.1% to 70%, preferably from 10% to 70%.

The term "insulated vessel" as used herein refers to either a metallic or nonmetallic vessel or a metallic vessel either composited or coated with a nonmetallic material, which vessels are adapted to be heatable or coolable from either inside or outside.

According to the invention, semisolid metal forming will proceed by the following specific procedure. In step (1) of the process shown in FIGS. 68 and 4, a complete liquid form of metal M is contained in a ladle 10. In step (2), the metal is cooled with a jig 20 to generate crystal nuclei from the low-temperature melt (which may optionally contain an element that is added to promote the generation of crystal nuclei) and the metal is then poured into a ceramic vessel 30 having a heat insulating effect, thereby producing an alloy of a composition just below the liquidus line which has a large number of crystal nuclei. In subsequent step (3), the alloy is held partially molten within the insulated vessel 30 (or 30A). In the meantime, fine granular (nondendritic) primary crystals result from the introduced crystal nuclei [step (3)-a] and grow into spherical primary crystals as the fraction solid increases with the decreasing temperature of the melt [steps (3)-b and (3)-c]. Metal M thus obtained which has a specified fraction liquid is inserted into container 82 on an extruding machine 80 and extruded through a die 84 by pushing with a stem 86 under high pressure, yielding a shaped part P.

After the generation of the crystal nuclei., the semisolid metal M in the insulated vessel 30 maybe inserted into the container 82 on the extruding machine 80 by accommodating it into the container 82 in such a way that the part of it which faces the bottom of the insulated vessel 30 and which has a comparatively small portion of the impurities is directed toward the die 84; upon extrusion through the die, one can obtain a shaped part of high quality which has only a small impurity content. Alternatively, the surface (top surface) of the semisolid metal M may be freed of the oxide before it is recovered from the insulated vessel 30 and the thus cleaned semisolid metal is charged into the container 82 on the extruding machine 80.

The semisolid metal forming process of the invention shown in FIGS. 1(*a*), 2(*a*), 68 and 4 have obvious differences from the conventional thixocasting and rheocasting methods.

The casting, spheroidizing and molding conditions that are respectively set for the steps shown in FIG. 68, namely, the step of pouring the molten metal on to the cooling jig 20, the step of generating and spheroidizing primary crystals and the forming step are the same as set forth in Example 1.

Table 8 sets forth the conditions for the preparation of semisolid metal samples and the qualities of shaped parts. As FIG. 68 shows, the forming step consisted of inserting the semisolid metal into the container and extruding the same. The extruding conditions were as follows: extruding machine, 800° C.; extruding rate, 80 m/min; billet diameter, 75 mm; extrustion ratio, 20.

In Comparative Sample 1, the temperature of jig 20 with which the melt M was contacted was so high that the number of crystal nuclei generated was insufficient to produce fine spherical primary crystals; instead, coarse unspherical primary crystals formed as shown in FIG. 7.

In Comparative Sample 2, the casting temperature was so high that very few crystal nuclei remained within the ceramic vessel 30, yielding the same result as with Comparative Sample 1.

In Comparative Sample 3, the holding time was so long that the fraction liquid in the metal to be shaped was low, yielding a shaped part of poor appearance. In addition, the size of primary crystals was undesirably large.

In Comparative Sample 4, the holding time within the ceramic vessel 30 was short whereas the fraction liquid in the metal to be shaped was high; hence, only dendritic primary crystals formed. In addition, the high fraction liquid caused many segregations of components within the shaped part.

With Comparative Sample 5 the insulated vessel 30 was a metallic container having a small heat insulating effect, so the dendritic solidified layer forming on the inner surface of the vessel 30 would enter the spherical primary crystals generated in the central part of the vessel, yielding an inhomogeneous structure involving segregations.

TABLE 8

| | | | Conditions of the semisolid metal to be shaped | | | | | | |
|---|---|---|---|---|---|---|---|---|---|
| | No. | Alloy | Casting temperature (° C.) | Cooling jig | Temperature of the cooling jig (° C.) | Temperature of the metal within *3 vessel (° C.) | Holding time (min) | Fraction liquid just before shaping (%) | Primary crystal size (μm) |
| Comparative Sample | 1 | AC4CH | 625 | Used | 622 | 615 | 5 | 60 | 260 |
| | 2 | AC4CH | 950 | Used | 30 | 728 | 20 | 60 | 440 |
| | 3 | AC4CH | 680 | Used | 30 | 621 | 65 | 15 | 180 |
| | 4 | AC4CH-0.15% Ti—0.005% B | 630 | Used | 30 | 615 | 0.04 | 95 | *1 |
| | 5 | AC4CH | 630 | Used | 30 | 608 | 2 | 60 | *2 |
| | 6 | AC4CH-0.15% Ti—0.005% B | 630 | Used | 30 | 613 | 1 | 92 | *2 |
| | 7 | AC4CH | 630 | Not used | — | 622 | 5 | 60 | 270 |
| Invention Sample | 8 | AC4CH-0.15% Ti—0.005% B | 630 | Used | 30 | 611 | 6.5 | 55 | 58 |
| | 9 | AC4CH | 630 | Used | 30 | 608 | 12 | 45 | 72 |
| | 10 | AC4CH-0.15% Ti—0.005% B | 630 | Used | 400 | 612 | 5.5 | 60 | 90 |
| | 11 | AC4CH-0.15% Ti—0.010% B | 850 | Used | 25 | 611 | 6 | 60 | 70 |
| | 12 | AC4CH-0.15% Ti—0.015% B | 630 | Not Used | — | 620 | 15 | 35 | 110 |
| | 13 | AC7A | 660 | Used | 30 | 631 | 5.7 | 50 | 75 |
| | 14 | 7075 | 650 | Used | 30 | 619 | 1.5 | 80 | 85 |
| | 15 | AZ91 | 620 | Used | 30 | 588 | 4.2 | 55 | 78 |
| | 16 | AZ91-0.4% Si—0.01% Sr | 620 | Used | 30 | 588 | 4.3 | 55 | 78 |
| | 17 | AZ91-0.15% Ca | 620 | Not used | 30 | 592 | 4.5 | 55 | 118 |
| | 18 | AC4CH-0.15% Ti—0.015% B | 630 | Not used | — | 620 | 5 | 60 | 98 |

| | | | Quality of shaped part | | | |
|---|---|---|---|---|---|---|
| | No. | Alloy | Internal segregation | Amount of unspherical primary crystal | Eutectic size | Remarks |
| Comparative Sample | 1 | AC4CH | X | X | ○ | High jig temperature |
| | 2 | AC4CH | X | X | ○ | High casting temperature |
| | 3 | AC4CH | ○ | ○ | X | Long holding time |
| | 4 | AC4CH-0.15% Ti—0.005% B | X | *1 | ○ | Short holding time, high fraction liquid |
| | 5 | AC4CH | X | *2 | ○ | Metallic vessel was used at ordinary temperature |
| | 6 | AC4CH-0.15% Ti—0.005% B | X | *2 | ○ | Short holding time, high fraction liquid |
| | 7 | AC4CH | X | X | ○ | No grain refiner was used. |
| Invention Sample | 8 | AC4CH-0.15% Ti—0.005% B | ○ | ○ | ○ | |
| | 9 | AC4CH | ○ | ○ | ○ | Metallic vessel was used at 580° C. |
| | 10 | AC4CH-0.15% Ti—0.005% B | ○ | ○ | ○ | |
| | 11 | AC4CH-0.15% Ti—0.010% B | ○ | ○ | ○ | Water-cooled cooling jig was used. |
| | 12 | AC4CH-0.15% Ti—0.015% B | ○ | ○ | ○ | No jig was used. |
| | 13 | AC7A | ○ | ○ | ○ | |
| | 14 | 7075 | ○ | ○ | ○ | |
| | 15 | AZ91 | ○ | ○ | ○ | |
| | 16 | AZ91-0.4% Si—0.01% Sr | ○ | ○ | ○ | |
| | 17 | AZ91-0.15% Ca | ○ | ○ | ○ | No jig was used. |
| | 18 | AC4CH-0.15% Ti—0.015% B | ○ | ○ | ○ | Vibrations (100 Hz) were applied at amplitude of 0.1 mm. |

AC4CH: Al–7% Si—0.35% Mg m.p. 620° C.
7075: Al—4.5% Zn—1.1% Mg m.p. 640° C.
AZ91: Mg—9% Al—0.7% Zn m.p. 595° C.
AC7A: Al—5% Mg—0.4% Mn m.p. 635° C.
*1 Dendritic primary crystals
*2 Spherical primary crystals (with dendritic primary crystals)
*3 Temperature (° C.) of the metal as poured into the vessel from the cooling plate
Segragations: ○, a few; X, many
Amount of unspherical primary crystals: ○, small; X, large
Eutectic size: ○, fine; X, coarse In Comparative Sample 6, the fraction liquid in the metal to be shaped was so high that result was the same as with Comparative Sample 4.

With Comparative Sample 7, the jig 20 was not used; the starting alloy did not contain any grain refiners, so the number of crystal nuclei generated was small enough to yield the same result as with Comparative Sample 1.

In each of invention Samples 8–18, a homogeneous microstructure comprising fine (<150 $\mu$m) spherical primary crystals was obtained to enable the production of a shaped part having good appearance.

Example 13

Figure 69A:
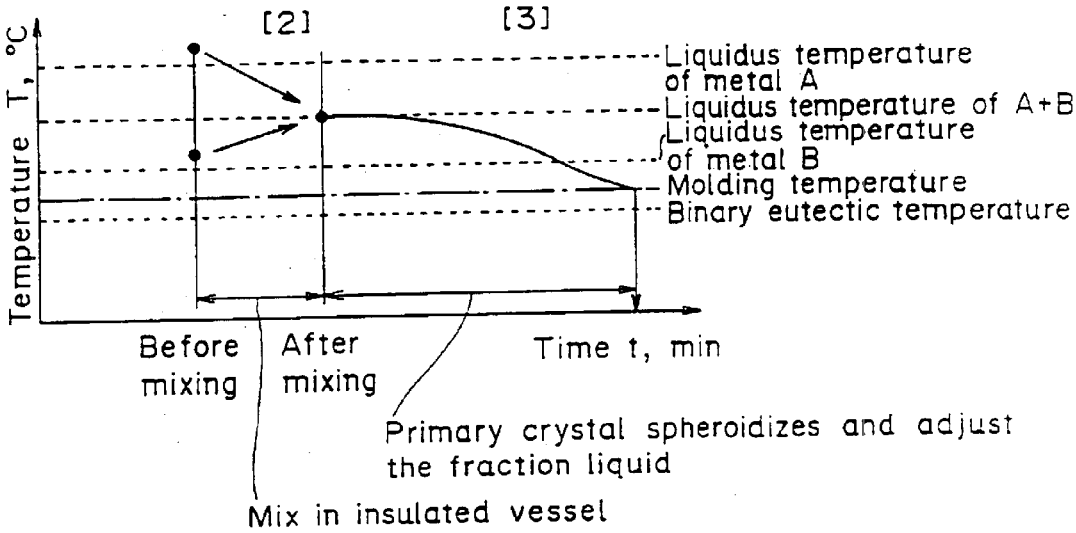
FIG. 69(*a*) and FIG. 69(*b*) are graphs which show respectively two process sequences for the semisolid forming of a hypoeutectic aluminum alloy according to an example of the invention (as in the thirty-sixth and thirty-seventh embodiments of the present invention), wherein FIG. 69(*a*) involves a mixture of two molten metals A and X, and FIG. 69(*b*) involves two molten metals A and B (including crystal nuclei) that were mixed after cooling with a cooling jig.
Figure 69B:
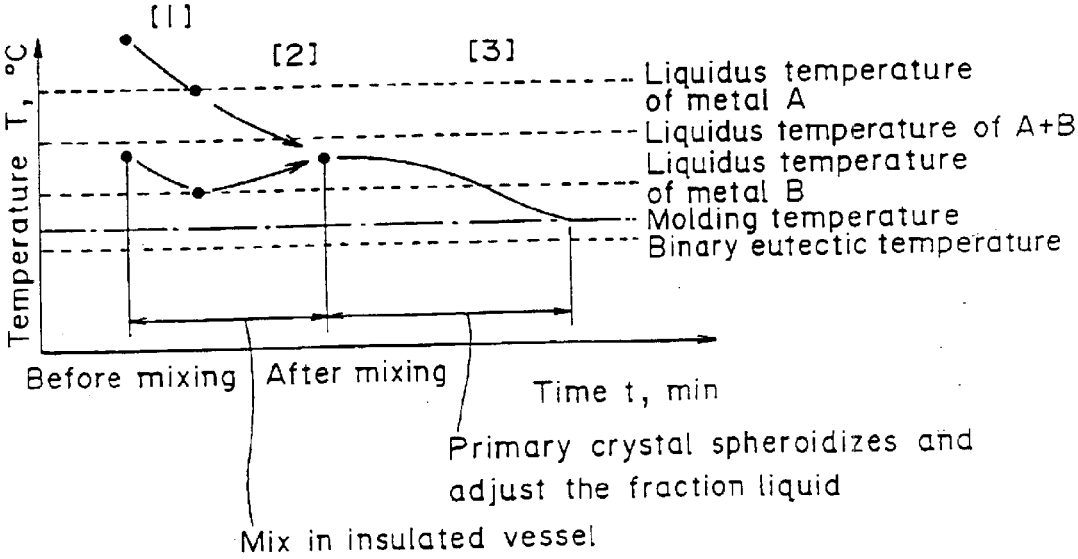
Figure 70:
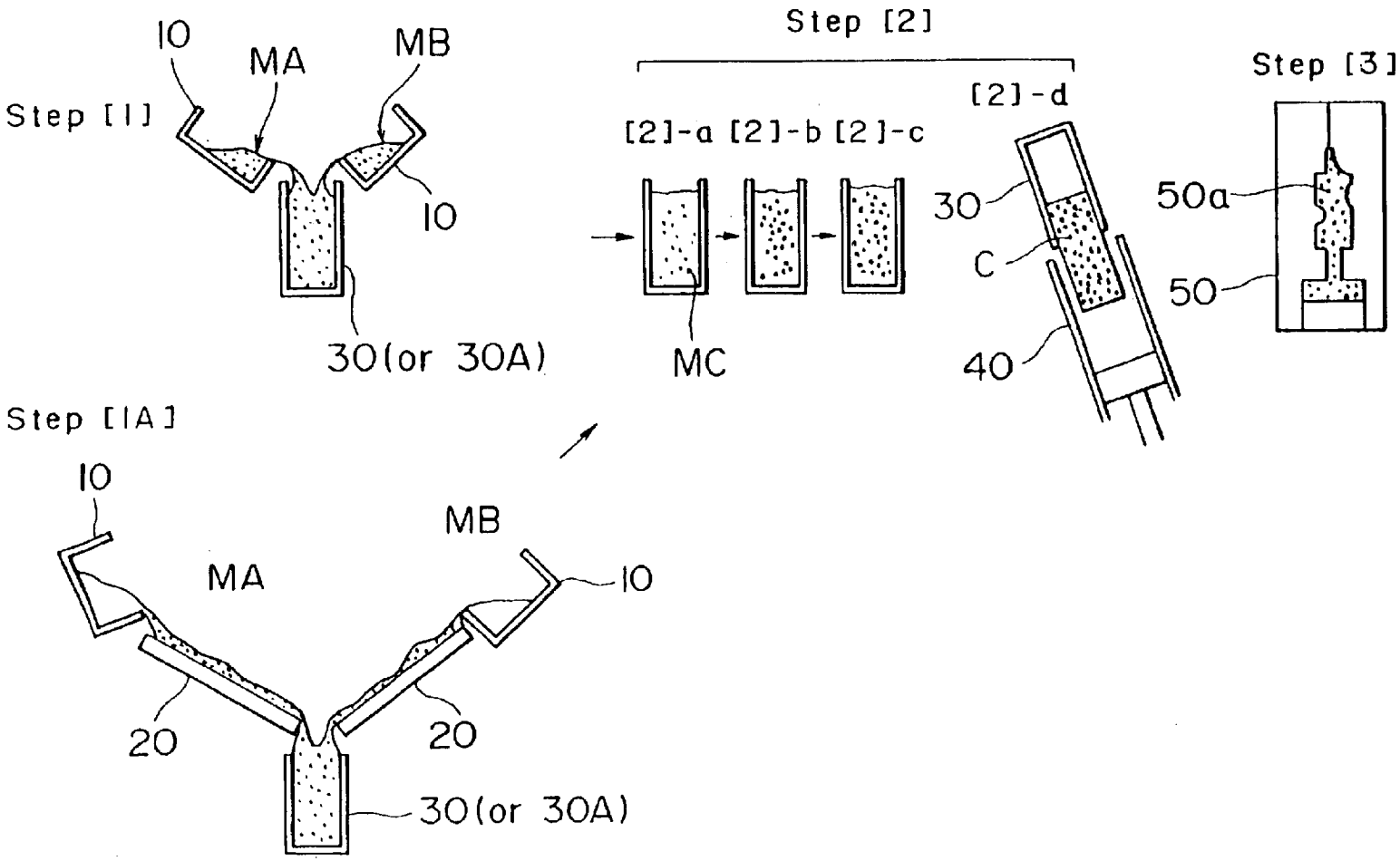
FIG. 70 is a schematic diagram which shows a process flow starting with the generation of spherical primary crystals and ending with the molding step according to the example shown in FIG. 69.
Figure 71:
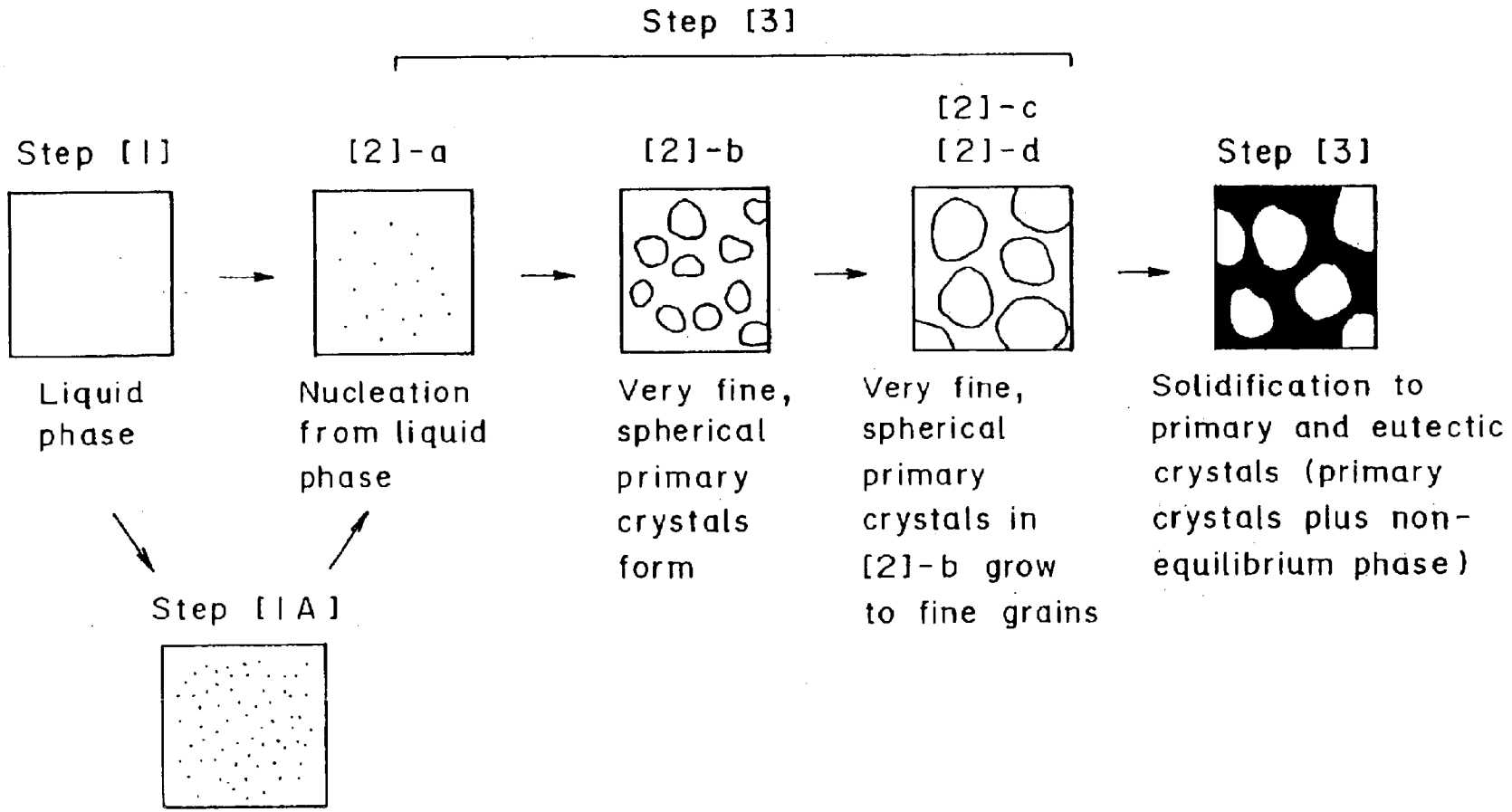
FIG. 71 shows diagrammatically the metallographic structures obtained in the respective steps shown in FIG. 70.
Figure 72:
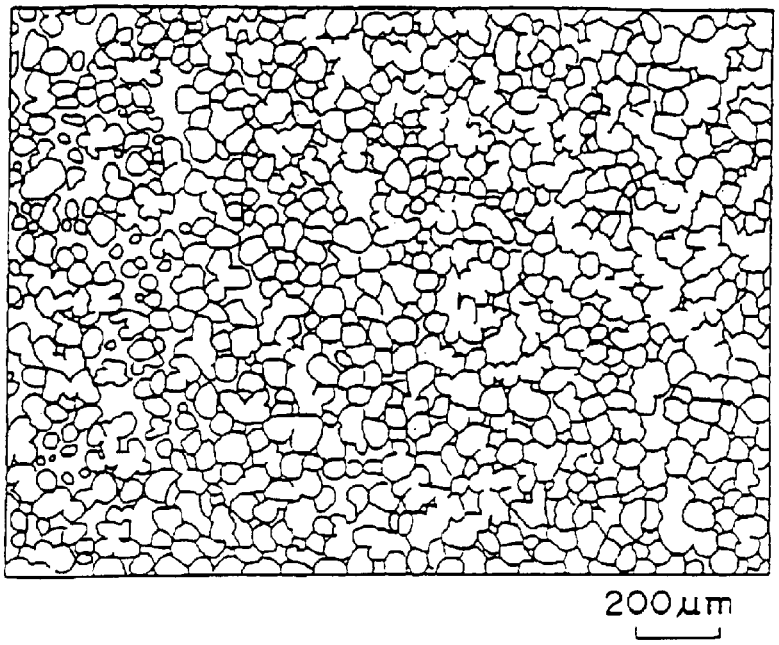
FIG. 72 is a diagrammatic representation of a micrograph showing the metallographic structure of a shaped part according to the example shown in FIG. 69.
Figure 73:
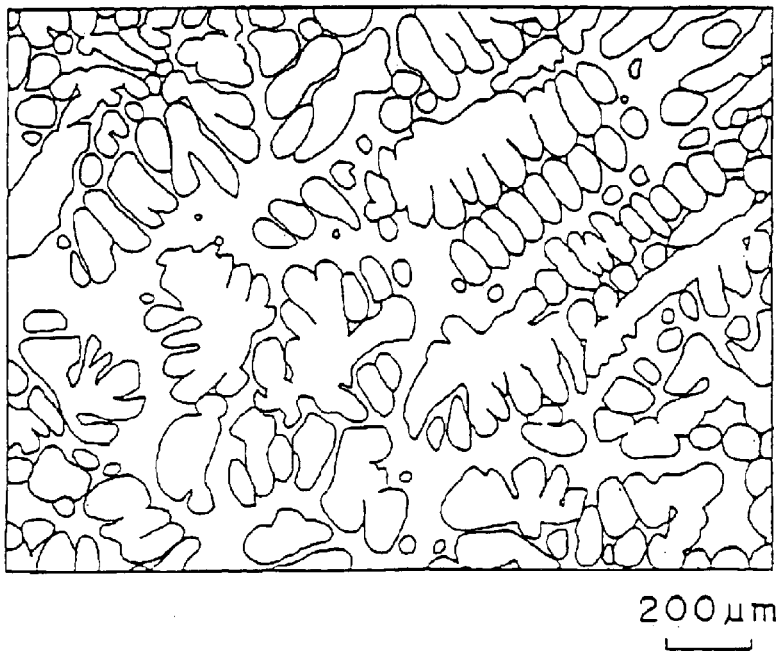
FIG. 73 Prior Art
FIG. 73 is a diagrammatic representation of a micrograph showing the metallographic structure of a shaped part according to the prior art (for comparison with the thirty-sixth and thirty-seventh embodiments of the present invention)

An example of the invention (as in the thirty-sixth and the thirty-seventh embodiments of the present invention) will now be described in detail with reference to accompanying FIGS. 69–73, in which FIG. 69 shows two process sequences for the semisolid forming of a hypoeutectic aluminum alloy; FIG. 70 shows a process flow starting with the generation of spherical primary crystals and ending with the molding step; FIG. 71 shows diagrammatically the metallographic structures obtained in the respective steps shown in FIG. 70; FIG. 72 is a diagrammatic representation of a micrograph showing the metallographic structure of a shaped part according to the invention; and FIG. 73 is a diagrammatic representation of a micrograph showing the metallographic structure of a shaped part according to the prior art.

The invention concerns a process which starts with either one of the following steps:

(1) two or more liquid alloys having different melting points that are held superheated to less than 50° C. above the liquidus temperature are mixed either directly within an insulated vessel having a heat insulating effect or along a trough in a channel into the insulated vessel, thereby generating crystal nuclei in the alloy solution (see FIG. 69); or (2) two or more metals to be mixed are preliminarily contacted with respective cooling plates so as to generate crystal nuclei and the metals that have attained temperatures just above or below the liquidus temperature are mixed either directly within an insulated vessel having a heat insulating effect or along a trough in a channel into the insulated vessel, thereby generating more crystal nuclei (see FIG. 70).

Either of the metals thus obtained is held within the insulated vessel for a period from 5 seconds to 60 minutes as it is cooled to a molding temperature where a specified liquid fraction is established, whereby the fine grains that have formed within the alloy solution are crystallized out as no dendrites, and the metal is then fed into a mold, where it is subjected to pressure forming.

The "specified liquid fraction" and the "insulated vessel "have the same meanings as defined in Example 1.

According to the invention, semisolid metal forming will proceed by the following specific procedure. In step (1) of the process shown in FIGS. 70 and 71, two complete liquid forms of metals MA and MB are contained in ladles 10 and poured into a ceramic container 30 (or ceramic-coated metal container 30A) which is an insulated vessel having a heat insulating effect. As a result, an alloy having a large number of crystal nuclei is obtained at a temperature either just below or above the liquidus line. Molten metals MA and MB may be poured either simultaneously or successively with one coming after the other. Alternatively, molten metals MA and MB may be poured into partitioned compartments in the insulated vessel 30 and the partition is removed all of a sudden so as to achieve mutual contact between the two metals. If desired, either molten metal MA or MB or both may be preliminarily contacted with a cooling jig 20 so as to have a number of crystal nuclei generated in the metal or metals and this is effective for the purpose of producing a large number of crystals [step (1A) in FIG. 70].

In subsequent step (2), the alloy mixture MC is held partially molten within the insulated vessel 30. In the meantime, extremely fine primary crystals result from the introduced crystal nuclei [step (2)-a] and grow into spherical primary crystals as the fraction solid increases with the decreasing temperature of the alloy mixture MC [steps (2)-b and (2)-c]. Alloy mixture MC thus obtained at a specified fraction liquid is inserted into an injection sleeve 40 [step (2)-d] and, thereafter, pressure formed within a mold cavity 50*a* on a die casting machine to produce a shaped part [step (3)].

The semisolid metal forming process of the invention shown in FIGS. 69, 70 and 71 has obvious differences from the conventional thixocasting and rheocasting methods.

The casting, spheroidizing and molding conditions that are respectively set for the steps shown in FIG. 69, namely, the step of pouring the molten metal on to the cooling jig 20, the step of generating and spheroidizing primary crystals and the forming step, are set forth below. Also discussed below is the criticality of the numerical limitations set forth in the thirty-sixth and the thirty-seventh embodiments of the present invention.

If the molten (liquid) metals MA and MB to be mixed have been superheated to more than 50° C. above the liquidus temperature, the temperature of either metal just after the mixing will neither be just above or below the liquidus temperature of the alloy mixture MC to be eventually formed. If the mixed metals are held within the insulated vessel 30, a microstructure consisting of coarse dendrites will form rather than a structure of uniform, near-spherical nondendritic crystals. To avoid these problems, the temperatures of molten (liquid) metals MA and MB to be mixed need be superheated to no more than 50° C. above the liquidus temperature. The "temperature either just above or below the liquidus temperature of the metal mixture to be eventually formed" means a temperature within the liquidus temperature ±15° C. The liquid metals to be mixed shall include alloys. The insulated vessel 30 for holding the metals the temperature of which have dropped to be within the defined range after the mixing shall have a heat insulating effect in order to ensure that the crystal nuclei generated will grow into nondendritic (near-spherical) primary crystals and have the desired liquid fraction after a specified time. The constituent material of the insulated vessel is in no way limited to metals and those which have a heat-retaining property and which yet wet with the melt only poorly are preferred. If a gas-permeable ceramic container is to be used as the insulated vessel 30 for holding magnesium alloys which are prone to oxidize and burn, the exterior to the vessel is preferably filled with a specified atmosphere (e.g., an inert or vacuum atmosphere).

If the holding time within the insulated vessel is less than 5 seconds, it is not easy to attain the temperature for the desired liquid fraction and it is also difficult to generate spherical primary crystals. What is more, semisolid metals of a uniform temperature profile cannot be attained. If the holding time exceeds 60 minutes, coarse spherical primary crystals will be generated.

It should also be mentioned that if the liquid fraction in the alloy which is about to be shaped by high-pressure casting is less than 20%, the resistance to deformation during the shaping is so high that it is not easy to produce shaped parts of good quality. If the liquid fraction exceeds 90%, shaped parts having a homogeneous structure cannot be obtained. Therefore, as already mentioned, the liquid fraction in the alloy to be shaped is preferably controlled to lie between 20% and 90%. More preferably, the liquid fraction should be adjusted to range between 30% and 70% in order to ensure that shaped parts of high quality can easily be produced by pressure forming. The means of pressure forming are in no way limited to high-pressure casting processes typified by squeeze casting and die casting and various other method of pressure forming may be adopted, such as extruding and casting operations.

By mixing two or more aluminum alloys having different liquidus temperature and holding the mixture within the insulated vessel 30, one can produce a semisolid metal of a fine spherical structure. If it is desired to generate more crystal nuclei so as to yield uniform and more fine-grained spherical structure in aluminum alloys, Ti and B may be added to the alloys. If the Ti content of the alloy mixture is less than 0.003%, the intended refining effect of Ti is not attained; beyond 0.30% a coarse Ti compound will form to cause deterioration in ductility. Hence, the Ti addition is controlled to lie between 0.003% and 0.30%. Boron (B) in the mixed metal MC cooperates with Ti to promote the refining of crystal grains but its refining effect is small if the addition is less than 0.0005%; on the other hand, the effect of B is saturated at 0.01% and no further improvement is expected beyond 0.01%. Hence, the B addition is controlled to lie between 0.0005% and 0.01%.

a specified level is particularly preferred since it allows for the generation of many crystal nuclei. In order to ensure that the temperatures of the molten metals MA and MB which have been contacted with the cooling jig 20 are either just above or below the respective liquidus lines, the molten alloys held superheated to less than 300° C. above the solidus temperatures are desirably contacted with a surface of the jig at a lower temperature than the melting points of said alloys. Preferably, the degree of superheating above the liquidus temperatures lie less than 100° C., more preferably less than 50° C.

Table 9 sets forth the conditions for the preparation of semisolid samples and the qualities of shaped parts. As shown in FIG. 70, the shaping operation consisted of inserting the semisolid metal into an injection sleeve and subsequent forming on a squeeze casting machine. The forming conditions were as follows: pressure, 950 kgf/cm$^2$; injection speed, 1.5 m/s; mold cavity dimensions, 100×150×10; mold temperature, 230° C.

In Comparative Sample 9, the holding time was so long that undesirably large primary crystals formed. In Comparative Sample 10, the temperatures of the alloys to be mixed were high and so was the temperature of the resulting mixture; hence, the number of the crystal nuclei generated was small enough to produce only dendritic primary crystals. In Comparative Sample 11, the holding time was short whereas the liquid fraction in the alloy mixture was high and this caused extensive segregations in the interior of the sharped part.

TABLE 9

| | | *1 Compositons and proportions of alloys to be mixed | | | | *2 Temperature of alloys just before mixing (° C.) | | *3 Alloy temperture just after mixing (° C.) | Cooling plate | Addition of Ti and B | *4 Holding time (min) | *5 Crystals in semisolid metal | | Internal segregation |
|---|---|---|---|---|---|---|---|---|---|---|---|---|---|---|
| | | Alloy ① | | Alloy ② | | | | | | | | | | |
| | No. | Composition (%) | Proportion (%) | Composition (%) | Proportion (%) | Alloy ① | Alloy ② | | | | | Morphology | Size (μm) | |
| Invention Sample | 1 | 9 Si | 50 | 5 Si | 50 | 5 | 10 | 1 | — | — | 8.0 | ○ | 100 | Absent |
| | 2 | 5 Si | 50 | 9 Si | 50 | 5 | 5 | 0 | — | — | 8.2 | ○ | 115 | Absent |
| | 3 | 9 Si | 50 | 5 Si | 50 | 4 | 7 | 2 | — | — | 7.7 | ○ | 120 | Absent |
| | 4 | 9 Si | 70 | 3 Si | 30 | 15 | 20 | 5 | — | — | 8.0 | ○ | 150 | Absent |
| | 5 | 11 Si | 30 | 5 Si | 70 | 5 | 5 | 3 | — | — | 9.3 | ○ | 120 | Absent |
| | 6 | 9 Si | 50 | 5 Si | 50 | 0 | 1 | −15 | Used | — | 5.9 | ○ | 70 | Absent |
| | 7 | 9 Si | 50 | 5 Si | 50 | 5 | 10 | 1 | — | Yes *6 | 7.9 | ○ | 85 | Absent |
| | 8 | 11 Al | 50 | 7 Al | 50 | 10 | 10 | 3 | — | — | 3.5 | ○ | 80 | Absent |
| Comparative Sample | 9 | 9 | 50 | 5 | 50 | 5 | 10 | 1 | — | — | 70 | ○ | 280 | — |
| | 10 | 9 | 50 | 5 | 50 | 70 | 60 | 30 | — | — | 15.2 | X | — | Present |
| | 11 | 9 | 50 | 5 | 50 | 10 | 10 | 3 | — | — | 0.06 | ○ | 15 | Present |

*1 Alloy ① was first inserted into the ceramic vessel; Alloy No. 8 was of Mg—Al system and the other alloys were of Al—Si system.
*2 Expressed in terms of the degree of superheating above the melting point of each alloy.
*3 Expressed in terms of the degree of superheating above the melting point of the alloy formed by mixing: Al—7% Si had m.p. of 615° C. and Mg—9% Al—0.6% Zn had m.p. of 595° C.
*4 Time taken for either the alloy (Al—7% Si) to attain 585° C. or the alloy (AZ91) to attain 580° C.
*5 ○, primary crystals were generally spherical; X, primary crystals were dendritic
*6 Ti, 0.15%; B, 0.005%

The constituent material of the jig 20 having the cooling zone with which the molten metals MA and ME are to be contacted before they are mixed is not limited to any particular types as long as it is capable of lowering the temperatures of the melts. A jig that is made of a highly heat-conductive metal such as copper, a copper alloy, aluminum or an aluminum alloy and which is controlled to provide a cooling effect for maintaining temperatures below In each of Invention Samples 1–8, a homogeneous microstructure comprising fine (<150 μm) spherical primary crystals was obtained to enable the production of a shaped part having no internal segregations.

Figure 74:
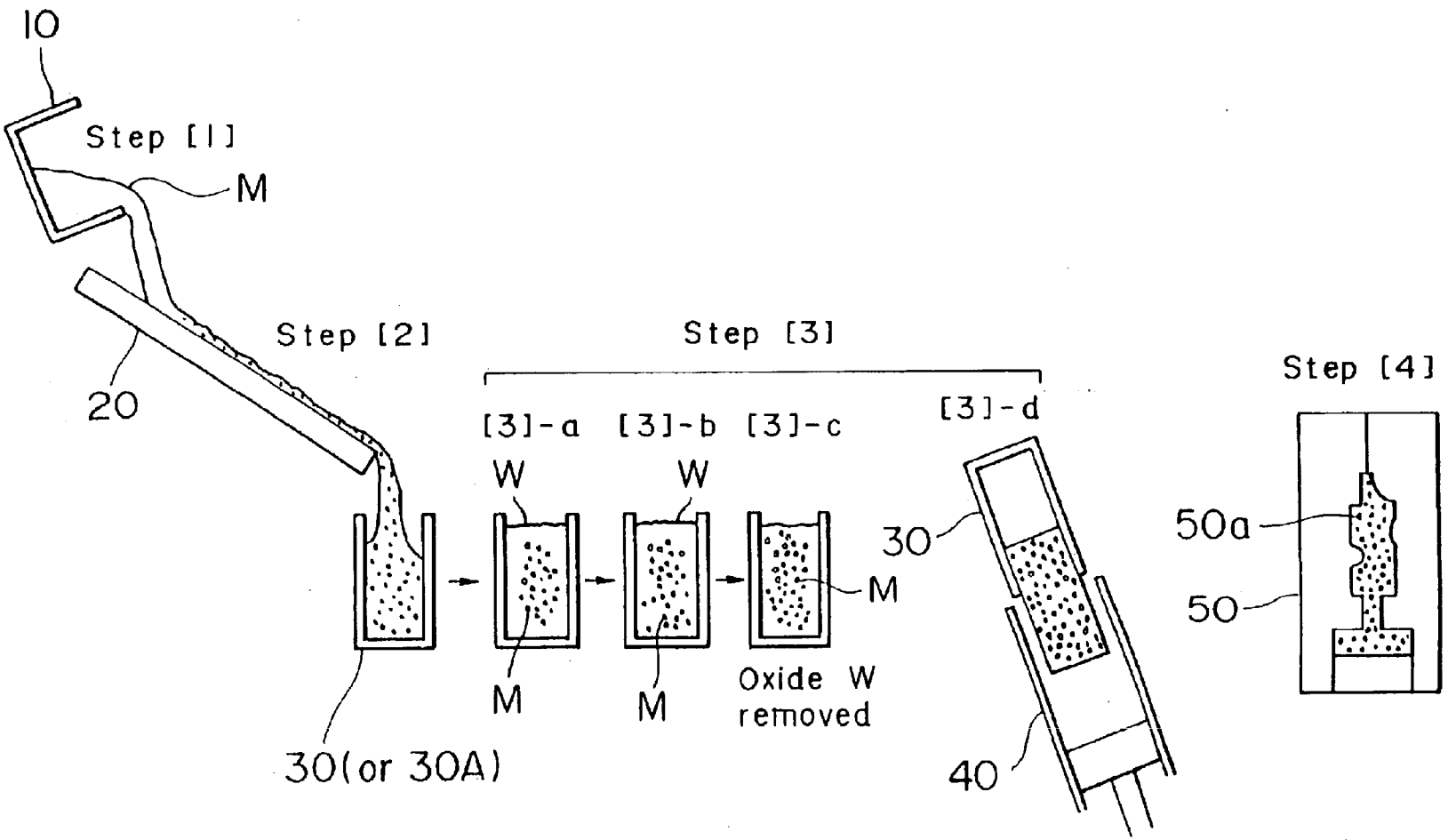
FIG. 74 is a schematic diagram which shows a process flow starting with the generation of spherical primary crystals and ending with the molding step according to an example of the invention (as in the thirty-eighth embodiment of the present invention)

This is an example of the thirty-eighth embodiment of the present invention and it was implemented by the same method as in Example 1, except that at the end of the step of holding the alloy partially molten within the insulated vessel 30 (or 30A), an oxide W forming on the semisolid metal was removed by means of a metallic or nonmetallic jig [step (3)-c in FIG. 74].

As also shown in FIG. 74, the shaping operation consisted of inserting the semisolid metal into an injection sleeve and subsequent forming on a squeeze casting machine. The forming conditions were as follows: pressure, 950 kgf/cm$^2$; injection speed, 1.5 m/s; mold cavity dimensions, 100×150×10; mold temperature, 230° C.

Table 10 shows how the quality of shaped parts was affected by the presence or absence of the oxide. Obviously, Invention Samples 23–26 had better results than Comparative Samples 21 and 22.

TABLE 10

| | | | Conditions of the semisolid metal to be shaped | | | | | | |
|---|---|---|---|---|---|---|---|---|---|
| | | | | | | | Holding vessel | | Jig used to |
| | No. | Alloy | Casting temperature (° C.) | Temperature just after pouring (° C.) | Temperature just before shaping (° C.) | Hold-time (min) | Temperature (° C.) | Constituent material | remove the top surface of the metal |
| Comparative Sample | 21 | AC4CH | 630 | 614 | 585 | 7.1 | 50 | ceramic | — |
| | 22 | AC4CH | 630 | 615 | 585 | 14 | 300 | ceramic | — |
| Invention Sample | 23 | AC4CH | 630 | 614 | 585 | 6.6 | 50 | ceramic | Aluminized iron jig having BN coat |
| | 24 | AC4CH | 630 | 616 | 585 | 7.2 | 50 | ceramic | Ceramic jig |
| | 25 | AC4CH | 630 | 617 | 585 | 15 | 300 | ceramic | Aluminized iron jig having BN coat |
| | 26 | AC4CH | 630 | 615 | 585 | 14 | 300 | ceramic | Ceramic jig |

| | | | Quality of shaped part | | | | | |
|---|---|---|---|---|---|---|---|---|
| | | | | | | Tensile | Elongation at break | |
| | No. | Alloy | When the oxide was removed | Oxide pickup | strength (MPa) | Maximum (%) | Minimum (%) |
| Comparative Sample | 21 | AC4CH | — | X | 291 | 16 | 9 |
| | 22 | AC4CH | — | X | 288 | 17 | 11 |
| Invention Sample | 23 | AC4CH | Just after pouring of the melt | ○ | 315 | 19 | 16 |
| | 24 | AC4CH | Just before the molding temperature was reached | ○ | 322 | 21 | 18 |
| | 25 | AC4CH | Just after pouring of the melt | ○ | 315 | 20 | 15 |
| | 26 | AC4CH | Just before the molding temperature was reached | ○ | 318 | 22 | 17 |

Figure 75B:
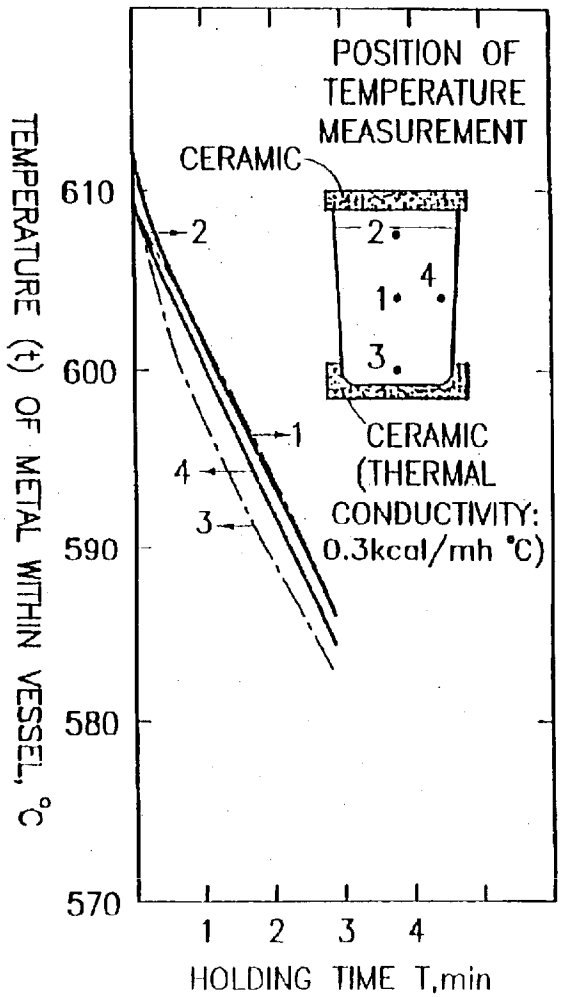
FIGS. 75(*a*) and 75(*b*) are graphs illustrating the correlationship between the temperature distribution of AC4CH alloy in a holding vessel and its cooling rate according to an example of the invention.
Figure 75A:
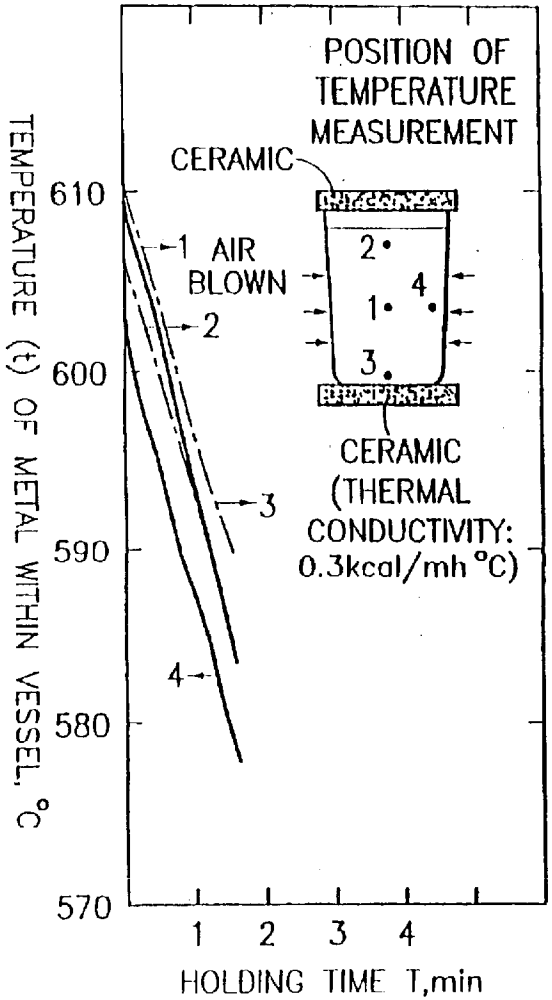
Figure 76A:
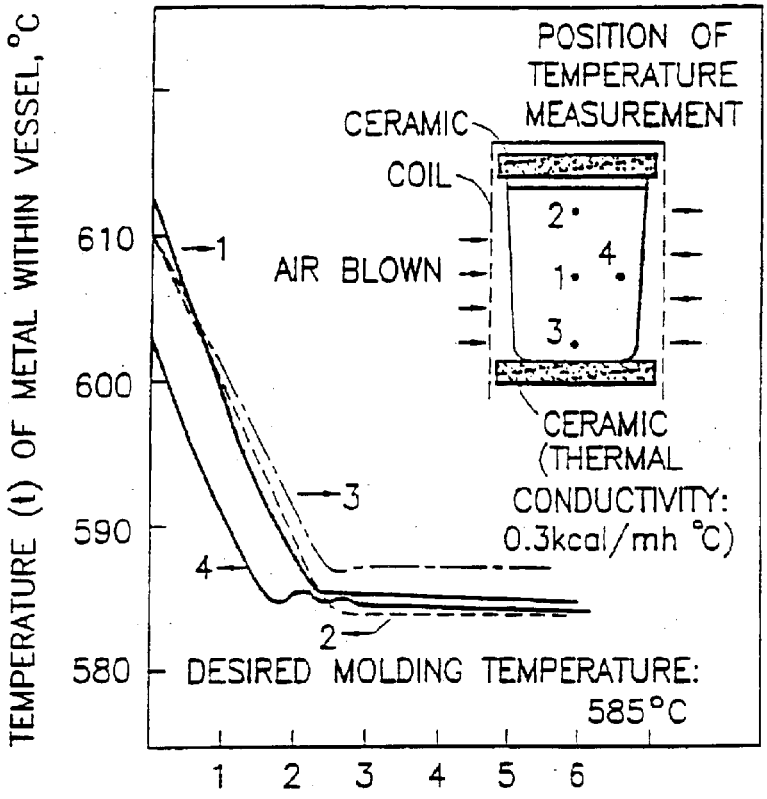
FIGS. 76(*a*), 76(*b*) and 76(*c*) are graphs showing the effect of r-f induction heating on the temperature distribution of AC4CH alloy in a holding vessel according to an example of the invention.
Figure 76B:
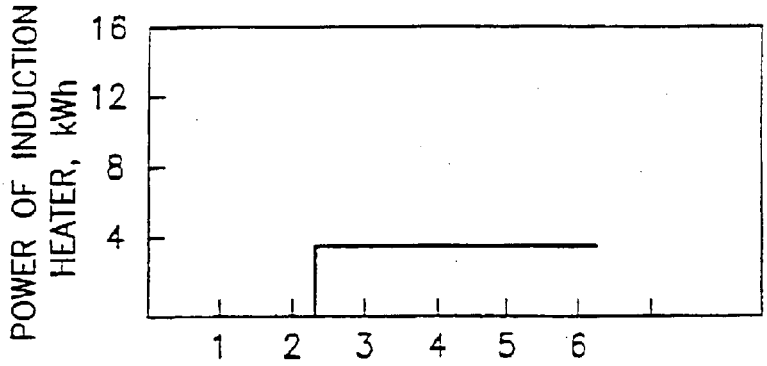
Figure 76C:
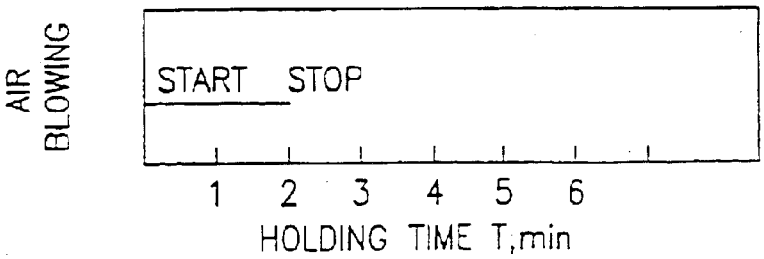
Figure 77A:
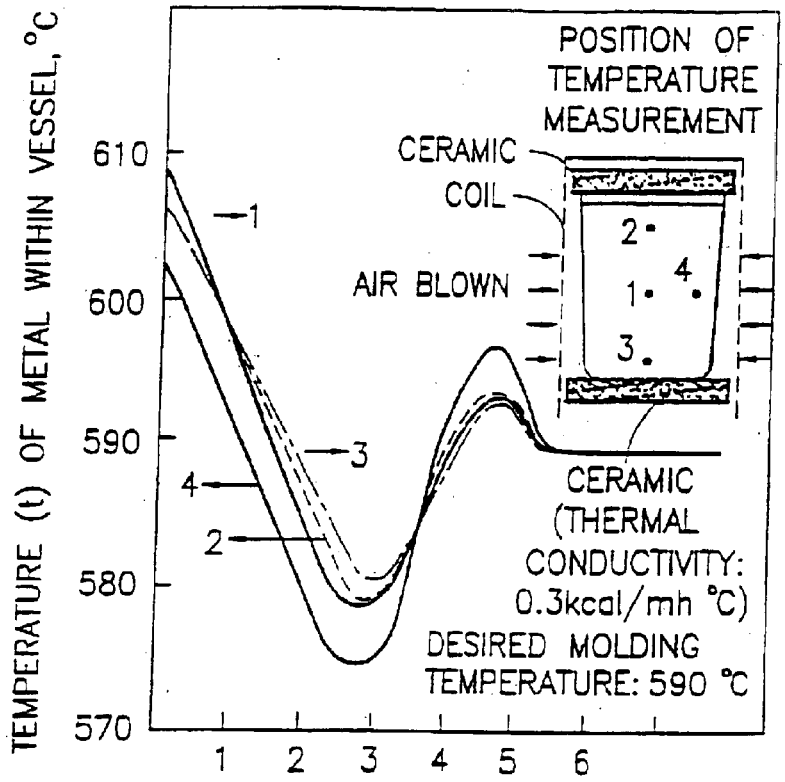
FIGS. 77(*a*), 77(*b*) and 77(*c*) are graphs showing the effect of r-f induction heating on the temperature distribution of AC4CH alloy in a holding vessel according to another example of the invention.
Figure 77B:
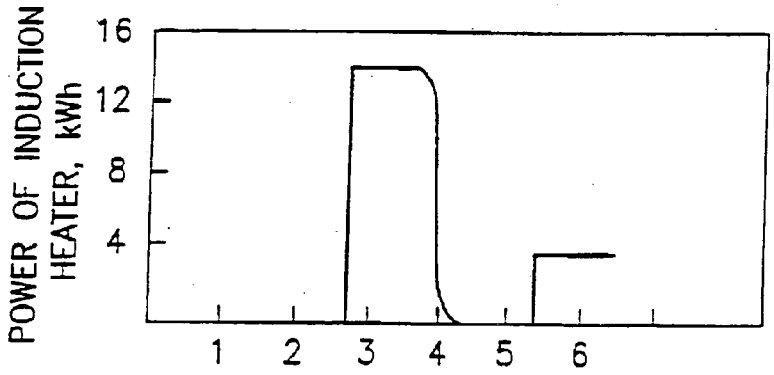
Figure 77C:
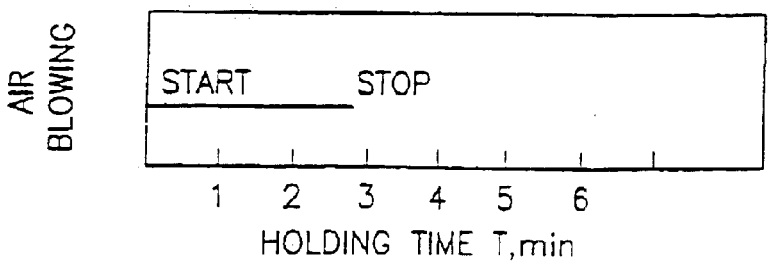

* Cooling jig (30° C.) was used to induce the generation of crystal nuclei.
* Insulated ceramic holding vessel was chiefly made of special calucium silicate.
* Oxide pickup was checked by deflection test.
* Tensile test was conducted four times under each condition.
* Oxide pickup: ○, negligible; X, a little Examples 15 et seq. will now be described in detail with reference to the following drawings: FIG. 1(*b*) is a diagram showing a process sequence for the semisolid forming of a hypoeutectic aluminum alloy having a composition at or above a maximum solubility limit; FIG. 2(*b*) is a diagram showing a process sequence for the semisolid forming of a magnesium or aluminum alloy having a composition within a maximum solubility limit; FIG. 3(*b*) shows a process flow starting with the generation of spherical primary crystals and ending with the molding step; FIG. 4 shows diagrammatically the metallographic structures obtained in the respective steps shown in FIG. 3(*b*); FIG. 5(*b*) is an equilibrium phase diagram for an Al—Si alloy as a typical aluminum alloy system; FIG. 6(*b*) is an equilibrium phase diagram for a Mg—Al alloy as a typical magnesium alloy system; FIG. 7(*b*) is a diagrammatic representation of a micrograph showing the metallographic structure of a shaped part according to the invention; FIG. 8 is a diagrammatic representation of a micrograph showing the metallographic structure of a shaped part according to the prior art; FIGS. 75(*a*) and 75(*b*) are graphs illustrating the correlationship between the temperature distribution of AC4CH alloy in a holding vessel and its cooling rate: FIGS. 76(*a*), 76(*b*) and 76(*c*) are graphs showing the effect of r-f induction heating on the temperature distribution of AC4CH alloy in a holding vessel; FIGS. 77(*a*), 77(*b*) and 77(*c*) are graphs showing the effect of r-f induction heating on the temperature distribution of AC4CH alloy in a holding vessel; and FIGS. 78(*a*), 78(*b*) and 78(*c*) illustrate how holding by r-f induction heating affects the compositional homogenization of a semisolid metal after the molding temperature was reached.

Figure 79:
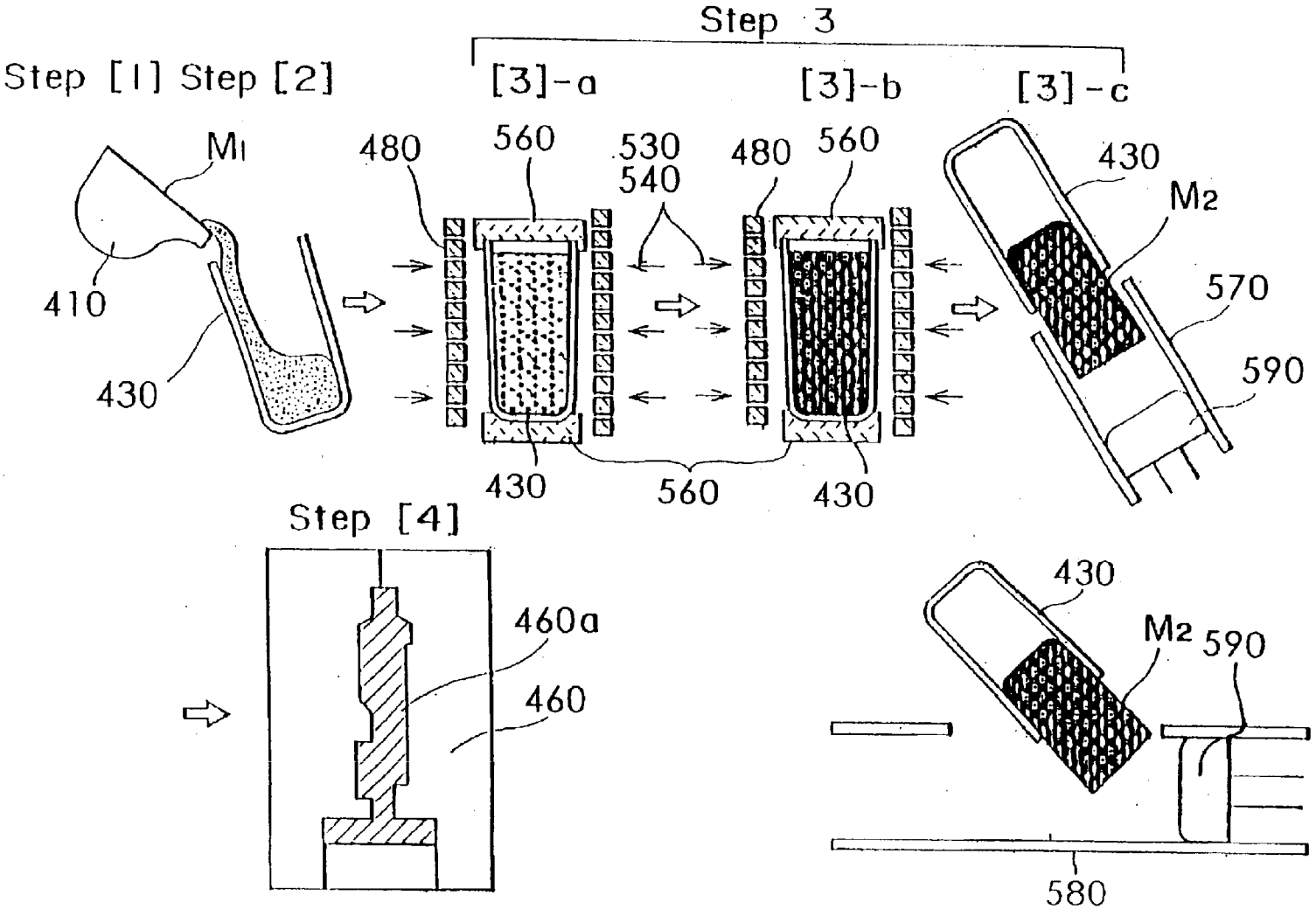
FIG. 79 is a schematic diagram which shows a process flow in the invention which starts with the generation of spherical primary crystals and which ends with the molding step.
Figure 80:
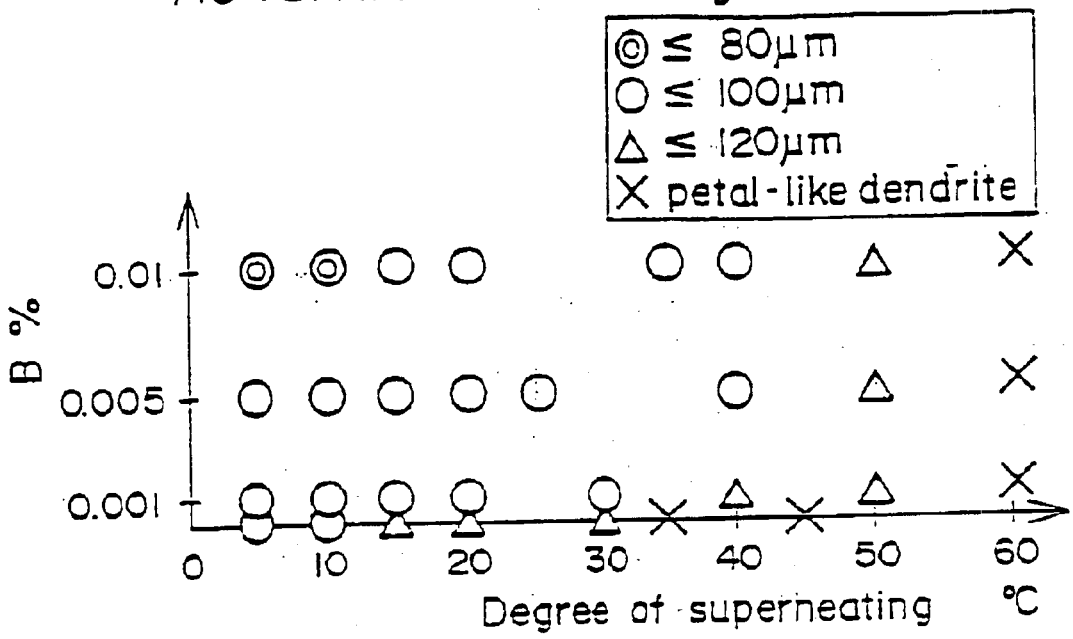
FIG. 80 is a graph showing how the B content and the degree of superheating of a melt during pouring affect the size and morphology of the primary crystals of AC4CH alloy (Al-7% Si-0.3% Mg-0.15% Ti) according to the invention.
Figure 81:
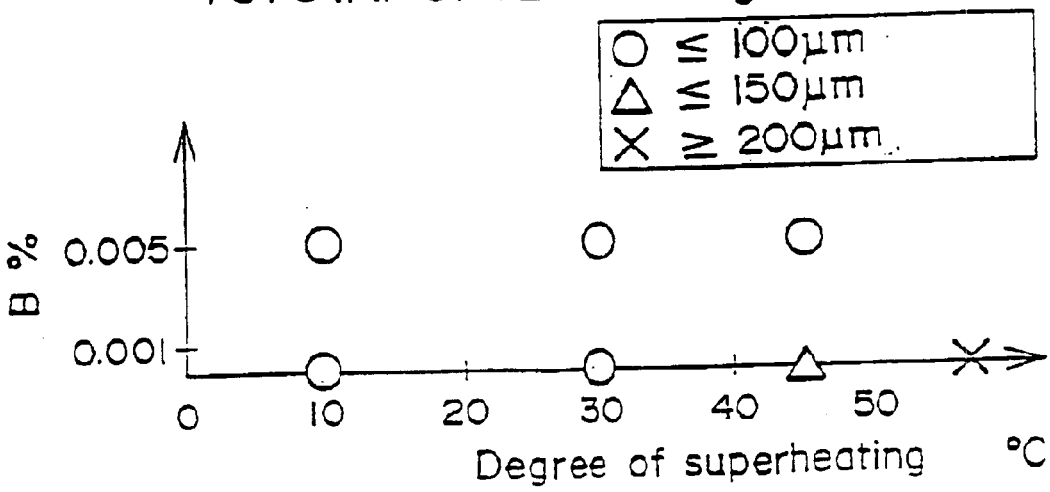
FIG. 81 is a graph showing how the B content and the degree of superheating of a melt during pouring affect the size and morphology of the primary crystals of 7075 alloy (Al-5.5% Zn-2.5% Mg-1.6% Cu-0.15% Ti) according to the invention.
Figure 82:
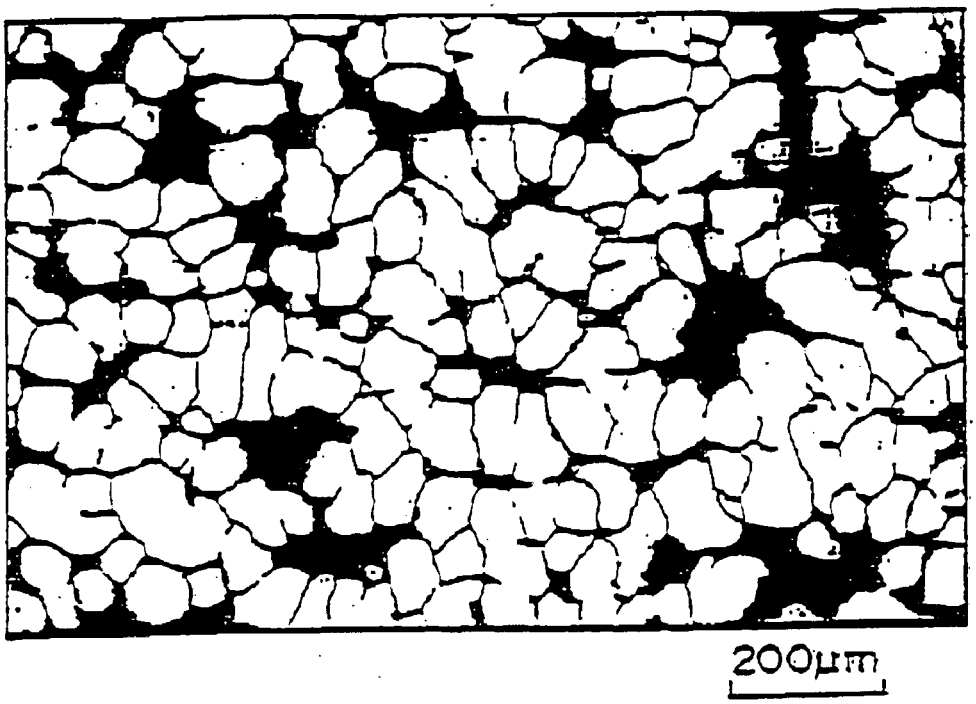
FIG. 82 is a diagrammatic representation of a micrograph showing the metallographic structure of a shaped part (from AC4CH-0.15% Ti) according to an example of the invention.
Figure 83:
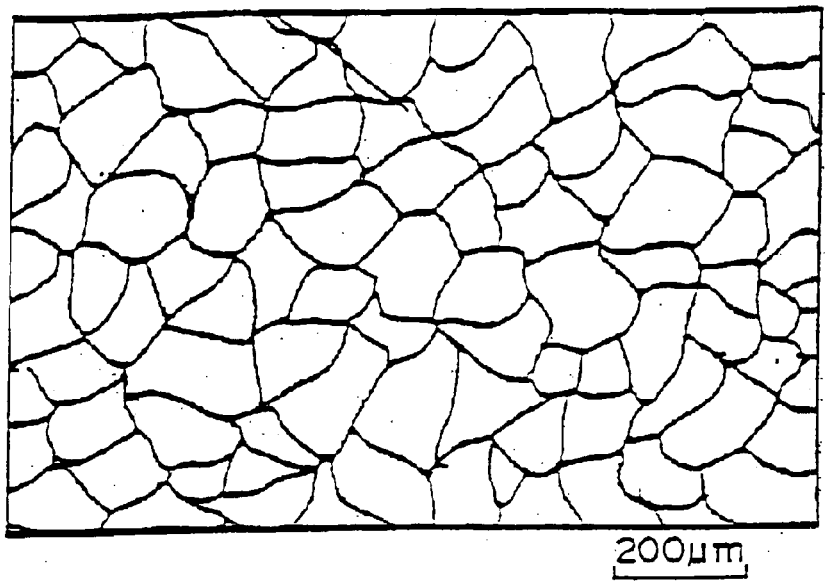
FIG. 83 is a diagrammatic representation of a micrograph showing the metallographic structure of a shaped part (from AZ91-0.01% Sr-0.4% Si) according to another example of the invention.
Figure 84:
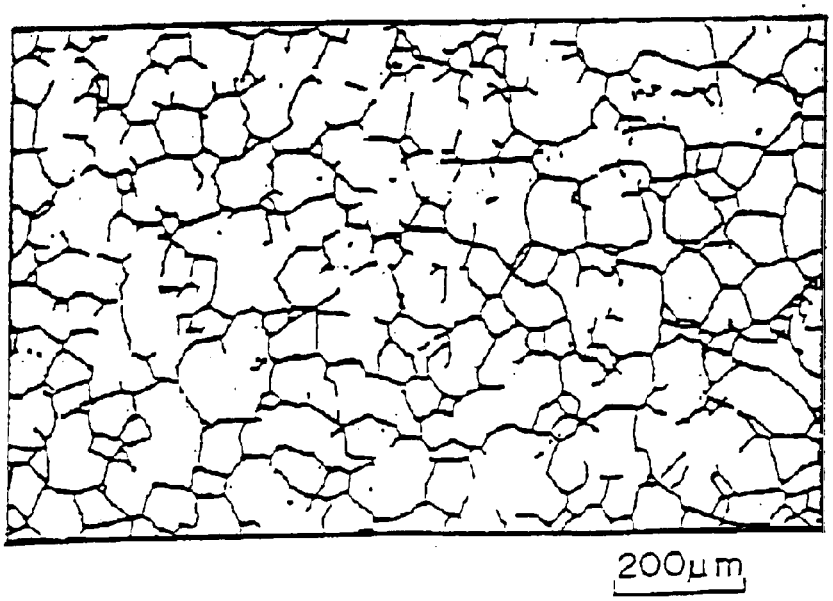
FIG. 84 is a diagrammatic representation of a micrograph showing the metallographic structure of a shaped part (from 7075-0.15% Ti-0.002% B) according to yet another example of the invention.

FIGS. 79 to 84 relate to Examples 25 to 28 of the invention. FIG. 79 shows a process flow starting with the generation of spherical primary crystals and ending with the molding step. Reference numbers 530 and 540 in FIG. 79 stand for the direction in which air is blown. Reference number 560 in FIG. 79 stands for a cap made of a ceramic or other heat insulating material which is used to avoid the partial rapid cooling of the molten metal. Reference number 580 in FIG. 79 stands for a sleeve. Reference number 590 in FIG. 79 stands for the tip of the piston slidingly mounted within the sleeve 580. FIG. 80 is a graph showing how the B content and the degree of superheating of a melt during pouring affect the size and morphology of the primary crystals of AC4CH alloy (Al-7% Si-0.3% Mg-0.15% Ti). FIG. 81 is a graph showing how the B content and the degree of superheating of a melt during pouring affect the size and morphology of the primary crystals of 7675 alloy (Al-5.5% Zn-2.5% Mg-1.6% Cu-0.15% Ti). FIGS. 82 to 84 are diagrammatic representation of a micrographs showing the metallographic structures of shaped parts within the scope of the invention.

FIGS. 85 to 88 are diagrammatic representations of a micrographs showing the metallographic structures of a shaped parts.

As shown in FIGS. 1(*b*), 2(*b*), 3(*b*), 5(*b*) and 6(*b*), the first step of the process according to the invention comprises superheating the melt of a hypoeutectic aluminum alloy of a composition at or above a maximum solubility or a magnesium or aluminum alloy of a composition within a maximum solubility limit, holding the melt superheated to less than 50° C. above the liquidus temperature as it is poured into a holding vessel, with a vibrating rod being submerged within the melt in the holding vessel and vibrated in direct contact with the melt so as to vibrate the latter and, after the end of the pouring, immediately pulling up said vibrating rod so that it disengages from the melt.

Thus, there is obtained the liquid alloy having crystal nuclei and at a temperature not lower than the liquidus temperature or the partially solid, partially liquid alloy having crystal nuclei and at a temperature less than the liquidus temperature but not lower than the holding temperature. Subsequently, either alloy in said holding vessel is cooled to the molding temperature, where a specified fraction liquid is established, at an average cooling rate of 0.01–3.0° C./s with a cooling medium such as air at room temperature being blown against said holding vessel from the outside and the alloy is held as such until just prior to the start of shaping under pressure, whereby fine primary crystals are generated in said alloy solution and the alloy within said holding vessel is temperature adjusted by induction heating such that the temperatures of various parts of the alloy fall within the desired molding temperature range for establishment of a specified liquid fraction not later than the start of shaping and said alloy is recovered from said holding vessel, supplied into a forming mold and shaped under pressure.

Another process according to the invention is also shown in FIG. 79 and the first step comprises superheating the melt of a hypoeutectic aluminum alloy of a composition at or above a maximum solubility or a magnesium or aluminum alloy of a composition within a maximum solubility limit, both alloys containing a crystal grain refiner (which is hereunder referred to as "refiner"), holding the melt superheated to less than 50° C. above the liquidus temperature as it is poured into a holding vessel 430. Then, the alloy is held for a period from 30 seconds to 330 minutes as the melt is cooled to the molding temperature whereas specified fraction liquid is established such that the temperature of either the poured liquid alloy superheated to less than 10° C. above the liquidus temperature or the poured partially solid, partially liquid alloy which is less than 5° C. below the liquidus temperature is allowed to decrease from the initial level and pass through a temperature range 5° C. below the liquidus temperature within 10 minutes, whereby fine primary crystals are generated in said alloy solution, and the alloy is recovered from the holding vessel 430, Supplied into a forming mold 460 and shaped under pressure.

In practice, a molten alloy which has been poured into the holding vessel is cooled by blowing air or water from the outside of the vessel until the melt reaches the predetermined temperature which is set above the temperature of shaping, while the temperature of the upper and the lower portions of the vessel is being maintained constant. Further, the temperature of various portions of the malt in the holding vessel is adjusted by induction heating 80 that the melt may have a temperature within the desired molding temperature range to establish a specified liquid fraction before the start of shaping at latest.

As discussed hereinbefore, the term "a specified liquid fraction" means a relative proportion of the liquid phase which is suitable for pressure forming. In addition to the percentages for the liquid fraction discussed hereinbefore, the following applies. In high-pressure casting operations such as die casting and squeeze casting, the liquid fraction is less than 75%, preferably in the range of 40%–65%. If the liquid fraction is less than 40%, not only is it difficult to recover the alloy from the holding vessel 330 but also the formability of the raw material is poor. If the liquid fraction exceeds 75%, the raw material is so soft that it is not only difficult to handle, but also less likely to produce a homogeneous microstructure, because the molten metal will entrap the surrounding air when it is inserted into the sleeve for injection into a mold on a die-casting machine or segregation develops in the metallographic structure of the casting. For these reasons, the liquid fraction for high-pressure casting operations should not be more than 75%, preferably not more than 65%.

In extruding and forging operations, the liquid fraction ranges from 1.0% to 70%, preferably from 10% to 65%. Beyond 70%, an uneven structure can potentially occur. Therefore, the liquid fraction should not be higher than 70%, preferably 65% or less. Below 1.0%, the resistance to deformation is unduly high; therefore, the liquid fraction should be at least 1.0%. If extruding or forging operations are to be performed with an alloy having a liquid fraction of less than 40%, the alloy is first adjusted to a liquid fraction of 40% and more before it is taken out of the holding vessel and thereafter the liquid fraction is lowered to less than 40%.

The "holding vessel" as used in the invention is a metallic nonmetallic vessel (including a ceramic vessel), or a metallic vessel having a surface coated with nonmetallic materials, or a metallic vessel composited with nonmetallic materials. Coating the surface of a metallic vessel with nonmetallic materials is effective in preventing the sticking of the metal. The holding vessel may be heated either internally or externally by means of a heater; alternatively, a r-f induction heater may be employed.

The term "the representative temperature" as used herein refers to the center temperature of the alloy charged into holding vessel. More specifically, it means the temperature at the center of the alloy in the holding vessel in both the height and radial directions. In practical operations, however, it is difficult to measure the temperature of the alloy center in both directions and, instead, the temperature in a position a specified depth (such as 1 cm) below the surface of a semisolid metal is measured. From this temperature, the representative temperature is estimated on the basis of the preliminarily established relationship between the representative temperature and the temperatures of various parts of the alloy.

According to the invention, the following methods are proposed for generating crystal nuclei, first by using vibrating jig during the pouring of a melt into the vessel, and second by using a low-temperature melt containing a refiner. Known methods may of course be employed to generate crystal nuclei, and they include the "seed pouring" method utilizing crystal liberation (the melt is cast to flow on a water-cooled inlined cooling plate) and mixing two liquid phases having different melting points. According to the invention, the crystal nuclei are generated "by vibrating the alloy which builds up in the holding vessel by pouring in a melt, the vibration being applied to said alloy by means of a vibrating rod which is submerged in the melt during its pouring so that it has direct contact with the alloy". This does not mean that the melt is poured on to the vibrating rod placed in the holding vessel; rather, the liquid alloy which is building up in the holding vessel after it was poured in is vibrated by means of the vibrating rod submerged in said alloy (when the pouring ends, the vibrating rod is immediately disengaged from the melt).

The term "vibration" as used herein is in no way limited in terms of the type of the vibrator used and the vibrating conditions (frequency and amplitude) and any commercial pneumatic and electric vibrators may be employed. As for the applicable vibrating conditions, the frequency typically ranges from 10 Hz to 50 kHz, preferably from 50 Hz to 1 kHz, and the amplitude ranges from 1 mm to 0.1 $\mu$m, preferably from 500 $\mu$m to 10 $\mu$m, per side.

The method of pouring the refiner-containing low-temperature melt into the holding vessel 430 should be such that crystal nuclei (fine crystals) can be generated in the poured melt. In order to ensure that the refiner which works as a foreign nucleus or as an element to accelerate the liberation of crystals will manifest its effect, the melt must be poured in at a specified rate and, in addition, it must be superheated to a temperature that is above the liquidus temperature by a specified degree. The degree of superheating varies with the kind of the refiner to be added and the amount of its addition (the criticality of the degree of superheating will be described later in this specification).

If the melt is poured in too fast, it is prone to entrap the surrounding air; on the other hand, if the melt is poured in too slowly, the intended effect of adding the refiner is not achieved and it is not efficient from an engineering viewpoint. Therefore, it is important that the metal be poured in at an appropriate rate within the range that does not cause entrapping of the surrounding air. The appropriate rate is faster than what is determined by equation (1) but slower than the rate determined by equation (2):

$$Y=0.015X+0.02 \text{ (preferably } Y=0.03X+0.02) \quad \text{Eq. (1)}$$

$$Y=0.017X+0.06 \quad \text{Eq. (2)}$$

where Y is the pouring rate (kg/s) and X is the weight of the melt (kg).

Titanium (Ti) may be added to the aluminum alloy as a refiner either alone or in combination with boron (B) in order to produce fine spherical crystal grains. If Ti is to be added alone, its refining effect is small if the addition is less than 0.03%. Beyond 0.30%, coarse Ti compounds well develop to reduce the ductility. Hence, Ti is added in an amount of 0.03%–0.30%.

If both Ti and B are to be added, the effect of Ti is small if its addition is less than 0.005%. Beyond 0.30%, coarse Ti compounds will develop to reduce the ductility. Hence, Ti is added in an amount of 0.005%–0.30% in combination with B. Boron (B), when added in combination with Ti, promotes the refining process. However, if its addition is less than 0.001%, only a small refining effect occurs. The effect of B is saturated if it is added in excess of 0.01%. Therefore, the addition of B should range from 0.001% to 0.01%.

Calcium (Ca) or the combination of Sr and Si may be added to the magnesium alloy as a refiner. If Ca is to be added, its refining effect is small if the addition is less than 0.05%. Beyond 0.30%, the effect of Ca is saturated. Therefore, the addition of Ca should range from 0.05% to 0.30%. In the case of combined addition of Sr and Si, only a small refining effect occurs if Sr is added in an amount of less than 0.005%. The effect of Sr is saturated if it is added in excess of 0.1%. Therefore, the addition of Sr should range from 0.005% to 0.1%. Silicon (Si), when added in combination with Sr, promotes the refining process. However, if its addition is less than 0.01%, only a small refining effect occurs. If Si is added in excess of 1.5%, its effect is saturated and, what is more, there occurs a drop in ductility. Therefore, the addition of Si should range from 0.01% to 1.5%.

According to the invention, semisolid metal forming will proceed by the following specific procedure. In step (1) of the process shown in FIGS. 3(*b*) and 4, a complete liquid form of metal M1 is contained in a ladle 410. In step (2), the alloy M1 is poured into a holding vessel 430 (which) is either a ceramic or a ceramic-coated metallic vessel) as a vibrating rod 420 submerged in the alloy to have direct contact with it is vibrated to impart vibrations to the alloy, with the holding vessel 430 being vibrated with a vibrator 440 as required during the pouring of the melt. After the end of the pouring operation, the vibrating rod 320 is immediately pulled up so that crystal nuclei are generated in the alloy which is either liquid or partially liquid at a temperature near the liquidus temperature.

In subsequent step (3), the alloy is cooled at an average cooling rate of 0.01° C./s–3.0° C./s and held as such within the holding vessel 430 until just prior to the start of shaping under pressure so that fine primary crystals are generated in said alloy solution; at the same time, induction heating (i.e., energization of a heating coil 380 around the holding vessel 430) is performed to effect temperature adjustment right after the pouring of the melt such that the temperatures of various parts of the alloy in the vessel will fall within the desired molding temperature range for establishment of a specified fraction liquid not later than the start of the molding step. For cooling the alloy, air (or water) 490 is blown against the holding vessel from its outside. If necessary, both the tip and bottom portions of the holding vessel 430 may be heat-retained with a heat insulator or heated so that the alloy is held partially molten to generate fine spherical (non-dendritic) primary crystals from the introduced crystal nuclei. Metal M2 thus obtained at a specified fraction liquid is inserted from the inverted holding vessel 430 [see step (3)-d] into a die casting injection sleeve 450 and thereafter pressure formed within an mold cavity 460*a* on a die casting machine to produce a shaped part [step (4)].

Reference number 470 in FIG. 3(*b*) stands for a cap made of a ceramic or other heat insulating material. The use of cap 470 is necessary because the temperatures of the top and the bottom portions of the molten metal are the easiest to decrease.

In the other method of the invention, semisolid metal forming will proceed by the following specific procedure. In step (1) of the process shown in FIGS. 3(*b*) and 4, a complete liquid form of metal M1 containing a refiner is charged into a pouring ladle 410 (which is hereunder sometimes referred to simply as "ladle"). In step (2), the melt is gently but rapidly poured into a holding vessel 430 (which is either a ceramic coated or a ceramic vessel), thereby forming either a liquid or a partially solid, partially liquid alloy that contain crystal nuclei (fine crystal grains) and which are at a temperature near the liquidus temperature.

Subsequently in step (3), the temperature of the poured alloy which is either liquid and superheated to less than 10° C. above the liquidus temperature of which is partially solid, partially liquid and less than 5° C. below the liquidus temperature is allowed to decrease from the initial level and pass through a temperature zone 5° C. below the liquidus temperature within 10 minutes, whereby fine primary crystals are generated in said alloy solution; at the same time, induction heating (i.e., energization of a heating coil 480 around the holding vessel 430) is performed to effect temperature adjustment such that the temperatures of various parts of the alloy in the vessel 430 will fall within the desired molding temperature range for the establishment of a specified fraction liquid not later than the start of the molding step.

FIGS. 75(*a*) and 75(*b*) are graphs illustrating the correlationship between the temperature distribution of AC4CH alloy in the holding vessel and its cooling rate. In other words, FIGS. 75(*a*) and 75(*b*) show the effect of cooling rate (for cooling from 615° C. to 585° C.) on the temperature distribution of AC4CH alloy in the holding vessel 430; obviously, the temperature distribution becomes wider as the cooling rate increases.

FIG. 75(*a*) shows the case where the cooling rate was 0.3° C./s;

in this case, the alloy was cooled with air being blown from the outside of the holding vessel, the tip portion of which was heat-retained with a heat insulator which was also provided on the underside of the vessel. FIG. 75(*b*) shows the case where the cooling rate was 0.2° C./s; in this case, both the top and bottom portions of the vessel were heat-retained with a heat insulator and the alloy was cooled in the atmosphere.

FIGS. 76(*a*), 76(*b*) and 76(*c*) are graphs showing the effect of r-f induction heating on the temperature distribution of AC4CH alloy in the holding vessel. According to the invention when the representative temperature of the alloy (its center temperature as it is in the holding vessel) has reached +3° C. above the desired molding temperature the blowing of air is stopped and r-f induction heating is started when the desired temperature is reached.

FIGS. 77(*a*), 77(*b*) and 77(*c*) are graphs showing the effect of r-f induction heating on the temperature distribution of AC4CH alloy in the holding vessel. According to the invention, when the representative temperature of the alloy (its center temperature as it is within the holding vessel) has reached a temperature 11° C. below the desired molding temperature, the blowing of air is stopped and r-f induction heating is started.

If the r-f induction heater is started to operate before the temperature becomes unduly lower than the desired molding temperature, the temperatures of various parts of the alloy in the holding vessel 430 can be maintained at the desired molding temperature in a short time with small electric power. On the other hand, if the r-f induction heater becomes operational after the alloy's temperature has become at least 10° C. lower than the desired molding temperature, it is not easy to maintain various parts of the alloy in the vessel at uniform temperature without performing induction heating with high electric power for a prolonged time. Therefore, the induction heating should comprise at least one application of electric current in a specified amount for specified period of time before the representative temperature of the alloy slowly cooling in the holding vessel 430 has dropped to at least 10° C. below the desired molding temperature.

Figure 78A:
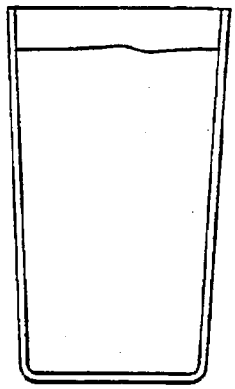
FIGS. 78(*a*), 78(*b*) and 78(*c*) are schematic drawings which illustrate how holding by r-f induction heating affects the compositional homogenization of a semisolid metal after the molding temperature was reached in an example of the invention.
Figure 78B:
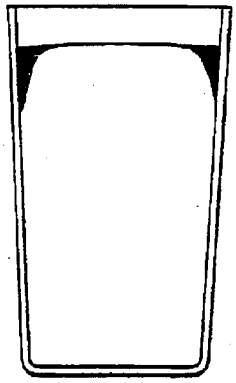
Figure 78C:
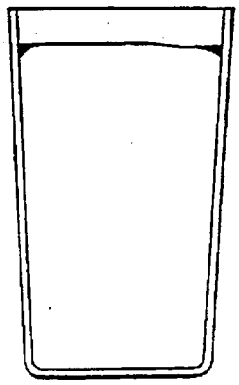

FIGS. 78(*a*), 78(*b*) and 78(*c*) illustrate how holding the r-f induction heating affects the compositional homogenization of a semisolid metal after the molding temperature has been reached. Each of the diagrams of FIGS. 78(*a*), 78(*b*) and 78(*c*) show a vertical section of the alloy in the holding vessel 430; FIG. 78(*a*) shows the state of the alloy which has attained the molding temperature; FIG. 78(*b*). Shows the state of the alloy which was held for 20 minutes by heating with the r-f indication heater at a frequency of 8 kHz; and FIG. 78(*c*) shows the state of the alloy which was held for 20 minutes by heating with the r-f induction heater at a frequency of 40 kHz.

The operating frequency of the r-f induction heater is 8 kHz before the alloy's temperature is adjusted to the molding temperature. A peculiar phenomenon which does not occur at the time the molding temperature has been reached (FIG. 78(*a*)) is observed if the alloy is held for a prolonged time; that is the uneven occurrence of the liquid phase in the top peripheral portion of the semisolid metal which is inherently a uniform mixture of the liquid and solid phases (the concentrated liquid phase is shown shaded in FIG. 78(*b*)).

This problem may be explained as follows: the metal in the holding vessel 430 forms "mushrooms" during the induction heating and the liquid phase of the semisolid metal floats in the top portion of the vessel mainly due to the agitating force. To suppress this agitating force, induction heating is performed at a higher frequency after the semisolid metal in the holding vessel has been adjusted to the molding temperature; consequently, the degree of the uneven occurrence of the liquid phase can be reduced. To this end, after the temperatures of the various parts of the alloy in the holding vessel have been adjusted by induction heating to fall within the desired molding temperature range within a specified time, the same alloy is held within the stated range until just prior to the start of the molding step by continuing the induction heating at a frequency either comparable to or higher than the frequency used in the preceding induction heating.

The semisolid metal forming process of the invention shown in FIGS. 1(*b*), 2(*b*), 3(*b*), 4 and 77(*a*) to 77(*c*) has the following differences from the conventional thixocasting and rheocasting methods. In the invention method, the dendritic primary crystals that have been generated within a temperature range of from the semisolid state are not ground into spherical grains by mechanical or electromagnetic agitation as in the prior art but the large number of primary crystals that have been generated and grown from the introduced crystal nuclei with the decreasing temperature in the range for the semisolid state are spheroidized continuously by the heat of the alloy itself (which may optionally by supplied with external heat hand held at a desired temperature). In addition, the semisolid metal forming method of the invention is characterized by the production of a uniform microstructure and temperature distribution by r-f induction heating with lower output and it is a very convenient and economical process since it does not involve the step of partially melting billets by reheating in the thixo-casting process.

The nucleating, spheroidizing and molding conditions that are respectively set for the steps shown in FIG. 3(*b*), namely, the step of pouring the metal into the holding vessel 430, the step of generating and spheroidizing primary crystals and the forming step, are set forth below more specifically. Also discussed below is the criticality of the numerical limitations the invention should have.

If crystal nuclei are to be generated by (1) applying vibrations to the melt in the holding vessel 430 or (2) pouring a Ti- and B-containing aluminum alloy or a Si and Sr-containing magnesium alloy or a Ca-containing magnesium alloy directly into the holding vessel, the melt should be superheated to less than 50° C., preferably less than 30° C., above the liquidus temperature. If crystal nuclei are to be generated by pouring a Ti-containing aluminum alloy into the holding vessel, the melt should be superheated to less than 30° C. above the liquidus temperature. If the temperature of the melt being poured into the holding vessel is higher than these limits, the following phenomena will occur;

(1) only a few crystal nuclei are generated;

(2) the temperature of the alloy as poured into the vessel is higher than the liquidus temperature and, hence, the number of residual crystal nuclei is small and the size of primary crystals is large enough to produce amorphous dendrites.

If the upper or lower portion of the holding vessel 430 is not heated or heat-retained while the alloy M1 poured into the vessel is cooled to establish a fraction liquid suitable for molding, dendritic primary crystals are generated in the skin of the alloy M1 in the tip and/or bottom portion of the vessel or a solidified layer will grow to cause nonuniformity in the temperature distribution of the metal in the holding vessel 430; as a result, even if r-f induction heating is performed, the alloy having the specified liquid fraction cannot be discharged from the inverted vessel 430 or the remaining solidified layer within the holding vessel 430 either introduces difficulty into the practice of continued shaping operation or prevents the temperature distribution of the alloy from being improved in the desired way.

In order to avoid these problems, if the poured metal is held in the vessel for a comparatively short time until the molding temperature is reached, the top and/or bottom portion of the holding vessel is heated or heat-retained at a higher temperature than the middle portion in the cooling process; if necessary, both the top and bottom portions of the holding vessel 430 may be heated not only in the cooling process but also before the pouring step.

If the wall thickness of the holding vessel 430 is reduced, the formation of a solidified layer can be suppressed; hence, the wall of the holding vessel is made smaller in the top and bottom portions than in the middle to thereby facilitate the discharge of the alloy from the holding vessel 430.

If the holding vessel 430 is made of a material having a thermal conductivity of less than 1.0 kcal/mh° C., the cooling time is prolonged to a practically undesirable level; hence, the holding vessel 430 should have a thermal conductivity of at least 1.0 kcal/mh° C. If the holding vessel 430 is made of a metal, its surface is preferably coated with a nonmetallic material (e.g., BN or graphite) the coating method may be either mechanical or chemical or physical. Both the magnesium and aluminum alloys are highly oxidizable metals, so if the holding vessel 430 is made of an air-permeable material or if the alloy is to be held for a long time in the vessel, the exterior to the vessel is preferably filled with a specified atmosphere (e.g., an inert or vacuum atmosphere). Even in the case of using the metallic vessel, the magnesium alloy which is highly oxidizable is desirably isolated by an inert of $CO_2$ atmosphere.

For preventing oxidation, an oxidation control element may be preliminarily added to the molten metal, as exemplified by Be and Ca in the case of the magnesium alloy and Be for the aluminum alloy. The shape of the vessel 430 is by no means limited to a tubular form and any other shapes that are suitable for the subsequent forming process may be adopted.

If the average rate of cooling in the holding vessel 330 is faster than 3.0° C./s, it is not easy to permit the temperatures of various parts of the alloy to fall within the desired molding temperature range for establishment of the specified liquid fraction even if induction heating is employed and, in addition, it is difficult to generate spherical primary crystals. If, on the other hand, the average cooling rate is less than 0.014° C./s, the cooling time is prolonged to cause inconvenience in commercial production. Therefore, the average rate of cooling in the holding vessel 430 should range preferably from 0.01° C./s to 3.0° C./s, more preferably from 0.05° C./s to 1° C./s.

Crystal nuclei can also be generated by pouring a refiner containing molten alloy directly into the holding vessel 430. In this case, if the poured alloy is superheated to more than 10° C. above than the liquidus temperature, fine spherical crystals cannot be produced no matter what cooling rate is adopted. Hence, the as-poured metal should be superheated to less than 10 above the liquidus temperature. If the temperature of the alloy which is either liquid and superheated to less than 10° C. above the liquidus temperature or partially solid, partially liquid alloy and less than 5° C. below the liquidus temperature is allowed to decrease from the initial level and pass through a temperature zone 5° C. below the liquidus temperature taking a time longer than 10 minutes, it is impossible to produce a fine spherical microstructure.

To avoid this problem, the temperature of the alloy is allowed to decrease from the initial level and pass through the temperature zone 5° C. below the liquidus temperature within 10 minutes, preferably within 5 minutes, to thereby generate fine primary crystals in the solution of the alloy, which is taken out of the holding vessel 430., supplied into the forming mold 460 and shaped under pressure.

If enhanced cooling of the holding vessel 430 is necessary, either air or water or both are blown against the holding vessel 430 from its outside. Depending on the need, the cooling medium may be blown from at least two different, independently operable heights exterior to the holding vessel such that the blowing conditions and times can be varied freely. The cooling medium to be blown, the amount of blow, its velocity, speed, position and timing are variable with the alloy in the holding vessel 330, the material of which the vessel is made, its wall thickness, etc.

If the temperature of the yet to be shaped alloy in the holding vessel exceeds the limits of ±5° C. of the desired molding temperature, a shaped part of uniform microstructure cannot be produced by casting. Hence, the temperature of the alloy in the holding vessel should be adjusted by induction heating to fall within the limits of ±5° of the desired molding temperature.

If the vibrating rod 420 is to be used for the purpose of creating crystal nuclei in the alloy being poured into the holding vessel, it preferably satisfied the following two requirements: it should be coolable either internally or externally in order to provide for its continued use and generate many crystal; the surface of the vibrating rod 420 should be coated with a nonmetallic material. It should be noted that the use of rod that can be cooled internally but which is nonvibrating has the following disadvantage even if it is coated with a nonmetallic material: when the rod is pulled up from the poured alloy, a solidified layer will stick extensively to the surface of the rod or many dendrites will form in the alloy in the holding vessel. To avoid this problem, the coolable rod must be vibrated when it is placed in contact with the molten metal.

The use of the vibrating rod 420 is effective in generating fine primary crystals in the alloy in the holding vessel but, at the same time, dendrites may occasionally form in those parts of the alloy which contact the inner surface of the holding vessel 430. To avoid this problem, the holding vessel 430 is preferably vibrated during pouring of the metal.

Table 11 sets forth the conditions for the preparation of semisolid metal samples to be shaped, and Table 2 sets forth the temperature distribution of yet to be shaped metal samples in the holding vessel, as well as the quality of shaped parts. As FIG. 3(*b*) shows, the forming step consisted of inserting the semisolid metal into the sleeve 450 and subsequent treatment with a squeeze casting machine. The forming conditions were as followed: pressure, 950 kgf/cm$^2$; injection rate, 0.5 m/s; casting weight (inclusive of biscuits), 1.5 kg; mold temperature, 230° C.

TABLE 11

Conditions for Preparation of Semisolid Metals to be Molded

| | Run No. | Alloy | Pouring temperature, ° C. | Nucleation | Temperature of metal in vessel, ° C. | Material of holding vessel | Molding Temperature, ° C. | Average cooling rate, ° C./s | Induction heating pattern A | B | C |
|---|---|---|---|---|---|---|---|---|---|---|---|
| Invention | 1 | AC4CH | 635 | V | 610 | 14 | 585 | 0.20 | ○ | | |
| | 2 | AC4CH | 635 | V | 609 | 14 | 585 | 0.10 | ○ | | |
| | 3 | AC4CH | 630 | V | 608 | 14 | 580 | 0.03 | | ○ | |
| | 4 | AC4CH | 625 | Ti | 610 | 14 | 585 | 0.15 | ○ | | |
| | 5 | AC4CH | 645 | V | 620 | 14 | 585 | 0.5 | ○ | | |
| | 6 | AC4CH | 635 | V | 610 | 14 | 585 | 0.18 | | ○ | |
| | 7 | AC4CH | 630 | Ti | 611 | 14 | 585 | 0.15 | ○ | | |
| | 8 | AC4CH | 640 | V, Ti | 610 | 14 | 582 | 0.13 | ○ | | |
| | 9 | AZ91 | 615 | V | 590 | 14 | 575 | 0.13 | ○ | | |
| | 10 | AZ91, Si, Sr | 615 | V | 592 | 14 | 570 | 1.0 | ○ | | |
| | 11 | AZ91, Ca | 625 | V | 596 | 14 | 570 | 0.5 | ○ | | |
| | 12 | AC7A | 645 | V | 628 | 14 | 610 | 0.20 | ○ | | |
| | 13 | AC4CH | 635 | Ti | 610 | 14 | 580 | 0.25 | ○ | | |
| Comparison | 14 | AC4CH | 635 | V | 609 | 14 | 585 | 0.25 | | | ○ |
| | 15 | AC4CH | 635 | V | 610 | 0.3 | 585 | 0.008 | ○ | | |
| | 16 | AC4CH | 635 | V | 610 | 14 | 585 | 0.15 | ○ | | |
| | 17 | AC4CH | 635 | Ti | 610 | 14 | 585 | 4.0 | ○ | | |
| | 18 | AC4CH | 690 | V | 660 | 14 | 585 | 0.15 | ○ | | |
| | 19 | AC4CH | 635 | Ti | 610 | 14 | 580 | 0.25 | ○ | | |

Conditions for Preparation of Semisolid Metals to be Shaped

| | Run No. | Alloy | Frecquency: Before adjustment to molding temperature | Frecquency: After adjustment | Temperature control of holding vessel: Top | Temperature control of holding vessel: Bottom | Cooling medium to be blown against holding vessel: Air or water | Cooling medium to be blown against holding vessel: Temperature, ° C. | Holding time, min | Metal weight, kg |
|---|---|---|---|---|---|---|---|---|---|---|
| Invention | 1 | ACACH | 8 | 8 | heat-retained | — | Air | 25 | 3.0 | 1.5 |
| | 2 | AC4CH | 8 | 8 | heat-retained | heat-retained | Air | 200 | 5.5 | 15.0 |
| | 3 | AC4CH | 8 | 8 | heat-retained | — | — | — | 40.0 | 15.0 |
| | 4 | AC4CH | 8 | 8 | heat-retained | heat-retained | — | — | 4.3 | 1.5 |
| | 5 | AC4CH | 8 | 8 | heat-retained | — | Air Water | 25 | 2.0 | 1.5 |
| | 6 | AC4CH | 8 | 8 | heat-retained | — | Air | 25 | 3.0 | 1.5 |
| | 7 | AC4CH | 8 | 45 | heat-retained | heat-retained | Air | 25 | 30.0 | 1.5 |
| | 8 | AC4CH | 8 | 8 | heat-retained | heated | Air | 100 | 4.5 | 15.0 |
| | 9 | AZ91 | 8 | 8 | heat-retained | heat-retained | — | — | 3.0 | 0.9 |
| | 10 | AZ91, Si, Sr | 8 | 8 | heat-retained | heat-retained | Air | 25 | 1.1 | 0.9 |
| | 11 | AZ91, Ca | 8 | 8 | heat-retained | heat-retained | Air | 25 | 2.0 | 0.9 |
| | 12 | AC7A | 8 | 8 | heat-retained | heat-retained | Air | 25 | 3.0 | 1.5 |
| | 13 | AC4CH | 8 | 8 | heat-retained | — | Air | 25 | 3.0 | 1.5 |
| | 14 | AC4CH | 8 | 8 | heat-retained | heat-retained | Air | 25 | 3.1 | 1.5 |
| | 15 | AC4CH | 8 | 8 | heat-retained | — | — | — | 65.0 | 20.5 |

TABLE 11-continued

| | | | | | | | | | | |
|---|---|---|---|---|---|---|---|---|---|---|
| Comparison | 16 | AC4CH | 8 | 8 | heat-retained | heat-retained | — | — | 40.0 | 1.5 |
| | 17 | AC4CH | 8 | 8 | | | Water | 25 | 0.3 | 1.5 |
| | 18 | AC4CH | 8 | 8 | heat-retained | heat-retained | — | — | 10.0 | 1.5 |
| | 19 | AC4CH | 8 | 8 | | — | Air | 25 | 2.8 | 1.5 |

Notes:
(m.p.) AC4CH Al—7% Si—0.3% Mg—0.15% Ti 615° C.
AZ91 Mg—9% Al—0.7% Mg—0.2% Na 595° C.
AC7A Al—5% Mg—0.4% Na 635° C.
(nucleation) V: based on claim 8; frequency 100 Hz; amplitude 0.1 mm per side
Ti: based on claim 9; 0.175% Ti and 0.005% B after addition of refiners
(induction heating)
pattern A: heated (−5 to +5° C.) after the representative temperature reached the desired molding temperature.
pattern B: heated each time the decreasing representative temperature reached a specified level.
pattern C: heating started at a temperature at least 10° C. below the desired molding temperature.
(material of holding vessel) Designated in terms of the thermal conductivity (kcal/mh ° C.) at. 500° C.; 14 for stainless steel S1; 18 for cast iron S2; 0.3 for ceramic C.
(heat-retained) Vessel was covered with a ceramic material having a thermal conductivity of 0.3 kcal/mh ° C.
(heated) Heated with air heater.
(blowing of cooling air or water)
Air: blown from the outside of coil to cool vessel within the coil.
Water: blown against the vessel before it was placed within the coil.
(holding time) Holding time from the end of metal pouring into vessel until the start of shaping.
(degree of spheroidization of primary crystals)
○, mostly spherical particles
Δ, coarse spherical particles
X, many dendrites and amorphous particles

TABLE 2

Temperature of Semisolid Metals and Microstructure of Shaped Parts

| No. | Temperature distribution of yet to be shaped metal | | Degree of spheroidization | Remarks |
|---|---|---|---|---|
| 1 | +2. | −1 | ○ | |
| 2 | +2. | −1 | ○ | |
| 3 | +2. | −1 | ○ | |
| 4 | +2. | −1 | ○ | |
| 5 | +3. | −2 | ○ | |
| 6 | +1. | −2 | ○ | |
| 7 | +2. | −1 | ○ | |
| 8 | +1. | −1 | ○ | Top and bottom portions of the vessel were about two thirds in thickness of the middle portion. |
| 9 | +1. | −1 | ○ | |
| 10 | +3. | −4 | ○ | |
| 11 | +2. | −2 | ○ | |
| 12 | +2. | −1 | ○ | |
| 13 | +2. | −2 | ○ | Extrusion molded |
| 14 | −10. | 5 | ○ | Induction heating started as at a temperature at least 10° C. below the desired molding temperature. |
| 15 | −4. | 5 | Δ | Cooling rate too slow. |
| 16 | −2. | −2 | ○ | Held by induction heating for an unduly long time. |
| 17 | −4. | 7 | x | Cooling rate too fast. |

TABLE 2-continued

Temperature of Semisolid Metals and Microstructure of Shaped Parts

| No. | Temperature distribution of yet to be shaped metal | | Degree of spheroidization | Remarks |
|---|---|---|---|---|
| 18 | −3. | −5 | x | Pouring temperature too high. |
| 19 | −1. | 3 | x | Vessel heat-retained insufficiently. |

It should be noted that the data for Run No. 13 in Tables 11 and 12 refer to the conditions for forming with an extruding machine and the quality of the shaped part. The forming step consisted of inserting the semisolid metal into the container and extruding the same. The extruding conditions were as follows: extruding machine, 800° C.; extruding rate (output rate), 80 m/min; extrusion ratio, 20; billet diameter, 75 mm.

In Run No. 14 (comparison) in Tables 11 and 12, the representative temperature of the alloy cooling in the holding vessel 330 had dropped to at least 10° C. below the desired molding temperature before induction heating started and, hence, the temperature of the alloy could not be adjusted to fall within the limits of ±5° C. of the desired molding temperature, thus making it impossible to produce a shaped part having a homogeneous microstructure.

In Run 15 (comparison), the cooling rate was slow and caused no big problems in temperature distribution but, on the other hand, the size of primary crystals exceeded 200 μm and the slow cooling was inconvenient to continuous production.

In Run No. 16 (comparison) the alloy in the holding vessel which had the temperatures of various parts adjusted to fall within the desired molding temperature range was continuously held as such by induction heating for an unduly long time and without changing the frequency; as a result, a liquid phase occurred extensively in the top peripheral portion of the semisolid metal.

In Run No. 17 (comparison), the cooling rate was so fast that even when induction heating was performed, the temperature of the alloy could not be adjusted to fall within the limits of ±5° C. of the desired molding temperature range and no shaped part having a homogeneous microstructure could be produced; what is more, a solidified layer formed within the vessel, making it difficult to recover the semisolid metal from the vessel.

In Run No. 18 (comparison), the high pouring temperature led to an unduly hot melt in the vessel and, hence, there were no residual crystal nuclei and many amorphous dendrites formed.

In Run No. 19 (comparison), the holding vessel was heat-retained only insufficiently so that the metal in the top of the vessel cooled prematurely, making it very difficult to recover the metal from the vessel.

In Run Nos. 1–13 according to the invention, there were obtained shaped parts having a homogeneous microstructure which, as shown in FIG. 7(*b*), had no recognizable amorphous dendrites but comprised fine spherical primary crystals.

FIG. 80 is a graph showing how the B content and the degree of superheating of a melt during pouring affect the size and morphology of the primary crystals of AC4CH allay (Al-7% Si-0.3% Mg-0.15% Ti). Unlike in the case of combined addition of Ti and B, no spherical crystals can be obtained at temperatures more than 30° C. above the liquidus temperature when only Ti was added as a refiner.

FIG. 81 is a graph showing how the B content and the degree of superheating of a melt during pouring affect the size and morphology of the primary crystals of 7075 alloy (Al-5.5% Zn-2.5% Mg-1.6% Cu-0.15% Ti). The 7075 alloy was in contrast with the AC4CH alloy in that fine spherical crystals are obtained with high degree of superheating even when only Ti is used as a refiner.

TABLE 13

| | Run No. | Alloy | Degree of Superheating, ° C. | Refiner, % | Temperature of metal in vessel, ° C. | Passing time, min | Overall holding time, min | Method adding refiner | Material of ladle | Medium for cooling holding vessel | Induction heating |
|---|---|---|---|---|---|---|---|---|---|---|---|
| Invention | 1 | AC4CH + Ti | 10 | 0.15, — | 612 | 0.3 | 3.6 | a | Cer. | — | Yes |
| | 2 | AC4CH + Ti, B | 35 | 0.15, 0.005 | 613 | 0.5 | 3.9 | c | Cer. | — | Yes |
| | 3 | AC4CH + Ti, B | 45 | 0.15, 0.008 | 616 | 1.0 | 5.0 | a | Cer. | — | Yes |
| | 4 | AC4CH + Ti, B | 30 | 0.15, 0.003 | 614 | 0.6 | 4.0 | d | Iron | — | Yes |
| | 5 | AC4CH + Ti, B | 30 | 0.15, 0.004 | 613 | 0.3 | 3.0 | b | Cer. | Air | Yes |
| | 6 | AC4CH + Ti, B | 30 | 0.15, 0.004 | 617 | 6.0 | 25.0 | a | Cer. | Water | Yes |
| | 7 | AZ91 + Ca | 15 | 0.15, — | 591 | 0.2 | 3.1 | a | Iron | — | Yes |
| | 8 | AZ91 + Si, Sn | 15 | 0.4, 0.01 | 595 | 0.3 | 3.2 | a | Iron | — | Yes |
| | 9 | 7075 | 35 | 0.05, — | 633 | 1.5 | 2.8 | a | Cer. | — | Yes |
| | 10 | 7075 | 47 | 0.15, 0.002 | 636 | 1.6 | 3.0 | a | Cer. | — | No |
| | 11 | | 15 | 0.03, — | 635 | 1.4 | 2.7 | a | Iron | — | No |
| | 12 | | 15 | 0.03, — | 633 | 1.5 | 2.9 | a | Iron | — | No |
| Comparison | 13 | AC4CH + Ti | 35 | 0.15, — | 614 | 0.5 | 4.0 | a | Cer. | — | Yes |
| | 14 | AC4CH + Ti, B | 60 | 0.15, 0.005 | 613 | 1.2 | 3.9 | c | Cer. | — | Yes |
| | 15 | AC4CH + Ti, B | 35 | 0.15, 0.005 | 615 | 14.5 | 25.5 | a | Cer. | — | Yes |
| | 16 | AC4CH + Ti, B | 30 | 0.15, 0.005 | 616 | 0.5 | 40.0 | a | Cer. | — | Yes |
| | 17 | AC4CH + Ti, B | 30 | 0.15, 0.003 | 613 | 0.5 | 2.5 | a | Cer. | Air | Yes |
| | 18 | AC4CH + Ti, B | 30 | 0.15, 0.003 | 614 | 0.5 | 25.0 | a | Cer. | Air | No |
| | 19 | AC4CH | 15 | —, — | 613 | 0.3 | 3.7 | a | Cer. | — | Yes |
| | 20 | AZ91 | 15 | —, — | 592 | 0.2 | 3.00 | a | Iron | — | Yes |
| | 21 | AZ91 + Sr | 15 | 0.015, — | 593 | 0.2 | 31.0 | a | Iron | — | Yes |
| | 22 | 7075 | 30 | —, — | 634 | 1.5 | 2.7 | a | Cer. | — | Yes |

| | Run No. | Alloy | Heating or heat-retention of holding vessel | Fraction liquid before shaping, % | Temperature distribution of metal in holding vessel | Amount of spherical particles | Size of primary crystals μm | Remarks |
|---|---|---|---|---|---|---|---|---|
| Invention | 1 | AC4CH + Ti | Yes | 60 | ○ | ○ | 100 | |
| | 2 | AC4CH + Ti, B | Yes | 60 | ○ | ○ | 100 | |
| | 3 | AC4CH + Ti, B | Yes | 60 | ○ | ○ | 115 | |
| | 4 | AC4CH + Ti, B | Yes | 60 | ○ | ○ | 95 | |
| | 5 | AC4CH + Ti, B | Yes | 60 | ○ | ○ | 95 | |
| | 6 | AC4CH + Ti, B | Yes | 60 | ○ | ○ | 130 | |
| | 7 | AZ91 + Ca | Yes | 60 | ○ | ○ | 140 | |
| | 8 | AZ91 + Si, Sn | Yes | 60 | ○ | ○ | 110 | |
| | 9 | 7015 | Yes | 60 | ○ | ○ | 105 | |
| | 10 | 7075 | Yes | 60 | ○ | ○ | 80 | |
| | 11 | | Yes | 60 | ○ | ○ | 90 | |
| | 12 | | Yes | 60 | ○ | ○ | 90 | |
| Comparison | 13 | AC4CH + Ti | Yes | 60 | ○ | X | 150 | Degree of superheating too high |
| | 14 | AC4CH + Ti, B | Yes | 60 | ○ | X | 100 | Degree of superheating too high |
| | 15 | AC4CH + Ti, B | Yes | 60 | ○ | X | 150 | Passing time too long |

TABLE 13-continued

| | | | | | | | |
|---|---|---|---|---|---|---|---|
| 16 | AC4CH + Ti, B | Yes | 60 | ○ | X | 180 | Holding time too long |
| 17 | AC4CH + Ti, B | No | 60 | X | ○ | 100 | Uneven distribution of metal temperature |
| 18 | AC4CH + Ti, B | No | 60 | X | ○ | 110 | Uneven distribution of metal temperature |
| 19 | AC4CH | Yes | 60 | ○ | X | 180 | Refiner absent |
| 20 | AZ91 | No | 60 | ○ | X | 200 | Refiner absent |
| 21 | AZ91 + Sr | Yes | 60 | ○ | X | 160 | Only Sr added |
| 22 | 7075 | Yes | 60 | ○ | X | 170 | Refiner absent |

Alloy AC4CH Al—7% Si—0.3% Mg (Ti not added)
AZ91 Mg—9% Al—0.7% Zn—0.4% Mn
7075 Al—5.5% Zn—2.5% Mg—1.6% Cu (Ti not added)
Temperature of metal in vessel: Temperature of as-poured metal
Passing time:
Time required for the as-poured melt to decrease in temperature from the initial level and through temperature zone 5° C. below the liquidus temperature.
Overall holding time:
Holding time required for the temperature of the as-poured melt to decrease from the initial level to the molding temperature.
Method of adding refiner: a. melted in holding furnace;
b. melted in ladle;
c. diluted;
m.p.: AC4CH 615° C.
AZ91 595° C.
7075 635° C.
Material of ladle:
Cer.: Ceramics;
Iron: Stainless steel or cast iron
Heating or heat retention of holding vessel:
both top and bottom portions of vessel were heated or heat-retained
Fraction liquid:
Estimated from equlibrium phase diagram and cooling curve.
Metal temperature distribution:
○, within ±5° C. of the desired temperature.
X, outside ±5° C. of the desired temperature.

Table 13 sets forth the conditions for the preparation of semisolid metal samples and the results of examination of the microstructure of shaped parts. As FIG. 79 shows, the forming step consisted of inserting the semisolid metal into the injection sleeve 576 and subsequent treatment with a squeeze casting machine. The forming conditions were as follows: pressure, 950 kgf/cm$^2$; injection rate, 0.5 m/s; casting weight (inclusive of biscuits), 1.5 kg; mold temperature, 230° C.

Figure 85:
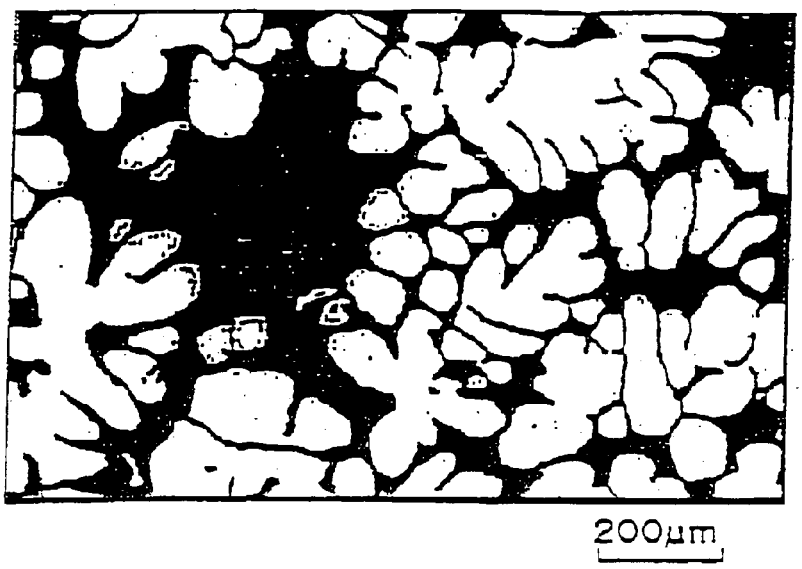
FIG. 85 Prior Art
FIG. 85 is a diagrammatic representation of a micrograph showing the metallographic structure of a shaped part (from AC4CH-0.15% Ti) according to a comparative example.

In Run Nos. 13 and 14 (comparisons) in Table 3, the degree of superheating above the liquidus temperature was so high that no fine spherical crystals were obtained but only coarse primary crystals formed (see FIG. 85).

In Run No. 15 (comparison), the temperature of the melt poured into the holding vessel 430 was allowed to decrease from the initial level and pass through a temperature zone 5° C. below the liquidus temperature taking a time longer than 10 minutes. In Run No. 16 (comparison), the holding time-was unduly long. Hence, only coarse primary particles were obtained in these runs.

In Run Nos. 17 and 18, neither top nor bottom portion of the holding vessel 430 was heat-retained or heated, so even when induction heating was effected, the alloy in the holding vessel 430 had an uneven temperature distribution.

Figure 86:
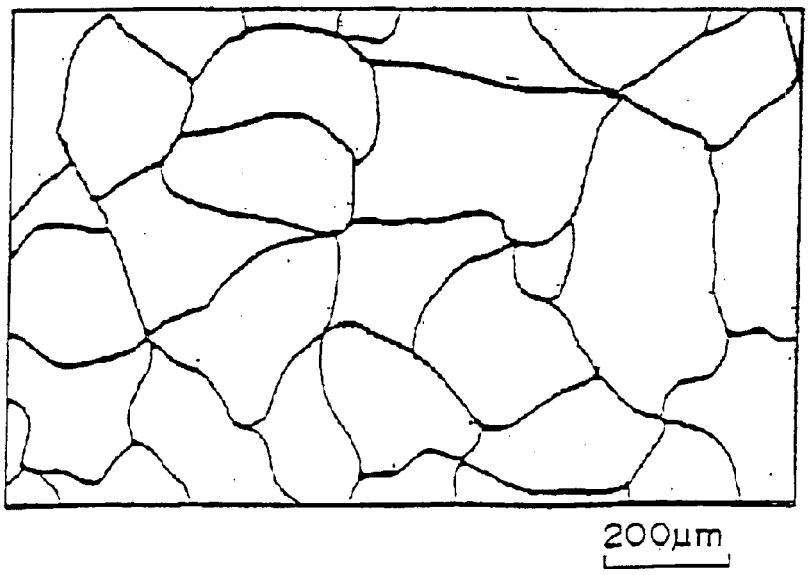
FIG. 86 Prior Art
FIG. 86 is a diagrammatic representation of a micrograph showing the metallographic Structure of a shaped part (from AZ91) according to another comparative example.
Figure 87:
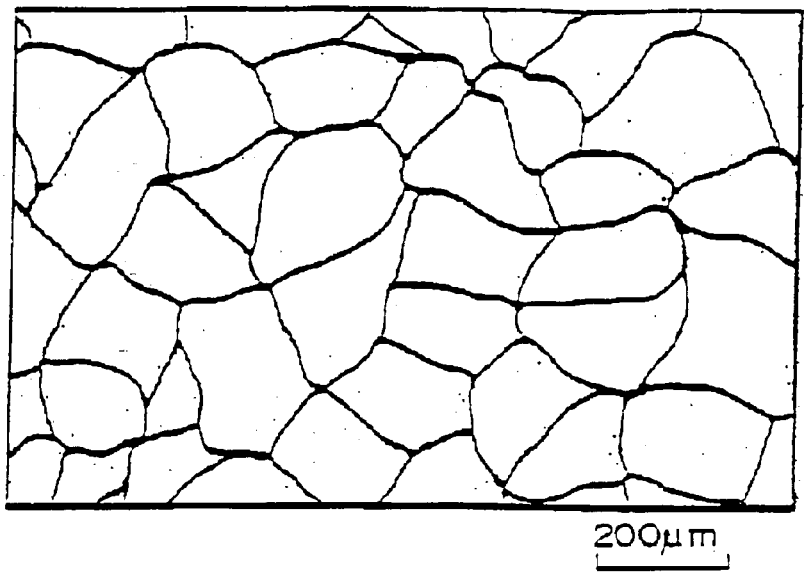
FIG. 87 Prior Art
FIG. 87 is a diagrammatic representation of a micrograph showing the metallographic structure of a shaped part (from AZ91-0.01% Sr) according to yet another comparative example.

In Run Nos. 19 and 20, the alloy samples produced only coarse primary crystals since they did not contain a refiner (see FIG. 86).

In Run No. 21 (comparison), only Sr was added as a refiner and the shaped part was not much refined compared to that of the alloy containing no Sr. See FIG. 87 for the microstructure of the shaped part obtained in Run No. 21.

Figure 88:
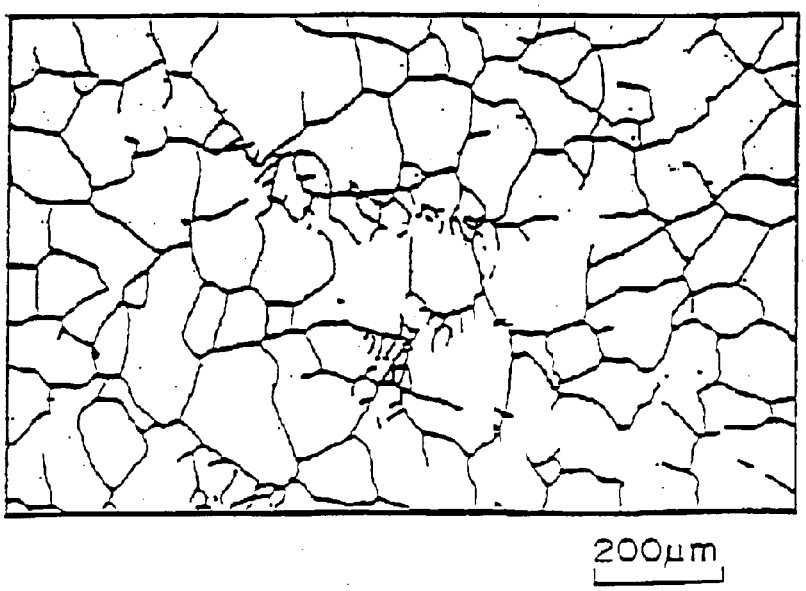
FIG. 88 Prior Art
FIG. 88 is a diagrammatic representation of a micrograph showing the metallographic structure of a shaped part (from 7075) according to still another comparative example.

In Run No. 22, the alloy sample did not contain a refiner and the degree of its superheating above liquidus temperature was unduly high; hence, only coarse primary crystals formed as shown in FIG. 88.

In contrast, the alloy samples prepared in Run Nos. 1–12 according to the fine spherical primary particles as shown in FIGS. 82, 83 and 84.

As will be understood from the foregoing description, according to the method of the invention for shaping semisolid metals, shaped parts having fine and spherical microstructures can be produced in a convenient, easy and inexpensive manner without relying upon agitation by the conventional mechanical and electromagnetic methods.

What is claimed is:

1. A method of shaping a semisolid metal comprising:

(a) feeding, without using a cooling jig, into an insulating vessel having an insulating effect, a molten alloy containing an element for promoting generation of crystal nuclei and being held to be superheated to less than 100° C. above a liquidus temperature of the alloy;

(b) maintaining said molten alloy in said insulating vessel for a period of 5 seconds to 60 minutes as said alloy is cooled to a molding temperature at a cooling rate of 0.01° C./s to 3.0° C./s thereby crystallizing fine primary spherical crystals in an alloy solution thereof containing a specified liquid fraction, and thereafter (c) feeding said alloy solution into a forming mold for shaping said alloy under pressure.

2. The method of claim 1, wherein the alloy is an aluminum alloy of a composition within a maximum solubility limit or a hypoeutectic aluminum alloy of a composition at or above a maximum solubility limit.

3. The method of claim 2, wherein the element for promoting generation of crystal nuclei comprises boron and titanium which are contained in the molten alloy in amounts of 0.001% to 0.01% and 0.005% to 0.3%, respectively.

4. The method of claim 1, wherein the alloy is a magnesium alloy of a composition within a maximum solubility limit.

5. The method of claim 4, wherein the element for promoting generation of crystal nuclei comprises strontium which is contained in the molten alloy in an amount of 0.005% to 0.1%.

6. The method of claim 4, wherein the element for promoting generation of crystal nuclei comprises silicon and strontium which are contained in the molten alloy in amounts of 0.01% to 1.5% and 0.005% to 0.1%, respectively.

7. The method of claim 4, wherein the element for promoting generation of crystal nuclei comprises calcium which is contained in the molten alloy in an amount of 0.05% to 0.30%.

8. A method of shaping a semisolid metal comprising:

(a) pouring a liquid alloy containing an element for promoting generation of crystal nuclei and being held to be superheated to less than 100° C. above a liquidus temperature of the alloy into a holding vessel such that fine, nondendritic primary crystals are crystallized in an alloy solution thereof, in which said holding vessel is adapted to be heated or cooled from inside or outside thereof, and is made of a material having a thermal conductivity of at least 1.0 kcal/hr·m·° C. measured at room temperature;

(b) cooling said liquid alloy sufficiently rapidly to provide a uniform temperature profile in said holding vessel, said cooling being carried out to a temperature at which a solid fraction appropriate for shaping is established, and (c) feeding said alloy into a forming mold for shaping said alloy under pressure.

9. The method of claim 8, wherein the cooling of said liquid alloy is performed with top and bottom portions of the vessel being heated to a greater degree than a middle portion of the vessel or heat is retained by the vessel, wherein the vessel is made of a heat-retaining material having a thermal conductivity of less than 1.0 kcal/hr·m·° C. or by heating the top portion of the vessel or the bottom portion of the vessel, while a remainder of the vessel has heat retained therein.

10. The method of claim 8, wherein the cooling of said alloy is performed with the holding vessel being accommodated within an outer vessel that has a smaller thermal conductivity than said holding vessel, or that has a thermal conductivity equal to or greater than that of said holding vessel and which has a higher initial temperature than said holding vessel, or a gas-filled gap is disposed in a space between said holding vessel and said outer vessel, said cooling being carried out at a cooling rate sufficient to provide a uniform temperature profile through the alloy in said holding vessel at a time no later than the start of the shaping.

* * * * *